US007168475B2

(12) United States Patent
Colson et al.

(10) Patent No.: US 7,168,475 B2
(45) Date of Patent: Jan. 30, 2007

(54) SHUTTER-TYPE COVERING FOR ARCHITECTURAL OPENINGS

(75) Inventors: Wendell B. Colson, Weston, MA (US); James M. Anthony, Denver, CO (US); Richard N. Anderson, Whitesville, KY (US); Steven R. Haarer, Whitesville, KY (US); Donald E. Fraser, Owensboro, KY (US); Robert A. Null, Arvada, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 184 days.

(21) Appl. No.: 10/479,893

(22) Filed: Dec. 1, 2003

(65) Prior Publication Data

US 2005/0072088 A1 Apr. 7, 2005

Related U.S. Application Data

(60) Provisional application No. 60/381,587, filed on May 17, 2002, provisional application No. 60/305,947, filed on Jul. 16, 2001.

(51) Int. Cl.
*E06B 9/306* (2006.01)

(52) U.S. Cl. ..... 160/168.1 R; 160/176.1 R; 160/902

(58) Field of Classification Search ..... 160/168.1 R, 160/173 R, 176.1 R, 177 R, 178.3, 178.1 R
See application file for complete search history.

(56) References Cited

U.S. PATENT DOCUMENTS

| | | | | |
|---|---|---|---|---|
| 291,222 | A * | 1/1884 | Phillips | 160/168.1 R |
| 2,116,357 | A * | 5/1938 | Laborda et al. | 160/168.1 R |
| 2,297,627 | A * | 9/1942 | Lochr | 160/168.1 R |
| 2,493,234 | A * | 1/1950 | Dunn | 160/167 R |
| 2,560,840 | A * | 7/1951 | Barnes, Sr. | 160/169 |
| 4,484,611 | A | 11/1984 | Anderson | |
| 4,928,369 | A * | 5/1990 | Schnebly et al. | 29/24.5 |
| 5,553,653 | A | 9/1996 | Rozon | 160/173 |
| 6,134,842 | A | 10/2000 | Cheng et al. | 52/1 |
| 6,378,262 | B1 | 4/2002 | Mercadante | 52/473 |
| 6,394,170 | B1 * | 5/2002 | Hsu | 160/168.1 R |

(Continued)

FOREIGN PATENT DOCUMENTS

| | | |
|---|---|---|
| EP | 0 151 839 A1 | 8/1985 |

(Continued)

*Primary Examiner*—Blair M. Johnson
(74) *Attorney, Agent, or Firm*—Dorsey & Whitney LLP

(57) ABSTRACT

A Venetian-style window blind (10) that resembles plantation style shutters is described. In a preferred embodiment, the headrail is shaped like the plurality of slats depending from it, is pivotally connected to the sides of a window frame by mounting brackets and has a hollow interior. Tilting of the plurality slats depending from the headrail is accomplished by vertically moving an actuator rod that is pivotally connected to the headrail. The plurality of slats are suspended from the headrail by a cord ladder to tilt in unison with the headrail. While tilting the blind assembly into the closed position, the headrail and depending slats also slide inwardly towards the windowpane. The slats are lifted through the actuation of a lift handle that is slidably attached to the actuator rod and contains therein a lock mechanism to hold the slats in a desired position.

53 Claims, 76 Drawing Sheets

U.S. PATENT DOCUMENTS

| | | | | |
|---|---|---|---|---|
| 6,421,966 | B1 | 7/2002 | Braunstein et al. | 52/173.3 |
| 6,601,633 | B2 * | 8/2003 | Sun et al. | 160/107 |
| 2002/0079066 | A1 | 6/2002 | Colson | 160/176.1 R |
| 2003/0015300 | A1 | 1/2003 | Colson et al. | 160/168.1 R |

FOREIGN PATENT DOCUMENTS

| | | |
|---|---|---|
| EP | 0 491 097 A1 | 6/1992 |
| GB | 1166738 | 10/1969 |
| WO | WO 02/06619 A1 | 1/2002 |

* cited by examiner

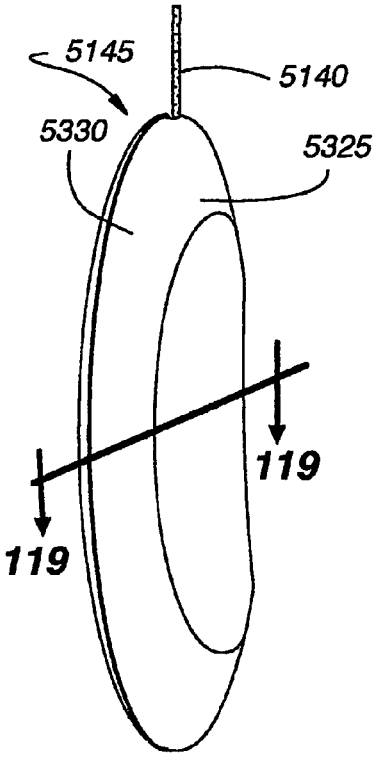
Fig.118
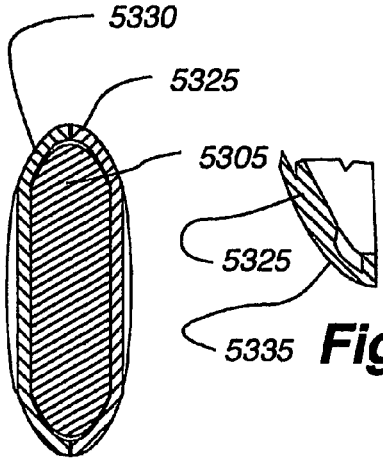
Fig. 120
Fig. 119
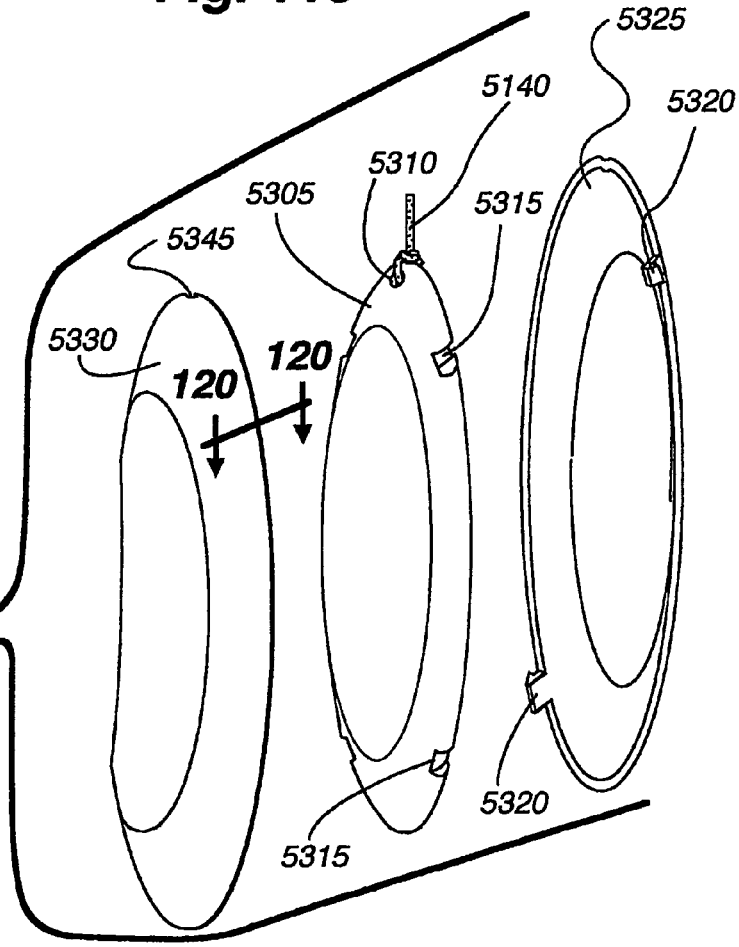
Fig. 121

SHUTTER-TYPE COVERING FOR ARCHITECTURAL OPENINGS

CROSS REFERENCE TO RELATED APPLICATIONS

This utility application claims priority to both U.S. provisional patent application No. 60/305,947, filed 16 Jul. 2001 and U.S. provisional patent application No. 60/381,587, filed 17 May 2002. This application is also related to U.S. utility patent application Ser. No. 10/197,674, concurrently filed herewith on 16 Jul. 2002, for Shutter-Like Covering And Hardware For Architectural Openings, which claims priority to U.S. provisional patent application No. 60/306,049 filed 16 Jul. 2001 and is hereby incorporated by reference in its entirety.

BACKGROUND OF THE INVENTION

1. Field of the Invention

The invention relates generally to a covering for an architectural opening, and more particularly to a window blind assembly comprising a plurality of horizontal slats, which can be retracted as well as moved from an open and closed position, wherein the blind assembly has a look at least partially reminiscent of plantation-style shutters.

2. Background Description

Venetian style blinds and plantation style shutters are two styles of window coverings commonly used in residential and commercial applications.

Conventional Venetian blind assemblies typically comprise a head rail, a bottom rail and a plurality of horizontal slats disposed therebetween. Lift cords extend from a catch mechanism in the head rail to the bottom rail. By releasing the catch and by pulling on or guiding the portions of the lift cords that extend form the headrail and the catch, the vertical distribution of the slats can be moved up or down between retracted and extended positions across an opening. Furthermore, each of the plurality of slats is typically supported by a cord or tape ladder. The ladder is typically attached to a tilt mechanism in the headrail for pivot about the slats longitudinal axis, whereby rotating a rod or pulling cords that extend from the mechanism, the plurality of slats can be opened or closed depending on how much light a users wants to pass through the opening.

Generally speaking, Venetian blinds are thinner and lighter than plantation shutters and do not have the peripheral frame required in plantation shutters. The headrails of the Venetian blind assemblies that typically contain the mechanisms necessary to control operation of the blinds are often not very architecturally pleasing, and may even be unsightly. It is common for an architectural opening having a Venetian blind to make use of a valance or other interior design element to hide the headrail.

Plantation shutters typically comprise a plurality of horizontal slats like the Venetian blinds, yet they tend to be more massive in appearance. The plurality of slats are typically enclosed in a peripheral framework that surrounds the architectural opening. Because, the slats are connected directly to the framework they cannot be moved up and down. They can, however, be pivoted between open and closed positions usually by the operation of an actuator rod that is loosely attached to the slats, wherein movement upwardly or downwardly of the actuator rod pivots the slats between the open and closed positions.

Although many consider plantation shutters to be more attractive than Venetian blinds, there are some drawbacks that discourage purchases. Perhaps, the biggest drawback is that plantation shutters cannot be easily removed from a window, leaving the user with the limited choice of having the slats in the open position or the closed position, but no ability to have a clear unobstructed view through the window such as is provided when a Venetian blind is retracted. Furthermore, because shutters are typically very deep, and the framework often extends beyond the surface of the interior wall, it is only on deeply inset windows that shutter type blinds can be installed flush with the wall surface.

SUMMARY OF THE INVENTION

The covering for an architectural opening as described below in various embodiments is a blend of a Venetian type blind and a shutter, wherein there is no peripheral frame as found in shutters. In general, the headrail has a look that is similar to that of the foot rail (or bottom slat) and in preferred variations, the headrail comprises a similar shape as the plurality of slats depending from it.

In one preferred embodiment, the headrail of the covering is pivotally connected to a pair of mounting brackets for pivotal movement about a longitudinal horizontal axis. A plurality of horizontally disposed slats are suspended therefrom and are coupled to the headrail by a cord ladder. Vertical movement of a vertically extending actuator rod operatively attached to the headrail acts to pivotally move the slats about longitudinal horizontal axes between open and closed positions. For retracting or extending the covering across an architectural opening, lift cords are secured to a bottom slat and extend upwardly across the slats then horizontally along and inside the headrail to a side location where they terminate at a lift actuator. By moving the lift actuator vertically, the slats can be retracted or extended across the architectural opening. In a first variation, the bottom end of the actuator rod is pivotally attached to the window frame. In a second variation, the bottom end of the actuator rod is pivotally attached to the bottom slat, (or foot rail) which is mounted for pivotal movement about a longitudinal horizontal axis.

In another variation of this one preferred embodiment, mounting brackets are provided which receive a pair of pins that extend horizontally from the ends of the headrail into separate slots in the brackets. When the headrail is pivoted from an open position to a closed position, the pins sliding in the slots cause the headrail to slide horizontally toward the architectural opening. Wide slats that extend a considerable distance beyond a surface of a window or the like in an architectural opening may thereby be moved into a position wherein the slats are flush or nearly flush with the surface when in a closed position but will shift away from the surface when being opened to accommodate the width of the slats. Additionally, other variations are described wherein the headrail pivots about its longitudinal axis but does not move laterally.

In a second preferred embodiment of the covering, it incorporates a balanced tilt mechanism for moving the horizontal slats in lieu of the actuator rod. The balanced tilt mechanism permits the slats (or vanes) of the horizontal blind to be pivoted in either clockwise or counterclockwise directions with minimal effort by gently lifting or pulling on a weighted tassel hanging from the end of a tilt actuator cord. Variations of this second preferred embodiment utilize a lift cord locking mechanism contained within the pivoting headrail.

Other aspects, features and details of the present invention can be more completely understood by reference to the following detailed description of a preferred embodiment, taken in conjunction with the drawings, and from the appended claims.

BRIEF DESCRIPTION OF THE DRAWINGS

FIG. 118 is a isometric view of a weighted tassel.

FIG. 119 is a cross section top view of the tassel taken along line 119—119 of FIG. 118.

FIG. 120 is a fragmentary view of a lipped edge of a female plastic cover for the weighted tassel taken along line 120—120 of FIG. 121.

FIG. 121 is an exploded isometric view of the weighted tassel.

FIG. 123 is a top view of the locking mechanism taken along line 123—123 of FIG. 122 illustrating the locking mechanism in its locked position.

FIG. 124 is a cross sectional side view of the locking mechanism taken along lines 124—124 of FIG. 123.

FIG. 125 is a cross sectional top view of the locking mechanism taken along line 125—125 of FIG. 124.

FIG. 126 is a top view of the locking mechanism taken along line 123—123 of FIG. 122 illustrating the locking mechanism in its unlocked position.

FIG. 127 is an isometric front view of an alternative embodiment covering utilizing one-sided cord ladders.

FIG. 128 is an isometric rear view of an alternative embodiment covering utilizing one-sided cord ladders.

FIG. 129 is a cross sectional side view of the covering of FIG. 127 taken along line 129—129 of FIG. 127.

FIG. 130 is a cross sectional side view of the covering of FIG. 127 taken along line 130—130 of FIG. 127.

FIG. 131 is a partial bottom view of a slat taken along line 131—131 of FIG. 129.

FIG. 132 is a partial bottom view of a slat taken along line 132—132 of FIG. 130.

FIG. 133 is an exploded isometric view of a first embodiment breakaway tassel to be utilized with a plurality of lift cords.

FIG. 134 is an isometric view of the first embodiment breakaway tassel.

Figure 134:
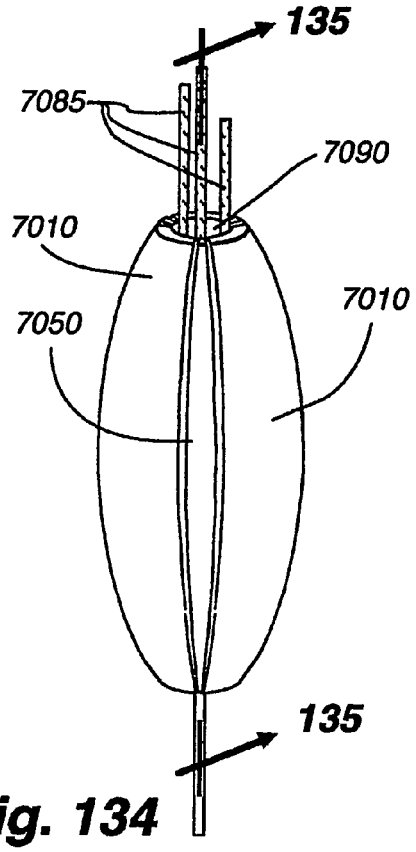
Figure 135:
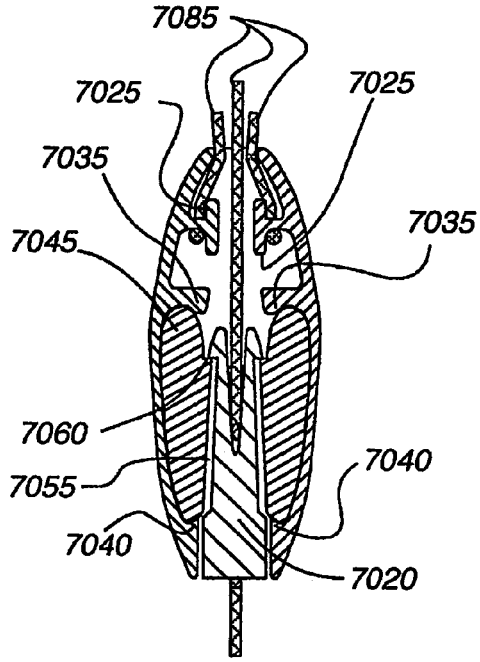

FIG. 135 is a cross sectional side view of the first embodiment breakaway tassel as viewed along line 135—135 of FIG. 134.

Figure 136:
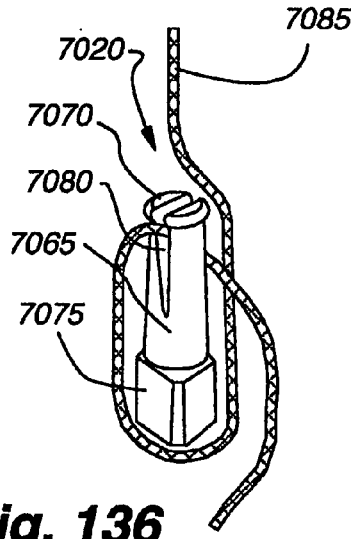
Figure 137:
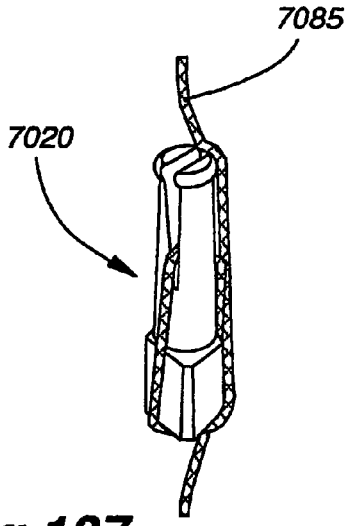

FIGS. 136 and 137 are isometric views of a center lift cord retaining pin showing how a lift cord is secured to the pin.

Figure 138:
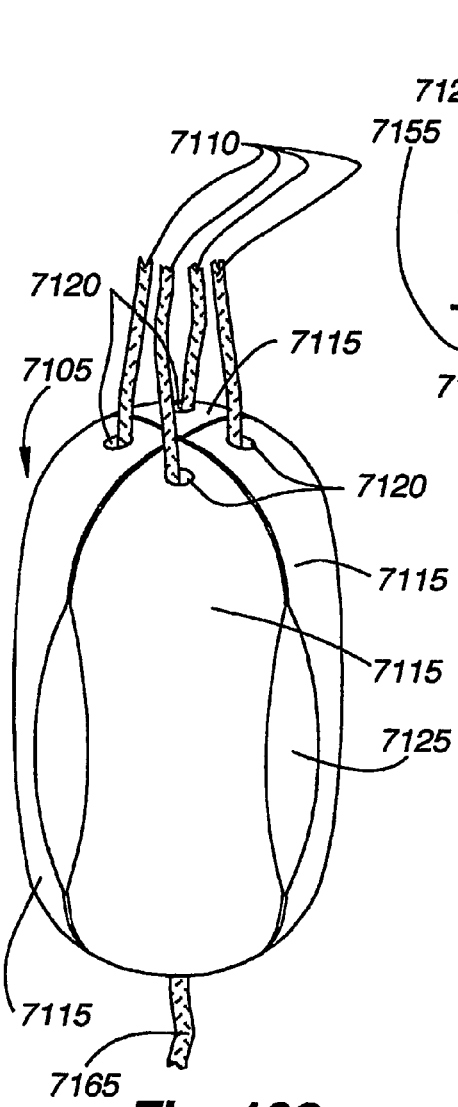

FIG. 138 is an isometric view of a second embodiment breakaway tassel.

Figure 139:
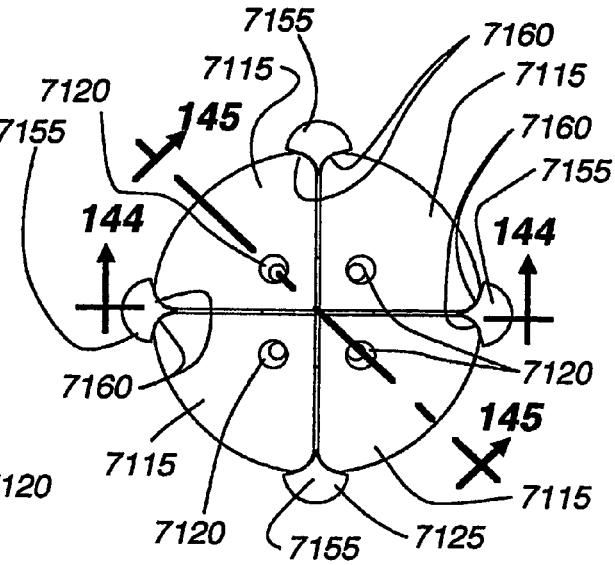

FIG. 139 is a top view of the second embodiment breakaway tassel.

Figure 140:
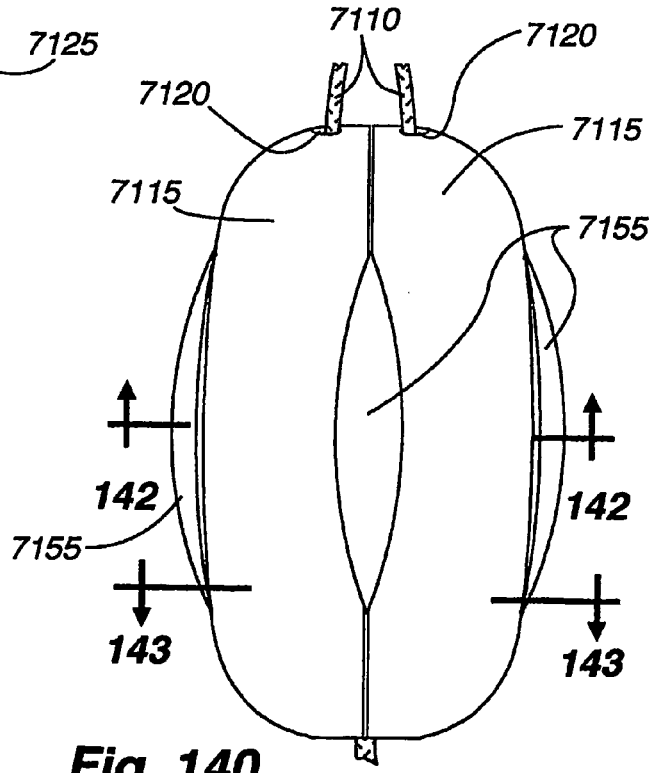

FIG. 140 is a side view of the second embodiment breakaway tassel.

Figure 141:
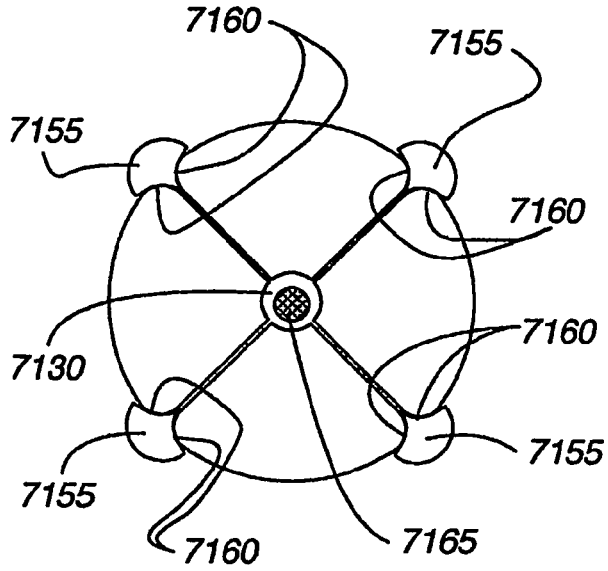

FIG. 141 is a bottom view of the second embodiment breakaway tassel.

Figure 142:
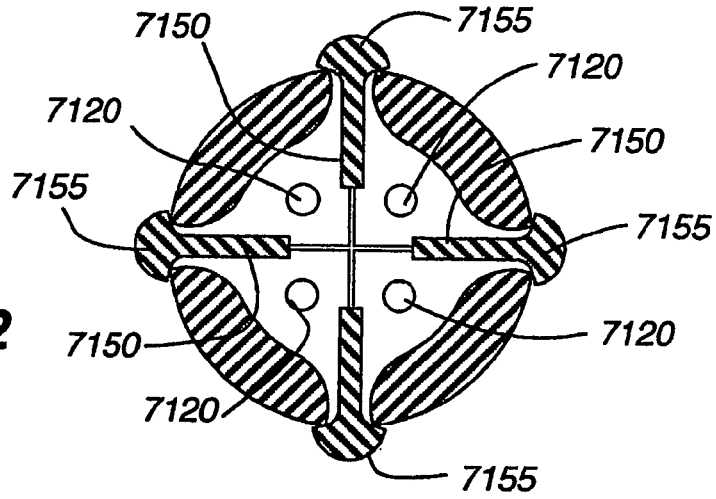

FIG. 142 is a cross sectional bottom view of the breakaway tassel taken along line 142—142 of FIG. 140.

Figure 143:
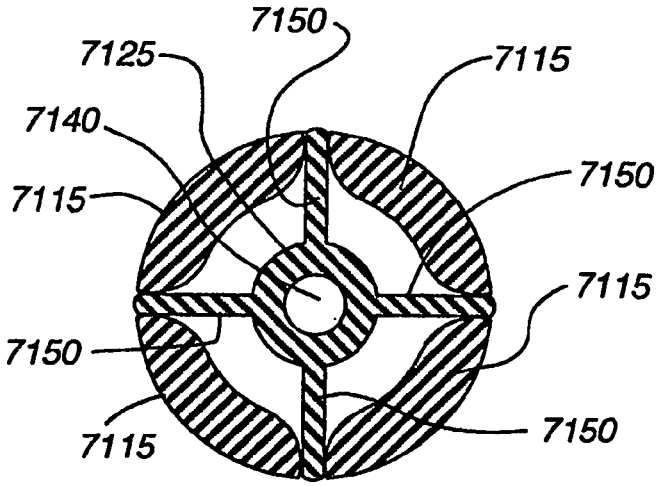

FIG. 143 is a cross sectional top view of the breakaway tassel taken along line 143—143 of FIG. 140.

Figure 144:
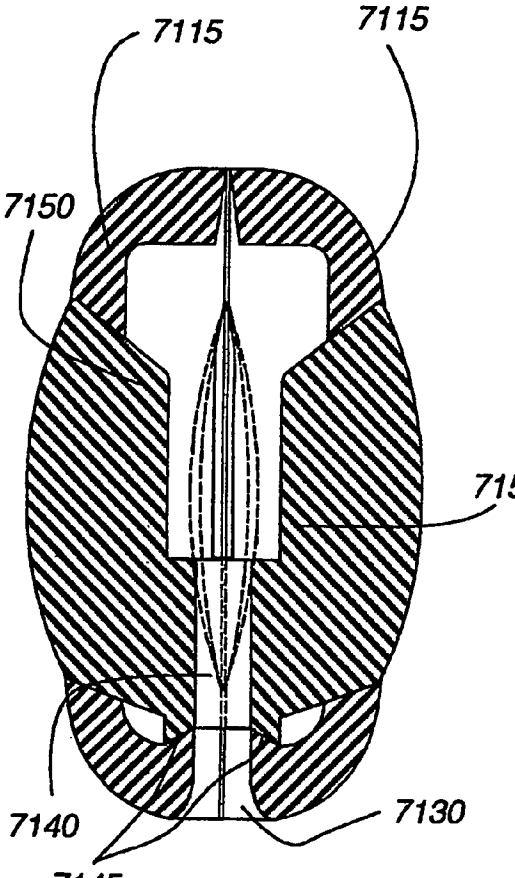

FIG. 144 is a cross sectional side view of the second embodiment breakaway tassel taken along line 144—144 of FIG. 139.

Figure 145:
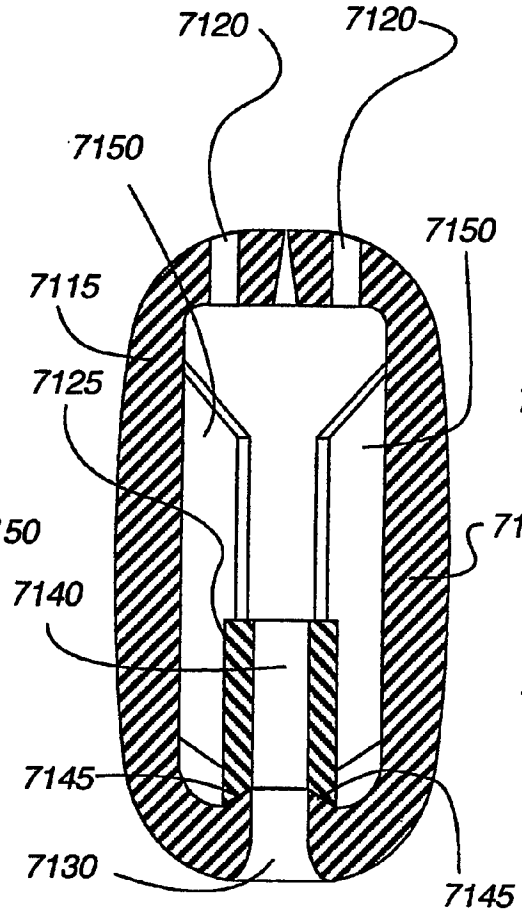

FIG. 145 is a cross sectional side view of the second embodiment breakaway tassel taken along line 145—145 of FIG. 139.

Figure 146:
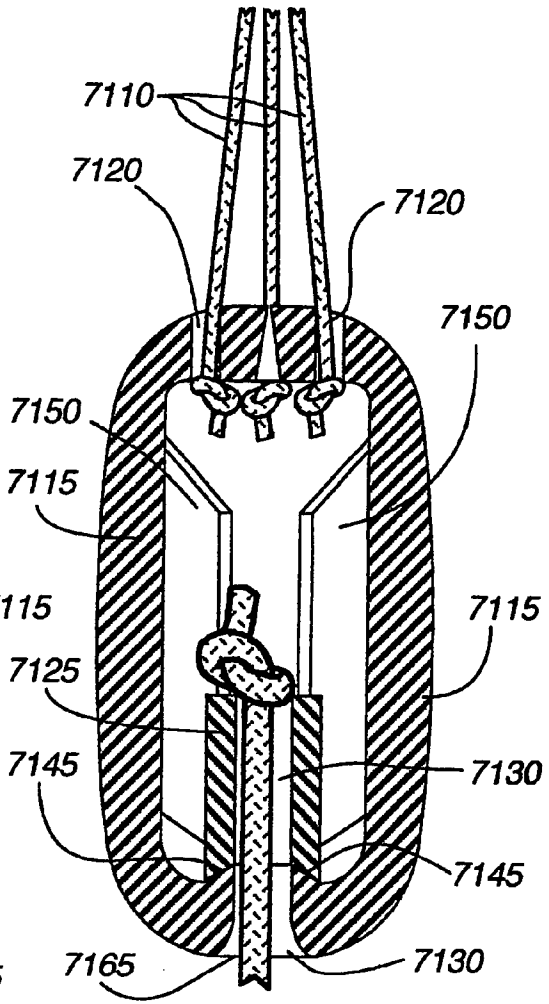

FIG. 146 is a cross sectional side view of the second embodiment breakaway tassel taken along line 145—145 of FIG. 139 showing the lift cords secured therein.

Figure 147:
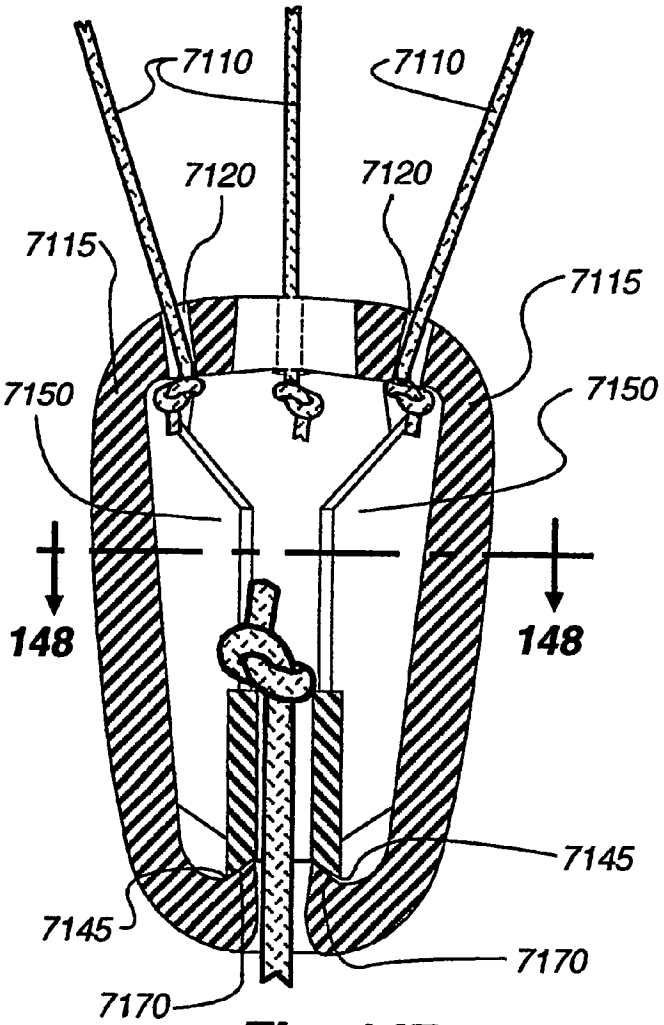

FIG. 147 is a cross sectional view taken along line 145—145 of FIG. 139 illustrating the tassel as it begins to break apart.

Figure 148:
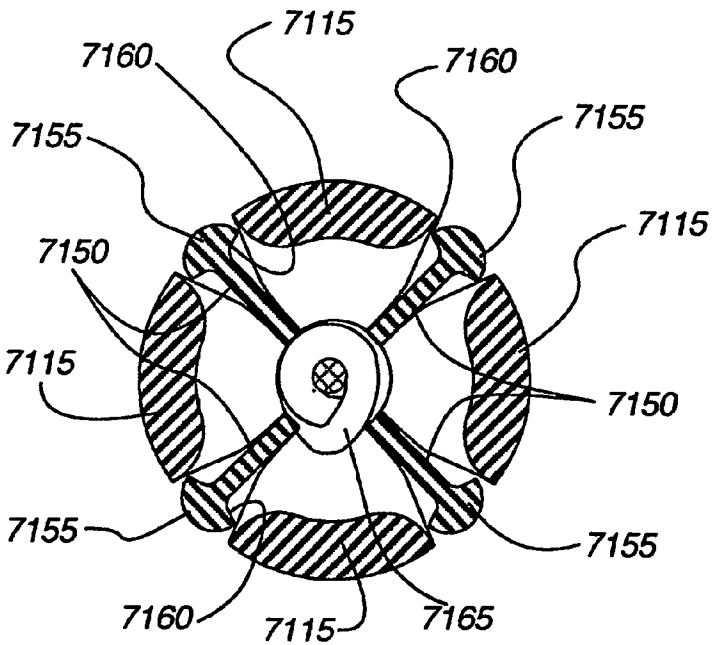

FIG. 148 a view similar to FIG. 143 showing the cord securing members separating from the center coupling member of the second embodiment breakaway tassel.

Figure 149:
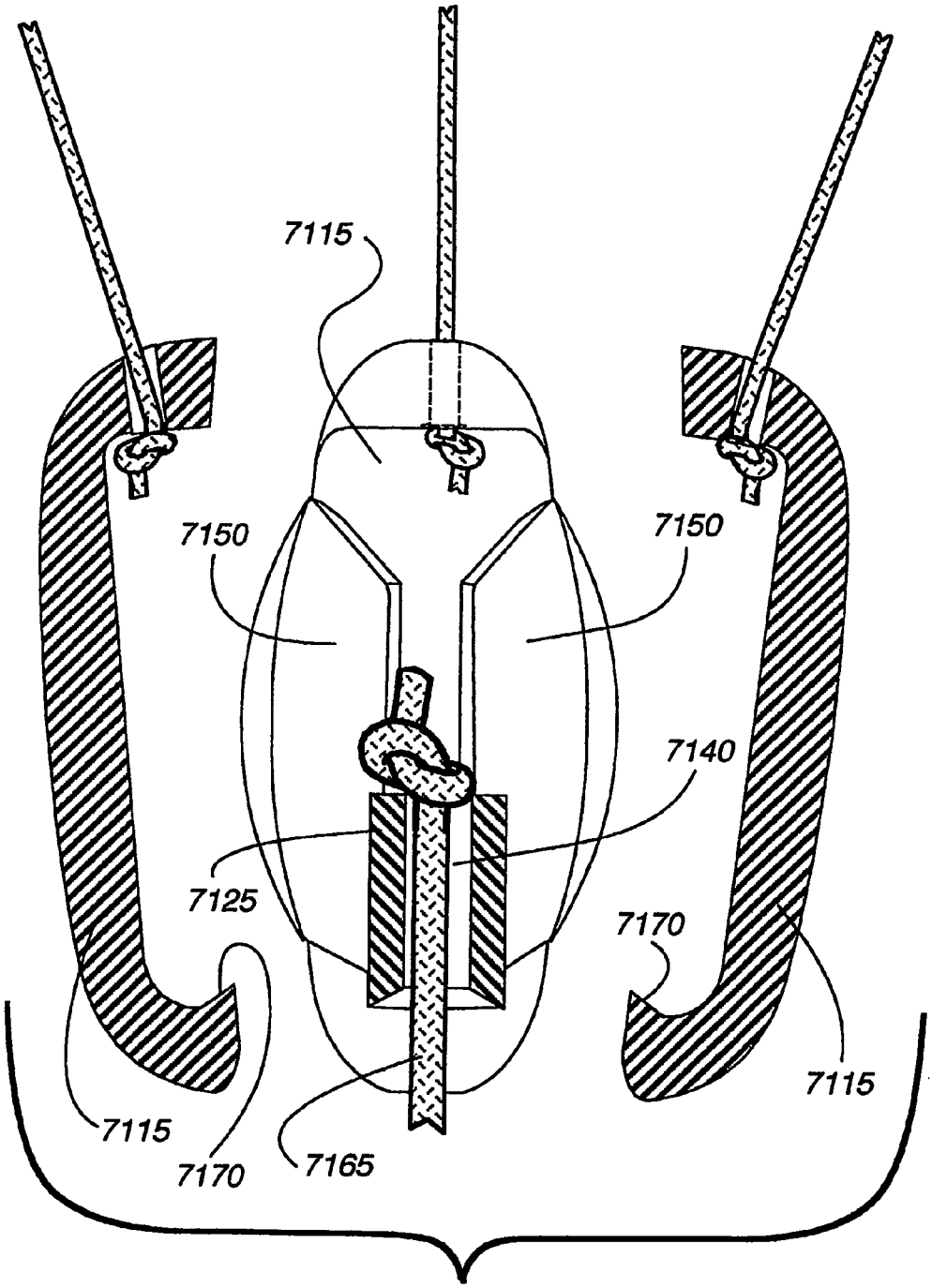

FIG. 149 is a cross sectional side view of the second embodiment tassel after the cord securing members have separated from the center coupling member.

DETAILED DESCRIPTION OF THE PREFERRED EMBODIMENTS

Referring to FIGS. 1–12, a window blind assembly 10 according to a preferred embodiment of the invention is illustrated. While the present invention will be described for use as a window blind, it can be used in any architectural opening such as doorways, archways and the like. The blind assembly comprises (i) a horizontal, self supporting and generally rigid slat-shaped headrail 12 pivotally coupled to a window frame by a pair of mounting brackets 14, (ii) a horizontal, self supporting and somewhat rigid lower slat 16 (or foot rail) coupled to the headrail by one or more lift cords 22, (iii) a plurality of horizontal slats 24 disposed between the top and bottom slats and coupled thereto by a cord ladder 26, and (iv) an actuator rod 28 for both lifting and tilting the slats. The slats are tubular in configuration and made of a fibrous material which has been somewhat rigidified so that the slats are horizontally self supporting. The tubular fabric slats are described in greater detail in a co-pending and concurrently filed United States patent application that is owned by the assignee of the present application entitled "Shutter-Like Covering And Hardware For Architectural Openings" (patent application Ser. No. 10/197,674. It will be appreciated in alternative embodiments of the present invention that other types of slats, such as those made of wood or aluminum, could also be used in place of the fibrous material slats.

The headrail 12 is preferably tubular, having a hollow interior containing pulleys 30 and 32 for receiving and guiding the lift cords 22. The headrail 12 is preferably fabricated from aluminum, although alternative versions could be fabricated from other suitable materials such as plastic. The headrail 12 is typically covered with a non-woven fabric to match the other slats 24 in the blind assembly 10. The headrail 12 also includes ends caps 34, for pivotal attachment to two mounting brackets 14 that are attached to either side of the window frame.

Figure 8:
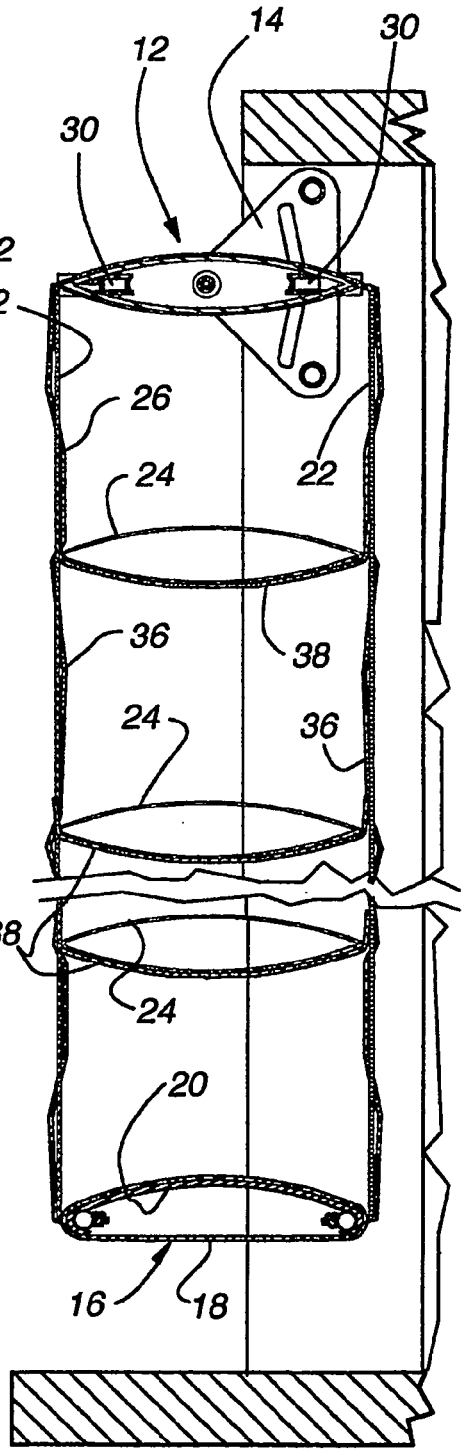
FIG. 8 is a vertical section of the blind assembly taken along line 8—8 of FIG. 6.
Figure 12:
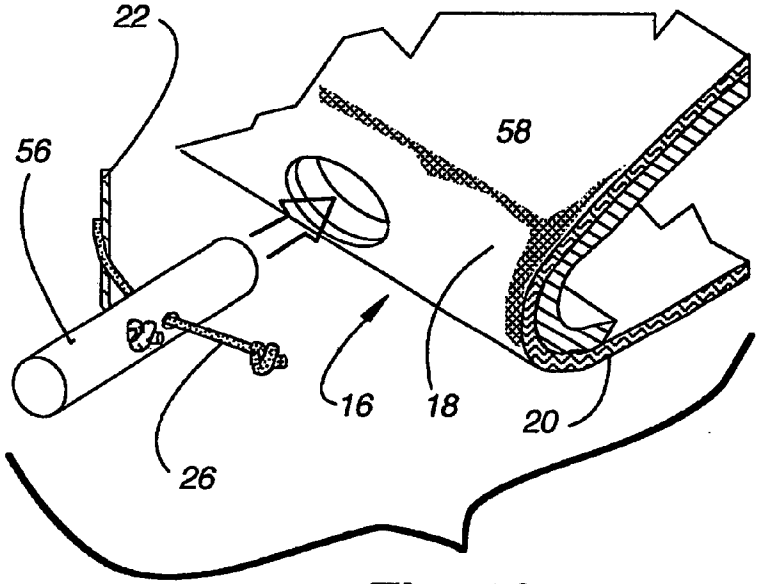
FIG. 12 is a fragmentary isometric view of the rigid bottom slat illustrating a means for attaching the lift and cord ladders thereto according to one embodiment of the invention.
Figure 11:
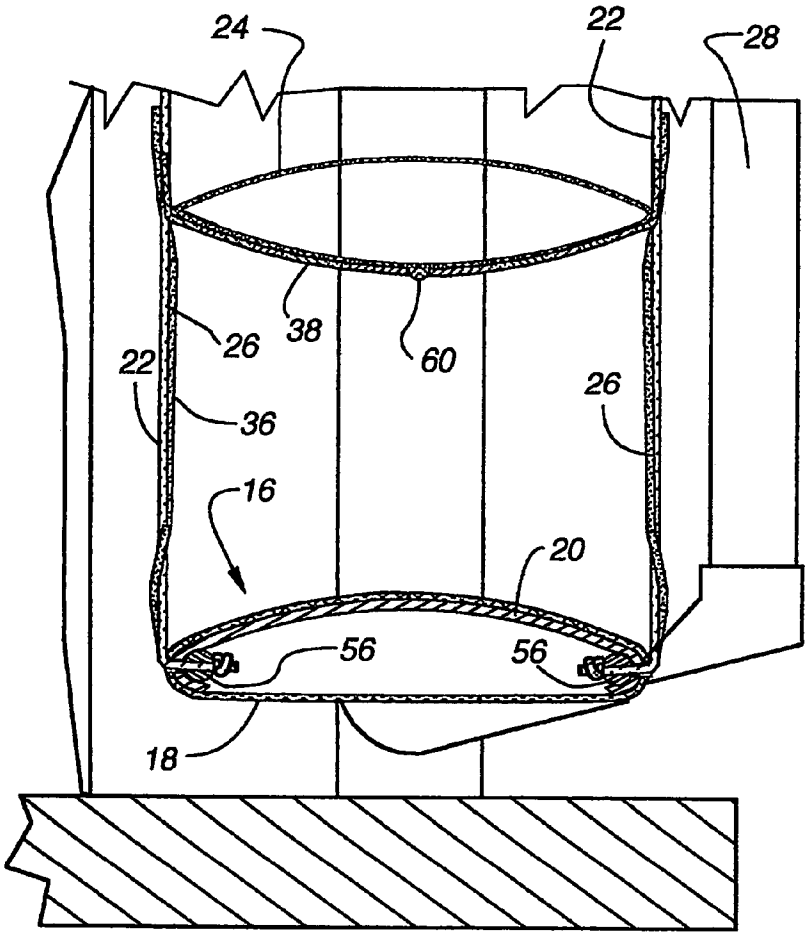
FIG. 11 is a fragmentary vertical section of the blind assembly taken along line 11—11 of FIG. 6.

The horizontal bottom slat 16 is also tubular and is preferably, but not necessarily, fabricated from a non-woven fabric shell 18 internally reinforced with a plastic piece 20 (as shown in FIGS. 11 and 12). The bottom slat 16 typically depends from the headrail 12 by way of a plurality of horizontally spaced vertically extending lift cord pairs 22 and serves as the foot rail for the window blind assembly. The lift cord pairs 22 are fixedly attached to the bottom slat 16 at opposite ends of the slat and pass upwardly along the front and back edges of the other slats 24 to the headrail. The lift cord pair can be intertwined with the vertical sections of the cord ladders. The lift cords pass into the hollow interior of the headrail 12 wherein they pass around the pulleys and pass laterally toward an end of the headrail. Each lift cord pair 22 includes a front lift cord that extends along the front edges of the slats 24, and a rear lift cord that extends along the back edges of the slats 24 (as best illustrated in FIG. 8).

Figure 51:
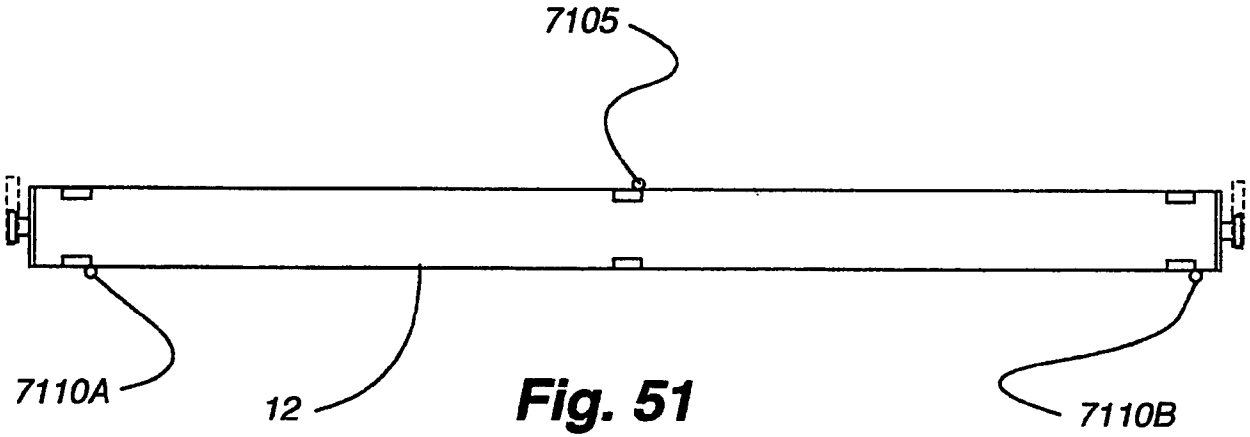
FIG. 51 is a schematic view showing the placement of lift cords of a covering utilizing three lift cords spaced at differing longitudinal locations along the headrail.
Figure 52:
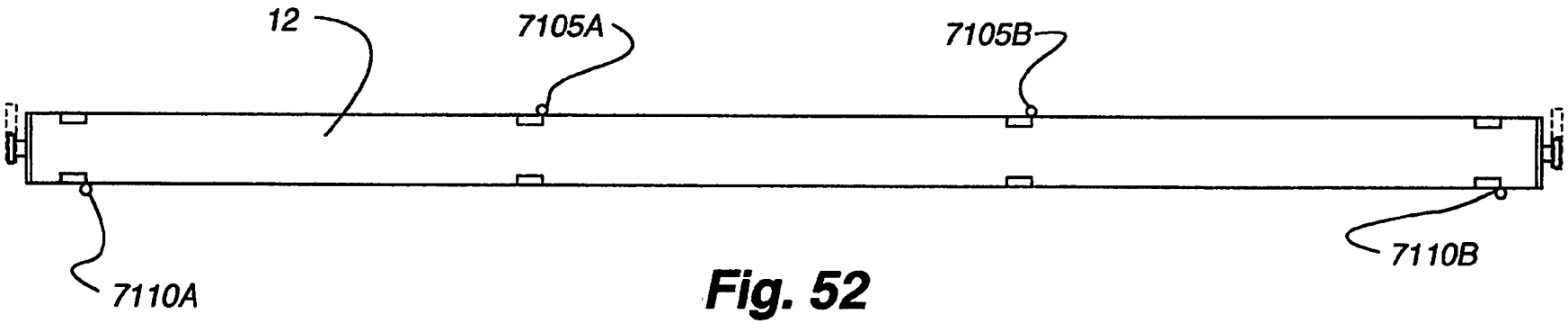
FIG. 52 is a schematic view showing the placement of lift cords of a covering utilizing four lift cords spaced at differing longitudinal locations along the headrail.

Referring to FIGS. 51 and 52, in wider window blind assemblies that utilize three or more cord ladders 26, the front lift cords 7005 and rear lift cords 7010 need not be paired together at the same longitudinal positions on the slats or headrail 12 that correspond to the positions of the cord ladders 26. For instance as shown in FIG. 51, when three cord ladders are utilized only three lift cords are required: a left front lift cord 7110A that can be intertwined with the front riser cord of a left cord ladder (not shown); a right front lift cord 7110B that can be intertwined with the front riser cord of a right cord ladder (not shown); and a center rear lift cord 7105 that can be intertwined with the rear riser cord of a center cord ladder (not shown). As illustrated in FIG. 52, when four cord ladders are utilized only four lift cords are required: front left and right end lift cords 7110A and B respectively and rear left and right lift cords 7105A and B respectively that are in-between the end lift cords. The lift cords can be intertwined with the riser cords of the cord ladders (not shown). Alternatively, concerning the four cord ladder blind assembly, the two end lift cords could extend along the rear of the slats and the in-between lift cords could extend could extend along the front of the slats.

Figure 44:
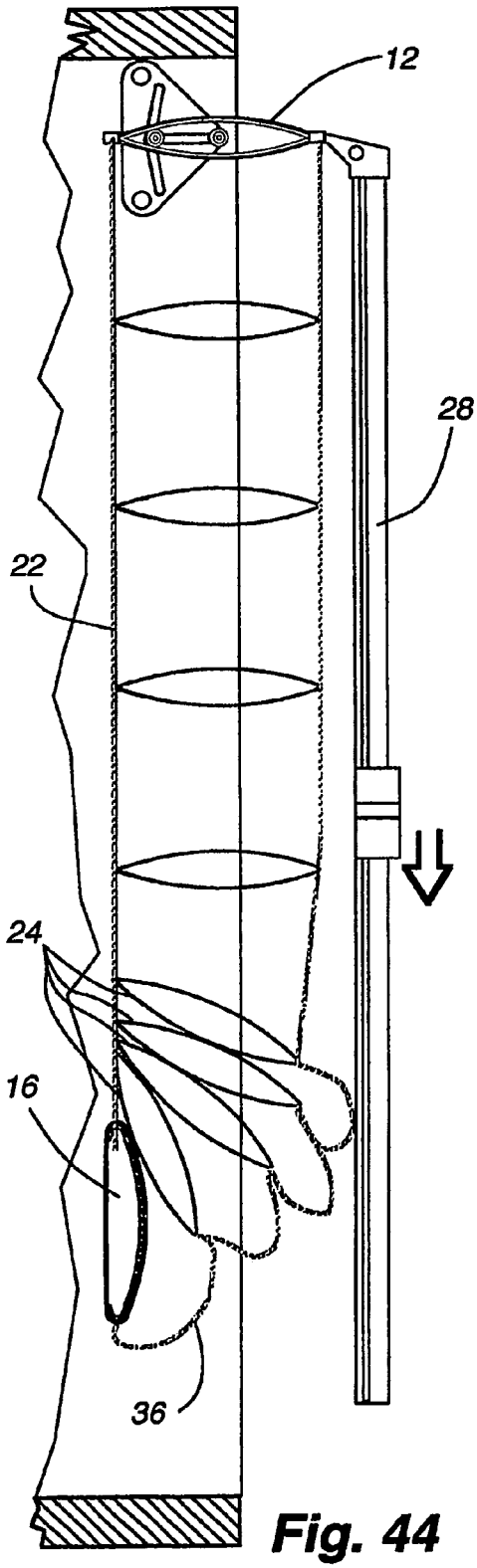
FIG. 44. is a vertical cross section of an alternative window blind assembling incorporating a single lift cord attached to the rear of the headrail and depending slats with the lower slats in a partially raised configuration.
Figure 45:
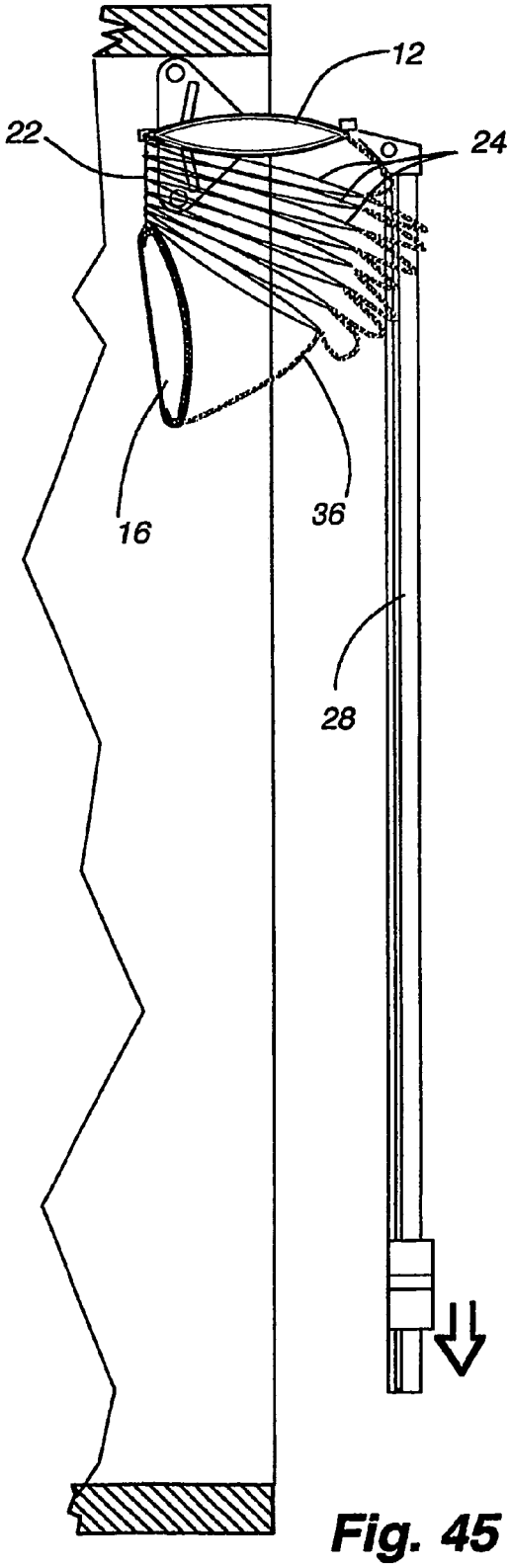
FIG. 45 is a vertical cross section similar to FIG. 44 with the slats in their fully raised position.
Figure 47:
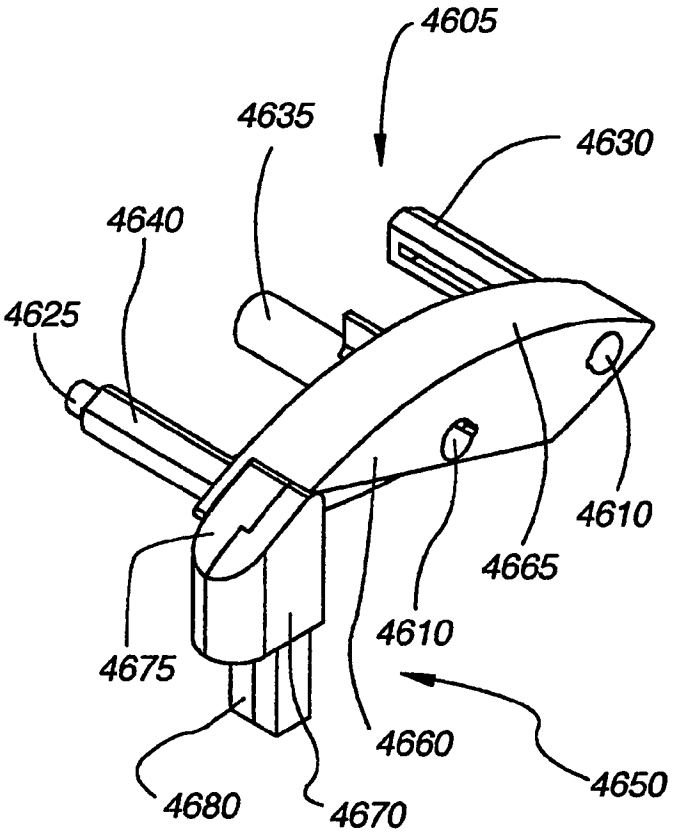
FIG. 47 is an isometric view of the alternative actuator rod top end cap and the alternative headrail end cap showing the top end cap attached to the headrail end cap.
Figure 46:
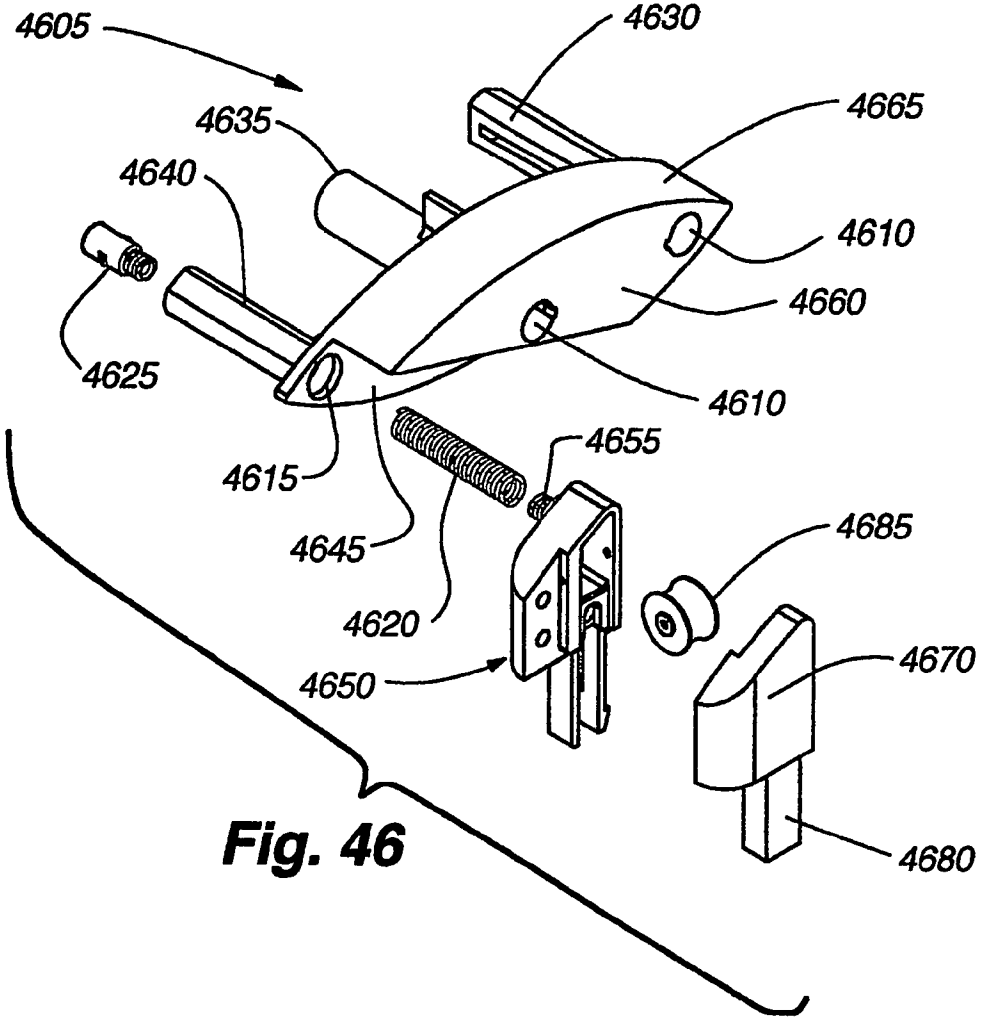
FIG. 46 is an exploded isometric view of an alternative actuator rod top end cap and an alternative headrail end cap.
Figure 48:
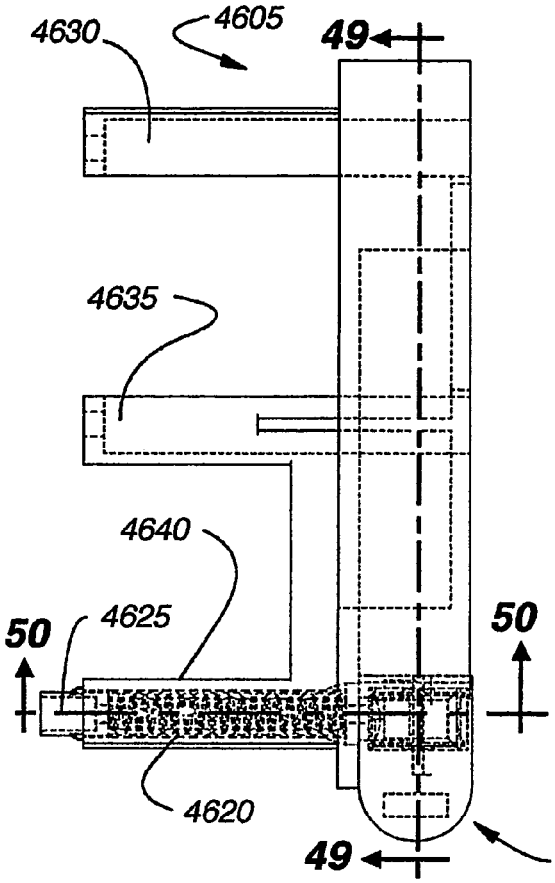
FIG. 48 is a cross-sectional top view of the alternative actuator rod top end cap and the alternative headrail end cap.
Figure 49:
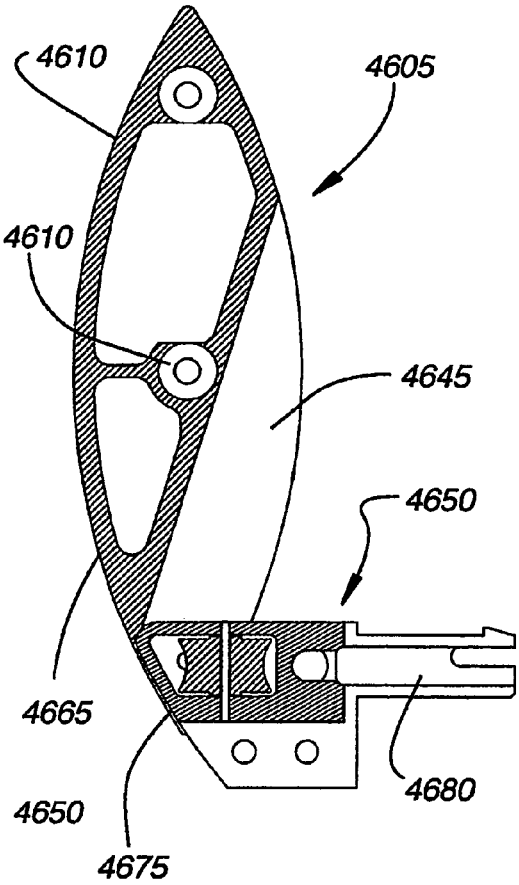
FIG. 49 is a cross-sectional view of the alternative actuator rod top end cap and the alternative headrail end cap taken along line 49—49 of FIG. 48.
Figure 50:
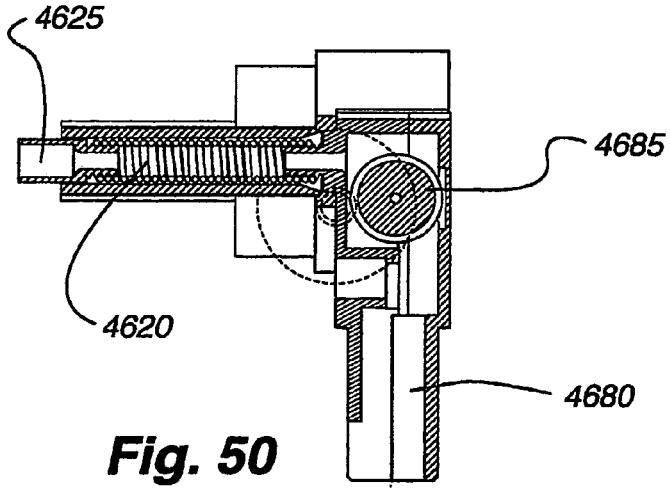
FIG. 50 is a cross-sectional view of the alternative actuator rod top end cap and the alternative headrail end cap taken along line 50—50 of FIG. 48.

In an alternative embodiment, only a single lift cord is utilized as illustrated in FIGS. 44 and 45. Preferably the lift cord 22 extends along the back edge of the slats 24 (the edge adjacent to the window), although alternatively it can extend along the front edge of the slats as well. Accordingly as the slats 24 are raised, the front end of the bottom slat 16 and the front ends of the lower slats 24 flop downwardly as best shown in FIG. 44 until any further downwardly movement of a slats front end is prohibited by the tension of a front riser cord 36 of the cord ladder 26 and a cross rung 38 associated with the slat. As a result the bottom slat 16 and associated lower slats 24 form an aesthetically pleasing stack that from a side or cross-sectional view is reminiscent of a portion of a flower with each vane resembling a pedal emanating from the center of the flower pedal as shown in FIG. 45, wherein the slats resemble a quarter section of a flower.

Figure 4:
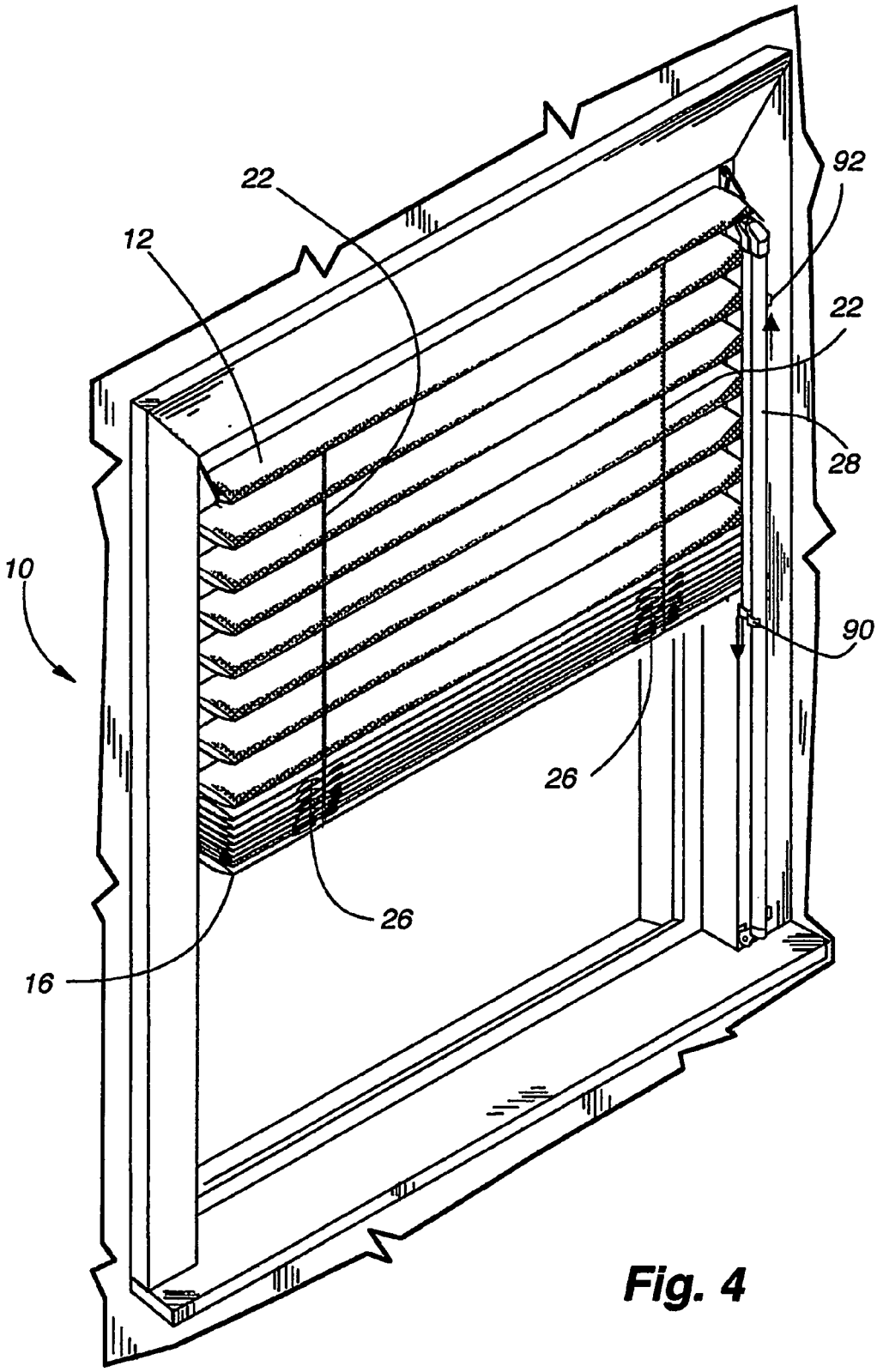
FIG. 4 is an isometric view of the front of a blind assembly in a partially raised and retracted position.
Figure 5:
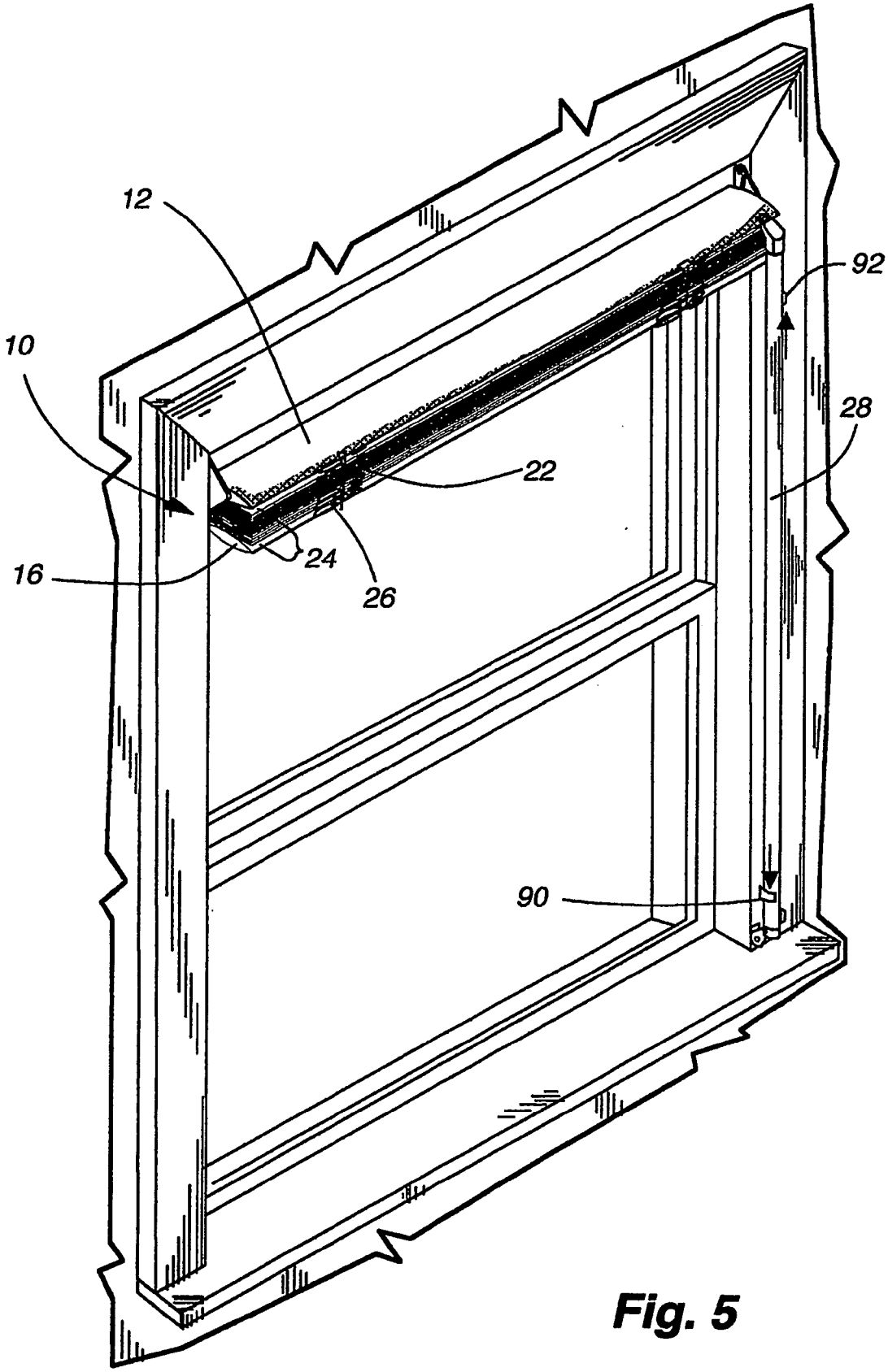
FIG. 5 is an isometric view of the front of a blind assembly in its fully raised and retracted position.
Figure 6:
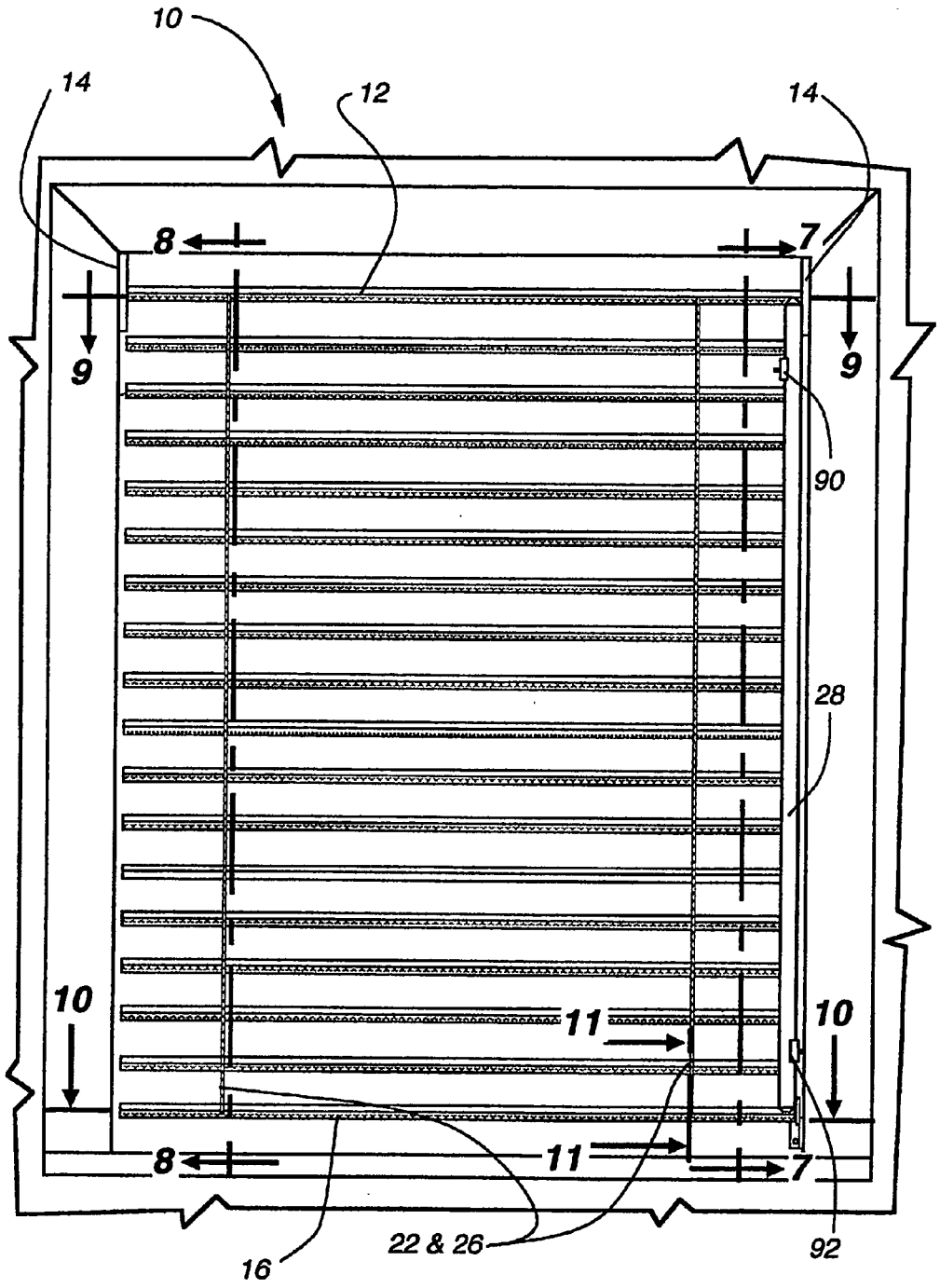
FIG. 6 is a front view of the bind assembly.
Figure 7:
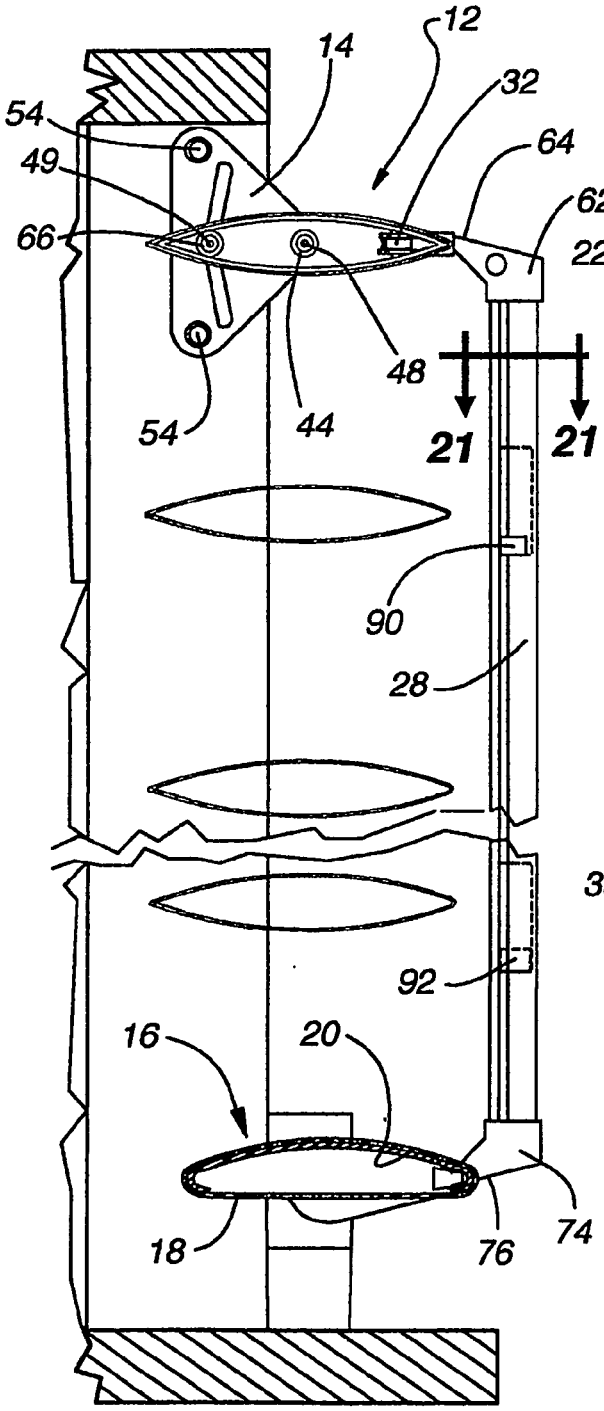
FIG. 7 is a vertical section of the blind assembly taken along line 7—7 of FIG. 6.

Referring back to FIGS. 1–12, the horizontal slats 24 are vertically spaced in-between the top and bottom slats 12 and 16, and coupled thereto by a plurality of cord ladders 26. In a preferred embodiment the slats 24 have an upwardly convex arcuate side and a downwardly convex arcuate side, each intersecting and terminating proximate the front and rear edges of the slats. When the slats are compressed, such as when the blind assembly is retracted with the slats vertically stacked immediately beneath the headrail, the sides of the slats collapse onto each other, significantly reducing the height of each horizontal slat 24 (as is best illustrated in FIGS. 4 and 5).

Each cord ladder 26 typically comprises two vertically orientated riser cords 36 that are spaced from each other with a plurality of the cross rungs 38 spanning the space therebetween. Each horizontal slat 24 is cradled in corresponding cross rungs 38 of the plurality of cord ladders 26. Each of the riser cords 36 is generally coextensive with a lift cord 22 as illustrated in FIG. 8 with the lift cords 22 being intertwined with the riser cords and periodically woven between two vertically spaced and adjacent cross rungs 38. Each riser cord of each cord ladder 26 is fixedly attached to the bottom slat 16 at a bottom end and to the headrail 12 at a top end.

A vertically orientated actuator rod 28 is pivotally attached to the headrail 12 at its top end and to the window frame at it bottom end. The slats 24 may be tilted open or closed by moving the actuator rod 28 vertically. A pair of lift handle members 90 and 92 are slidably disposed within the actuator rod 28 and are coupled with each other and to the plurality of lift cords 22, such that slidable movement of the lift handles 90 and 92 along the actuator rod 28 raises or lowers the blind assembly 10 as will be described in greater detail below.

Figure 18:
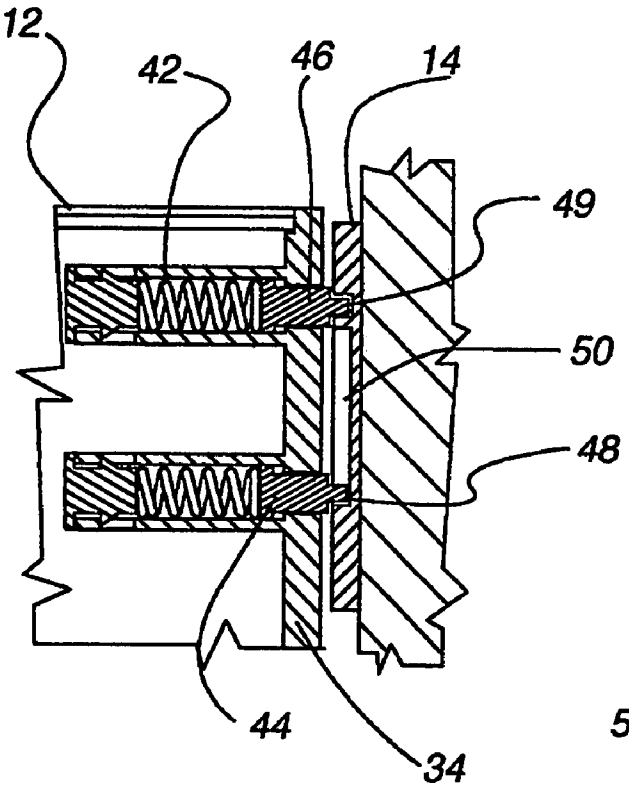
FIG. 18 is a fragmentary horizontal section of the headrail and an associated mounting plate taken along line 18—18 of FIG. 15.

Blind Assembly Structure Associated with the Tilting of the Slats and the Operation Thereof:

As previously described, the headrail 12 is pivotally attached at both ends to the window mounting plates 14. The attachment occurs by way of a pair of end caps 34 that are fixedly attached to either end of the headrail 12 by any suitable means including but not limited to interference fitment, adhesive, riveting or the like. As illustrated in FIG. 18, each end cap 34 includes two receptacles 42 in which spring loaded pins 44 and 46 are received and retained. The pins 44 and 46 are preferably biased in an extended position perpendicularly to the face of the end cap 34 and substantially parallel to a longitudinal axis of the headrail 12. The tips 48 and 49 of the pins are sized to be pivotally and slidably received in slots 50 and 52 in the mounting plates 14. One of the pins 44 is located on each end cap 34 proximate the cross-sectional center of the headrail 12, and the other pin 46 is disposed towards the rear longitudinal edge of the headrail 12. By depressing the pins, the headrail can be positioned between and in alignment with two opposing mounting plates 14 and the pins can be engaged in the mounting plate slots 50 and 52 upon release, thereby securing the blind assembly 10 to the window opening.

FIGS. 46–50 illustrate a first alternative embodiment headrail end cap 4605. Like the end cap described above, the end cap has two receptacles 4610 in which spring loaded pins 44 and 46 (not shown) are received and retained. As above, the pins are to be received in the appropriate slots of an associated mounting plate 14 or mounting bracket 3305 (described below). Unlike the end cap 34, however, the alternative end cap 4605 does not mount flush with the end of the headrail 12, rather it extends beyond the headrail and comprises a cross sectional shape similar to that of the headrail 12 as can be best seen in FIG. 49. An alternative top end cap 4650 of the actuator rod 28 is pivotally attached to and integrated with the alternative top end cap 4605. A receptacle 4615 is provided in the alternative end cap to receive a tubular axle protrusion 4655 of the actuator rod top end piece 4650. Each of the receptacles 4610 and 4615 have inwardly extending portions 4630, 4635 and 4640 that extend inwardly into headrail 12 from the alternative end piece 4605. Contained within the inwardly extending portions 4630 and 4635 of the pin receptacles are springs (not shown) associated with the pin members. A spring 4620 is also contained within the inwardly extending portion 4640 of the tubular axle receptacle 4615. This spring 4620 is attached at one end to the alternative top end piece 4650 and at another end to a spring holder 4625 at the inside edge of the inwardly extending portion 4640. The spring 4620 acts to resiliently hold the top end cap 4650 against the headrail end cap 4605. Further, the spring connection of the actuator rod to the headrail end cap via the actuator rod top end piece, permits the tubular protrusion 4655 to be pulled from receptacle 4615, so that the actuator rod may be folded flat against and substantially parallel with the headrail for packing and shipping of the associated blind assembly. When the blind is unpacked, the tubular protrusion is biased into the receptacle by the spring, positioning the actuator rod for use once the blind assembly is properly mounted. The two inwardly extending receptacle portions 4630 and 4640 located proximate the edges of the headrail 12 also act to secure the end cap 4605 within the headrail. The portion of the end cap extending beyond the headrail also includes a recessed area 4645 for receiving the actuator rod top end cap 4650 such that the outside surface 4660 of the end cap 4605 and the top surface 4665 of the end cap are essentially aligned when the blind assembly is open with similar surfaces 4670 and 4675 on the actuator rod end cap 4650 giving the two end caps 4605 and 4650 a complementary and aesthetically pleasing look.

FIGS. 53–57 illustrate a second alterative headrail end cap 6405, a second alternative actuator rod end cap 6410 and alternative connecting structure 6415 and 6420. The illustrated components are adapted for use with an alternative actuator bar 6060 that is described in greater detail below as relating to the alternative lift mechanism 6150 and the second alternative pivoting mechanism 6005. Like the alternative embodiment described above, the second alternative embodiment also permits the actuator rod assembly to be stowed against and parallel to the headrail for shipment, although the manner in which this is accomplished differs somewhat from the first alternative embodiment.

Figures 53, 54, 55, 56, 57:
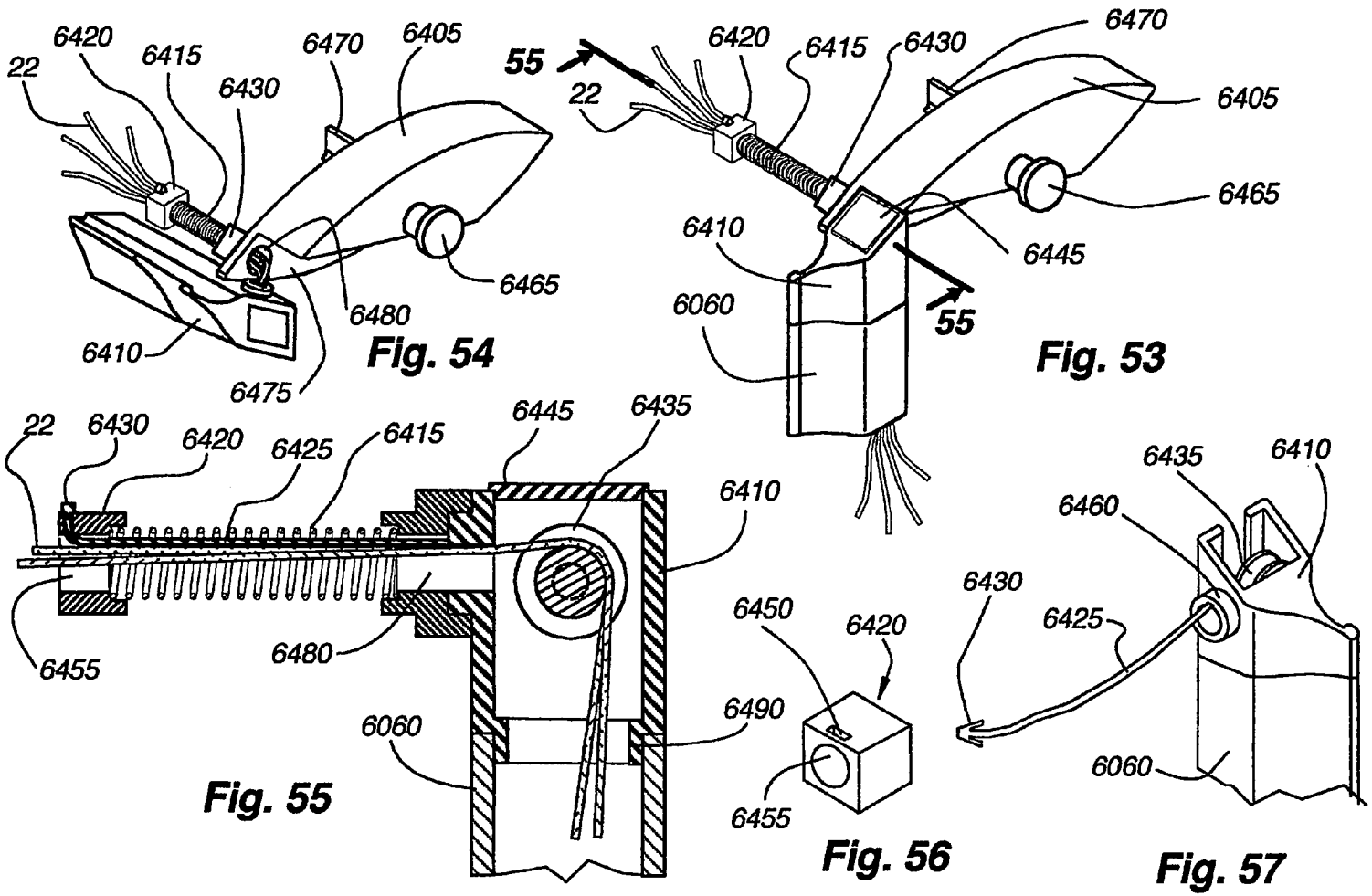
FIG. 53 is an isometric view of second alternative embodiment headrail and actuator rod end caps and the associated connecting structure.
FIG. 54 is an isometric view similar to FIG. 53 except the actuator rod is disposed in a position that is essentially parallel to an associated headrail for easier shipment of a blind assembly.
FIG. 55 is a cross section taken along line 55—55 of FIG. 53.
FIG. 56 is an isometric view of the spring stop
FIG. 57 is an isometric view of the second alternative embodiment actuator rod end cap.
Figure 58:
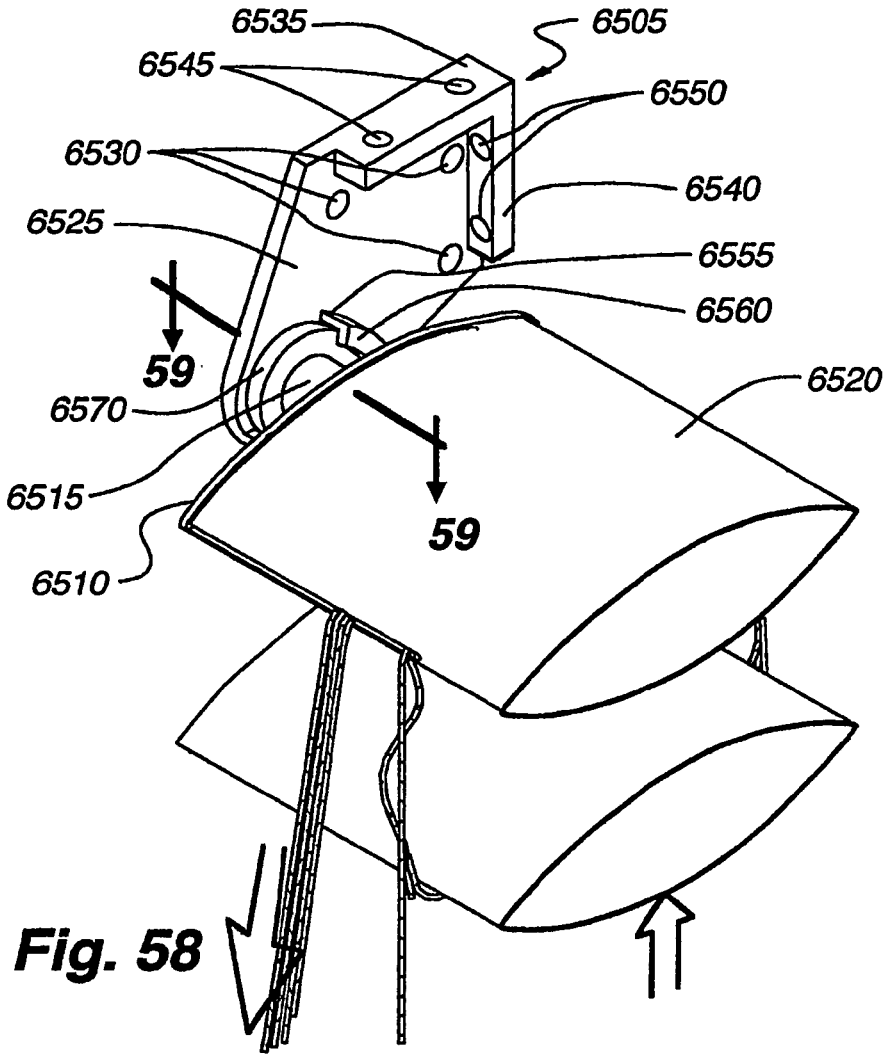
FIG. 58 is an isometric view of the second alternative mounting bracket and a portion of an associated headrail assembly.

As illustrated in FIG. 54, the second alternative headrail end cap 6405 does not mount flush with the end of the headrail, rather it extends beyond the headrail in a similar manner as the first alterative embodiment headrail end cap. Extensions 6470 to the end cap are provided that permit the end cap to be securely received into the end of the tubular headrail. A single plastic mounting cylinder 6465 that has a flanged end 6485 is utilized to couple with an alternative mounting bracket 6505 as is described in detail below. It is to be appreciated that the other described mounting systems may be utilized with appropriately modified variations of the second alternative embodiment end cap. The headrail end cap also includes a recessed area 4675 similar to the one in the first alternative headrail end cap embodiment that allows the second alternative actuator rod end cap 6410 to interface with the headrail end cap in an aesthetically pleasing manner as best shown in FIG. 53. A generally horizontal hole 4680 is provided through the headrail end cap to permit the lift cords 22 to pass therethrough from the interior of the headrail to the actuator rod end cap and into the interior of the actuator rod 6060. The hole also provides an interface for pivotally joining with the second alternative actuator rod end cap.

The second alternative actuator rod end cap 6410 has an exterior shape similar to that of the corresponding second alternative actuator rod 6060 as is shown in FIGS. 53 and 57. The actuator rod end cap also includes a bottom portion 6490 that is received into the interior of the actuator rod at its top end to secure the end cap and the rod together as shown in FIG. 55. A protrusion 6460 having a hole passing therethrough is provided on the side of the actuator rod end cap that is sized to be received in the corresponding hole 6480 in the headrail end cap as is also shown in FIG. 55. The hole in the protrusion allows the lift cords to pass through it and over a pulley 6435 that is contained in and rotatably attached to the actuator rod end cap. The pulley acts to redirect the lift cords into the interior of the actuator rod. A plastic cap 6465 as shown in FIG. 53 is typically provided to be snapidly received against the top side of the actuator rod end cap to hide the pulley from view giving the end cap a more pleasing appearance. Extending from and integrally molded with the actuator rod end cap is an at least flexible plastic rope 6425 with a molded barbed end 6430.

The barbed end 6430 is received and secured in an opening 6450 in a spring stop 6420, which is illustrated in FIG. 56. The spring stop includes a hole 6455 through which the lift cords 22 pass. Also as best shown in FIG. 55, one end of a coil spring 6415 is received in a countersunk portion of the hole 6455. The other end of the spring is received in a countersunk portion of the hole 6480 through the headrail end cap. The lift cords also pass through the center of the spring. It is appreciated that the spring stop is not secured to the headrail but rests inside the headrail.

To prepare a blind assembly incorporating the second alternative headrail and actuator rod end caps 6405 and 6410 for transport, a user simply pulls the actuator rod 6060 and its end cap away from the headrail end cap and folds the actuator rod over into a parallel orientation with the headrail. The actuator rod end cap remains connected with the headrail via the plastic rope 6425 which is secured to the spring stop 6420. It is appreciated that as the actuator rod end cap is removed from the headrail end cap, the spring stop is pulled to the right, compressing the spring 6415. When the blind assembly is ready for installation, the bias applied by the compressed spring helps pull the actuator rod end cap's protrusion into position in the headrail end cap's corresponding hole. Additionally, the spring's bias acts to hold the actuator rod end cap in place relative to the headrail end cap.

Figure 20:
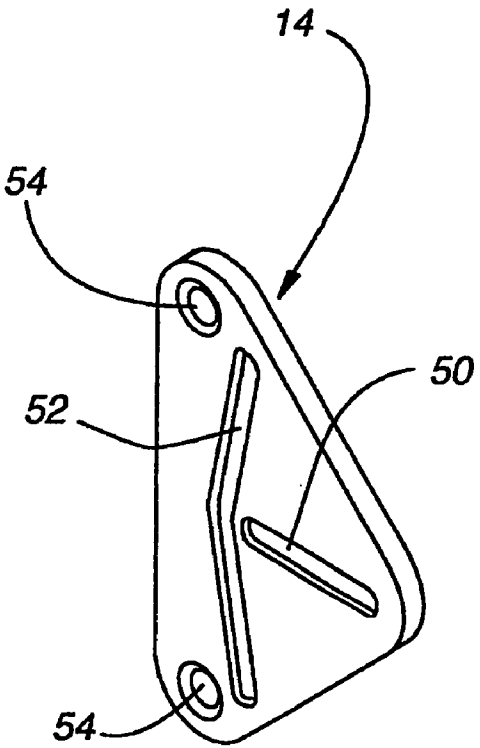
FIG. 20 is an isometric side view of a mounting bracket.
Figure 19:
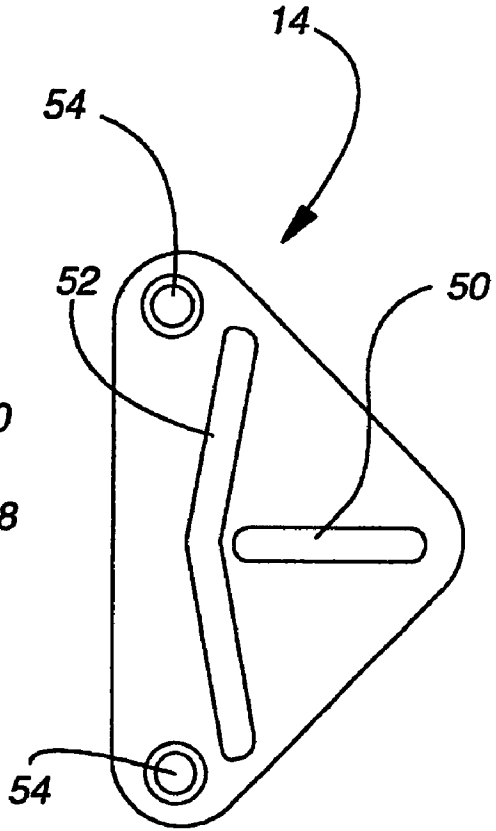
FIG. 19 is a side view of a mounting bracket.

Referring to FIGS. 18–20, one of the mounting plates 14 is illustrated. The side mounting plate 14 is typically fabricated from a suitable plastic or metal. It comprises several fastener holes 54 through which a screw or other fastener may be received to secure the mounting plate 14 to a window frame. The mounting plate 14 further comprises two slots 50 and 52 in which the tips 48 and 49 of the spring-loaded pins 44 and 46 are received. Typically, the width of the slots 50 and 52 is only slightly greater than the width of the pin tips 48 and 49 to facilitate slidable movement of the tips in the slots. The slots may pass all the way through the mounting plate or they may extend into the plate only a fraction of the plates thickness as is necessary to receive the tips of the spring loaded pins. The first slot 50 is straight and generally horizontally disposed to receive the tip 48 of the centered pin 44. The second slot 52 is generally vertically disposed having a slight v-shape wherein the legs of the "V" are sloped toward the first slot 50 and the angle of incidence between the two legs of the "V" is very obtuse approaching 150°. The second slot 52 could be arcuate in shape. It is to be appreciated that the placement and configuration of the slots provided herein are merely illustrative, and that other suitable slot configurations may be specified that operate in a functionally similar manner to those illustrated herein. The disposition of the slots not only allows the headrail 12 to pivot about the center pin 44 when the slats are being opened or closed but also causes the headrail 12 to move laterally guided by the second slot 52 via the other pin 46 for reasons that will become more apparent later.

Figure 36:
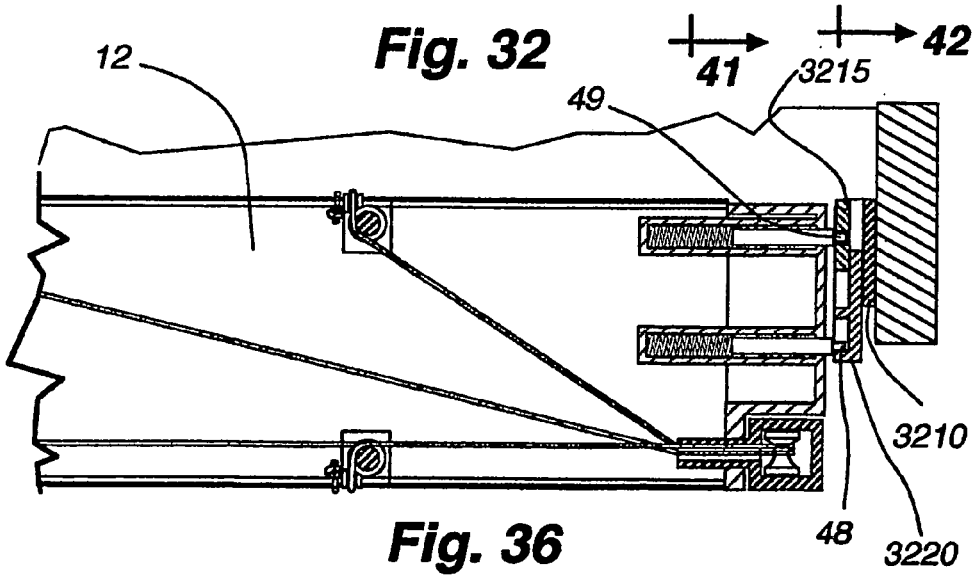
FIG. 36 is a cross sectional view of the headrail and alternative mounting bracket taken along line 36—36 of FIG. 32.
Figure 33:
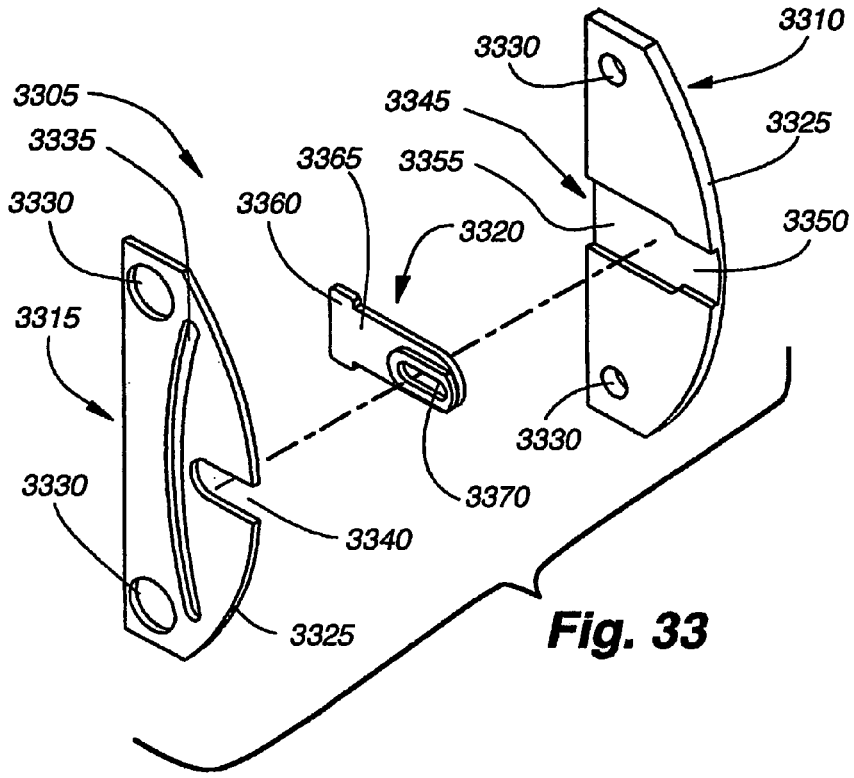
FIG. 33 is an exploded view of an alternative headrail mounting bracket.
Figure 34:
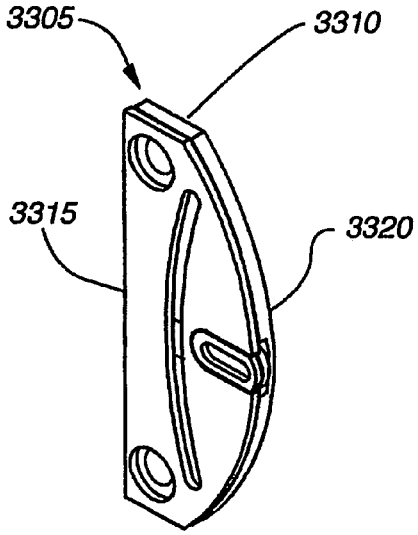
FIG. 34 is an isometric view of the alternative mounting bracket with the slider piece in its retracted position.
Figure 35:
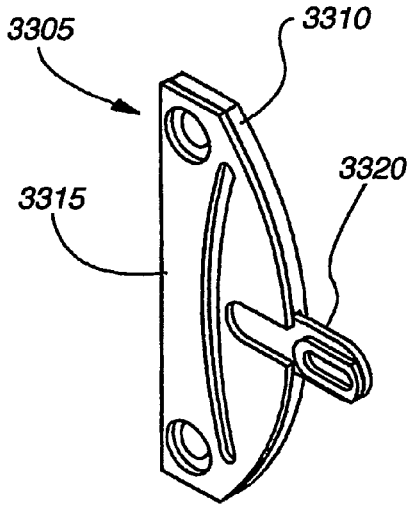
FIG. 35 is an isometric view of the alternative mounting bracket with the slider piece in its extended position.
Figure 37:
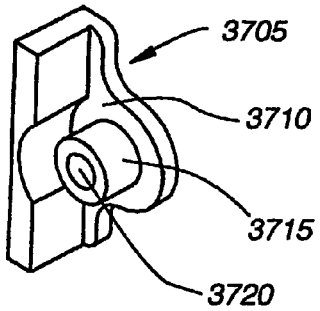
FIG. 37 is an isometric view of the window frame attachment piece of the alternative pivoting mechanism.
Figure 38:
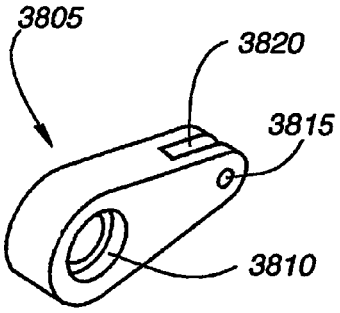
FIG. 38 is an isometric view of the pivoting piece of a first alternative pivoting mechanism.
Figure 39:
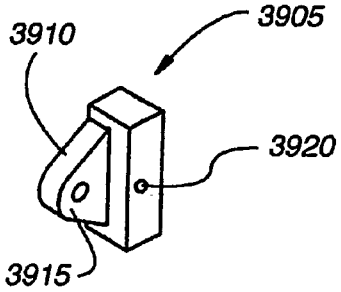
FIG. 39 is an isometric view of the pivoting piece of the first alternative pivoting mechanism.
Figure 41:
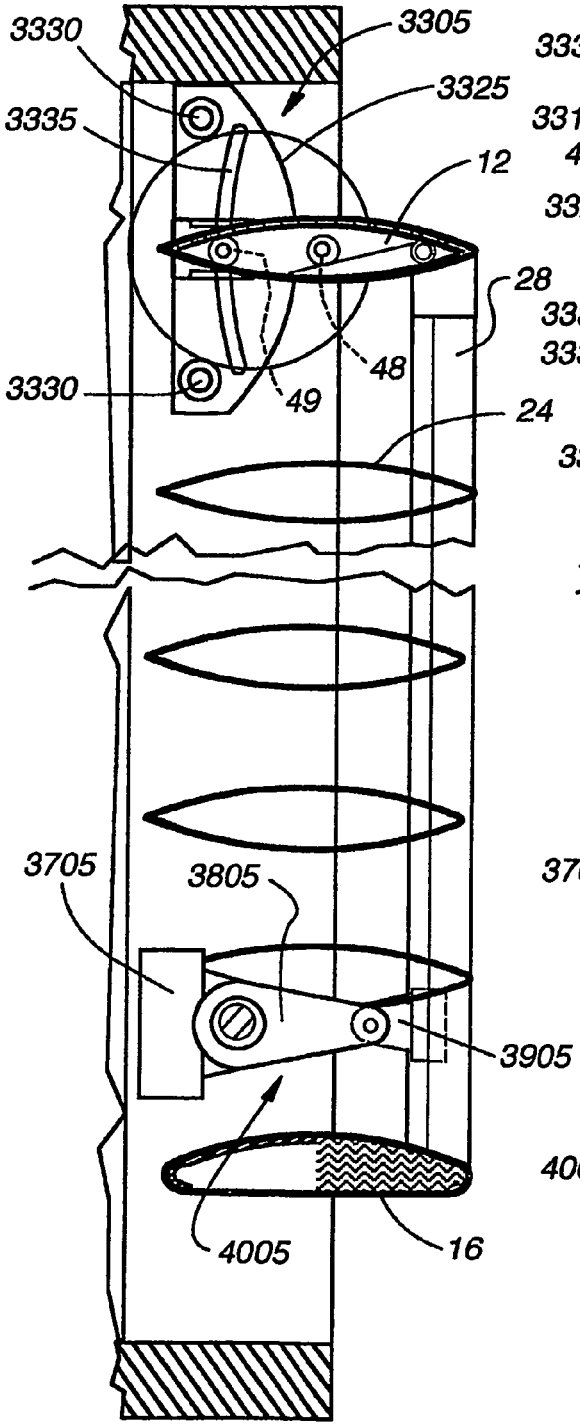
FIG. 41 is a cross sectional view of the window blind assembly incorporating the alternative mounting bracket and pivoting mechanism as taken along line 41—41 of FIG. 32.

FIGS. 33–36 and 41 illustrate a first alternative embodiment mounting bracket 3305. The alternative mounting bracket 3305 includes a outside piece 3310, which is mounted up against the window frame, an inside piece 3315, which is mounted against the outside piece 3310, and a slider piece 3365 that is sandwiched between the inside and outside pieces. Both the inside and outside pieces have curvilinear front faces 3325 that approximate the curvilinear cross-sectional shape of either the top or bottom surface of the headrail 12. Both the inside and outside pieces also include holes 3330 through which fasteners can be received to secure the mounting bracket 3305 to the window frame. The inside piece includes an elongated curvilinear slot 3335 that is generally vertically disposed. The elongated slot 3335 is configured to receive pin tip 49 and is operationally equivalent to the second slot 52 of mounting plate 14. The inside piece 3315 also includes a wider horizontally disposed slot 3340 which is configured to receive a portion of the slider piece 3320. The outside piece 3310 has a horizontal channel 3345 disposed across its width proximate its lengthwise center. The channel 3345 is configured to slidably receive the slider piece 3310. The channel 3345 has a first portion 3350 proximate the front edge of the outside piece and a second portion 3355 that is wider than the first portion and extends from the back edge and meets with the first portion of the channel. The width of the first portion 3350 corresponds to the width of a front portion 3365 of the slider piece 3320 and the width of the second portion corresponds to the width of the back portion 3360 of the slider piece. The front portion 3365 of the slider piece also includes a slot 3370 configured to receive pin tip 48. FIGS. 34 and 35 illustrate the bracket 3305 in the assembled configuration with the sliding piece 3320 in its retracted and extended positions. FIG. 36 illustrates a cross section of the bracket 3305 with a headrail 12 installed on it as viewed from above, and FIG. 41 illustrates another cross sectional view of the mounting bracket 3305 with the window covering installed thereon. Operationally, the sliding piece 3320 performs a similar function as slot 50 of mounting plate 14 as will be described in greater detail below.

Figure 59:
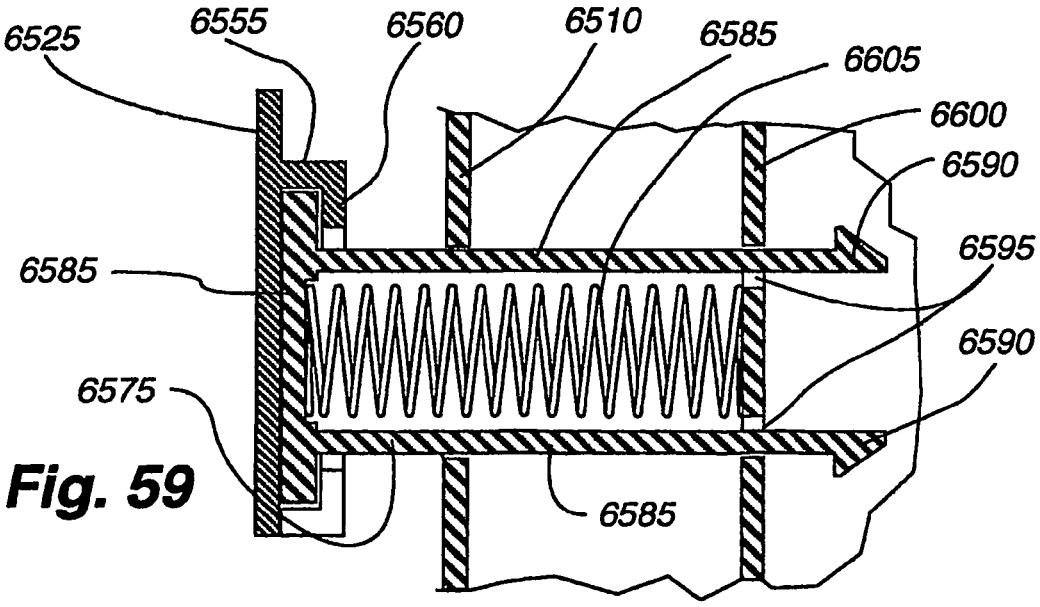
FIG. 59 is a fragmentary cross sectional view of the mounting bracket and a pivotal spring-biased plastic mounting cylinder contained within the end of the headrail.
Figure 60:
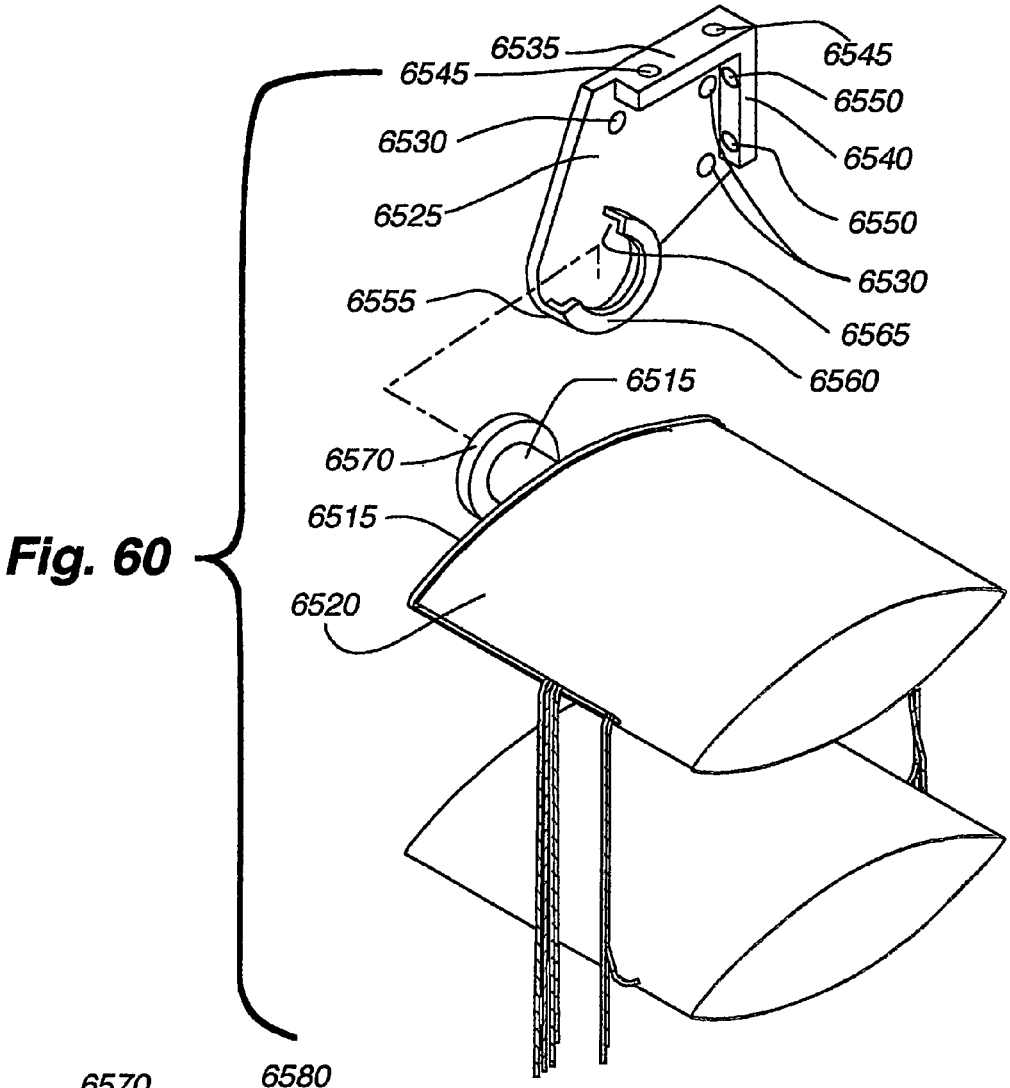
FIG. 60 is an exploded isometric view of the mounting bracket and an associated portion of a corresponding headrail.

FIGS. 58 to 61 illustrate a second alternative embodiment mounting bracket 6505 for use with an alternative headrail end cap 6510 that incorporates a single flanged plastic cylinder member 6515 protruding from the cap's end along a longitudinal axis of rotation of the headrail 6520. Referring primarily to FIG. 60, the second alternative mounting bracket typically comprises a vertically-orientated plastic plate 6525 that is generally parallel to the end of the end cap the plate has a plurality of mounting holes 6530 disposed therethrough to receive fasteners to secure the bracket to the framework of an architectural opening. From both a top edge of the plate and a rear edge of the plate, integrally molded flanges 6535 and 6540 extend perpendicularly and outwardly from the plate in the general direction of the headrail. The flanges meet at a top rear corner of the mounting bracket and each have a plurality of fastener holes 6545 and 6550 passing through each of them. Accordingly, the mounting bracket can alternatively be mounted to the framework of an architectural opening using the fastening holes in the flanges. Proximate the front bottom edge of the plate a generally semicircular arcuate wall 6555 extends outwardly at a generally perpendicular angle from the inside surface of the plate. From the distal edges of the wall, a flange 6560 extends radially inwardly for a short distance, thereby forming a semicircular cradle slot 6565 in which the flange 6570 of the end cap's plastic cylinder is pivotally received to support the headrail and the blind assembly across an architectural opening. As best shown in FIG. 60, the open side of the cradle slot faces upwardly and forwardly at an angle of about 30–45 degrees off of vertical.

Figure 61:
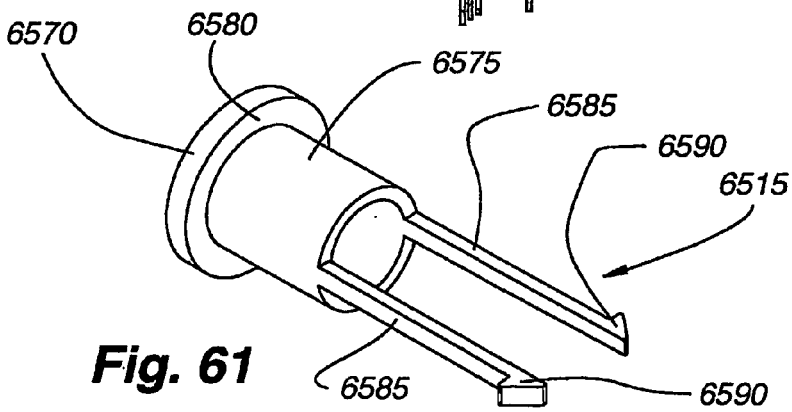
FIG. 61 is an isometric view of the flanged plastic cylinder utilized with the second alternative mounting bracket.

Referring primarily to FIGS. 59 and 61, the flanged cylinder member 6515 is snapidly received in the end cap 6510 of the headrail 6520 to prevent the rotation of the cylinder member relative to the headrail end cap. The flanged cylinder member is configured to slide longitudinally within the headrail to permit the headrail to be mounted in openings that vary an inch or so in width. The flanged cylinder member includes a cylindrical portion 6575 that extends from an opening in the end cap to a distal end in the form of a circular plate 6580 having a diameter greater than that of the cylindrical portion, thereby forming a circular flange. The other end of the cylindrical portion terminates in the interior of the end cap and the headrail, wherein two opposing legs 6585 extend inwardly in the longitudinal direction of the headrail. Each leg has a outwardly facing detent 6590 at its free end. The detents are resiliently received through slots 6595 formed in a laterally-extending wall 6600 formed in the end cap to limit the maximum longitudinal extent of the flanged cylinder member from the end of the end cap. One of the top and bottom surfaces of the legs rest on an interior surface of the end cap or the headrail so that the flanged cylinder member is prevented from rotating relative to the headrail. A coil spring 6605 is provided that spans between the laterally-extending wall and a backside of the circular plate to bias the flanged cylinder member in its fully extended position.

Operatively, to place the headrail 6520 into a pair of mounted second alternative embodiment mounting brackets 6505, a user (or two users if the blind is over 4 feet in width) compresses the flanged cylindrical members 6515 into the headrail end cap 6510 as necessary to line them with their corresponding cradle slots 6565 in the mounting brackets. The flanged ends 6570 of the cylindrical members are then seated in the slots, rotatably securing the headrail in place.

Figure 9:
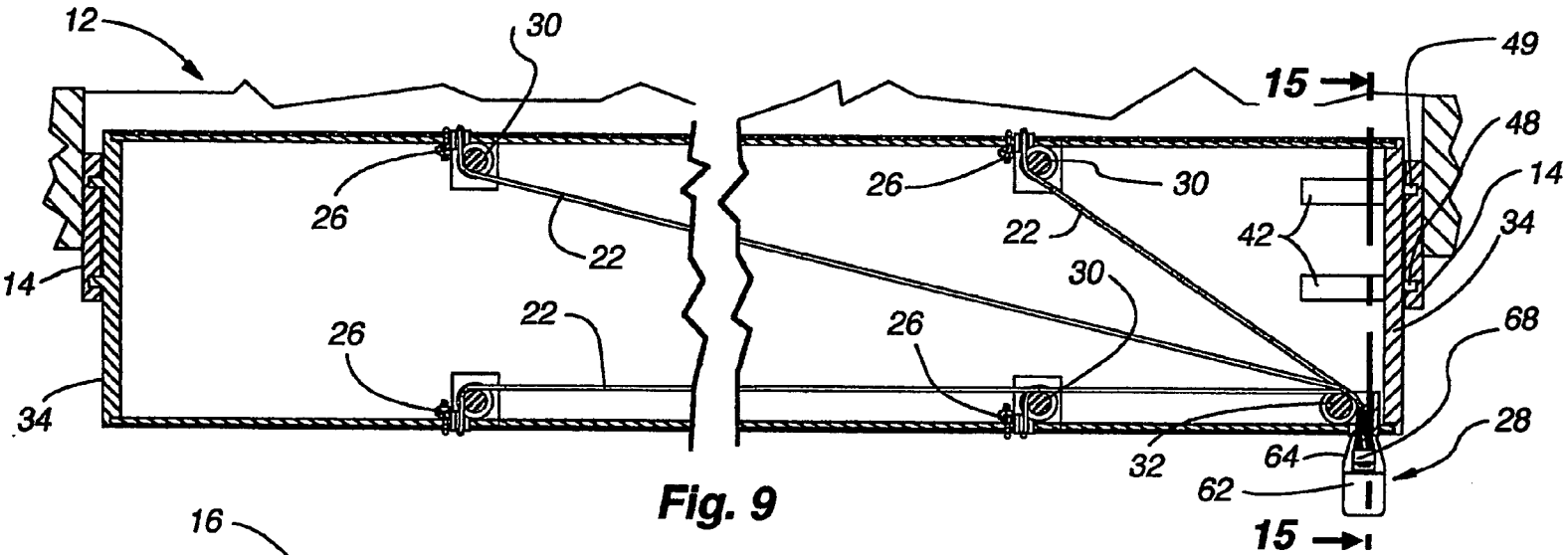
FIG. 9 is a horizontal section of the blind assembly taken along line 9—9 of FIG. 6.

FIG. 9 illustrates the attachment of the cord ladders 26 to the headrail 12. The top ends of each of the riser cords 36 of each cord ladder pass through holes proximate either the front or back longitudinal edges of the headrail 12 at corresponding longitudinal locations. The top ends of the riser cords 36 are knotted to secure the cord ladder to the headrail 12. It is to be appreciated that many other means of attaching the cord ladders 26 to headrail 12 are possible provided the connections are secure enough to support the weight of the cord ladders 26 and the plurality of slats 24 cradled in cross rung cords 38 of the cord ladders.

Figure 10:
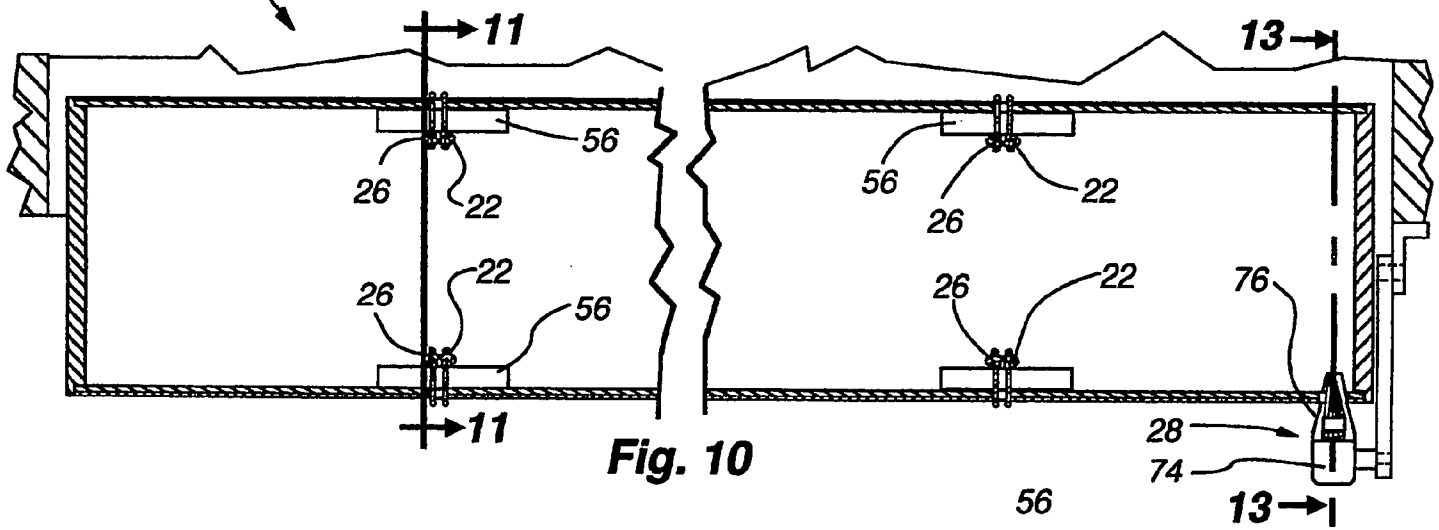
FIG. 10 is a horizontal section of the blind assembly taken along line 10—10 of FIG. 6.

The bottom ends of the cord ladders 26 (and the lift cords 22) are secured to the bottom slat 16 as illustrated in FIGS. 10–12. Each of the bottom ends of the riser cords 36 of the cord ladders 26 pass through a transverse hole in a cylindrical anchor block 56 and are knotted to secure the bottom ends to the cylindrical anchor block 56. Each cylindrical anchor block 56 is then passed through an appropriately sized hole 58 in the front or back longitudinal edge of the bottom slat 16 into the interior of the bottom slat and rotated so as to be trapped in the hollow interior of the bottom slat. When the bottom slat is suspended from the lift cords and the riser cords, the cylinders 58 are encouraged to nest against an inside concave surface of the bottom slat, thereby coupling the cord ladders to the bottom slat.

Figure 68:
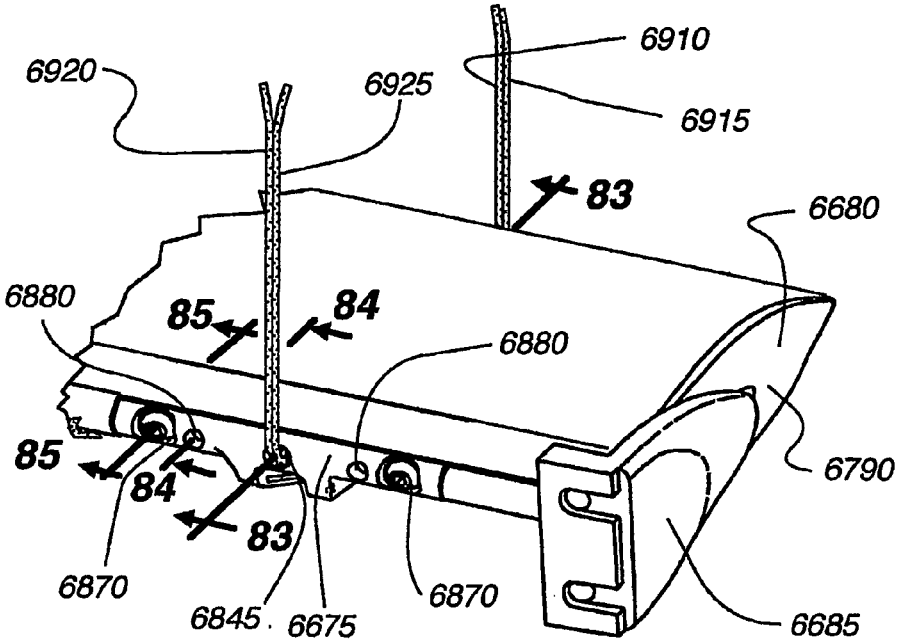
FIG. 68 is a partial isometric end view of the alternative foot rail showing the cord adjustment member and the optional foot rail mounting brackets.
Figure 69:
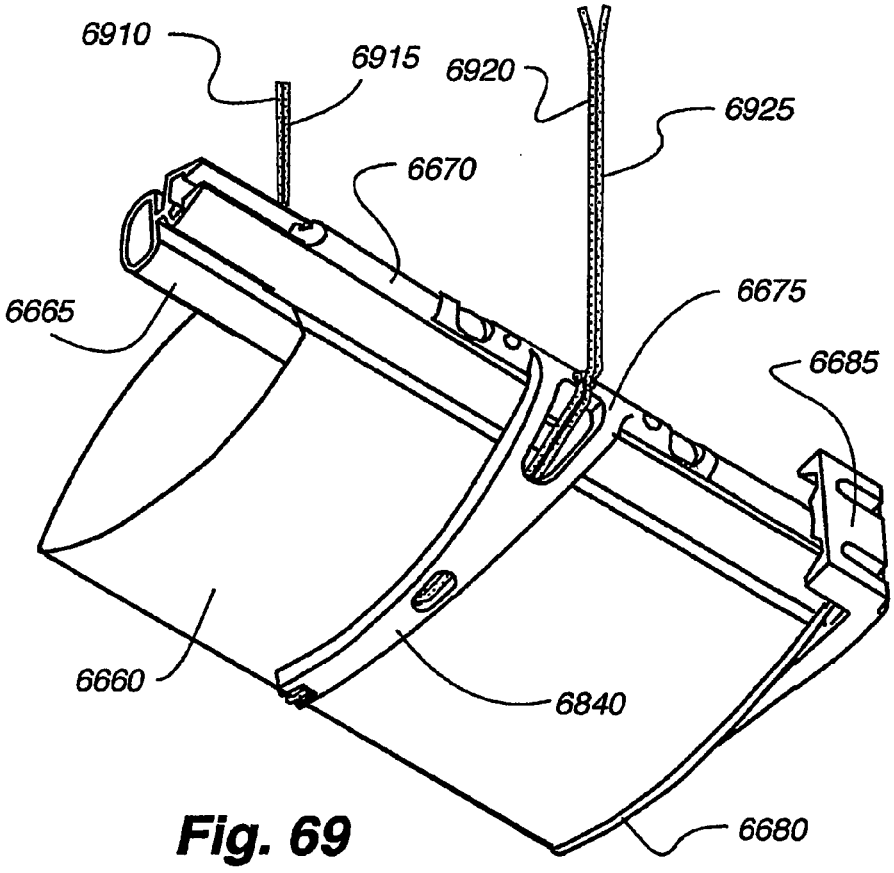
FIG. 69 is a partial isometric bottom view of the alternative foot rail showing the cord adjustment member.
Figure 70:
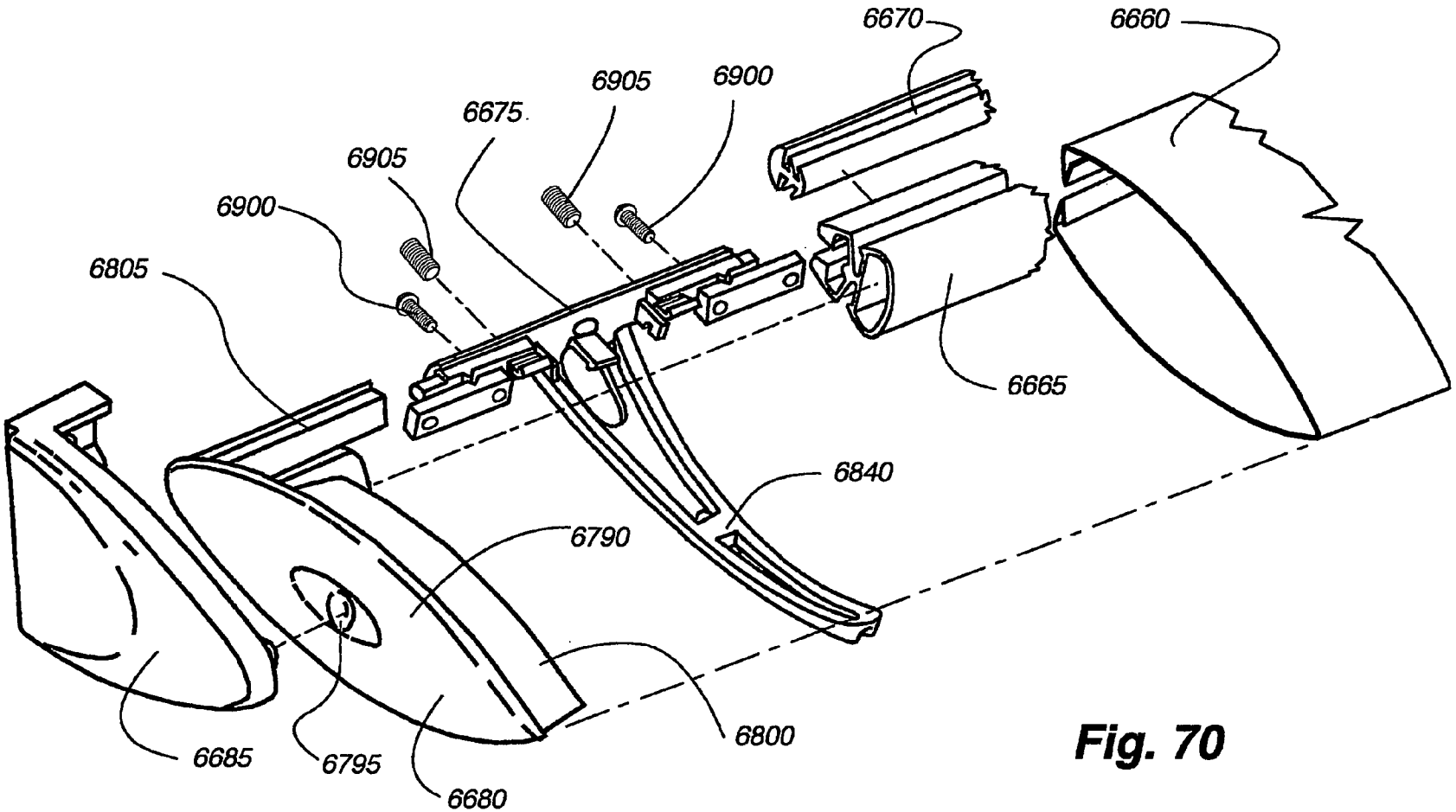
FIG. 70 is an exploded isometric view of the alternative foot rail showing the cord adjustment member.

A first alternative foot rail assembly including a cord adjustment member for adjusting the length of and securing the cord ladder risers and lift cords is illustrated in FIGS. 62–85. The basic components of the alternative foot rail are illustrated in FIGS. 62–67 and include (i) a translucent plastic vane 6660, (ii) a colored vane insert 6655, (iii) a longitudinally-extending extrusion 6665, and (iv) a rear edge plug 6670. To attach the various lift cords and riser cords of the blind assembly to the foot rail a plurality of cord adjustment members 6675 are utilized as shown in FIGS. 68–70. Finally, end caps 6680 are provided to close the ends of the alternative foot rail and to provide a manner of attaching optional foot rail mounting brackets 6685 to the alternative foot rail assembly 6650.

Figures 62, 63:
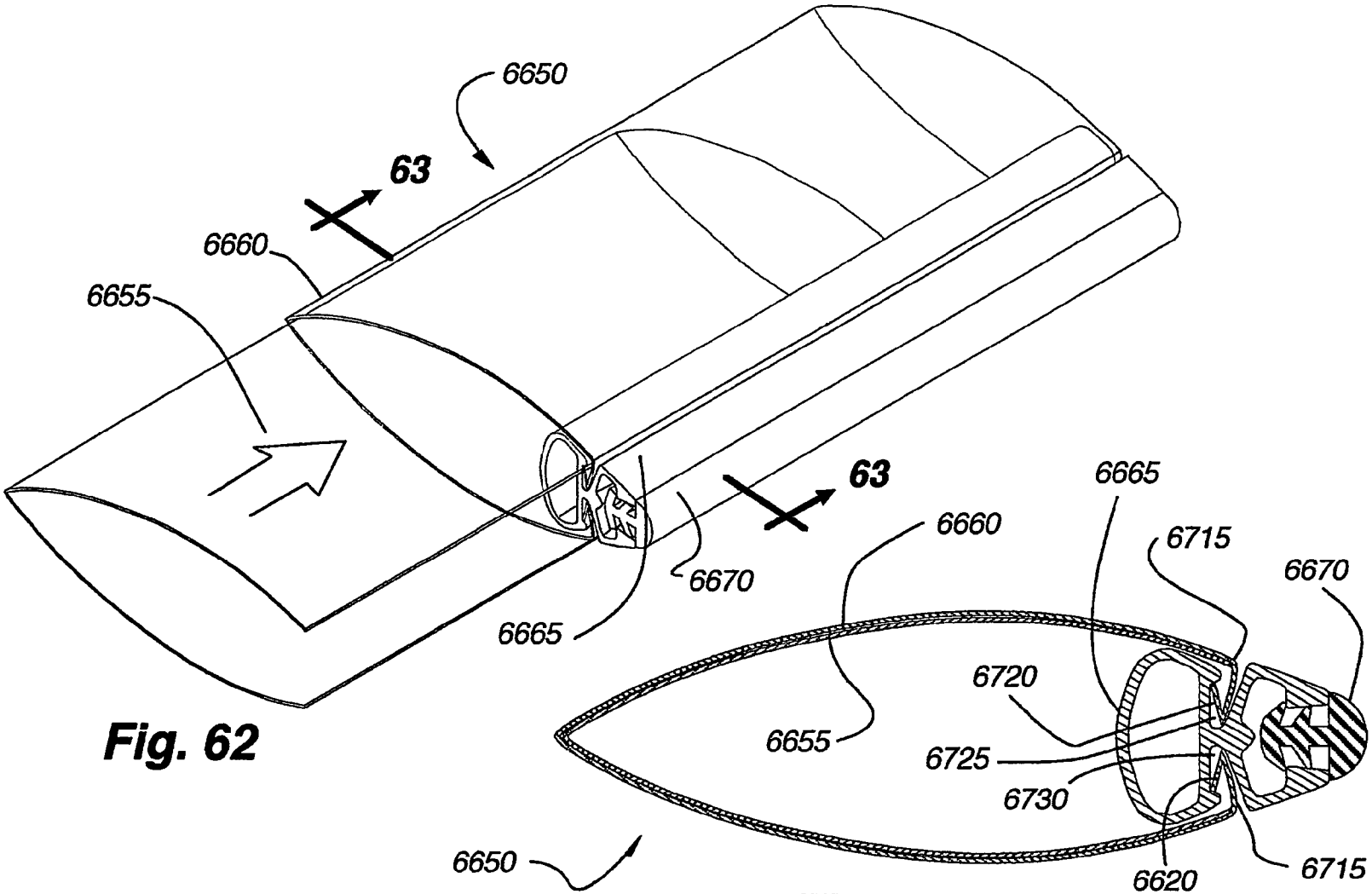
FIG. 62 is an isometric view of a first alternative embodiment foot rail showing the color insert partially installed.
FIG. 63 is a cross sectional side view of the alternative foot rail taken along line 63—63 of FIG. 62.
Figure 64:
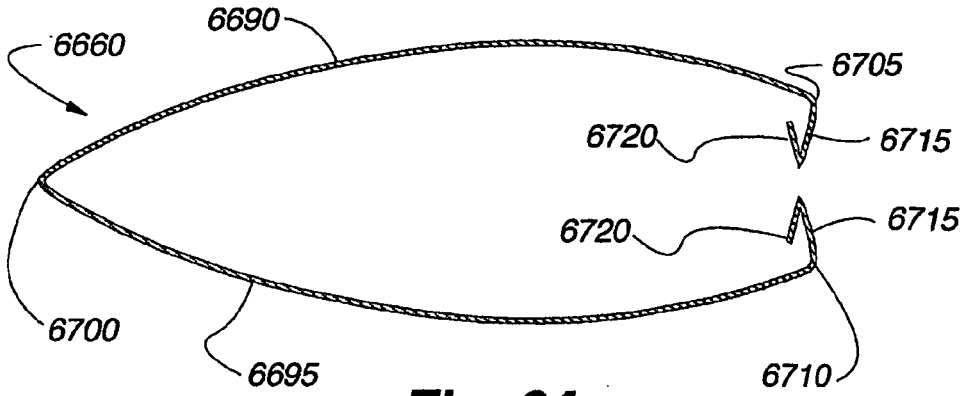
FIG. 64 is a cross sectional side view of a translucent plastic vane that comprises a portion of the alternative foot rail.

Referring to FIGS. 62–64, the alternative foot rail 6650 includes a preferably translucent plastic vane 6660, although colored vanes or vanes made of alternative materials may also be used. The translucent vane is defined by top and bottom outwardly convex arcuate sides 6690 and 6695 that are joined at a front edge 6700. The vane generally resembles and is generally of the same dimensions as the slats of the associated blind assembly. Unlike the slats, however, the sides of the plastic vane do not meet or join together at a common rear edge of both sides. Rather, the walls of both the top and bottom sides are turned inwardly at their rearmost edge 6705 and 6710, extending either downwardly or upwardly from the respective top or bottom side and forming a pointed hook 6715 with a barb 6720. Each pointed hook is opposite and spaced-apart from the other pointed hook. As best shown in FIG. 63, the pointed hooks are received in corresponding top or bottom channels 6725 and 6730 formed in the longitudinally-extending extrusion 6665.

Figure 65:
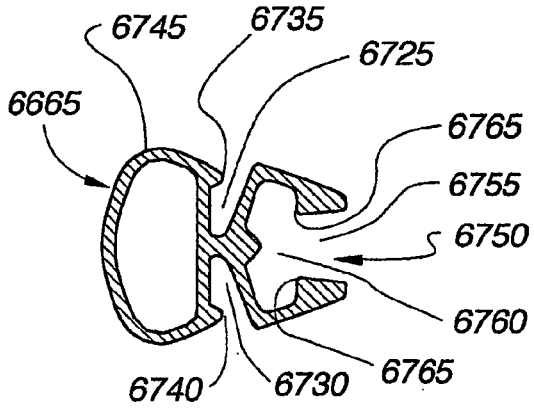
FIG. 65 is a cross sectional side view of a longitudinally-extending extrusion that comprises a portion of the alternative foot rail.

The longitudinally-extending extrusion 6665 is best shown in FIGS. 62 and 65. The extrusion is typically comprised of aluminum or magnesium, although a plastic extrusion may be used as well. The extrusion serves several purposes in the alternative foot rail. First, the extrusion has one upwardly facing top channel 6725 and one downwardly facing bottom channel 6730 that are adapted to receive the pointed hooks 6715 of the plastic vane 6660 therein. A lip 6735 and 6740 is provided at the opening of each channel such that the width of each channel at the opening is less than the maximum width of the corresponding hooks. The width of each channel is greater below each of the lips. Accordingly, as the hooks are inserted into the channel and the barbs 6720 are resiliently compressed against the adjoining face of the hook until they are inserted beyond the channel's lip, wherein the barbs resiliently spring back to their normal position. As shown in FIG. 63, the distal end of each barb rests against the back side of the corresponding lip effectively holding the plastic vane in place against the extrusion. The extrusion also includes a tubular portion 6745 that is contained within the plastic vane as best seen in FIG. 63. The tubular portion stiffens the foot rail and adds weight to the foot rail. Finally, a rear facing channel 6750 is provided. The rear facing channel includes a throat 6755 that opens to the rear that has a smaller width than the main cavern 6760 of the channel. Accordingly two lips 6765 are formed at the intersection of the throat and the main cavern. The rear channel is adapted to snapidly receive and secure therein both the rear edge plug 6670 and each of the cord adjustment members 6675.

Figure 66:
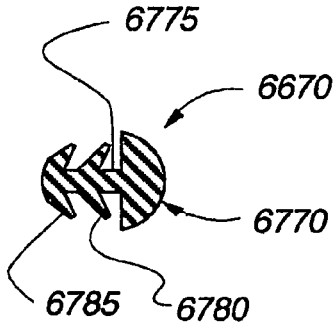
FIG. 66 is a cross sectional side view of a longitudinally-extending rear edge plug that comprises a portion of the alternative foot rail.

The rear edge plug 6670 is best illustrated in FIGS. 62 and 66. The plug is typically fabricated from an elastomeric material, such that the impact of the foot rail against a surface such as a window pane with not damage the window pane. The exposed edge 6770 of the plug is typically rounded forming a generally semicircular cross section. A leg 6775 extends from opposite side of the plug and has two pair of opposing barbs 6780 and 6785 extending therefrom. The leg is inserted into the throat of the rear channel with the barbs compressing against the leg. Once the endmost pair of barbs 6785 has passed through the throat into the main cavern of the channel, the barbs resiliently expand locking the plug in place by yieldingly engaging the lips of the rear channel.

Figure 67:
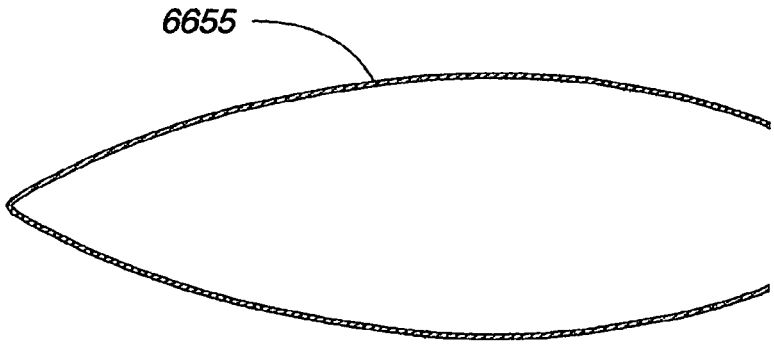
FIG. 67 is a cross sectional view of the color insert that comprises a portion of the alternative foot rail.

Referring to FIGS. 62 and 67, a colored insert 6655 may be utilized in conjunction with the alternative foot rail especially when a translucent vane 6660 is used. The colored insert is typically comprised of the same material as that of the slats of the blind assembly. Preferably, the insert is constructed from a slat that has its rear edge removed so that it may be slid into place on the inside of the translucent vane. By placing the insert on the inside of a translucent plastic vane, the material is protected from dust and dirt that may accumulate on the sill of a window when the foot rail is lowered against or otherwise touches the sill.

As illustrated in FIGS. 68–71, end caps 6680 are provided to cover the ends of the alternative foot rail 6650. Each end cap is typically fabricated from a molded plastic and includes an end face 6790 with a semispherical depression 6795 formed therein at a location corresponding to the pivotal axis of the foot rail. The depression mates with the optional foot rail mounting bracket 6785 to secure the foot rail in place relative to the framework of the architectural opening. Further, the end cap includes extension walls 6800 that are adapted to be inserted into the plastic vane 6660, preferably underneath of the colored insert 6655 to help secure the end cap to the foot rail. Additionally, the end caps each have a rear edge portion 6805 of a predetermined length that is slid into the end of the rear channel 6750 of the extrusion. The outside face 6810 of the rear edge portion is typically rounded similar to the rear edge plug 6670. The length of the rear edge portion is such that the corresponding cord adjust member 6675 can be abutted against the rear edge portion to align the cord adjustment member in its proper position relative to the headrail and the depending lift cords and riser cords.

Figure 71:
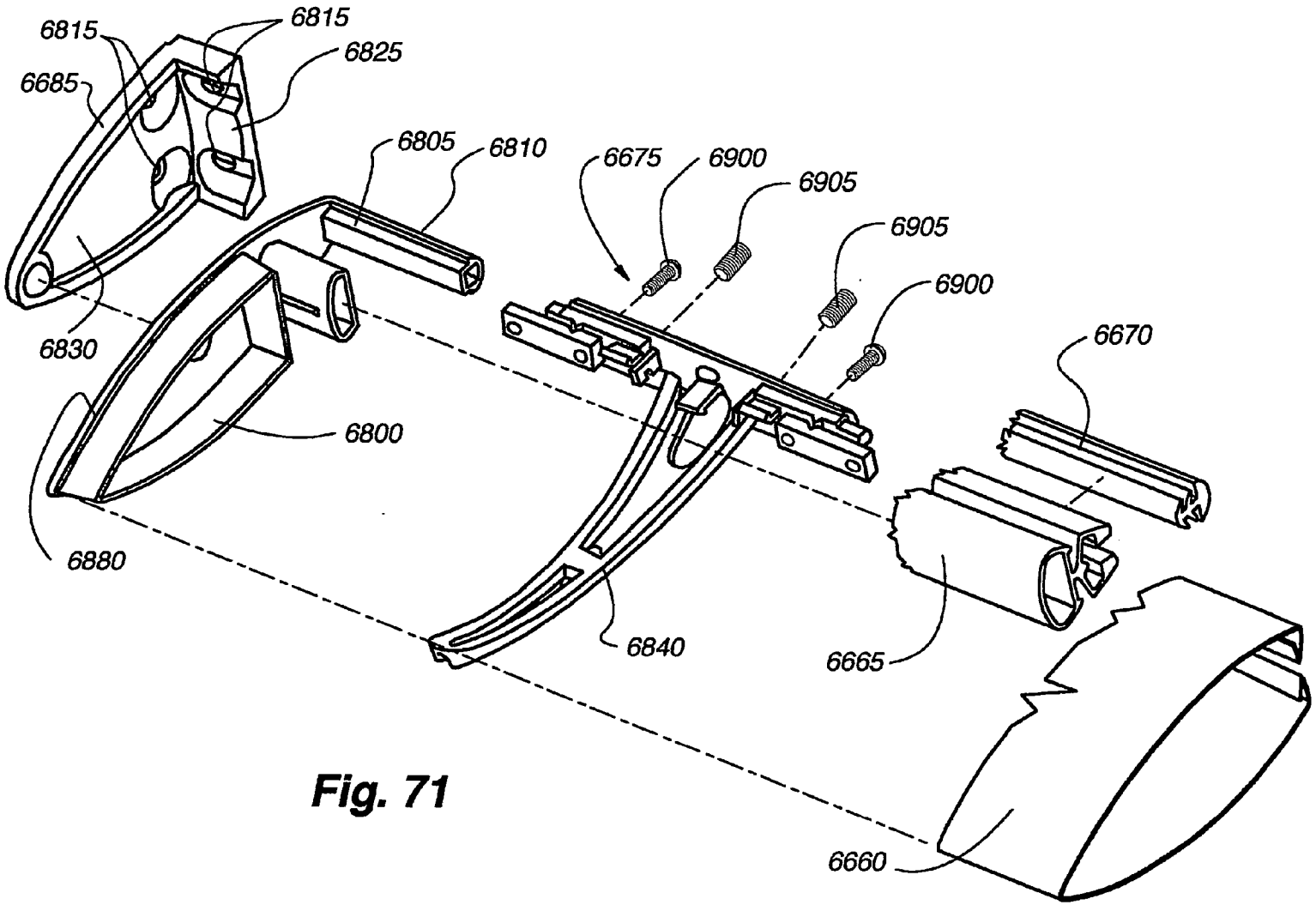
FIG. 71 is another exploded isometric view of the alternative foot rail taken from a different perspective also showing the cord adjustment member.

As stated above, the semispherical depression 6795 is adapted to connect with the foot rail mounting bracket 6685. The foot rail mounting bracket is best shown in FIGS. 70 and 71. It typically comprises a one piece molded plastic L-shaped bracket having knockout type fastener mounting holes 6815 in each leg 6820 and 6825 of the bracket generally proximate the intersection of the bracket's legs, thereby permitting the bracket to be mounted to differently orientated vertical surfaces. At the distal end of the long leg 6820, a semispherical protrusion 6830 is integrally formed on the long leg's inside face. The semispherical protrusion is sized to mate with the semispherical depression in a corresponding end cap. Accordingly, the foot rail can be pivotally secured to prevent unwanted swinging and vertical movement of the foot rail by placing the foot rail between two properly-positioned mounting brackets with the semispherical protrusions being received into the semispherical depressions. It is to be appreciated that when the foot rail mounting brackets are utilized, the blind assembly cannot be retracted without first removing the foot rail from the brackets. Fixing the foot rail in place may be desirable in certain installations, such as when covering a window on a door. By fixing the foot rail the blind assembly is prevented from swinging back and forth each time the associated door is opened or closed.

Various views of the cord adjustment member 6675 are shown in FIGS. 68–85. The cord adjustment member performs two basic functions: (i) it secures the cord ladder's riser cords 6915 and 6925 and the lift cords 6910 and 6920 to the foot rail; and (ii) it allows for the easy adjustment of the lengths of the cords for use with a blind assembly of a particular length.

Figures 72, 73:
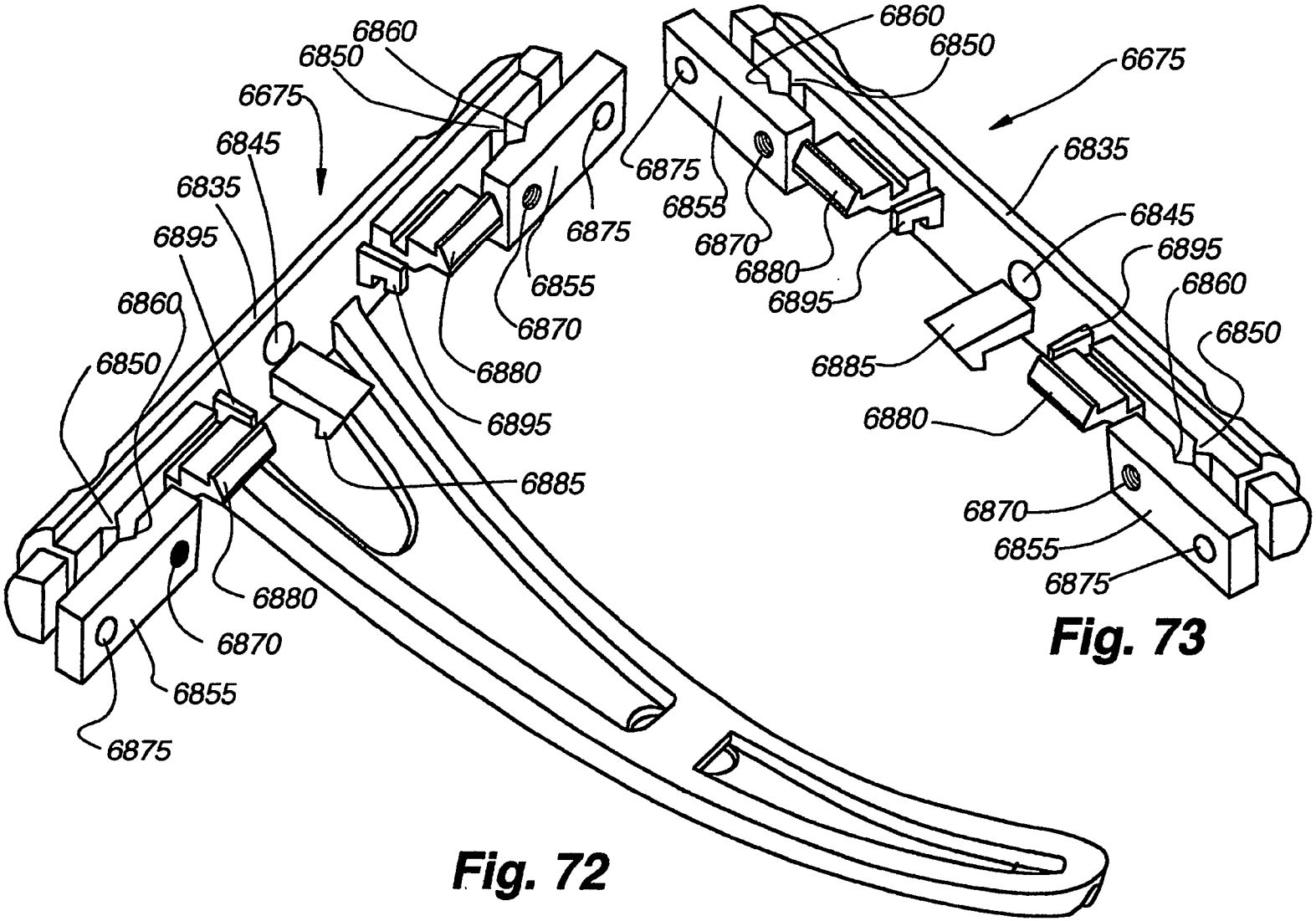
FIG. 72 is an isometric view of the cord adjustment member for use proximate the ends of the alternative foot rail.
FIG. 73 is an isometric view of a variation of the cord adjustment member for use with a one-sided cord ladder and the alternative foot rail.

Referring primarily to FIGS. 72–73, the various elements of the cord adjustment member 6675 are described herein. The cord adjustment member includes a longitudinally-extending rear edge member 6835 that forms the rear edge of the alternative foot rail 6650 along the portions of the foot rail where it is installed. Accordingly, the rear surface of the member is rounded similarly to the rear edge plug 6670. The opposite side of the rear edge member is adapted to be received into the throat 6755 of the rear channel 6750 of the extrusion 6665.

Figure 74:
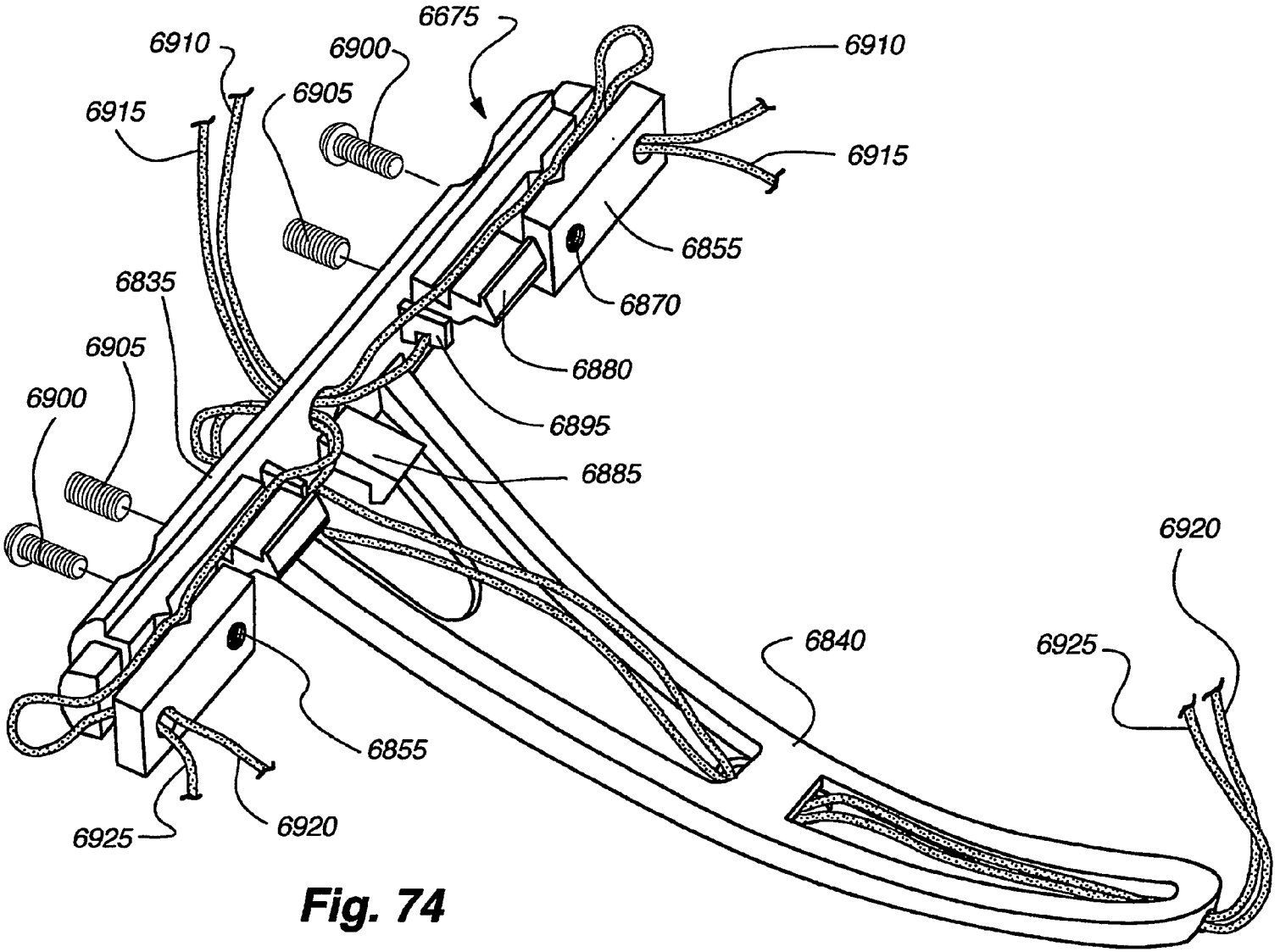
FIG. 74 is an isometric top view of the cord adjustment member showing the lift cords and riser cords of the cord ladders threaded therethrough.
Figure 75:
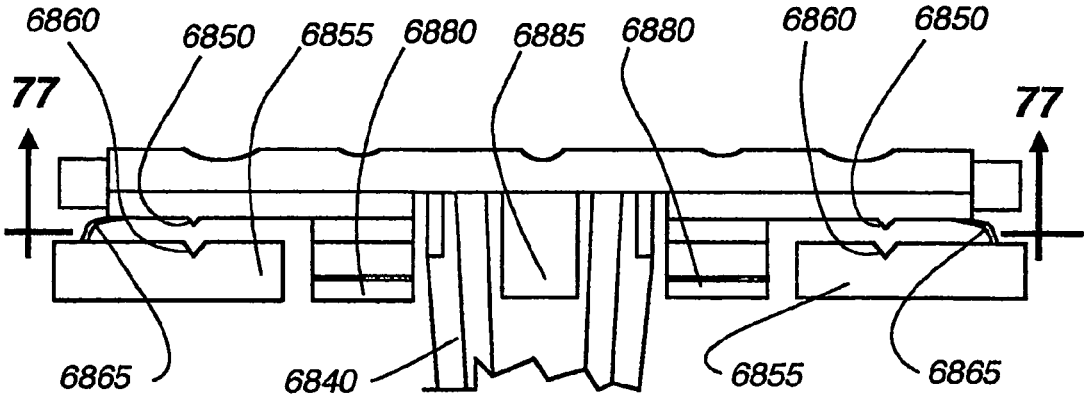
FIG. 75 is a partial cross sectional top view of the adjustment member.
Figure 76:
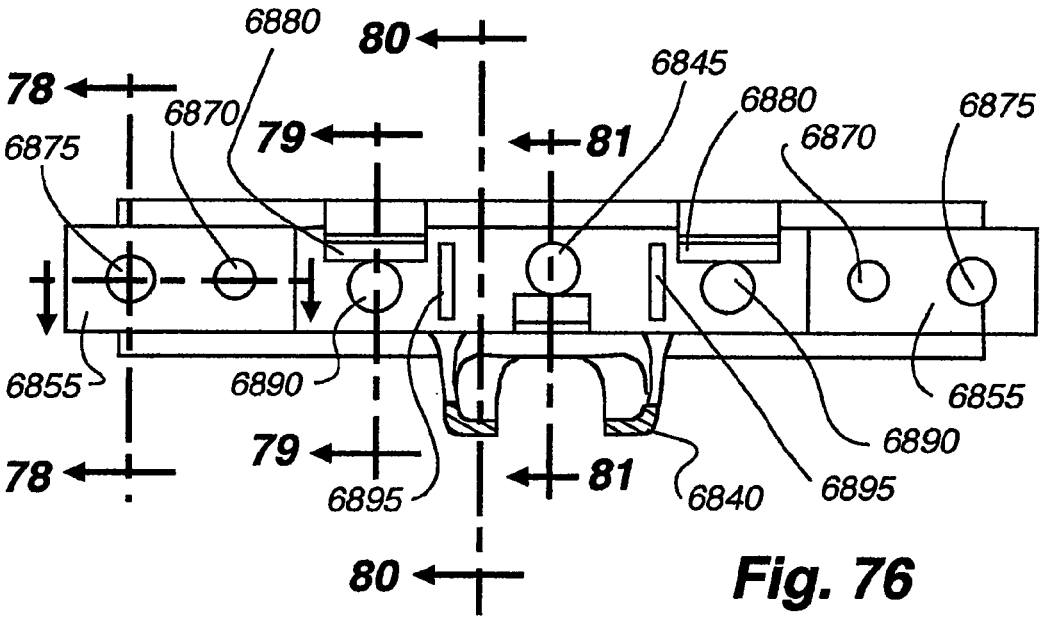
FIG. 76 is a side view of the adjustment member.
Figure 77:
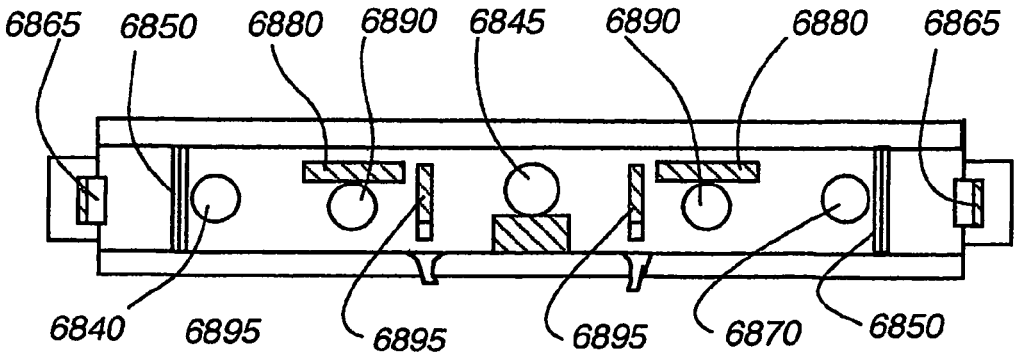
FIG. 77 is a partial cross sectional side view of the adjustment member taken along line 76—76 of FIG. 75.
Figure 78:
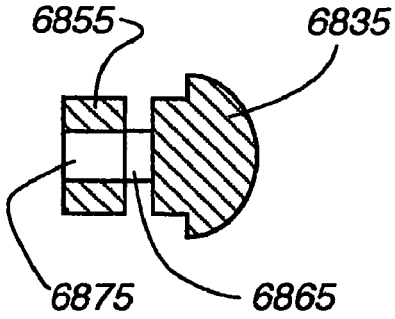
FIG. 78 is a partial cross sectional end view of the adjustment member taken along line 78—78 of FIG. 76.
Figure 79:
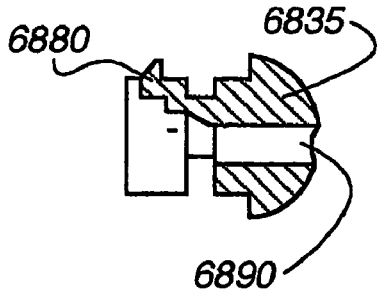
FIG. 79 is a partial cross sectional end view of the adjustment member taken along line 79—79 of FIG. 76.
Figure 80:
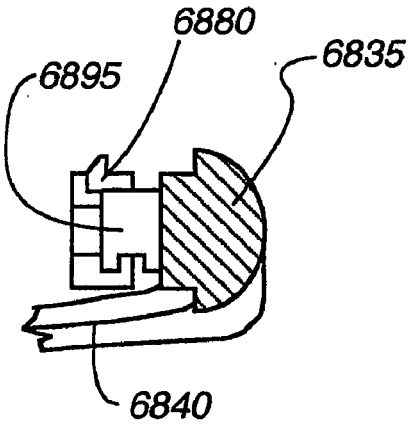
FIG. 80 is a partial cross sectional end view of the adjustment member taken along line 80—80 of FIG. 76.
Figure 81:
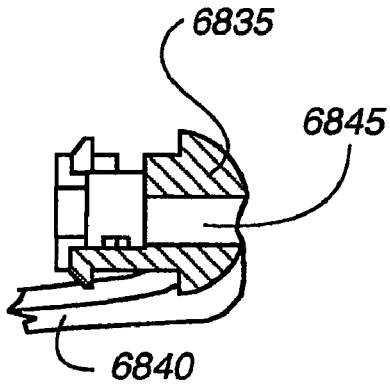
FIG. 81 is a partial cross sectional end view of the adjustment member taken along line 81—81 of FIG. 76.

A cord opening 6845 is provided proximate the longitudinal center of the edge member 6835 through which the front and rear riser cords 6915 and 6925 and lift cords 6910 and 6920 pass to the backside of the cord adjustment member and ultimately into the rear channel 6750 as shown in FIG. 74. The front lift and riser cords are guided to the cord opening by a front cord guide 6840 that extends along the bottom side of the plastic vane from its front edge to the edge member. In a variation of the cord adjustment member, as shown in FIG. 73, no cord guide is provided for center and intermediate lift and riser cords, where no front lift or riser cords are utilized as is discussed below in reference to FIGS. 51 and 52.

The front side of both the cord adjustment member 6675 in general and the longitudinally-extending rear edge member 6835 specifically is shown in FIGS. 68–69. In addition to the cord hole 6845, four additional holes or bores are provided through the edge member. The two endmost are clamp bolt holes 6870 that are threaded in clamp blocks 6855 that are described in detail below. The clamp bolt holes are countersunk to receive the heads of the clamp bolts 6900. The other two holes are threaded set screw bores 6880 in which set screws 6905 are received to secure the lift cord member in place in the rear channel 6750.

Figure 83:
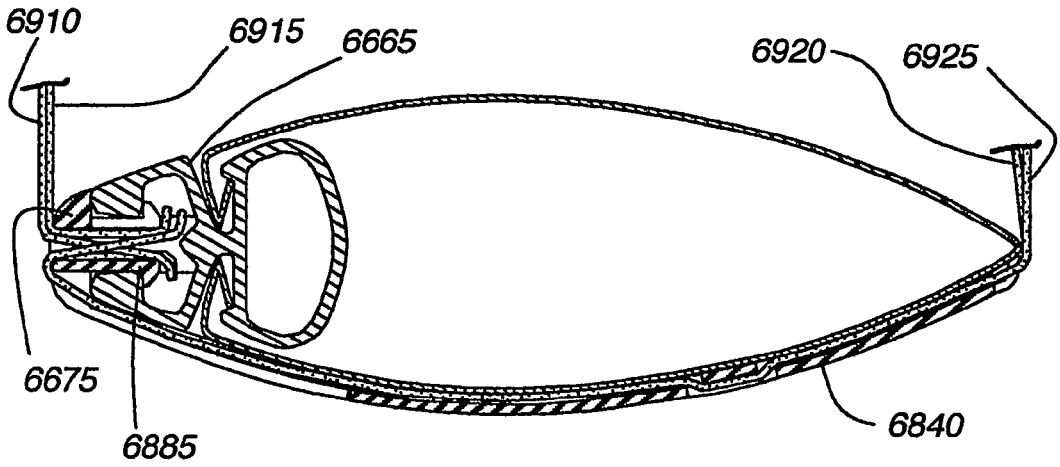
FIG. 83 is a cross sectional view of the alternative foot rail showing the installed adjustment member as taken along line 83—83 of FIG. 68.
Figure 84:
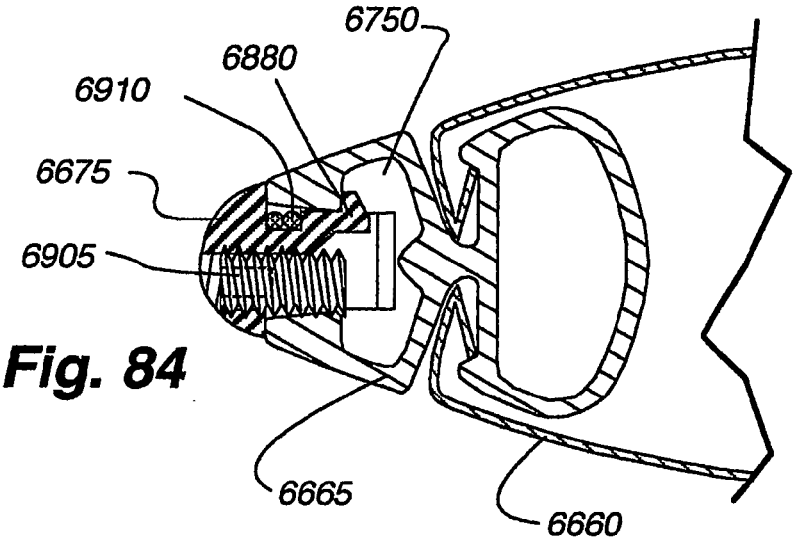
FIG. 84 is a partial cross sectional view of the alternative foot rail showing the installed adjustment member as taken along line 84—84 of FIG. 68.

On the opposite side of the rear edge member 6835, there are several detents 6880 and 6885. A single downwardly facing detent 6885 protrudes from the edge member below the cord opening 6845, and two upwardly facing detents 6880 protrude from equally spaced locations to the right and the left of the downwardly facing detent. Each of the detents are adapted to snap into place (or be slid from an open end of the extrusion) over the lips 6765 of the rear channel to secure the cord adjustment member in place as is best illustrated in FIGS. 83 and 84. Beneath each of the upwardly facing detents is one of the aforementioned threaded screw set holes 6870. As illustrated in FIG. 84 tightening, the associated set screw 6905 as shown in FIG. 84 braces the screw against the bottom side of the throat 6755 of the extrusion and the bottom side of the corresponding upwardly facing detent 6880 to frictionally fix the cord adjustment member in the rear channel to prevent undesirable movement longitudinally along the channel.

Referring back to FIG. 74, once the cords are passed through the cord hole 6845, they are routed either to the left or the right depending on whether they are front or rear cords. In the illustrated example, the rear cords are routed to the right. As shown in FIG. 34, the one cord of the pair is routed above a vertically orientated guide plate 6895 through a channel provided in the top of the right upwardly facing detent's leg, in between the clamp block 6855 and the opposite side of the rear edge member, and out of the clamp cord passage 6875 in the clamp block into the main cavern 6760 of the rear channel where the cord typically terminates. The other cord of the pair of illustrated front cords is routed below the guide plate in a notch provided in the plate, in between the clamp block, and into the main cavern through the clamp cord passage as well where it typically terminates. As shown in FIG. 84, the notch provided on the bottom edge of the plate 6895 guides the cord towards the main cavern of the rear channel around the set screw 6905 so it does not interfere therewith. It is appreciated that the rear cords are similarly routed through similar elements of the cord adjustment member to the left of the cord hole.

Figure 82:
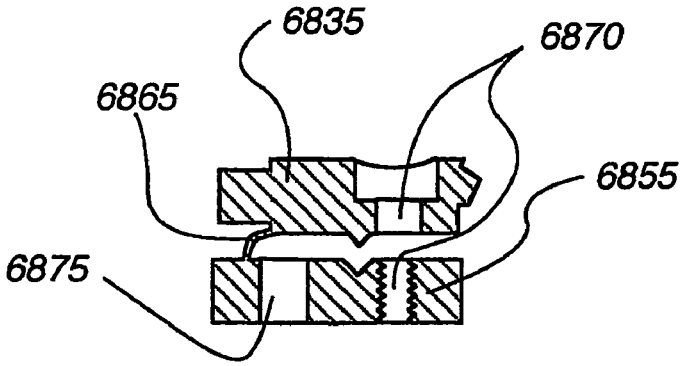
FIG. 82 is a partial cross sectional side view of the adjustment member taken along line 82—82 of FIG. 76.
Figure 85:
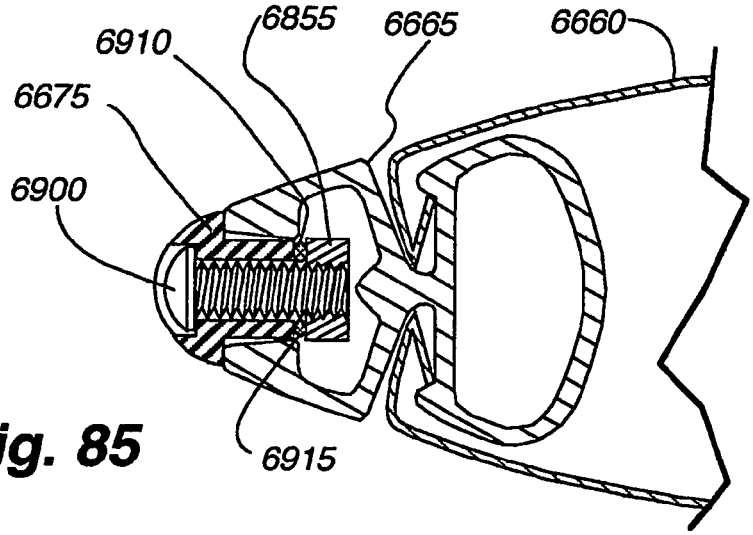
FIG. 85 is a partial cross sectional view of the alternative foot rail showing the installed adjustment member as taken along line 85—85 of FIG. 68.

The clamp block 6855 is best shown in FIGS. 74 and 82. It is attached to the rear edge member by a resilient tang 6865. A vertical triangular channel 6860 is provided in each clamp block that corresponds to a vertical protrusion 6850 in the rear edge member. As the clamp is tightened against the rear edge member by tightening the clamp bolt 6900, the protrusion and triangular channel crimp the cords passing across them thereby effectively locking the cords in place. The left cords clamped in place between the clamp block and the rear edge member is illustrated in FIG. 85.

To adjust the length of the lift and riser cords after they have been threaded into place as illustrated in FIG. 74, the user first pulls the cords through the clamp cord passage to the proper length. Next, the user tightens the clamp block against the rear edge member with the clamp bolt. The same process is repeated with the other clamp block as applicable. If the cord adjustment member has not yet been placed in the rear channel of the foot rail it is either snapped in place or slid in place from one of the ends of the foot rail. Finally, once placed in the proper position along the rear channel of the foot rail, the cord adjustment member is locked in its longitudinal position along the foot rail by tightening the set screws into the throat of the rear channel.

As has been previously described, each slat of the plurality of slats 24 is cradled and supported by a set of corresponding cross rungs 38 as best illustrated in FIG. 11.

In a preferred embodiment, each slat 24 is attached to a cross rung 38 on the slat's bottom side by one or more drops of glue 60 (as shown) or any other suitable means. Each slat is a three dimensional object having of a two dimensional cross-section and a center of gravity. By connecting the cross rung portion 38 to the slat 24 at a point below but substantially in line with and offset from the center of gravity when the slat 24 is in its horizontal open position, the slat is encouraged by gravity to pivot about the rung cord connection point to assume a more vertical position when closed. As the slat 24 is tilted towards a closed position, one half of the rung cord 38, which has an end connected to an upwardly extending riser cord 36 acts to lift the corresponding side of the slat 24, while the opposite half of the rung cord and its adjacent riser cord 36 act to lower its side of the slat. As this tilting action occurs, the center of gravity pivots towards a more horizontally aligned relationship with the connection point. Once the slat has pivoted approximately 45 degrees, the slat pivots downwardly under its own weight about the connection point. When the slat is in its fully closed position, the center of gravity is horizontally offset relative to the connection point, thereby encouraging the slat to over-tilt. The final amount of slat tilt is limited by engagement with an adjacent slat and the engagement effects a seal between adjacent slats through which light cannot pass. On prior art blinds where no connection is made between the slats and the cross rungs, the interrelationship of the slats and the cord ladders suspending them tend to prevent this intimate closure toward the end of the stroke rather than encourage it. It is noted that the connecting of the slat to the cross rung portion is even effective on thin metal-slatted blinds, despite the fact that the center of gravity of the slats would be below the connection point rather than above when the slats are open and horizontal. The metal slats just need to be pivoted a greater amount much closer to 90 degrees before over-tilting occurs. A more complete explanation of slats secured to cross rungs and the benefits thereof can be found in co-pending application Ser. No. 10/003,097 filed Dec. 6, 2001, entitled "Ladder Operated Covering With Fixed Vanes For Architectural Openings which is of common ownership with the present application and is hereby incorporated by reference.

Figure 2:
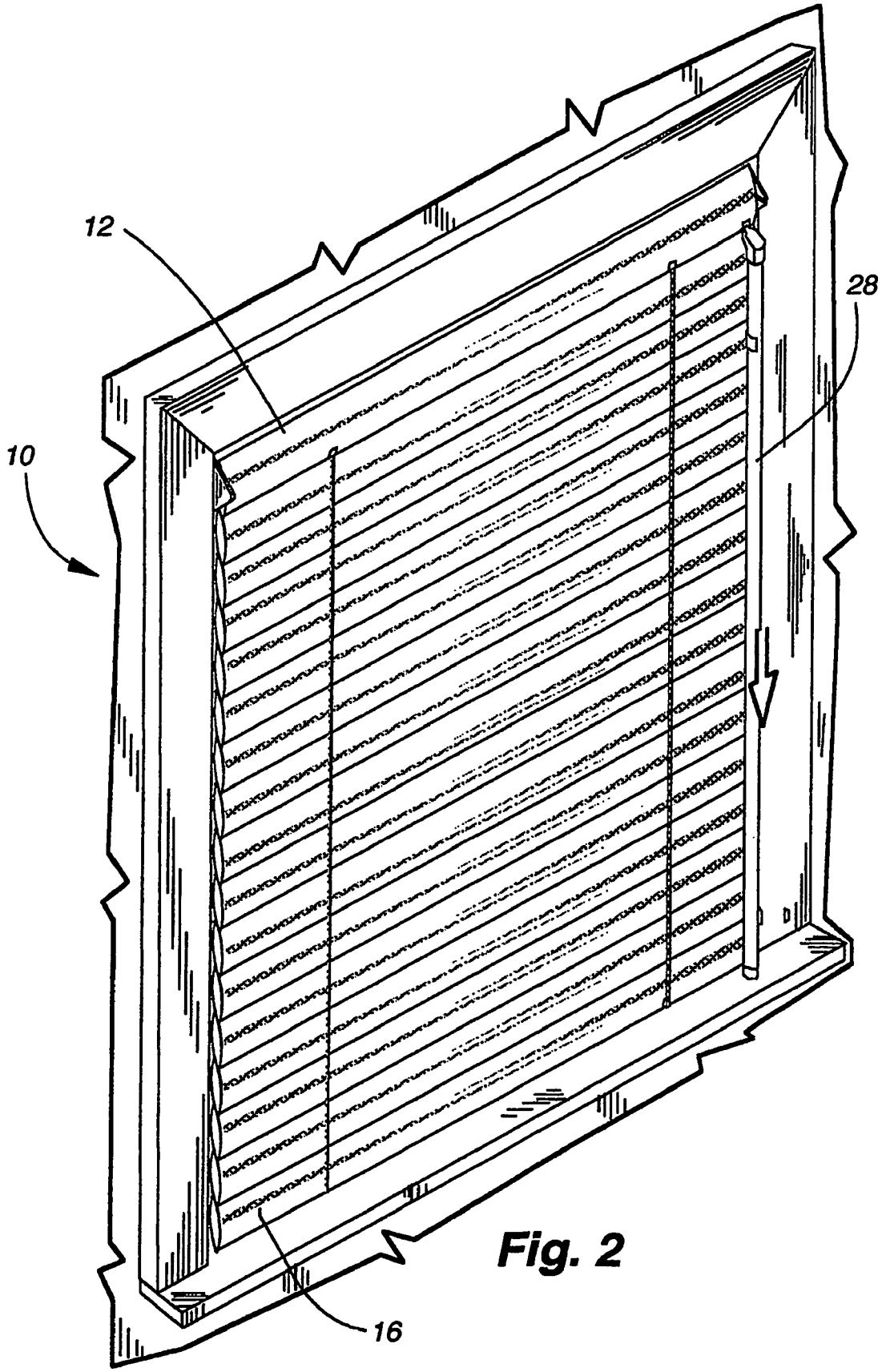
FIG. 2 is an isometric view of the front of a blind assembly in its extended position with the slats in a first closed position.
Figure 3:
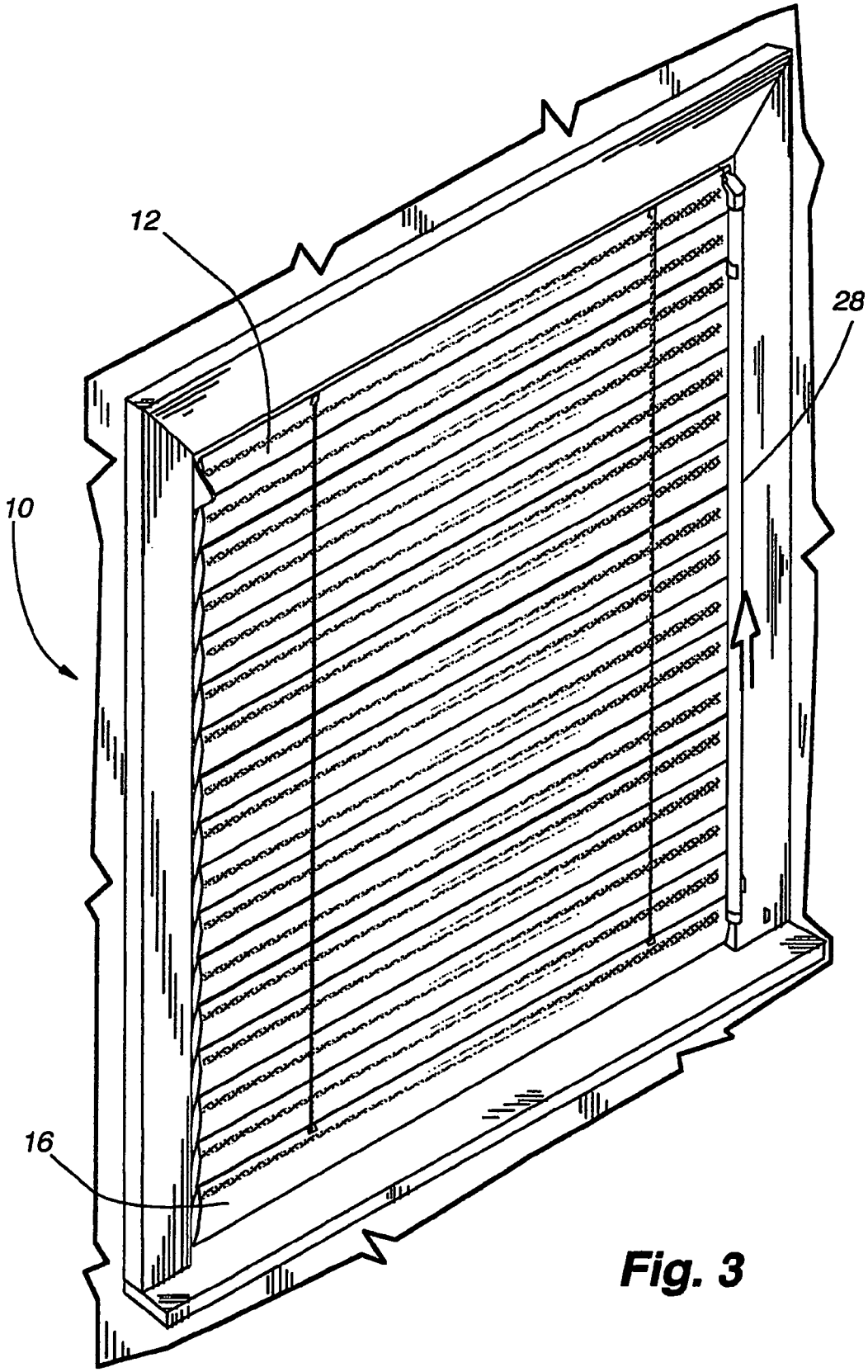
FIG. 3 is an isometric view of the front of a blind assembly in its extended position with the slats in a second closed position.
Figure 17:
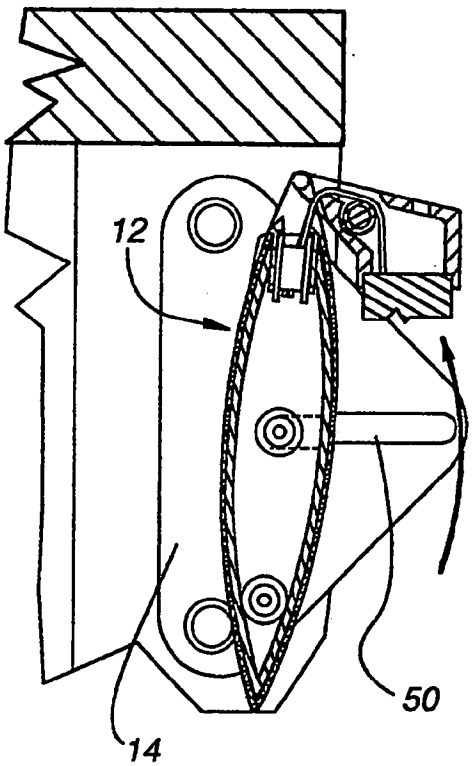
FIG. 17 is similar to the fragmentary section of FIG. 15, wherein the headrail has been pivoted into the second closed position.
Figure 16:
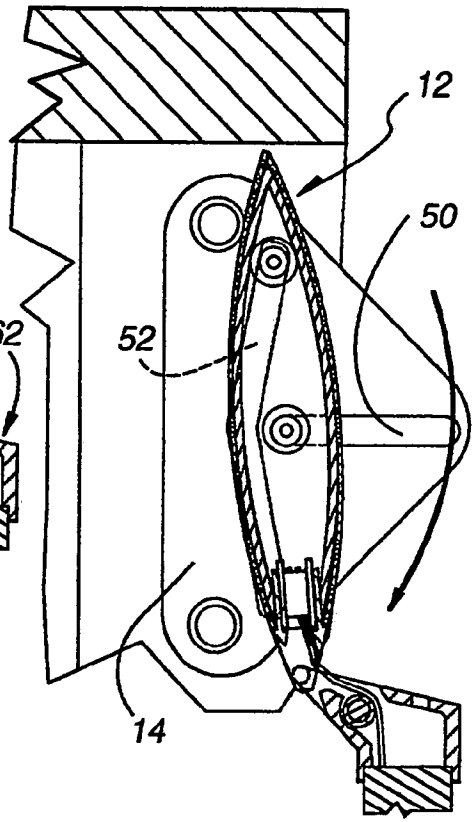
FIG. 16 is similar to the fragmentary section of FIG. 15, wherein the headrail has been pivoted into the first closed position.
Figure 15:
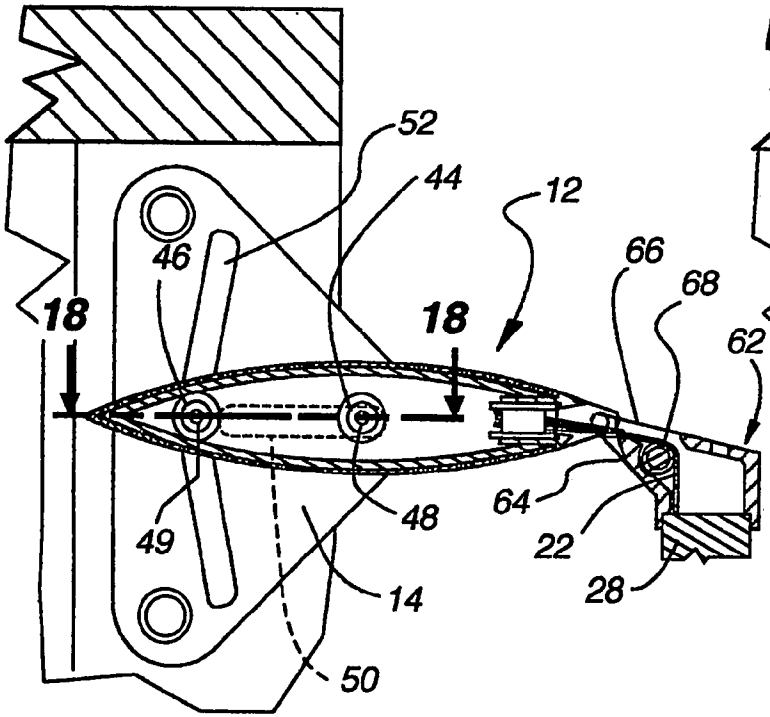
FIG. 15 is a fragmentary vertical section taken along line 15—15 of FIG. 9 illustrating the rigid headrail and its pivotal connection with the window frame-mounting bracket.

As shown in FIGS. 2 and 3 upward or downward movement of the actuator rod 28 causes the slats 24 to open or close. The actuator rod 28 is preferably fabricated from an aluminum extrusion and has several channels formed therein for receiving components related to the lift mechanism as will be described later. The top end of the vertically orientated rod is pivotally attached to the front longitudinal edge of the headrail (near either longitudinal end of the headrail) through an actuator rod top end cap 62. The top end cap 62 is typically received over the top end of the actuator bar 28 and fixed in place. As illustrated in FIGS. 15–17, a tongue 64 extends substantially horizontally and upwardly from the vertical actuator bar 28 towards the front longitudinal edge of the headrail 12, wherein a front end of the tongue is pivotally attached to the headrail. The top end cap 62 also comprises a slot 66, and a pulley 68, for receiving and directing the lift cords into the actuator bar in addition to a pulley 70 for a connector cord 72 (shown in FIG. 23) as will be described in greater detail below.

The alternative actuator rod top end cap 4650 is utilized in conjunction with the alternative headrail end cap 4605 as illustrated in FIGS. 46–50. As described above in conjunction with the alternative headrail end cap 4605, the actuator rod top end cap 4650 is pivotally attached to the headrail end cap by a tubular axle protrusion 4655. The lift cords of an associated window blind assembly are threaded from the interior of the headrail 12 through the inwardly extending portion 4640 of the tubular axle receptacle 4615 on the alternative end cap 4605 and then through the tubular axle protrusion 4655. A pulley 4685 is provided within the top end piece for directing the lift cords downwardly in the actuator bar 28. The top end cap 4650 also includes a downwardly extending portion 4680 that is received in the interior of the actuator rod 28 to secure the top end cap therein. As shown best in FIG. 46, the top end cap is preferably fabricated of two pieces that are snapped, bonded, screwed or otherwise joined together around the aforementioned pulley. Although the top end cap can be fabricated from a number of materials and methods, it is preferably comprised of a molded plastic.

Figure 14:
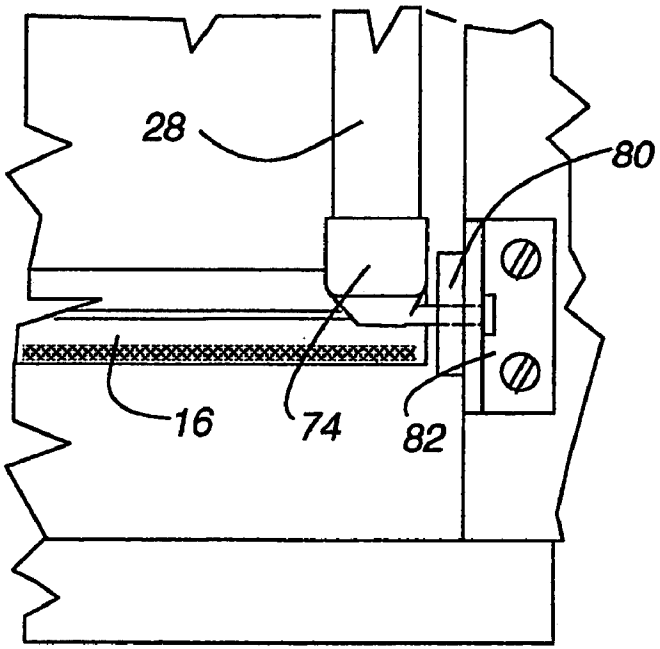
FIG. 14 is a fragmentary front view illustrating the lower end of the actuator rod and the associated lower mounting bracket.
Figure 13:
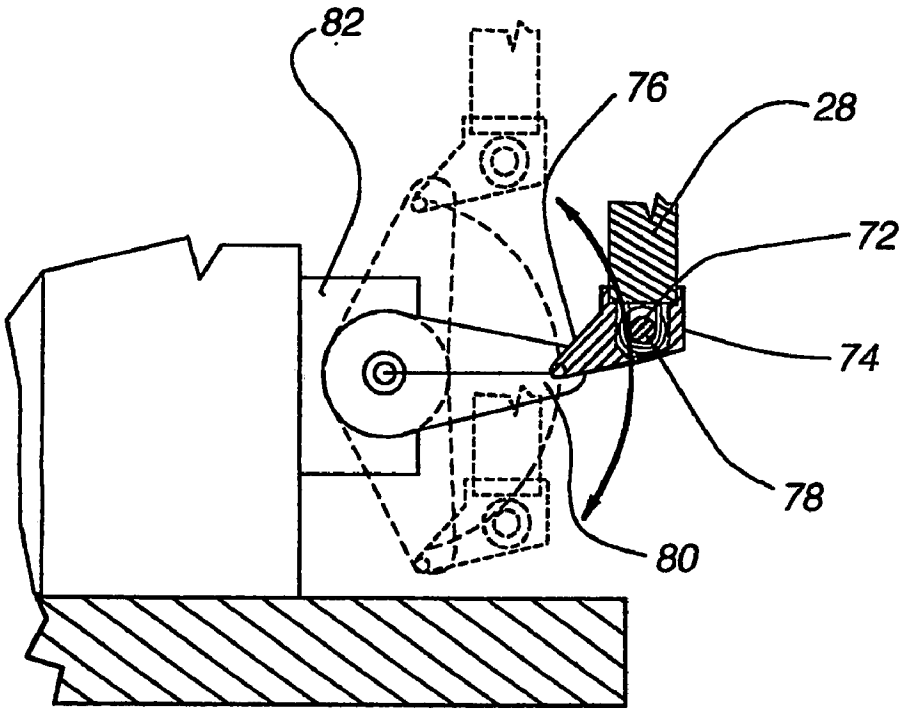
FIG. 13 is a fragmentary sectional illustrating the pivotal movement of the lower end of the actuator rod and the associated lower mounting bracket taken along line 13—13 of FIG. 10.

Referring to FIGS. 13 and 14A, the bottom end cap 74 is fixed to the bottom end of the actuator bar 28. A tongue 76 extends substantially horizontally and downwardly from the bottom end of the vertical actuator bar towards a pivot arm 80 to which the end of the tongue 76 is pivotally connected. The bottom end cap also comprises a connector cord pulley 78. The pivot arm is part of an actuator rod mounting bracket 82. The actuator rod mounting bracket 82 is fixedly attached to a window frame proximate its bottom end. As shown in FIG. 13, the pivot arm 80 is pivotally attached to the fixed portion of the mounting bracket 82 and pivots in a substantially vertical plane that is parallel to the ends of the slats 24. The pivot arm 80 essentially acts to direct the upward or downward movement of the actuator rod 28 and may be eliminated in certain alternative embodiments without significantly effecting the general operation of the actuator rod 28 when tilting the plurality of slats 24.

Figure 40:
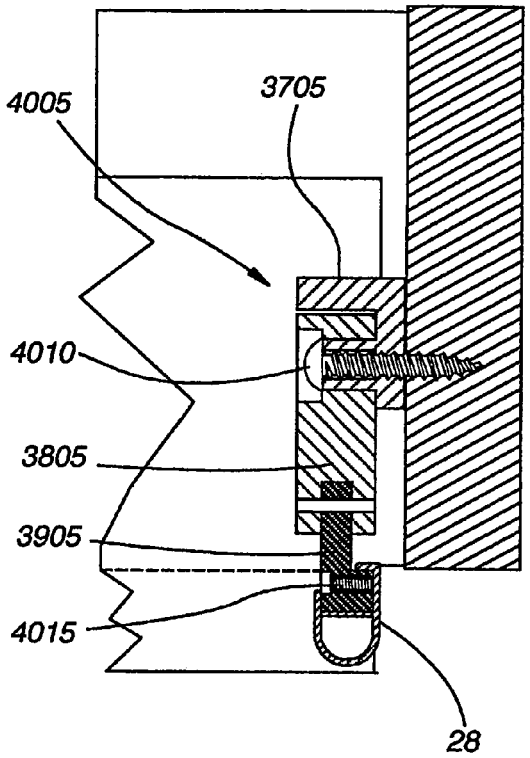
FIG. 40 is a cross sectional view of the first alternative pivoting mechanism taken along line 40—40 of FIG. 32.

FIGS. 37–40 illustrate components of an alternative pivoting mechanism 4005 for use with the actuator rod 28 instead of the bottom end cap 74 described above. FIG. 41 illustrates the alternative pivoting mechanism 4005 secured to a window frame with an actuator rod 28 attached thereto. As is best shown in FIG. 41, the alternative pivot mechanism 4005 is not integrated with a pulley at the bottom of the actuator bar 28 but is located above the end of the actuator bar. As necessary a separate end cap (not shown) incorporating a pulley is provided. The alternative pivoting mechanism 4005 comprises a window frame attachment piece 3705, a pivoting arm 3805 and an actuator rod attachment piece 3905. The window frame attachment piece 3705 is generally L-shaped with the outer surface of one arm 3710 of the "L" for butting directly against the window frame. A boss 3715 having a bore 3720 passing through it extends horizontally from the inside surface of the one arm 3710. The boss 3715 serves as an axle for the pivoting arm 3805, which has a bore 3810 proximate one end that is placed over the boss 3715 as shown in FIG. 40. A screw 4010 is received through both bores 3720 and 3810 and secures both the window attachment piece 3705 and the pivoting arm 3805 to the window frame. The pivoting arm 3805 extends from the window attachment piece 3705 in a direction parallel to the window frame. The pivoting arm 3805 has a smaller bore 3815 passing through it at the other end, along with a slot 3820 formed in the other end that is perpendicular to the small bore 3815. A vertically oriented tongue 3910 that extends from the actuator rod attachment piece 3905 is received in the slot 3820, wherein a securing pin (not shown) can be slid within the small bore 3815 of the pivoting arm 3805 and a small bore 3915 in the tongue 3910 to pivotally secure the pivoting arm 3805 to the actuator attachment piece 3905. In other words, a typical clevis in the pivoting arm forms slot 3820 to receive the tongue 3915 of the attachment piece 3905 with a clevis pin being used to pivotally join the tongue and the pivoting arm. The actuator arm attachment piece 3905 includes a threaded bore 3920 passing through a portion of the attachment piece that is received in the end of the actuator rod 28. A set screw 4015 that is secured in the threaded bore 3920 is tightened to secure the attachment piece and the pivoting mechanism to the actuator bar as is best shown in FIG. 40.

Figure 86:
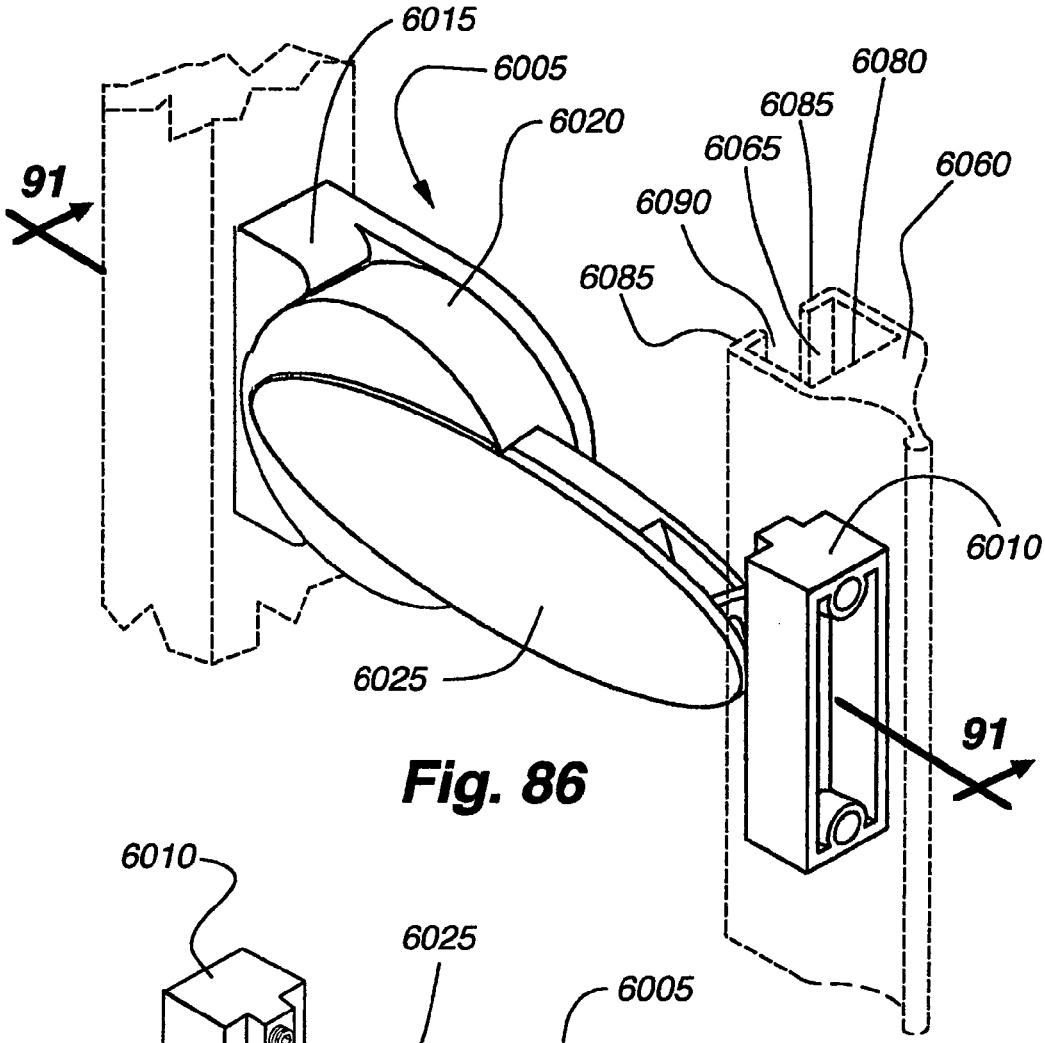
FIG. 86 is a isometric front view of a second alternative pivoting mechanism for coupling the lower portion of the actuator bar with the frame of an architectural opening.
Figure 87:
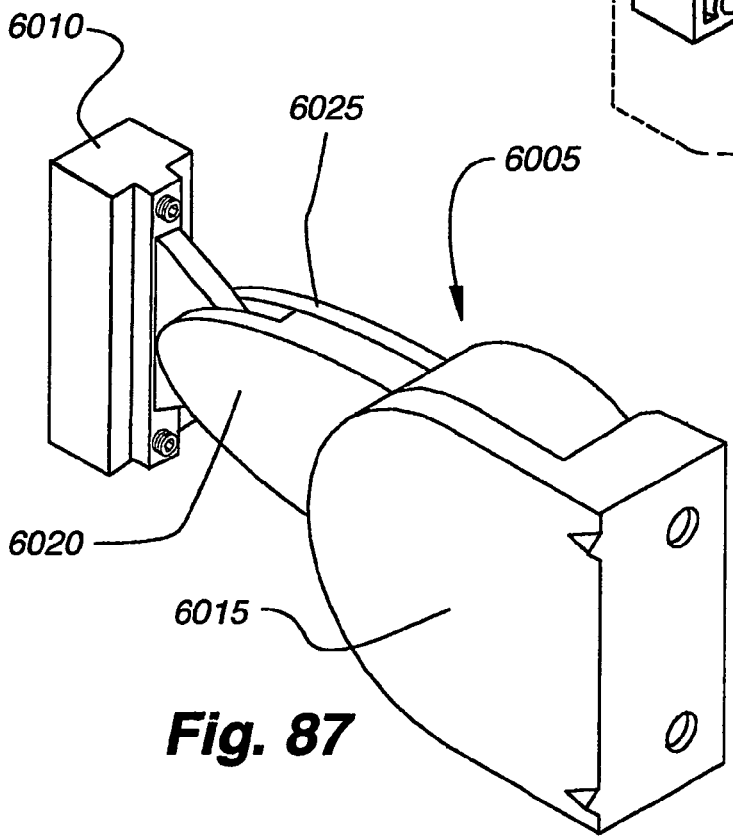
FIG. 87 is a isometric rear view of a second alternative pivoting mechanism.
Figure 88:
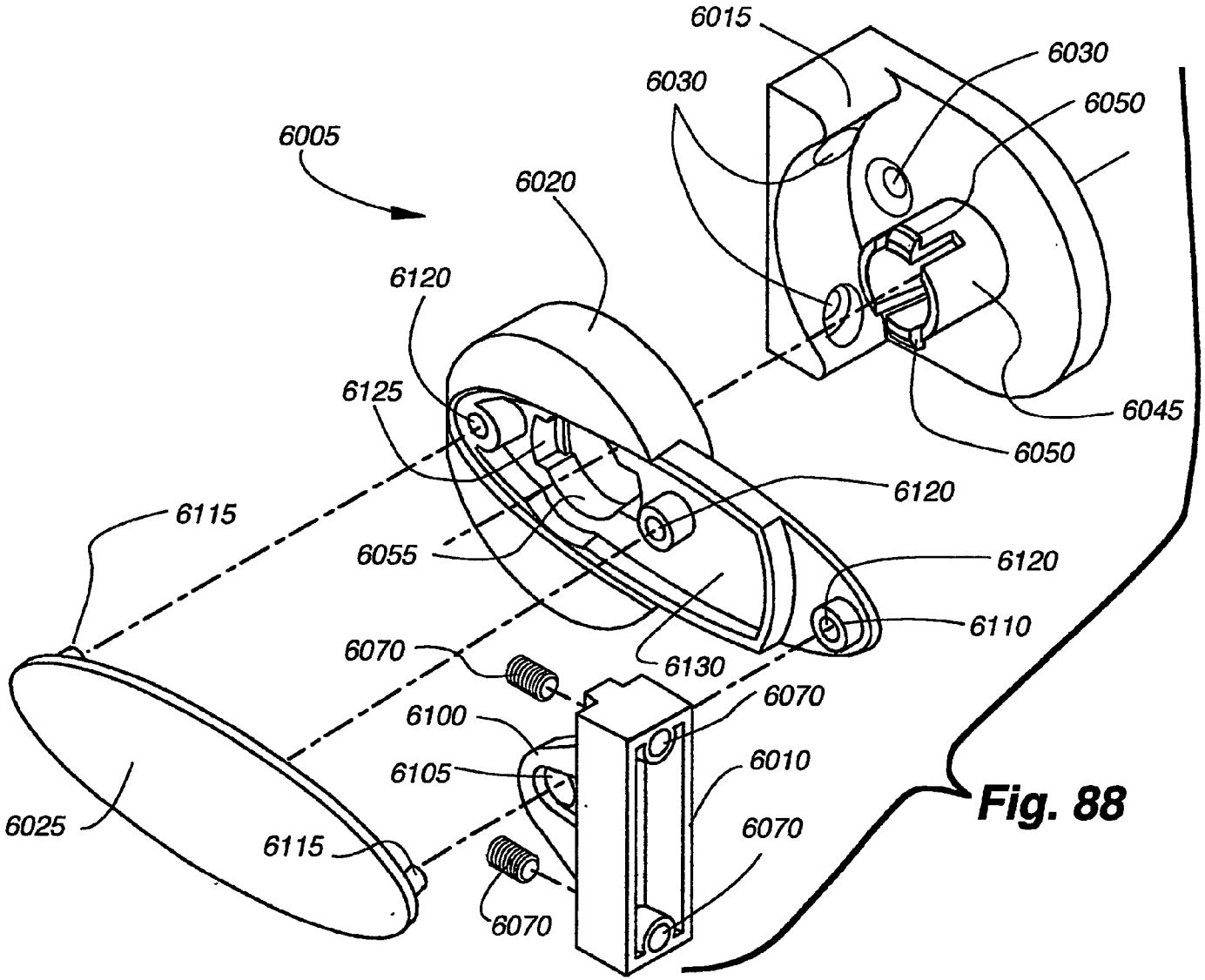
FIG. 88 is an isometric exploded view of the second alternative pivoting mechanism.

FIGS. 86–92 illustrate a second alternative pivoting mechanism 6005. The second alternative pivoting mechanism is generally similar to the first alternative pivoting mechanism in the manner of its operation and the location of its attachment to the actuator rod, although there are differences in construction and assembly. Referring primarily to FIG. 88, the primary components of the second alternative pivoting mechanism include (i) a window frame attachment piece 6015, (ii) an actuator rod attachment piece 6010, (iii) a pivoting arm, and (iv) a pivoting arm cover. The window frame attachment piece is generally L-shaped with mounting holes 6030 passing through each of the piece's sides through which screw-type fasteners 6035 can be received to secure it to a front or side facing surface of an associated window frame 6040. A generally cylindrical boss 6045 extends generally horizontally from an inside surface of one leg of the window frame attachment piece. The boss serves as an axle for the pivoting arm as is described below. The boss further includes outwardly-lipped detents 6050 that are configured for receipt in opposing keyways 6125 in a corresponding bore 6055 in the pivoting arm.

The actuator bar attachment piece 6010 is received in the interior of an extruded alternative actuator bar 6060. As is shown in FIG. 86, the alternative actuator bar is configured differently than the actuator bar 28 utilized with the other pivoting mechanism embodiments. The alternative actuator bar is also utilized in conjunction with the ball and wedge alternative lift mechanism described in detail below. The attachment piece is received in the interior channel 6065 of the actuator bar and includes two threaded bores 6070 in which set screws 6075 are tightened to brace the attachment piece between the front wall 6080 of the longitudinally extending interior channel 6095 and opposing lips 6085 bordering a longitudinally-extending slot 6090 of the alternative actuator bar. A generally vertically orientated tongue 6100 extends from the body of the attachment piece 6010 and has a horizontal bore 6105 therethrough for pivotally receiving the pivoting arm 6020. It is to be appreciated that like the actuator bar attachment piece of the first alternative pivoting mechanism, the actuator bar of the second embodiment can also be attached to the actuator bar anywhere along its length, although typically, the attachment piece will be secured to the actuator bar proximate its bottom end.

Figure 89:
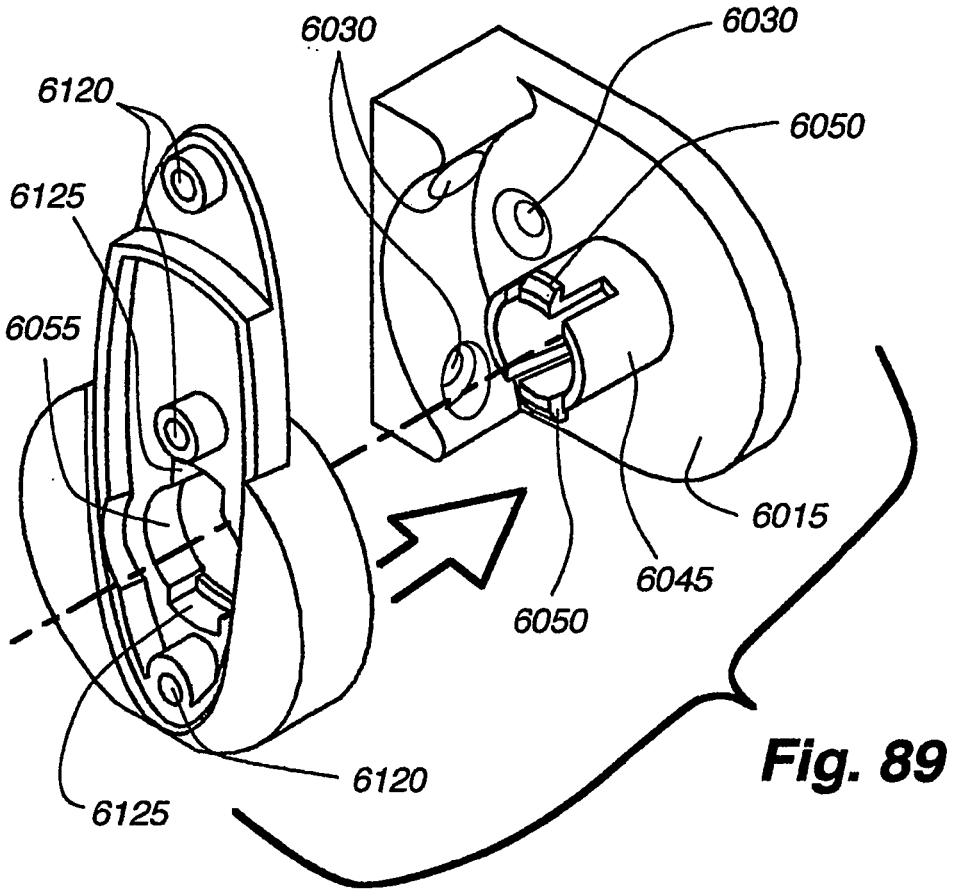
FIGS. 89 and 90 are isometric views of the primary components of the second alternative pivoting mechanism illustrating how the pieces pivotally interface.
Figure 90:
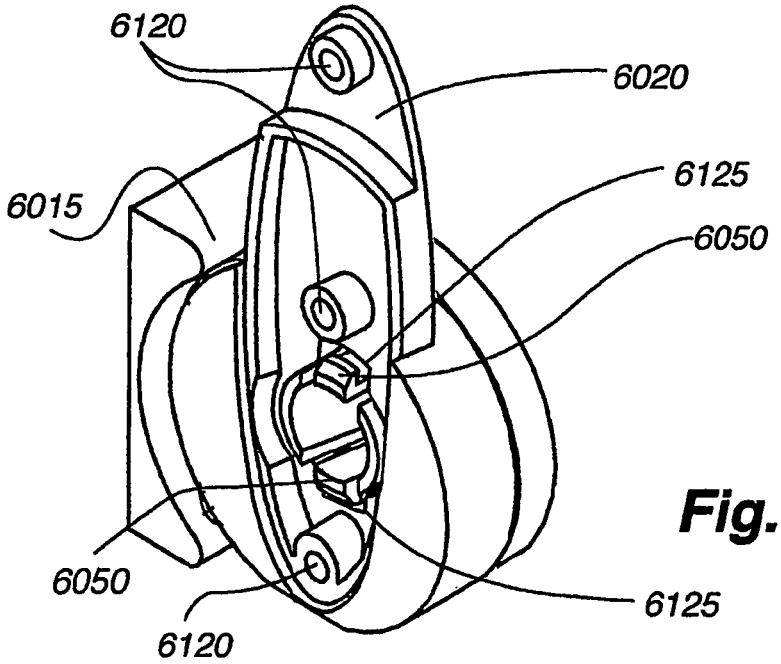

The pivoting arm 6020 is pivotally joined to both the actuator rod and the window frame attachment pieces. A pivot arm boss 6110 extending from and generally integrally-molded into the arm at one end thereof is received in the corresponding horizontal bore 6105 in the actuator bar attachment piece's tongue 6100. The pivoting arm cover 6025 has three integrally molded pins 6115 that snapidly into corresponding openings 6120 in the pivoting arm including an opening in the pivot arm boss to pivotally sandwich the tongue 6100, securing it to the one end of the pivoting arm. The pivotal connection of the pivoting arm with the window frame attachment piece is illustrated in FIGS. 89 and 90. As indicated, the pivoting arm is orientated until the opposing keyways that extend from the pivoting arm bore 6055 and the longitudinal axis of the arm are generally vertically-orientated. The bore is then slid over the cylindrical boss 6045 with the lipped detents 6050 passing through the keyways 6125 as indicated in FIG. 90. By pivoting the pivoting arm about the boss, the lips of the detents are moved over an inside surface 6130 of the arm preventing the arm from being removed from the window attachment piece 6015 unless the arm is orientated vertically upwardly or downwardly. By snapping the aforementioned pivoting arm cover into place a pivoting mechanism having a finished look is presented as is best illustrated in FIGS. 86 and 87.

Figure 91:
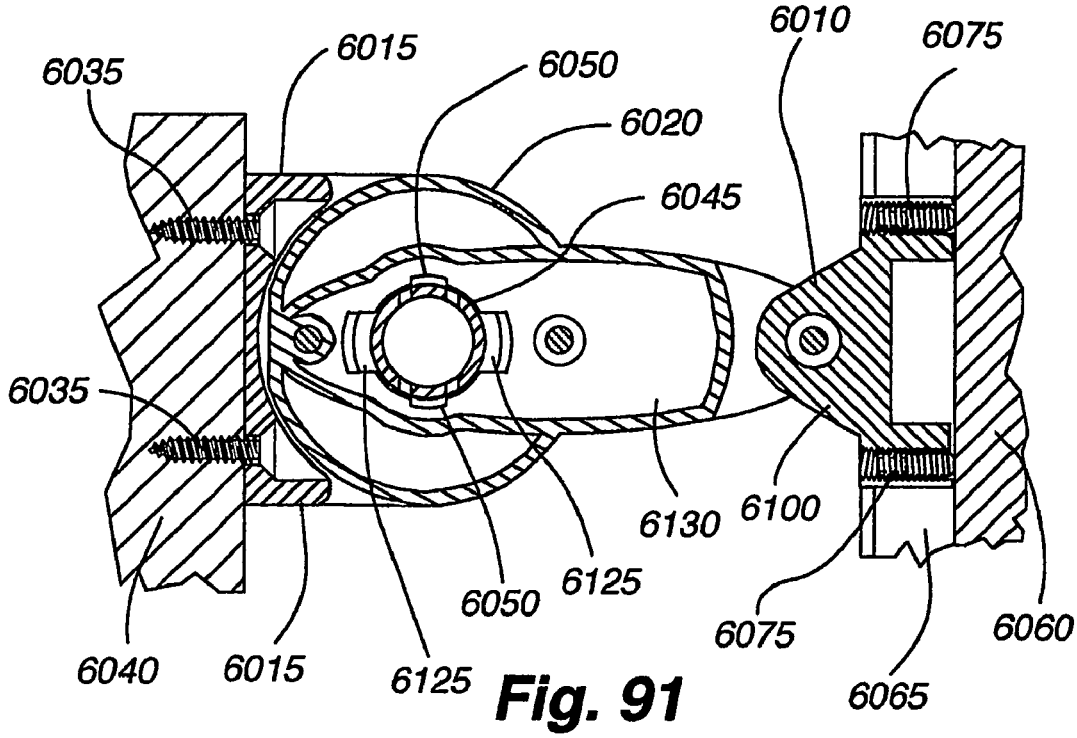
FIG. 91 is a cross sectional view taken along line 91—91 of FIG. 86 showing the pivoting mechanism in its position corresponding to the fully open position of the slats.
Figure 92:
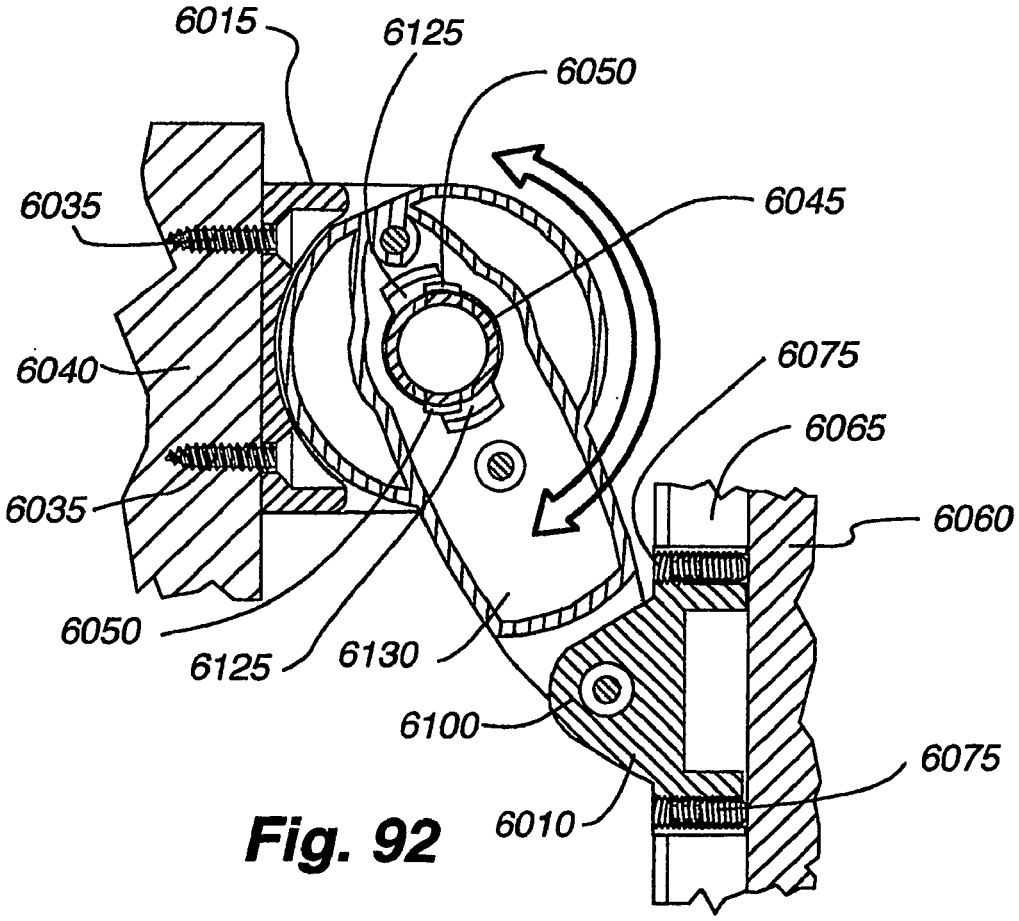
FIG. 92 is also a cross sectional view taken along line 91—91 of FIG. 86 showing the pivoting mechanism in its position corresponding to a fully closed position of the slats.

FIGS. 91 and 92 illustrate pivoting arm 6020 of the second alternative pivoting mechanism in positions that respectively correspond to the fully open position and one of the fully closed positions of the associated blind assembly. As clearly shown, even when the blind assembly is in its fully closed position, at least a portion of the lips of the lipped detents overlap the inside surface of the pivoting arm, thereby preventing the pivoting arm from separating from the window attachment piece 6015. Ordinarily to disconnect the window attachment piece from the pivoting arm, the pivoting arm cover must be removed, the tongue of the actuator rod piece 6010 must be separated from the pivoting arm, and the pivoting arm must be rotated into a vertical position to align the keyways with the lipped detents.

Figure 1:
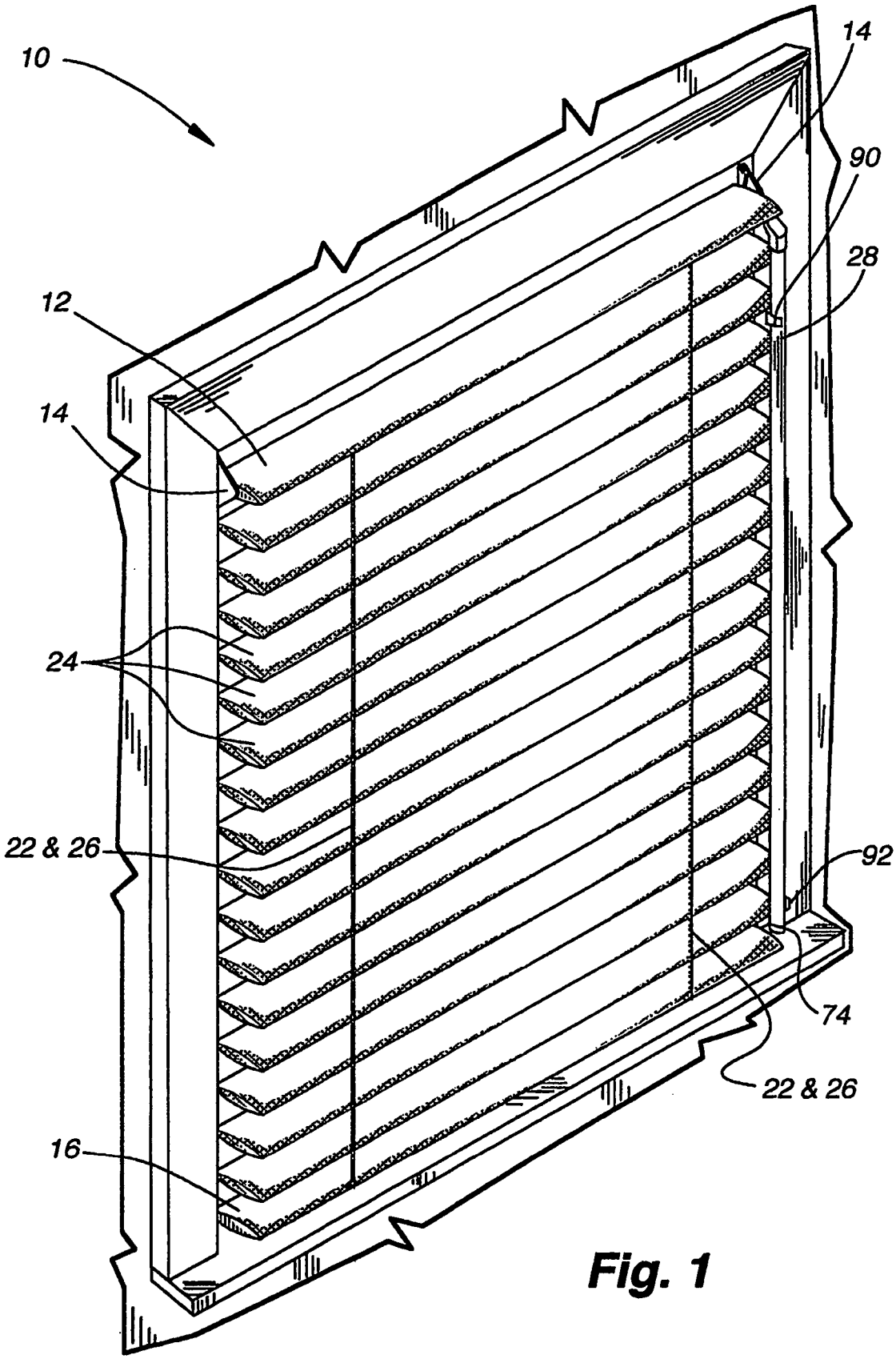
FIG. 1 is an isometric view of the front of a blind assembly in its extended position with the slats in the open position.

FIGS. 1–3 and 15–17 illustrate the tilting operation of the preferred embodiment. FIG. 1 illustrates the blind assembly 10 in its extended position substantially covering the entire window with the slats 24 in their horizontally open position, wherein a maximum amount of light is passed therethrough. The position of the spring-loaded pins 44 and 46 of the headrail end cap 34 when the slats are in the open position is illustrated in FIG. 15. The centered pin 44 is located at the front end of the horizontal slot 50 and the rear pin 46 is located at the intersection of the legs of the "V"-shaped slot 52, vertically centered within the "V"-shaped slot. FIG. 15 illustrates a blind assembly 10 mounted in a window that is only shallowly recessed into a wall, such that the centered pin 44 of the headrail 12 must be located in front of the surface of the wall when the slats 24 are open in order for the rear longitudinal edge of the headrail 12 and the corresponding lower slats 24 to clear the window pane.

By moving the actuator bar 28 downwardly as shown in FIG. 2, the slats 24 can be tilted into a first closed position. As can be seen in FIG. 16, the headrail 12 is pivoted in a clockwise direction with the front longitudinal edge of the headrail moving downwardly and the back or rear longitudinal edge of the headrail moving upwardly. As can be appreciated, the rear riser cords 36 of the cord ladders 26 are also pulled upwardly, since the top end of the rear riser cords 36 are fixedly attached to the rear longitudinal edge of the headrail 12. Concurrently, the front riser cords 36 are lowered. This causes the rung cords 38 and the slats 24 cradled therein to pivot clockwise as well, wherein the top side of a slat proximate its rear longitudinal edge contacts the bottom side proximate the front longitudinal edge of the slat next above it. As the headrail 12 is pivoted clockwise, the centered pin 44 is encouraged to move rearwardly in the horizontal slot 50 as the "v"-shaped slot 52 guides the rear pin 46 upwardly. This pin movement causes the rear longitudinal edge of the headrail to move rearward to a position underneath and in close proximity to the upper side of the window frame, thereby providing a better light seal than if the headrail had not pivoted inwardly. The reward movement of the headrail also causes the remainder of the blind assembly 10 suspended from the headrail to move inwardly, such that the blind assembly is closely adjacent to the window pane and substantially contained within the window frame when the slats 24 are closed, and the slats do not protrude significantly beyond the surface of the corresponding wall. This provides a better light seal between the vertical sides of the window frame and the ends of the slats than could be obtained if the slats were not moved laterally toward the window pane.

By moving the actuator bar upwardly as shown in FIG. 3, the slats can be tilted into a second closed position. As can be seen in FIG. 17, the headrail 12 is pivoted in a counterclockwise direction with the front longitudinal edge of the headrail moving upwardly and the rear longitudinal edge of the headrail moving downwardly. As can be appreciated, the front riser cords 36 of the cord ladders 26 are also pulled upwardly, since the top end of the front riser cords 36 are fixedly attached to the front longitudinal edge of the headrail 12. Concurrently, the rear riser cords 36 are lowered. This causes the rung cords 38 and the slats 24 cradled therein to pivot counterclockwise as well, wherein the top side of a slat proximate its rear longitudinal edge contacts the bottom side proximate the front longitudinal edge of the slat above it. As the headrail 12 is pivoted counterclockwise, the centered pin 44 is encouraged to move rearwardly in the horizontal slot 50 as the "v"-shaped slot 52 guides the rear pin 46 downwardly. This pin movement causes the top longitudinal edge of the headrail to move rearwardly to a position underneath and in close proximity to the window pane and the upper side of the window frame, thereby providing a better light seal than if the headrail had not moved inwardly. The rearward or lateral movement of the headrail also causes the remainder of the blind assembly 10 suspended from the headrail to move inwardly, such that the blind assembly is substantially contained within the sash and casement of the window when the slats 24 are closed, and the slats do not protrude significantly beyond the surface of the corresponding wall. As described above, this provides a better light seal between the vertical sides of the window frame and the ends of the slats than could be obtained if slats were not moved inwardly.

To move the slats from either closed position to the open position, the actuator bar 28 is moved either upwardly or downwardly depending on the initial closed position of the slats. The one edge of the headrail 12 moves upwardly pulling the associated riser cords 36 with it, while the other edge moves downwardly. The riser cords 38 movement causes the attached rung cords 38 and the corresponding slats to pivot to their horizontal positions. As the headrail is moved to a horizontal position, the centered pin 44 is encouraged to move forwardly in the horizontal slot 50 as the "v"-shaped slot 52 guides the rear pin either upwardly or downwardly towards the intersection of the two legs of the "v." Accordingly, the headrail 12 and the depending plurality of slats 24 move laterally in an outward direction away from architectural opening. When mounted in a shallowly recessed window, this laterally outward movement permits the rear edge of the slats to clear the pane of the window.

Figure 42:
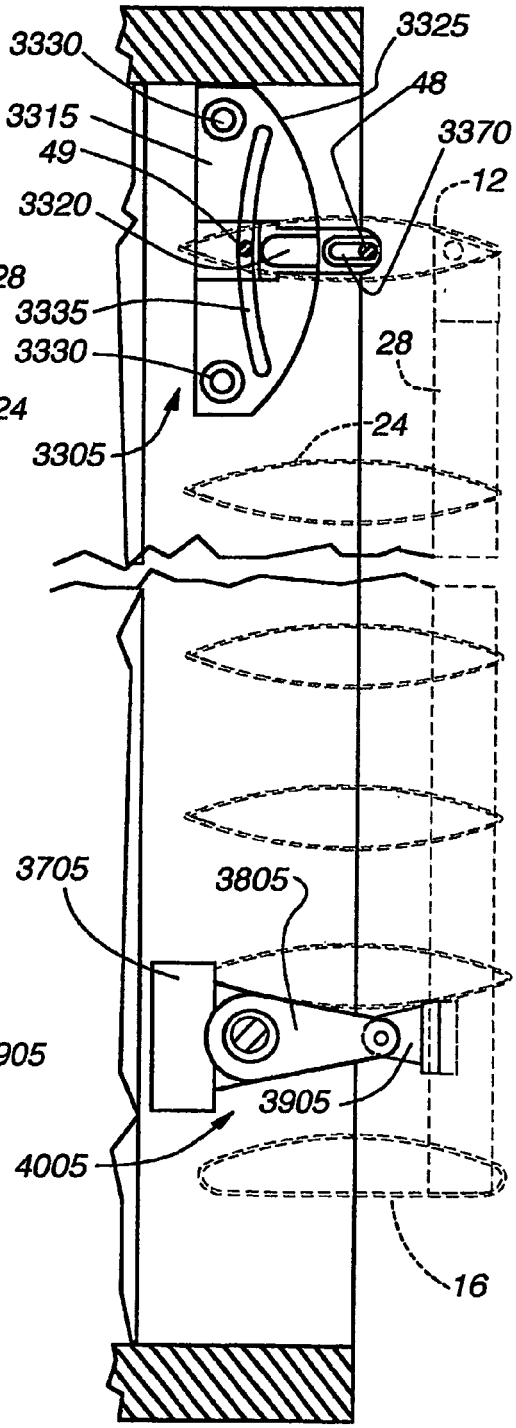
FIG. 42 is a cross sectional view of the window blind assembly incorporating the alternative mounting bracket and pivoting mechanism as taken along line 42—42 of FIG. 32.
Figure 43:
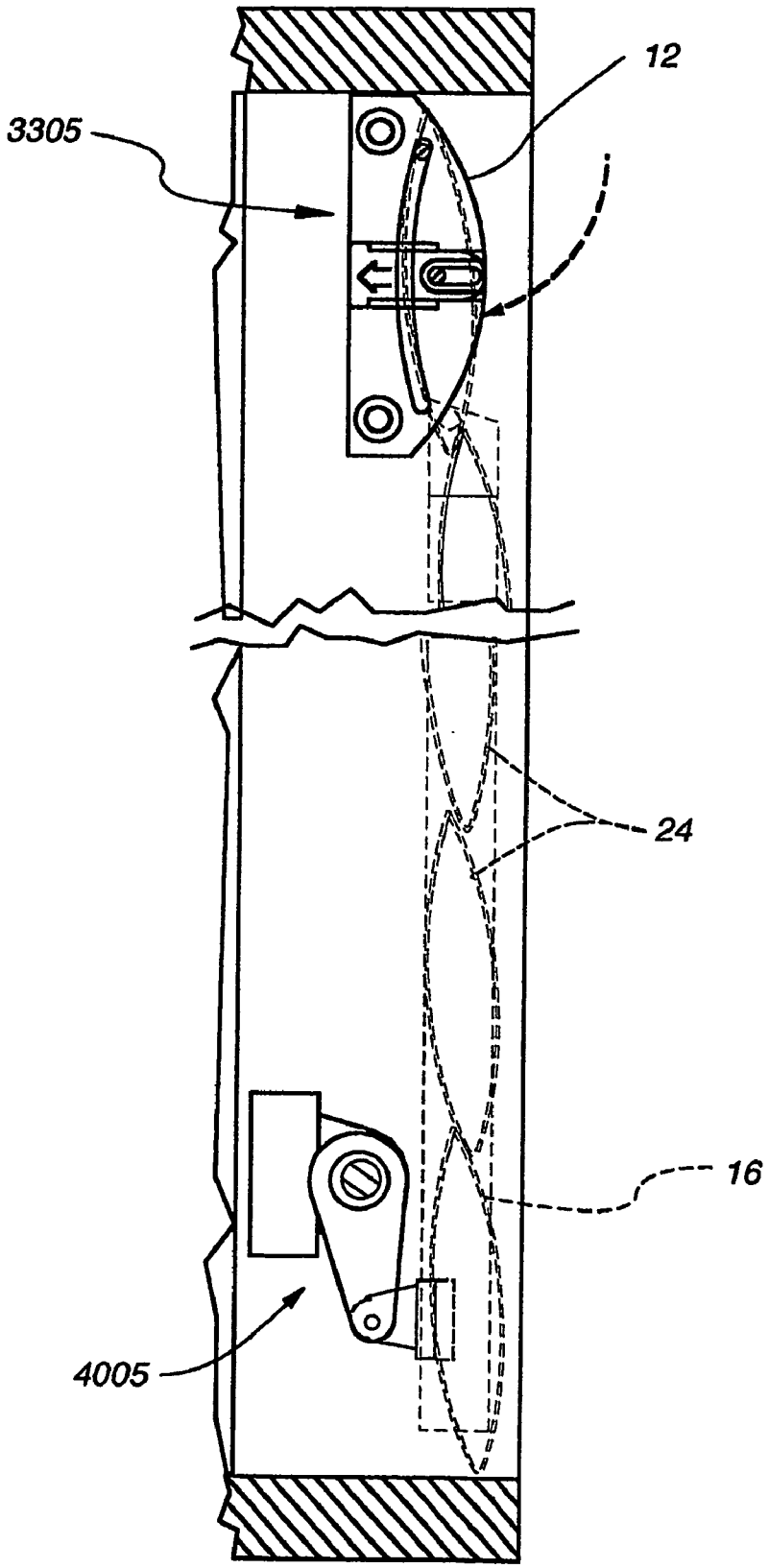
FIG. 43 is a cross sectional view of the window blind assembly incorporating the alternative mounting bracket and pivoting mechanism as taken along line 42—42 of FIG. 32 with the slats in their closed position.

FIGS. 42 and 43 illustrate the tilting operation of an alternative embodiment window covering assembly utilizing the alterative mounting bracket 3305 and the alternative pivoting mechanism 4005. In general, both alternative mounting bracket and the alternative pivoting mechanism operate in the same manner as described directly above. As shown in FIG. 42, the slats 24 are in their horizontal and open position. In the open position, the front centered pin 44 is in its most forward position, wherein the pin tip 48 rests in the slot 3370 of the sliding piece 3320 and the sliding piece is extended to its frontmost position within the mounting bracket 3305. The sliding piece 3320 is prevented from sliding out of the inside and outside pieces 3315 and 3310 by the impact between the wide back portion 3360 of the slider 3320 and the thin first portion 3350 of the horizontal slot 3345. The sliding piece may extend beyond the front surface of the window frame, so that the wide slats 24 can clear the surface of the window when in the open position. Also in the open position the pivoting arm 3810 of the alternative pivoting mechanism 4005 is fully extended and horizontally disposed.

By moving the actuator bar 28 downwardly the slats 24 can be tilted into the first closed position. As shown in FIG. 43, the headrail 12 is pivoted in a clockwise direction with the front longitudinal edge of the headrail moving downwardly and the back or rear longitudinal edge of the headrail moving upwardly. As the headrail 12 is pivoted clockwise, the centered pin 44 is encouraged to move rearwardly first in the slot 3370 until the end of the slot is reached and next by causing the sliding piece 3320 to slide backwardly into the outside and inside pieces 3310 and 3315 of the mounting bracket along slot 3345. Since the front and rear pins are at fixed distances from each other, the tip 49 of the rear pin, slides generally upwardly in the curvilinear slot 3335. This movement causes headrail 12 to pivot inwardly and the rear longitudinal edge of the headrail to move generally upwardly to a position underneath and in close proximity to the upper side of the window frame, thereby providing a better light seal than if the headrail had not pivoted inwardly. Unlike with mounting plate 14, alternative mounting bracket 3305 is contained entirely within the framework of the window in the closed positions such that no elements of the window blind assembly extend beyond the front of the window frame as is desirable for aesthetic reasons. In the closed position the slider 3320 is retracted behind the curvilinear surface 3325 of the mounting bracket 3305. As is also evident in FIG. 43, the top surface of the headrail 12 is generally in alignment with the curvilinear surface of the mounting brackets, giving the closed window assembly a very clean and integrated appearance further enhancing the shutter like appearance of the window blind assembly.

In other alternative embodiments of the blind assembly, a headrail having only a single centered pin on either end may be utilized with corresponding mounting brackets, each having a single hole to receive the centered pin. Additionally, the second alternative embodiment mounting bracket and headrails adapted therefore can be used as well. It is understood the headrail and corresponding lower slats will not move laterally when closed, but such movement may not be necessary when the blind assembly is used in a window that is more deeply recessed relative to the inside surface of the wall. Other alternative mounting brackets and associated headrail configurations that permit the pivotal movement of the headrail relative to its mounting brackets are described in detail below.

It is desirable that when the slats of a blind assembly are fully tilted to either the first or second position, that the raised riser cords 36 are taut and the lowered riser cords 36 are slack relative to their connection with the headrail 12. Accordingly, the formerly horizontal cross rung cords 38 lie substantially vertically against the raised riser cords 36. Ideally, the cross rung cords 38 are supported from above only by their connection with the raised riser cords 36. In this configuration, the slats 24 of the blinds are encouraged to tilt as close to a fully vertical position as possible, limited only by contact with the edges of the adjacent slats 24, thereby creating an effective light seal. It is appreciated that some sophisticated high-end prior art blind assemblies utilize a cam shaped drum within a tilting mechanism that causes the lowered riser cords to travel a greater distance downwardly than the raised riser cords travel upwardly, thereby helping to ensure that the lowered riser cords are slack when in a fully tilted position.

Figure 30:
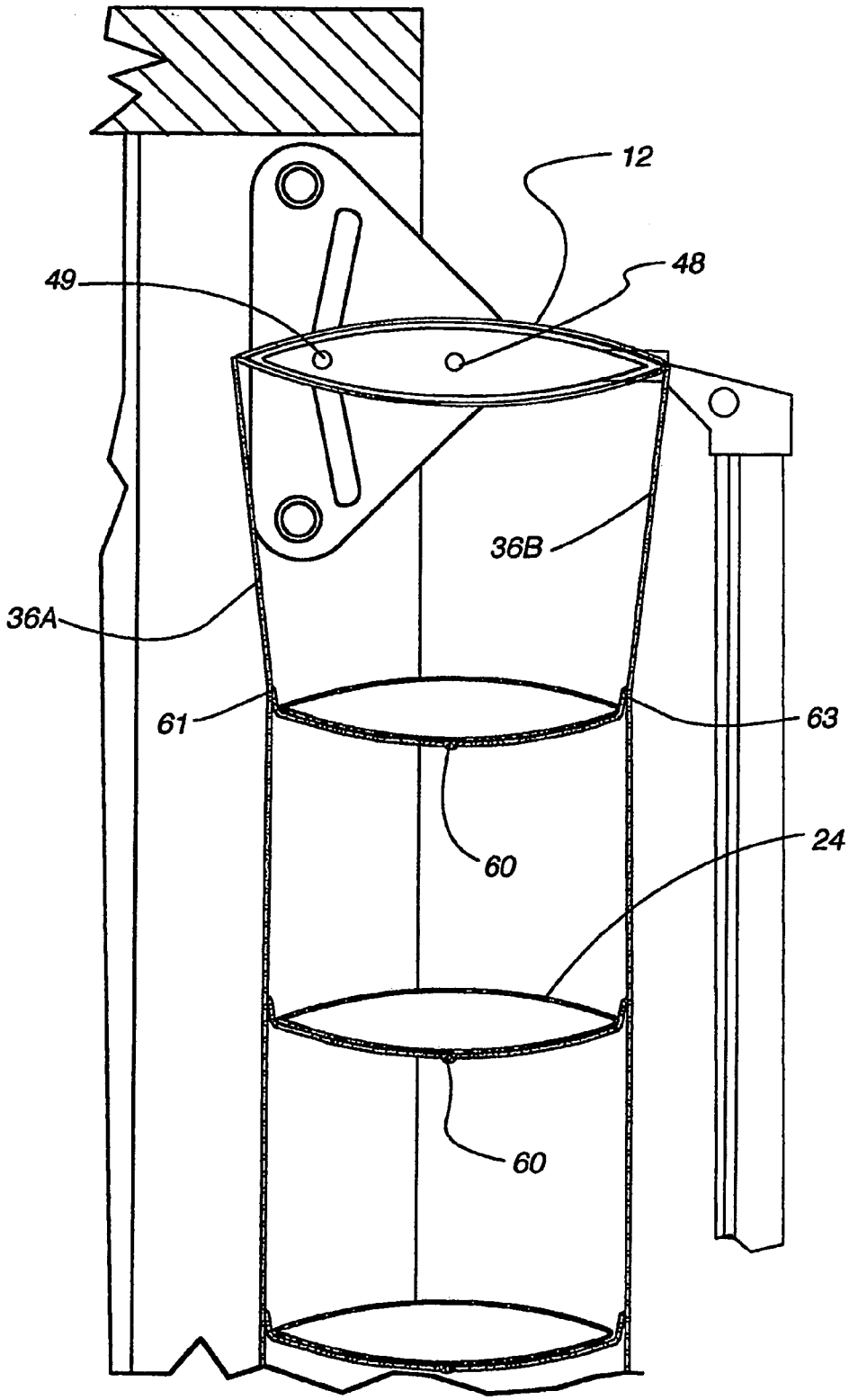
FIG. 30 is a fragmentary vertical section of the headrail and a couple of slats depending therefrom in an open position.
Figure 31:
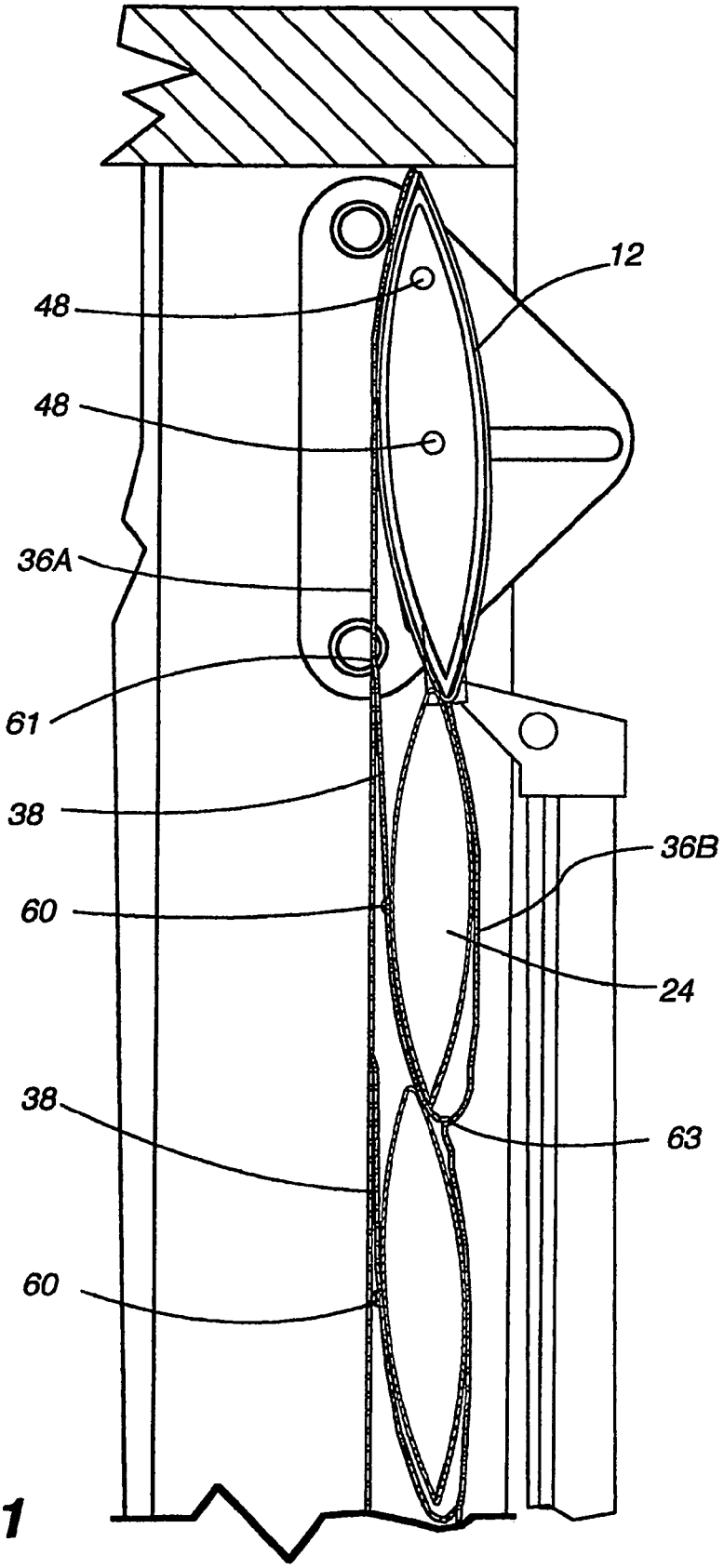
FIG. 31 is a fragmentary vertical section of the headrail and a couple of slats depending therefrom in a closed position.
Figure 32:
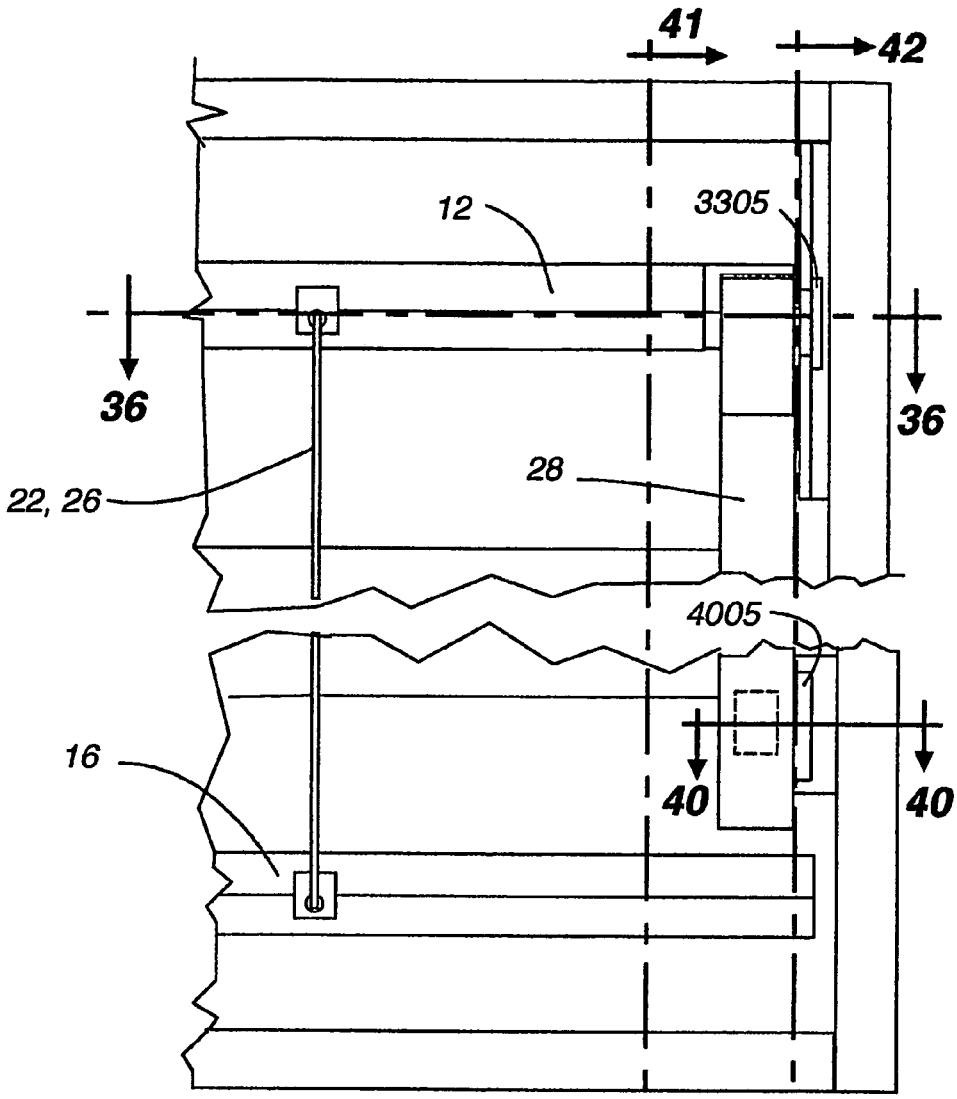
FIG. 32 is a fragmentary front view of the window blind assembly incorporating the alternative mounting bracket and pivoting mechanism.

In the preferred embodiment, a headrail 12 that is wider than the plurality of slats 24 that depend from it is specified to accomplish the same result as the cam-shaped drum of sophisticated prior art tilting mechanisms. One riser cord 36 of each cord ladder 26 is attached to the front edge of the headrail 12 and the other riser cord 36 is attached to rear edge. Referencing FIGS. 30 and 31, when the headrail 12 is tilted from the open horizontal position to a nearly vertical closed position, one riser cord 36A of the cord ladder 26 travels generally upwardly a distance equal to one half the width of the headrail 12, thereby raising the connection point 61 between the riser cord 36 and the first rung cord 38 the same distance. The other riser cord 36B is simultaneously lowered from a distance equal to half the width of the headrail 12. The other connection point 63 is lowered as well; however, since the length of the cross rung cord 38 is less than the difference in travel between the riser cords 36, the portion of the lowered riser cord 36B above the other connection point 63 is completely unloaded and becomes slack. Accordingly, the entire weight of the depending slats 24 is carried by the raised riser cords 36A through the connecting points at glue dots 60 on the cross rungs, such that the lowered riser cords 36B do not impose a countering force through their connections 63 with the corresponding rung cords 38 that can prevent the slats 24 from pivoting as close to vertical as possible.

The ratio of the width of the headrail 12 to the depending slats 24 is also very important. If the headrail 12 is too wide, the depending slats 24 will reach the closed position before the headrail has been pivoted fully, resulting in a non-uniform appearance when the blinds are in the closed position. Furthermore, if the size difference between the headrail 12 and the depending slats 24 is too great, it can be aesthetically displeasing, wherein the size of the headrail detracts from the otherwise uniform appearance of the slats. An optimum headrail width that both best ensures the full closure of the depending slats and does not distract from the aesthetics of the blind assembly has been found to be 10 to 15% larger than the slats 24 that depend from it. At a very minimum, however, the distance between the connection points of the riser cords of a ladder with the headrail 12 must be at least equal to the width of the slats 24 or the distance between the corresponding cross rung connecting points 61 and 63.

Blind Assembly Structure Associated with the Lifting and Lowering of the Slats and the Operation Thereof As previously described, corresponding sets of front and rear lift cords are horizontally spaced on the blind assembly 10. They are fixedly attached to the bottom slat 16 as shown in FIGS. 10–13 and as described in the preceding section. The lift cords 22 are located adjacent and intertwined with the riser cords 36 and woven periodically through the rung cords 38 of cord ladders 26 as shown in FIG. 8. The lift cords 22 pass through openings in the headrail 12 into the hollow interior of the headrail, and as best illustrated in FIG. 9, each of the lift cords 22 is guided around a first set of pulleys 30 located proximate the openings and towards a gathering pulley 32 located at one end of the headrail 12. The gathering pulley 32 is located proximate the location where the top end cap 62 of the actuator bar 28 is pivotally attached to the front longitudinal edge of the headrail. From the gathering pulley 32, the plurality of lift cords 22 passes through another opening in the headrail, and into the slot 66 formed in the tongue 64 of the top cap 62 as shown in FIG. 15. Alternatively, the lift cords pass through a bore in inwardly extending portion 4640 of the headrail end cap inside of the spring 4620 and in the alternative top cap 4650 through an opening at the end of the tubular protrusion 4655. Next, the lift cords 22 pass over a guide rod or pulley 70 or 4685 into an interior channel 84 of the actuator rod 28. Finally, as illustrated in FIG. 23, the lift cords terminate around a tie-off cylinder 88 within a first lift handle member 90.

Figure 21:
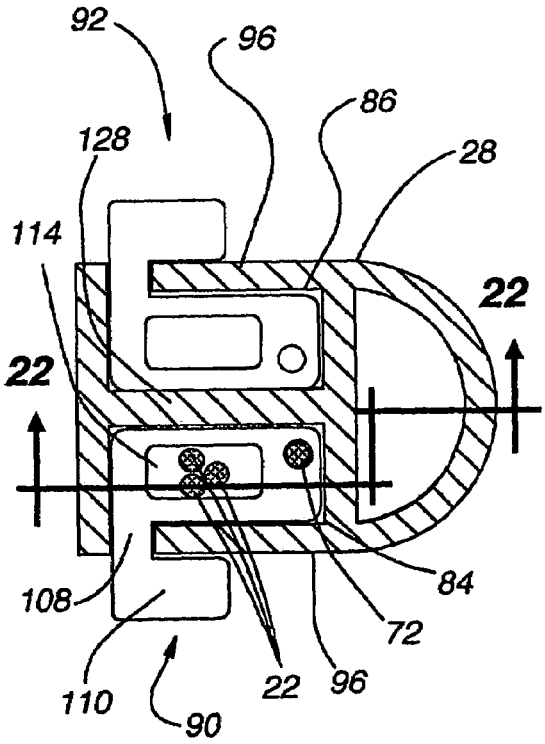
FIG. 21 is a horizontal section of the actuator rod taken along line 21—21 of FIG. 7.

In one embodiment, as shown in FIG. 21, lift handle members 90 and 92 are slidably received in separate and adjacent channels 84 and 86 formed in the actuator rod 28. The channels have opposing vertically orientated slots 94 that extend through respective outer sidewalls 96 of the actuator rod 28, and continue the entire length of the actuator rod. Each of lift handle members 90 and 92 comprises a body member 98, whereas the first lift handle member additionally comprises a locking assembly 100 for both securing the plurality of lift cords 22 to the first handle member 90 and securing the slats 24 in place at a desired vertical position.

Figure 22:
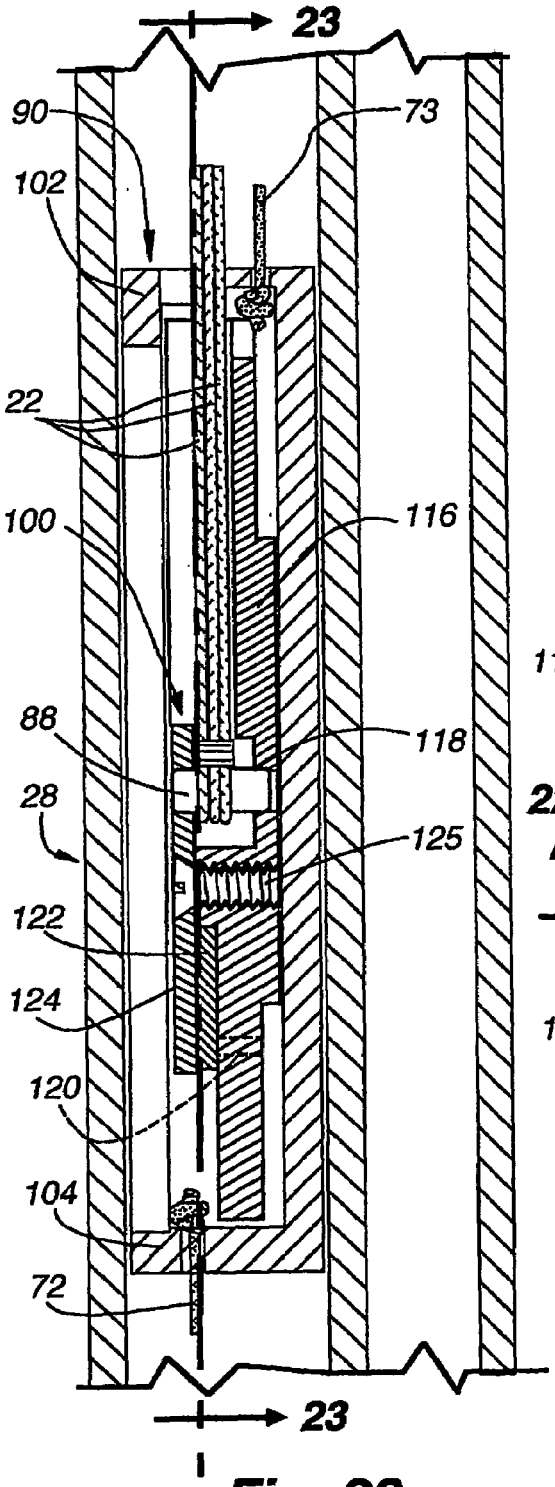
FIG. 22 is a fragmentary vertical section of the actuator rod taken along line 22—22 of FIG. 21 illustrating a handle member including the lock assembly.
Figure 23:
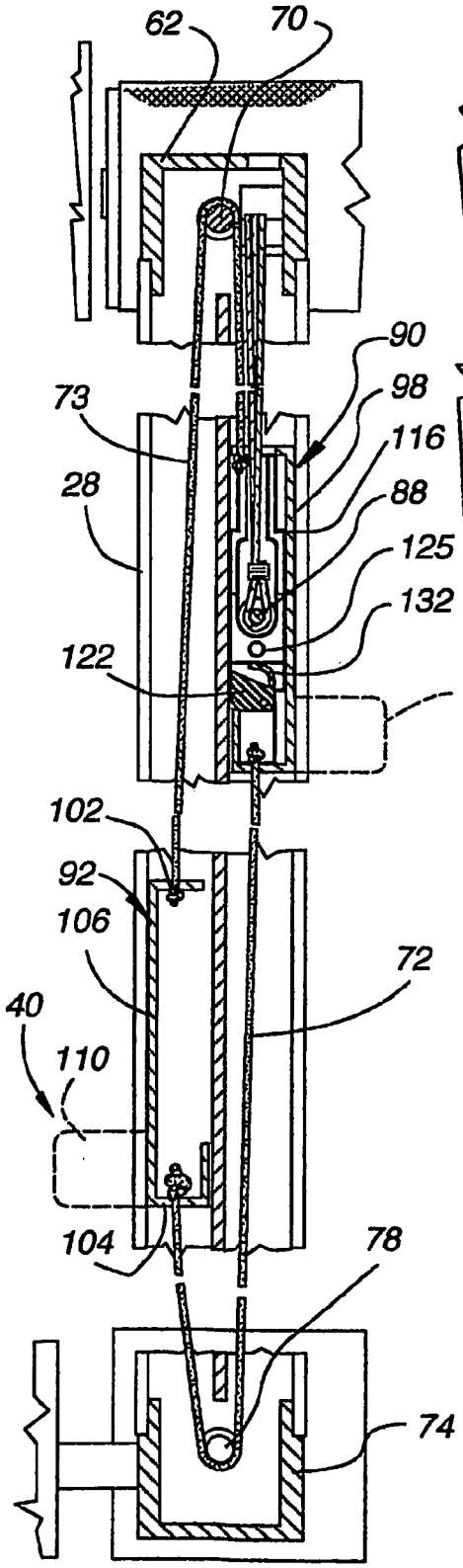
FIG. 23 is a vertical section of the actuator rod taken along line 23—23 of FIG. 22 illustrating both handle members and their interconnection via two connector cords.

As illustrated in FIGS. 21–23, the body member 98 includes top and bottom walls 102 and 104 that have a length and a width that are slightly smaller than the length and width of the channel 84 or 86 in which the body member 98 is received. The top and bottom walls 102 and 104 include knotholes 106 passing through them for receiving and securing the knotted end of a connection cord 72 or 73. The top and bottom walls 102 and 104 are connected by at least one sidewall 106. A protrusion 108 extends perpendicularly from the sidewall 106 of each of the body members and through the aforementioned slots in the actuator rod center sidewalls and is configured to provide finger holds 110 that may be used to slide the lift handle members 90 and 92 up and down. Finally, each body member 98 includes a partial sidewall 112 opposite the sidewall 106, wherein the partial sidewall 112 extends upwardly from the bottom wall 104 approximately ⅕ the length of the body member 98. The body member 98 of the first handle member (or first body member) further includes an opening 114 in the top wall 102 through which the plurality of lift cords 22 may pass.

Each of the body members 98 are contained within their respective actuator rod channels 84 and 86 as illustrated in FIGS. 21 and 23. A first connection cord 92 is secured in the knothole 106 in the bottom wall 104 of the first body member 98, wherein it passes downwardly in one channel 84 and over a pulley 78 located in the bottom end cap 74. Next, the first connection cord 92 passes upwardly through the other channel 86, wherein it is secured in the knothole 106 in the bottom wall 104 of the other body member 98. A second connection cord 73 is secured in the knothole 106 in the top wall 102 of the first body member 98, wherein it passes upwardly in the channel 84 and over a connector cord pulley 70 located in the top end cap 62. Next, the second connection cord 73 passes downwardly through the other channel 86, wherein it is secured in a knothole 106 in the top wall 102 of the other body member 98. Operatively, an interconnected loop is created such that sliding one handle member in one direction via the associated finger hold causes the other handle member to move in the opposite direction. Advantageously, a person of short stature can generally reach at least one of the handle members of a mounted blind assembly to lift or lower the slats regardless of the initial position of the slats.

A lock assembly 100 of the first handle member 90 is best illustrated in FIGS. 22–26. The lock assembly 100 comprises an elongated base member 116 that has a length that is at least a measurable distance shorter than the distance between the lower surface of the top wall and the upper surface of the bottom wall of the body member for reasons that will become apparent below. The base member 116 is received in the first body member 98 between the top and bottom walls 102 and 104, wherein the base member 116 has a width only slightly less than the distance between the body member sidewall 106 and the opposite partial sidewall 112. The base member 116 includes therein a horizontal bore 118 and a cutaway proximate the horizontal bore 118. The horizontal bore 118 is sized to receive one end of the tie-off cylinder 88 around which the looped or knotted ends of the lift cords 22 are terminated. The base member 116 further includes (i) a horizontal pivot pin bore 120 sized to receive the pivot pin of a wedge cam 122, and (ii) a threaded hole 125 for receiving a machine screw located between the two bores. Once the tie-off cylinder 88 and the pivot pin with the wedge cam 122 pivotally attached thereto are placed in there respective bores in the base member 116, a securing plate 124 is placed over the ends of the cylinder and the pivot pin and fastened to the base member 116 by a screw that passes through a hole in the securing plate 124 and is threaded into the threaded hole 125 of the base member 116.

Figure 25:
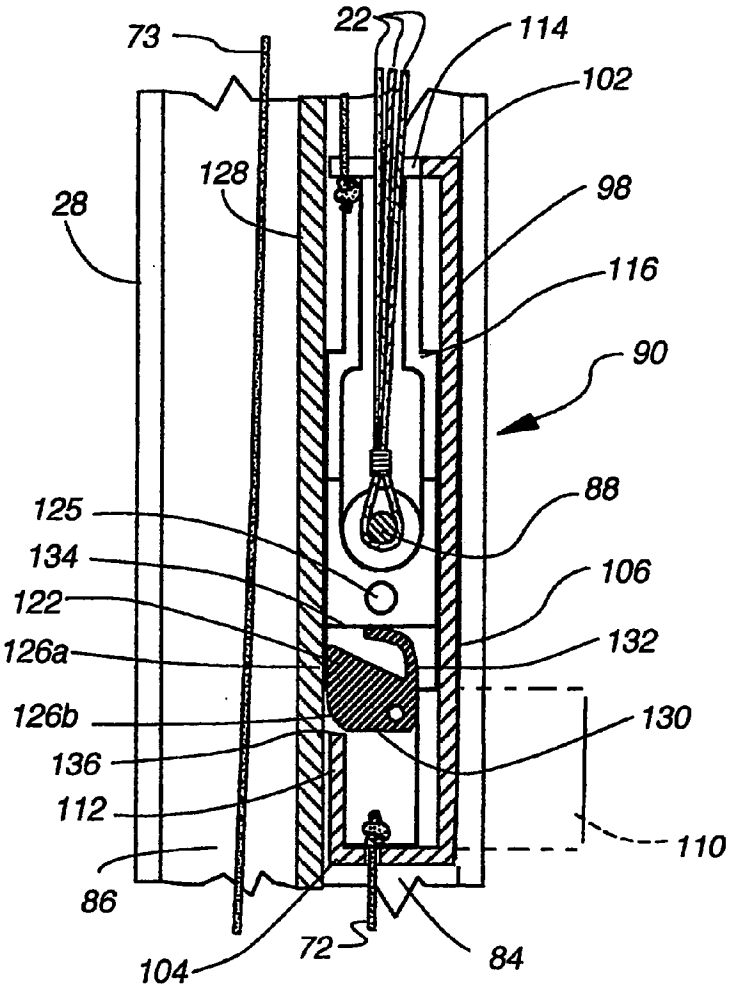
FIG. 25 is an enlarged vertical section of one handle member and the associated lock assembly when at rest in its normal position.
Figure 26:
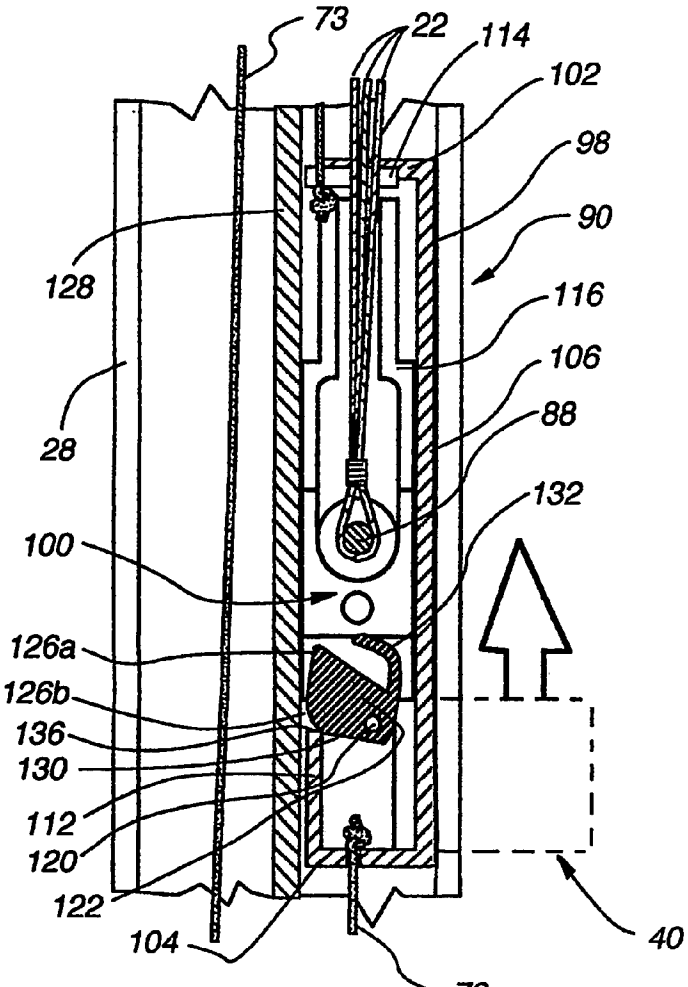
FIG. 26 is an enlarged vertical section of one handle member and the associated lock assembly similar to the section of FIG. 25 illustrating the handle member and lock assembly when the slats of the blind assembly are being lowered.

The wedge cam 122 is best illustrated in FIGS. 25 and 26. The wedge cam includes an engagement edge 126 that has an upper section 126*a* and a lower section 126*b*. The upper section 126*a* is generally parallel to and normally biased against an inner sidewall 128 of the associated actuator rod channel 84 that is adjacent the partial sidewall 112 of the first body member 98. The lower section 126*b* is arcuate and curves away from the actuator rod sidewall 128 until terminating at an intersection with a bottom edge 130 of the wedge cam 122. The wedge cam 122 further includes an arcuate spring arm 132 that extends upwardly from the body of the wedge cam 122 and is restrained by a horizontal surface 134 of the base member 116, thereby biasing the upper engagement edge 126*a* against the inner sidewall 128 of the channel 84. In a preferred embodiment, the wedge cam 122 is fabricated from a polyurethane material that has good dimensional properties but also provides for a high coefficient of friction between the engagement surface 126 of the wedge cam 122 and the inner sidewall 128.

Operatively, to lift and retract the slats 24 of the blind assembly 10 from the position illustrated in FIG. 4 to the position illustrated in FIG. 5, a user would either pull down on the finger holds 110 of the first handle member 90 or lift the finger holds 110 of the other handle member 92. As the slats are lifted, the first handle member 90 in which the wedge cam 122 resides travels downwardly in its actuator rod channel 84. Since the wedge cam 122 is designed only to prevent unwanted upward movement of the first handle member 90, it does not hinder the downward motion of the first handle member 90. In fact, the downward movement of the first handle member 90 relative to the actuator rod channel sidewall 128 acts to rotate the upper section 126*a* of the engagement edge clockwise away from the sidewall 128 of the actuator rod channel (as seen in FIG. 26).

Once the slats have been lifted to a desired position and the operator has released the finger holds 110 of the handle members, the force of gravity acting on the bottom slat 16 begins to pull the bottom slat downwardly and apply tension to the lift cords 22. This tension causes the first handle member 90 to be pulled in an upward direction in its channel 84. Once the first handle member is pulled upwardly a very slight distance, the wedge cam 122 rotates counterclockwise encouraged by the bias of the spring arm 132 and the friction between the channel inner sidewall 128 and the engagement edge 126*a* of the cam. The upper section of the engagement edge 126*a* is wedged downwardly into and against the inner sidewall 128 of the channel, thereby holding the first handle member 90 and the slats coupled thereto in the desired vertical position.

Normally, the lower surface of the top wall 102 of the body member 98 rests upon the top edge of the lock assembly base member 116 as shown in FIG. 25, thereby creating a small gap between the upper surface of the body member's bottom wall 104 and the bottom edge of the base member 116. Furthermore, a small gap is created between the bottom edge of the cam 122 and the top edge 136 of the partial sidewall 112. This small gap provides the cam wedge 122 sufficient room to rotate into the channel sidewall 128 and secure the lock assembly 100 and the slats vertically in place. When a user moves either of the finger holds 110 in the proper direction to lower the slats, the first body member 98 travels upwardly until the gap between the bottom edge of the base member 116 and the upper surface of the bottom wall 104 is eliminated, and more importantly, the top edge 136 of the partial sidewall 112 impacts the bottom edge 130 of the wedge cam 122, moving and rotating the upper section 126*a* of the engagement edge 126 upwardly, thereby freeing the first handle member 90 to move upwardly. As long as the partial sidewall 112 is pushing the upper section 126*a* of the engagement surface 126 away from the inner sidewall 128 of the channel 84, the slats 24 may be lowered, aided by the force of gravity caused in part by the weight of the bottom slat 16. Once the user lets go of the finger holds 110, the body member 98 will return to its normal position, providing enough distance between the bottom of the cam wedge 122 and the top edge 136 of the partial sidewall 112 to permit the cam's engagement surface 126 to move into and against the inner sidewall 128 as described above, thereby locking the slats in position.

It is understood that the handle members and the structure associated therewith is merely illustrative. Other methods and structure may be utilized to provide the advantages of the described handle member and actuator rod assembly. For instance, the means of connecting the lift cords to the handle member may vary. By way of example, the cords could be passed through one or more holes in the base member and knotted to secure them in place. In addition, in other variations, other means may be utilized to lock the handle member in place on or in the actuator bar with or without the use of a pivoting cam. In yet other variations, the second handle member may be eliminated.

Figure 24:
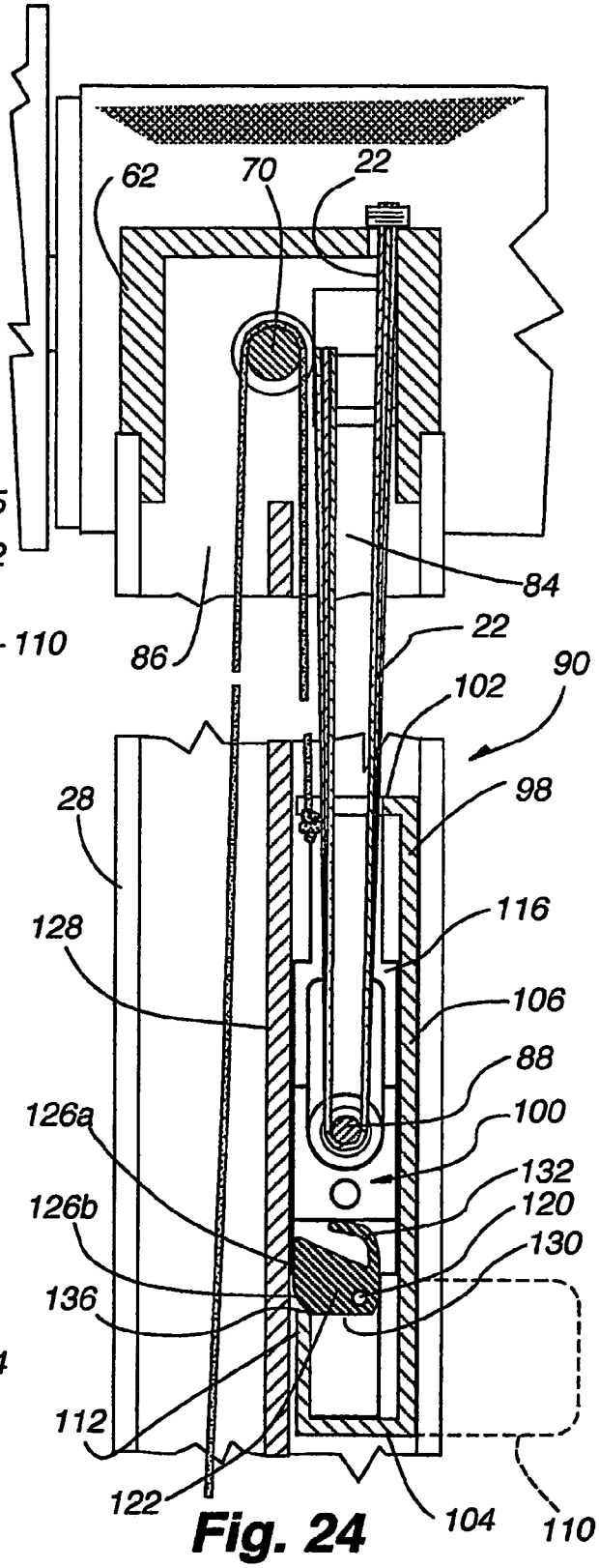
FIG. 24 is an enlarged vertical section similar to the section of FIG. 23, wherein the lift cords are looped around a cylindrical member on the lock assembly and secured to a top cap of the actuator bar according an alternative embodiment of the blind assembly.

A first alternative embodiment of the lift mechanism is illustrated in FIG. 24, wherein the plurality of downwardly extending lift cords 18 are looped around the cylinder 88, which may be replaced with a pulley, passed upwardly through the channel 84, and fixed to the top cap 62. This arrangement gives the operator of the handle members a 2:1 mechanical advantage, wherein a 1-inch vertical movement of the handle member results in a 2-inch movement of the bottom slat.

Figure 93:
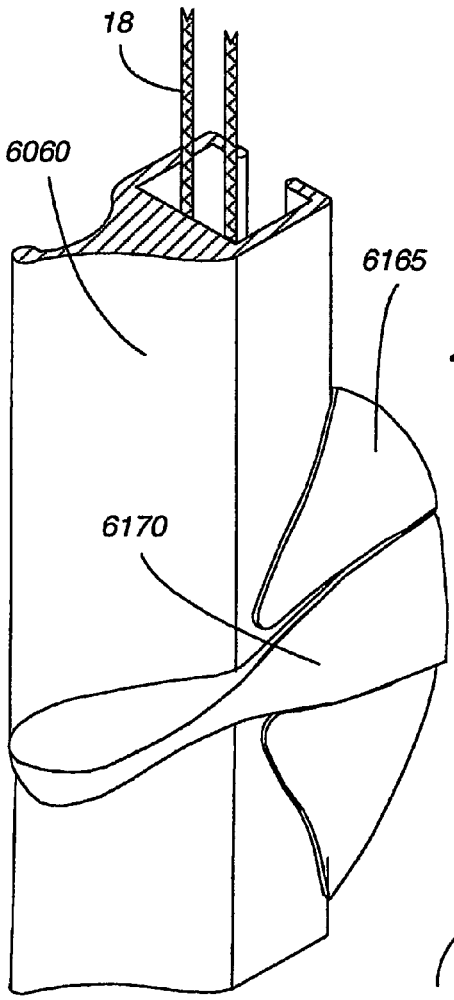
FIG. 93 is an isometric view illustrating the second alternative lift mechanism on a portion of an alternative actuator rod.
Figure 94:
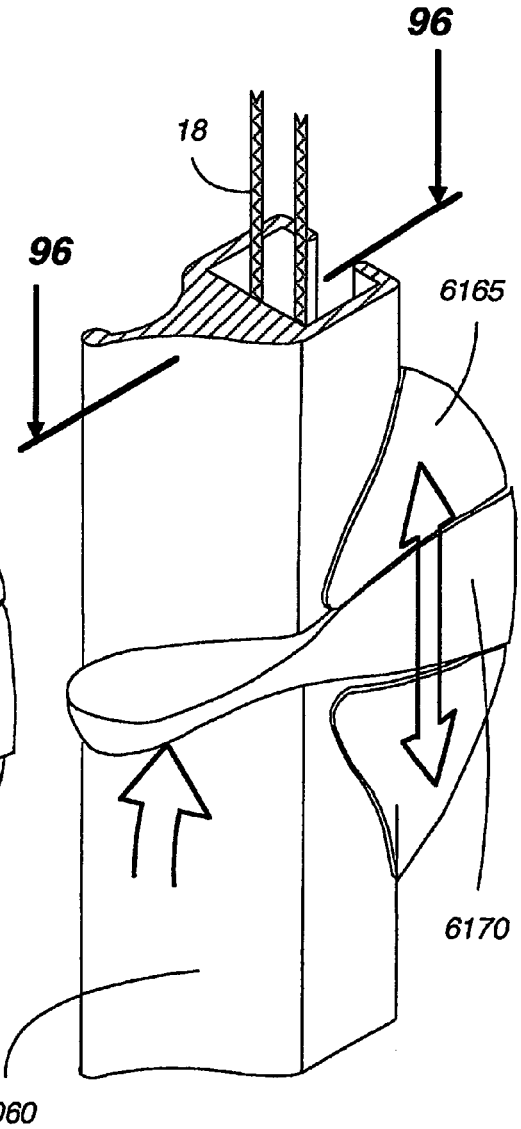
FIG. 94 is an isometric similar to FIG. 93 showing the directions a user must move the lock release lever to move the lift mechanism upwardly or downwardly.
Figure 95:
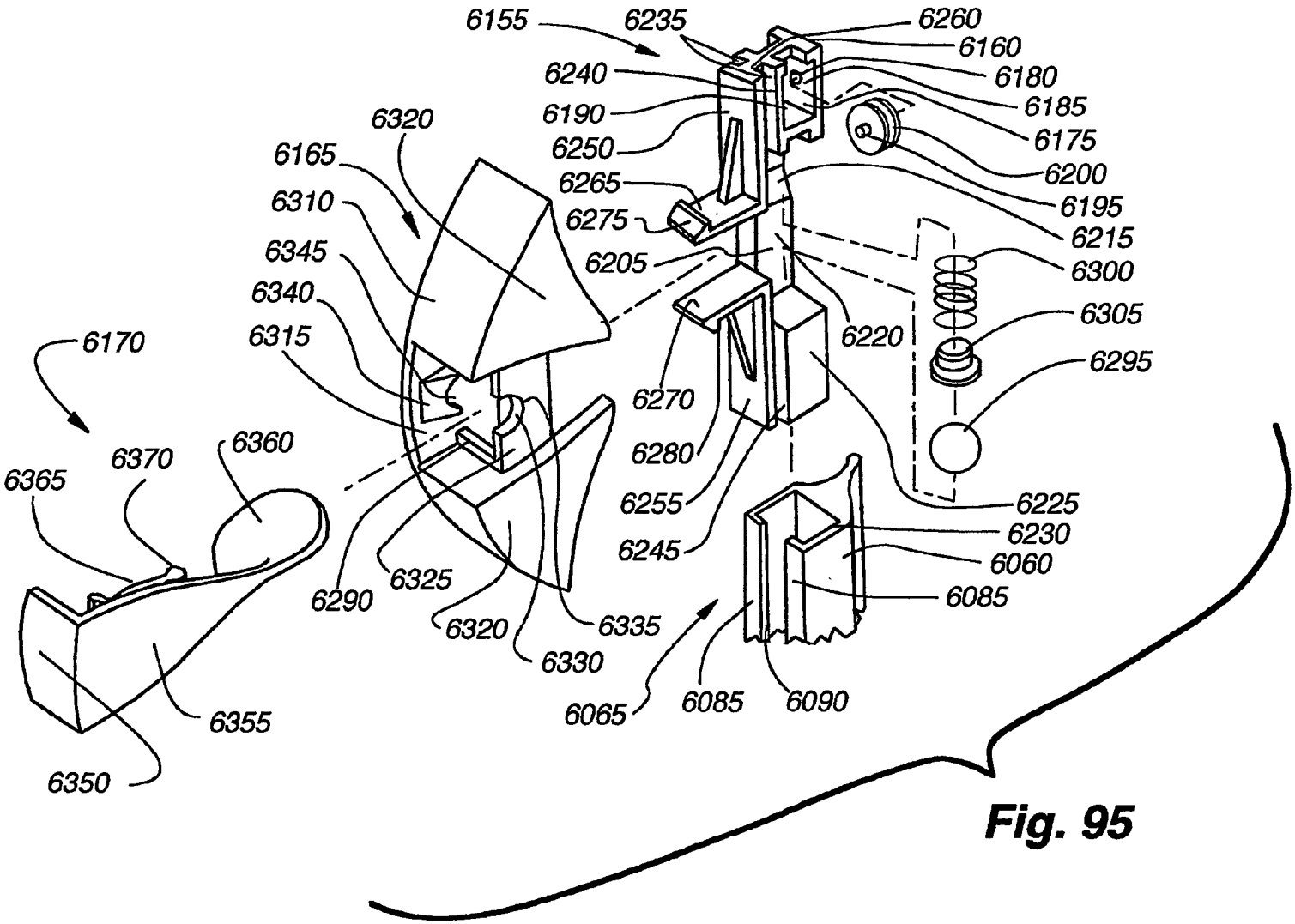
FIG. 95 is an exploded isometric view of the lift mechanism.
Figure 96:
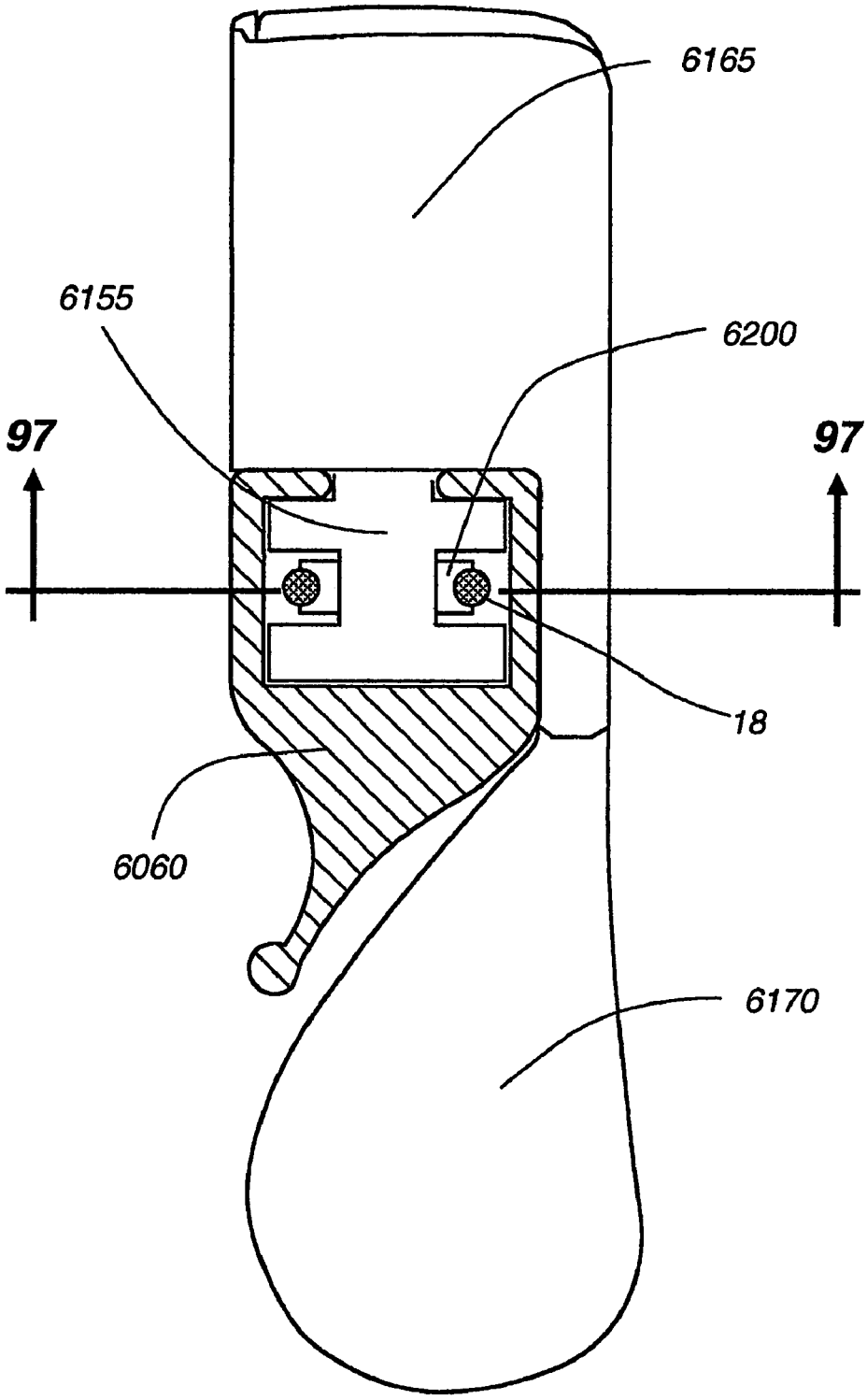
FIG. 96 is a top view of the lift mechanism taken along line 96—96 of FIG. 94.

A second alternative embodiment of the lift mechanism 6150 is illustrated in FIGS. 93–102. As shown in FIGS. 93 and 96, the lift mechanism is slidably received in the interior channel 6065 of the extruded alternative actuator bar 6060 through the longitudinally extending slot 6090. Referring primarily to the exploded view provided in FIG. 95, the major components of the second alternative embodiment lift mechanism comprise (i) a locking mechanism 6155 including a lift mechanism main body 6160, (ii) an arcuate finger hold 6165, and (iii) a lock release lever 6170.

Figure 102:
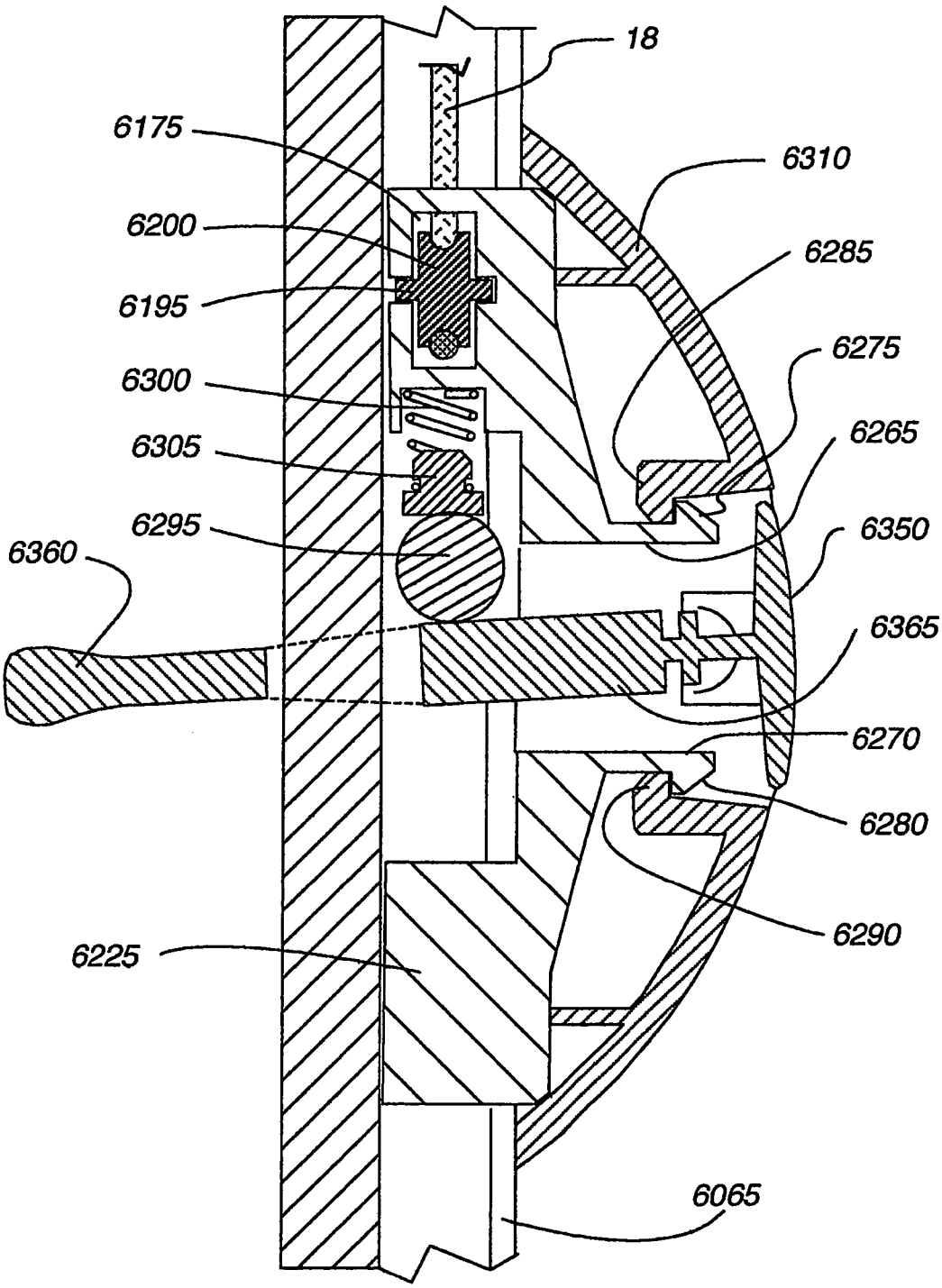
FIG. 102 is a cross sectional side view of the lift mechanism taken along line 102—102 of FIG. 97.

As best shown in FIG. 95, a pulley cavity 6175 is formed near the top end of the second alternative lift mechanism's main body 6160. Two small aligned horizontal bores 6180, as best seen in FIG. 102, extend into the pulley cavity from the respective front and rear walls 6185 and 6190 thereof. A pulley pin 6195 that passes through a center of a lift cord pulley 6200 is received in the bores and the lift cord pulley is accordingly rotatably retained in the pulley cavity. In a manner similar to that discussed above concerning the first alternative lift mechanism, one or more of the lift cords 18 are looped around the pulley and terminate at a top cap of the alternative actuator bar 6060. A left side wall 6205 (as best shown in FIG. 95) extends downwardly from the pulley cavity adjacent the left side of the actuator channel 6095. An upper portion 6210 of the left wall's inside surface extends vertically downwardly for a short distance until interfacing with a tapered portion 6215 that tapers inwardly to the right at an acute angle. The tapered portion terminates at an intersection with a lower portion 6220 of the left wall that extends vertically downwardly to a bottom portion 6225 of the main housing. Accordingly the horizontal distance between the inside surface of the left side wall and the opposite right wall 6230 of the actuator bar channel 6095 is greater at the upper portion than the lower portion. It is to be appreciated that substantially all of the bottom portion, the left wall and the structure comprising the pulley cavity are contained within the channel 6095 of the actuator bar for slidable movement therein.

Referring back to FIG. 95, vertically-extending slots 6235 are formed between the rear surface of the rear side wall 6240 and 6245 of both the pulley cavity structure and the bottom portion and corresponding detent side walls 6250 and 6255. The slots receive the lips 6085 of the alternative actuator bar as the rearwardly-extending interfaces 6260 between the rear side walls and the corresponding upper and lower detent walls are received in the actuator bar slot 6090 between the lips. Accordingly, the detent walls 6250 and 6255 are positioned outside of the actuator bar channel 6065. Upper and lower detent tabs 6265 and 6270 extend rearwardly and generally horizontally from the respective upper and lower detent walls of the main body at vertically spaced locations with the upper detent 6275 facing upwardly and the lower detent 6280 facing downwardly. As best shown in FIG. 102, the detents snapidly connect with corresponding upper and lower ledges 6285 and 6290 formed in the arcuate finger hold 6265 as will be discussed in greater detail below.

Figure 97:
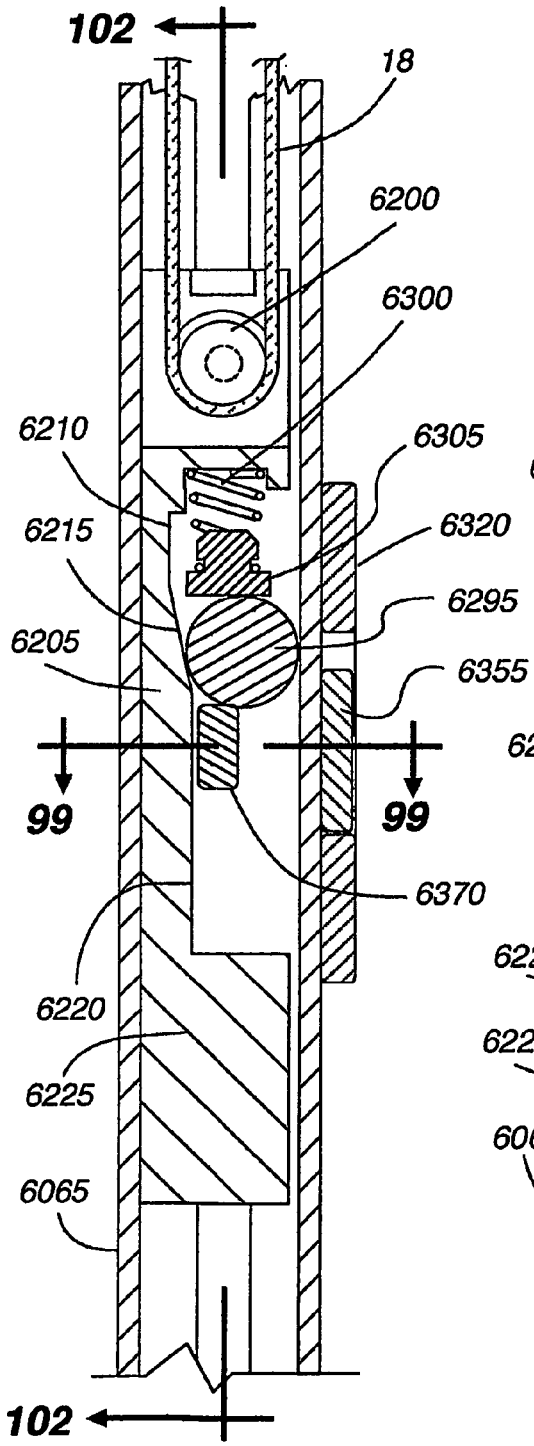
FIG. 97 is a cross sectional side view of the lift mechanism and an associated portion of the actuator rod taken along line 90—90 of FIG. 89 showing the lift mechanism in its locked position.

Still referring to FIG. 95, the locking mechanism further includes a plastic wedge ball 6295, a coil spring 6300, and a spring end cap 6305. As shown in FIG. 97, the ball is biased by the spring acting through the spring end cap into the space between the tapered portion and the right wall of the actuator bar in it normal position. The wedge ball has a diameter that is less than the distance between the upper portion 6210 of the left side wall 6205 and the right side wall 6230 of the actuator channel but greater than the distance between the lower portion 6220 of the left side wall and the right side wall of the actuator channel. Accordingly as an upwardly acting force is applied to the main body 6160 of the lift mechanism by the lift cords 18, the wedge ball is encouraged against the tapered portion and the right wall, thereby wedging the main body in place and preventing it from sliding upwardly in the actuator bar channel 6065. Accordingly, the slats of the blind assembly which are interconnected to the main body via one or more lift cords 18 are held in place.

In combination, the arcuate finger hold 6165 and the lock release lever 6170 are utilized to release the wedge ball 6295 permitting the lift mechanism to be slid upwardly or downwardly for adjusting the height of the slats. Referring generally to FIGS. 93, 94, 95 and 102, the finger hold extends generally rearwardly from the lips 6085 and slot 6090 of the alternative actuator bar 6060. The finger hold has an arcuate longitudinal profile forming a rear curved surface 6310. Further the width of the arcuate finger hold is generally similar to the width of the actuator bar. The left side 6315 of the finger hold (as viewed in FIG. 95) has a substantially vertically-extending straight edge which butts against the outside surface of the left lip of the actuator bar. As can be best seen in FIG. 93, the opposite right side 6320 of the finger hold extends beyond the rear side of the actuator bar and covers a substantial portion of the right wall 6230 of the actuator bar. As shown best in FIG. 95, the curved rear surface and the right side of the finger hold are bifurcated at their longitudinal centers, wherein an opening is provided to receive the lock release lever 6170. A generally rectangular integrally molded plate member 6325 spans the bifurcated right side and includes a rearwardly facing slot 6330 with a semicircle closed end 6335. At a location generally horizontally disposed to the closed end of the slot, a protrusion 6340 rises inwardly from the inside surface of the left side 6315. The protrusion includes a forwardly facing semicircular slot 6345 having a center point that is substantially coincident with the center point of the semicircular closed end of the rearwardly facing opposing slot end. Additionally, both the semicircular closed end and the semicircular slot have substantially similar radii, and are adapted to pivotally connect with the lock release lever as described in detail below. From the upper and lower rear edge of the rectangular member, the aforementioned upper and lower ledges 6285 and 6290 of the arcuate finger hold extend to the left side of the arcuate finger hold and are adapted to snapidly receive the detents 6275 and 6280 of the locking mechanism's main body 6160.

As mentioned above, the lock release lever 6170 is pivotally received in the arcuate finger hold 6165, and by pivotally actuating the lever, the locking mechanism 6155 can be released to allow the associated slats to be raised or lowered. The lever is best described with reference to FIGS. 99–101, 93 and 96. At the rear end, the lock release lever includes a generally vertically extending partially arcuate rear section 6350 that spans the spacing between the upper and lower portions of the arcuate finger hold's rear surface 6310 (as can be best seen in FIG. 99). The rear section intersects with a forwardly extending side section 6355 that spans a substantial portion of the gap between the upper and lower portions of the arcuate finger hold's right side wall 6320 (as can best be seen in FIG. 93). The right section continues forwardly beyond the front edge of the arcuate finger hold forming a finger tip actuator 6360. As can best be seen in FIG. 99, a lever arm 6365 extends forwardly from a location proximate the inside intersection of the rear section and the side section through the actuator rod's slot 6090 terminating within the channel 6095. Referring to FIG. 97, the end 6370 of the lever arm rests beneath the wedge ball 6295. A protrusion 6375 extends leftwardly from the lever arm for pivotal receipt in the semicircular slot 6345 formed on the left wall of the finger hold. Additionally the right side of the lever arm includes a portion 6380 (see FIG. 101) that is formed to be received in the semicircular end 6335 of the slot formed in the rectangular plate member 6325. When the lever is slid into the finger hold, the rectangular member resiliently deforms to allow the lever arm to snap in place in the semicircular slot and slot end. Several degrees of pivotal motion are afforded the lock release lever relative to the finger hold and the main body.

Figure 98:
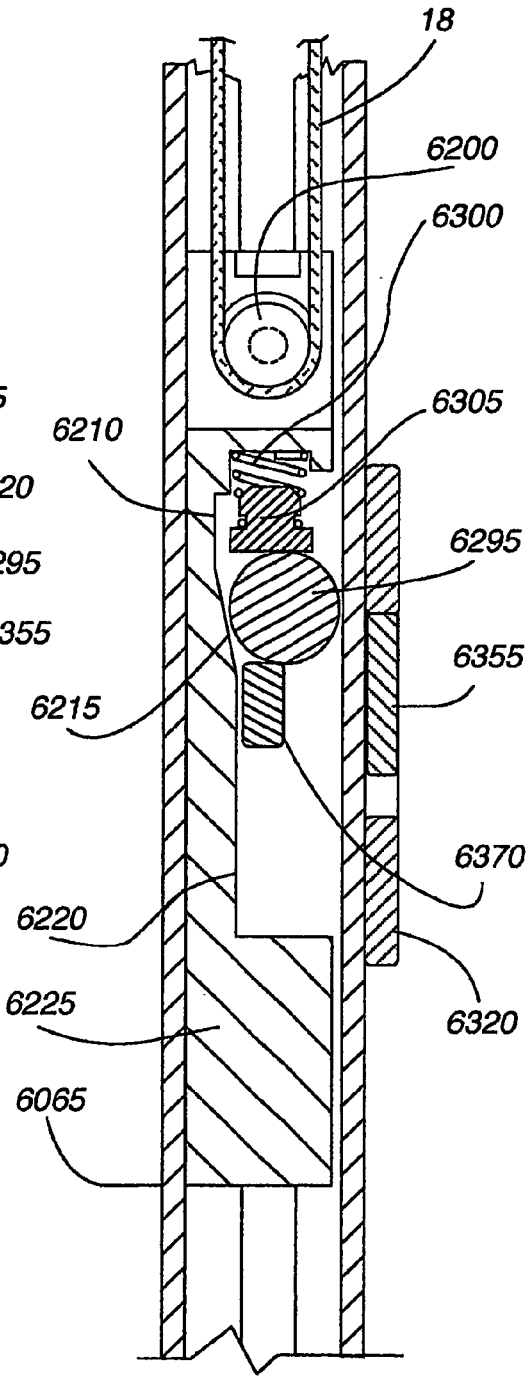
FIG. 98 is a cross sectional view similar to FIG. 90 showing the lift mechanism in its unlocked position.
Figure 99:
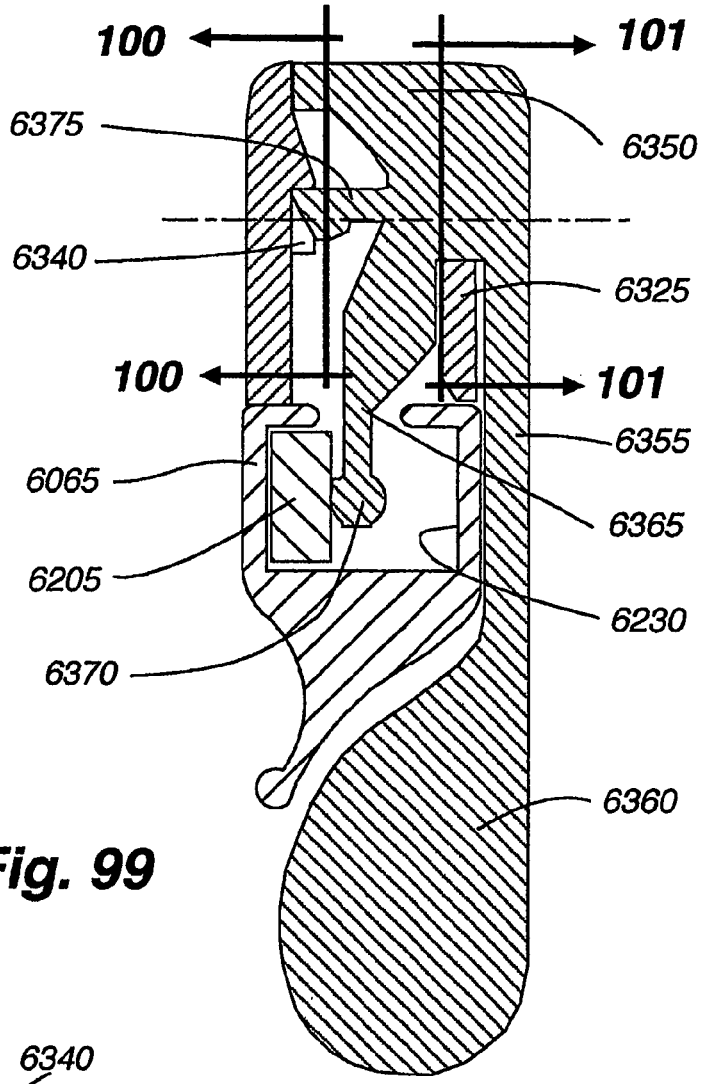
FIG. 99 is a top cross sectional view of the lift mechanism and the actuator rod taken along line 99—99 of FIG. 98.
Figure 100:
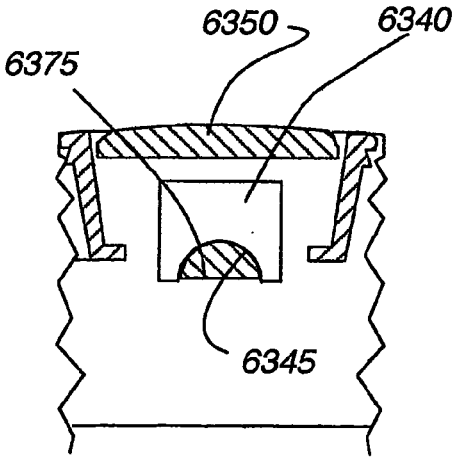
FIG. 100 is a partial cross sectional side view of the lift mechanism taken along line 100—100 of FIG. 99.
Figure 101:
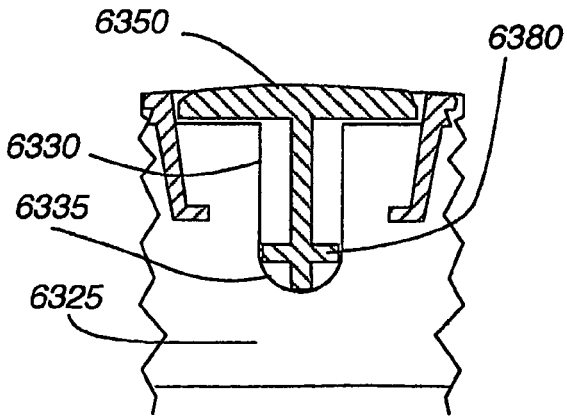
FIG. 101 is a partial cross sectional side view of the lift mechanism taken along line 101—101 of FIG. 99.

Operatively, to lift and retract the slats of a blind assembly with the second alternative lift mechanism 6150, a user would place his/her fingers on the arcuate finger hold 6165, push gently up on the finger tip actuator 6360 and move the arcuate finger hold upwardly or downwardly as indicated in FIG. 94. By pushing the finger tip actuator, the lever arm 6365 is pivoted about the semicircular slot 6345 and slot end 6335 causing its end 6370 that is in contact with the wedge ball 6295 to move upwardly as is shown in FIG. 98. Accordingly, the ball is moved from its wedged position between the left side wall of the main body and the right side wall of the actuator rod to allow the main body to be free to slidably move within the actuator rod channel. Once the finger tip is released the coil spring 6300 urges the wedge ball back into a position where it is wedged between the tapered portion of the left side wall and the right side wall thereby preventing movement of the main body.

An Alternative Embodiment Incorporating Two Tilt Actuator Rods

Figure 27:
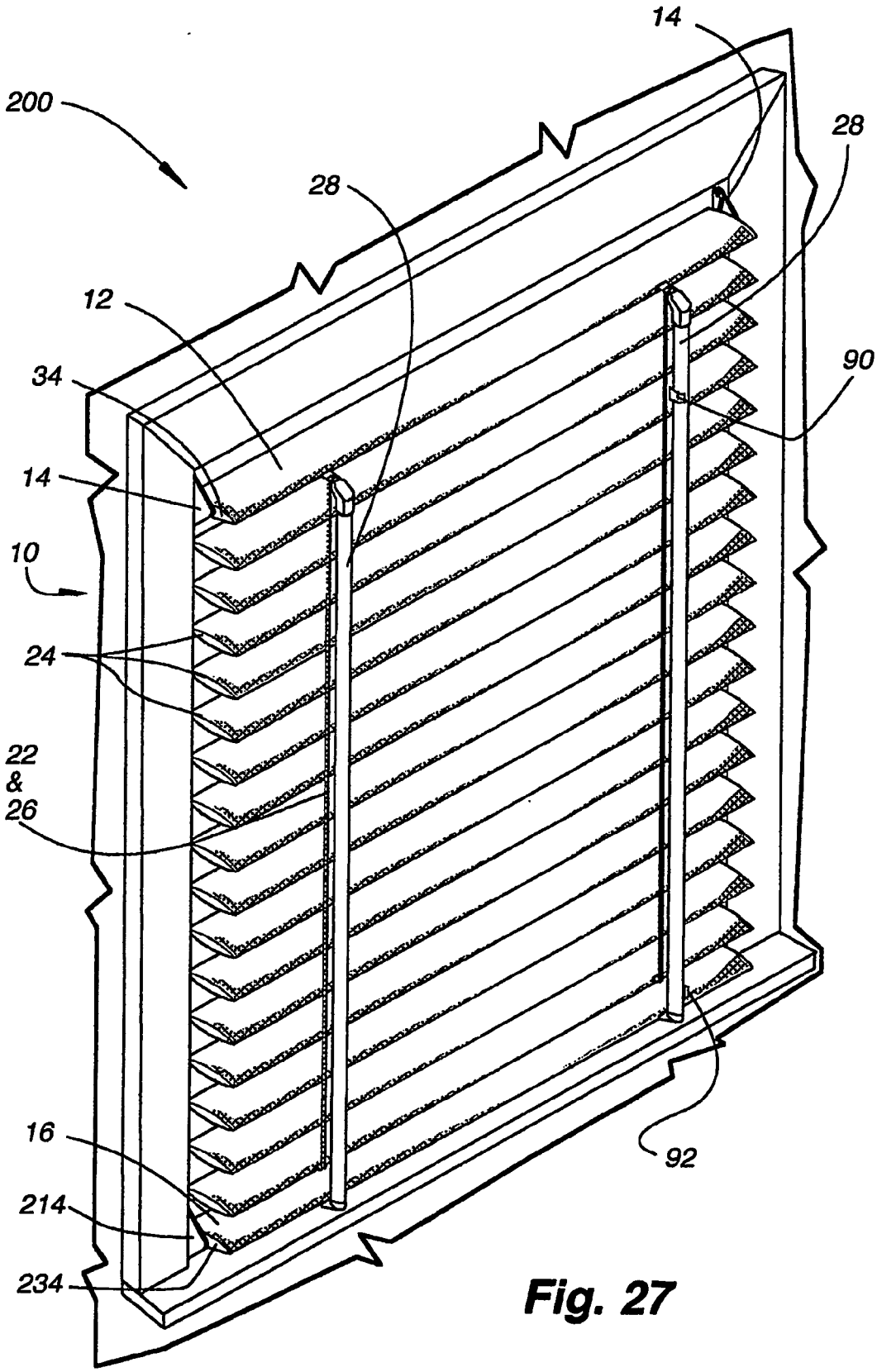
FIG. 27 is an isometric front view of an alternative embodiment blind assembly comprising two actuator rods that are pivotally connected to the bottom slat in an open and extended position.
Figure 28:
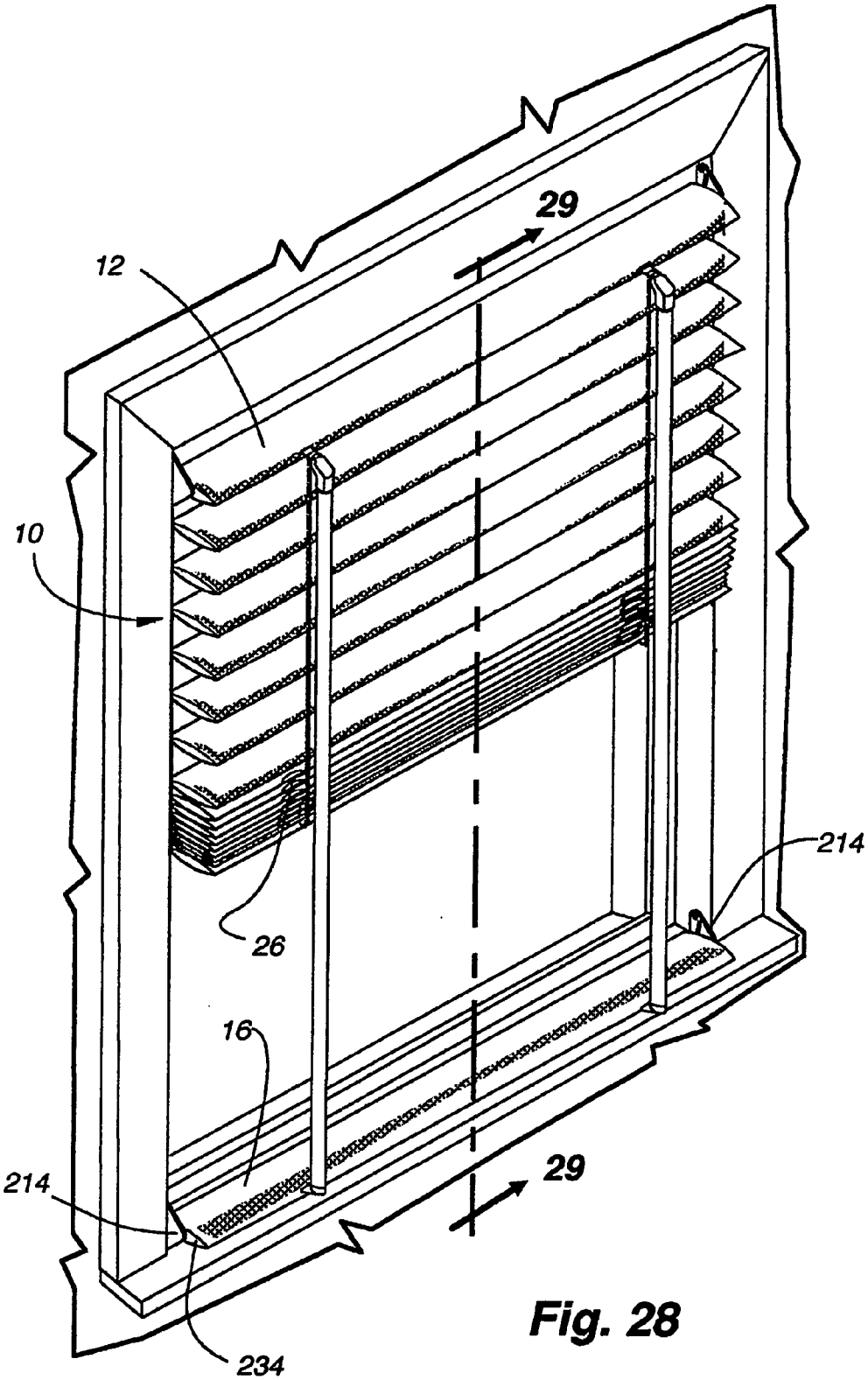
FIG. 28 is an isometric front view of the alternative embodiment blind assembly, wherein the slats are partially raised and retracted.
Figure 29:
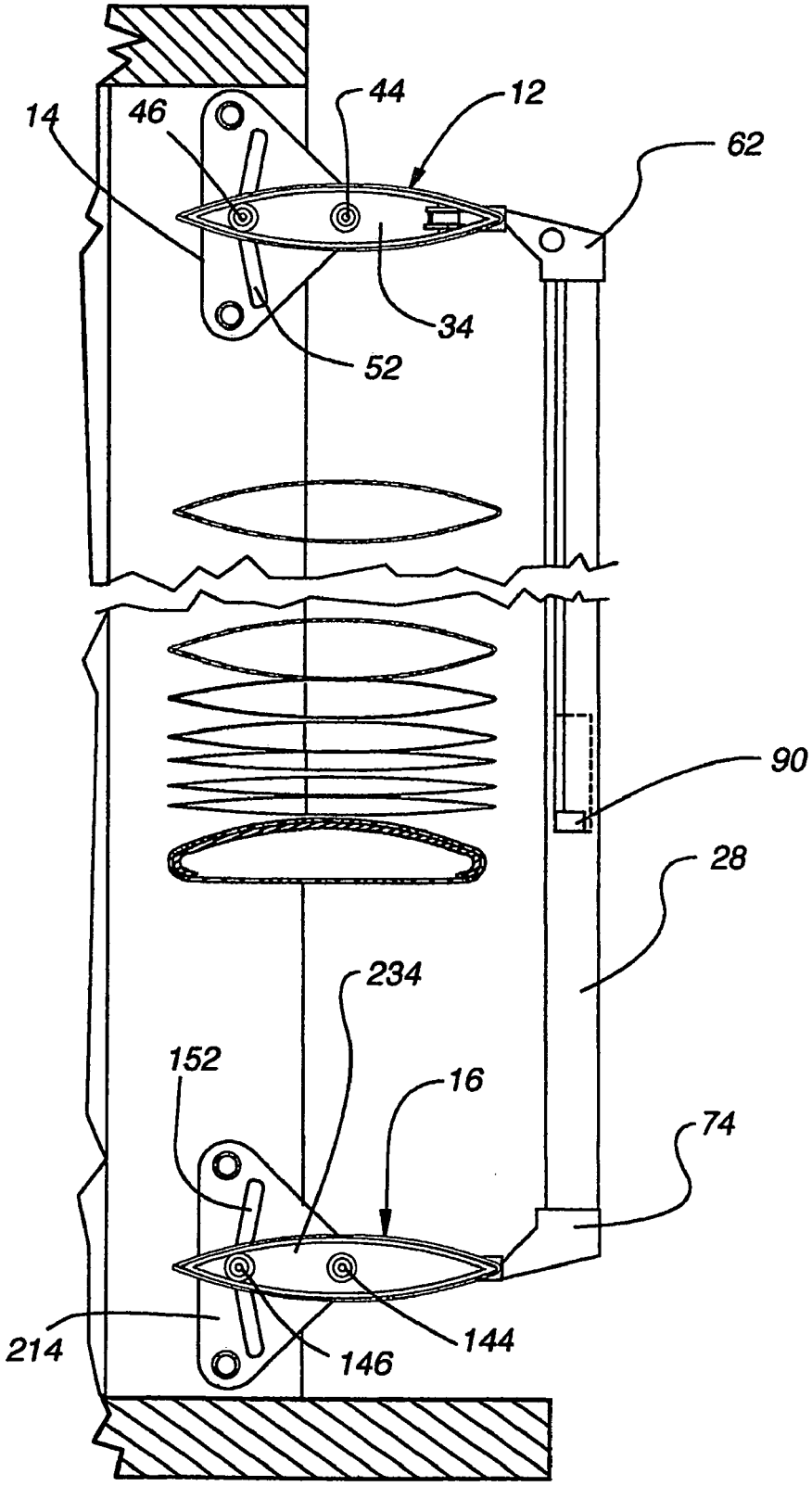
FIG. 29 is a vertical section of the alternative embodiment blind assembly taken along line 29—29 of FIG. 28.

An alternative blind assembly 200 is illustrated in FIGS. 27–29. The assembly comprises a bottom slat 16 having end caps 234 and mounting brackets 214 very similar to those utilized to fix the headrail 12 to the window frame as described above concerning the preferred embodiment. The alternative blind assembly 200 also comprises a pair of actuator rods 28, which are preferably vertically aligned with the cord ladder and lift cords in front thereof. Instead of being connected to a mounting bracket, the bottom end caps 74 of the actuator rods are pivotally attached to the front edges of the bottom slat 16. The lift cords are affixed to the bottom slat and extend upwardly into the headrail 12 as previously described. From there the lift cords are routed out of the interior of the headrail and into one of the actuator rods 28, where they are threaded into a channel of the actuator rod and terminate at a handle member 96 assembly similar to the one described above. Operationally, either actuator rod 28 may be used to tilt the shades up or down in much the same manner as described above, and the slats may be lifted or lowered using the handle member(s) in the same manner as described above, it being recognized that the bottom slat remains in position as the remaining slats are stacked vertically immediately beneath the headrail or distributed between the top and bottom slats.

An Alternative Embodiment Incorporating a Balanced Tilt Mechanism

A balanced tilt mechanism and a blind assembly incorporating the balanced tilt mechanism are described with reference to FIGS. 103–126. In a typical balanced tilt mechanism of the alternative embodiment, a weight hanging off the end of a tilt actuator cord applying a downwardly biasing force is balanced against a spring located within the headrail that applies a contravening upwardly biasing force to the tilt actuating cord. The cord is wrapped around a bobbin that is operatively coupled to a headrail through one or more gears to permit the pivoting of the headrail about rotational shafts associated with mounting brackets. Operationally, the balance is upset by gently pushing or pulling up or down on the tilt actuator cord, thereby causing the cord to retract or extend and the head rail to tilt accordingly. It is to be appreciated that because the mechanism is balanced very little effort is required to tilt the blinds.

Referring to FIGS. 103–108, one alternative embodiment of a blind assembly 5100 incorporating the balanced tilt mechanism is illustrated. The blind assembly 5100 comprises: (i) a horizontally-extending slat-shaped rigid head rail 5105 that is pivotally coupled to a window frame 5110 by a pair of mounting brackets 5115; (ii) a horizontally-extending somewhat rigid lower slat 5120 coupled to the top slat by a plurality of lift cords (not shown) and ladder tapes 5125; (iii) a plurality of horizontal slats 5130 disposed between the head rail and the lower slat and supported by the ladder tapes; (iv) a lift actuator cord 5135 for lifting and lowering the slats; and (v) a tilt actuator cord 5140 including a weighted end tassel 5145.

The illustrated blind assembly utilizes somewhat airfoil-shaped hollow slats, bottom slat and head rail. Alternative configuration blind assemblies using the balanced tilt mechanism are anticipated as the slats can be in any suitable shape and fabricated from any suitable material. For instance, slats fabricated from plastic, fabric, metal and wood are contemplated. Further, the head rail can be of any number of shape configurations that are similar to or different from the associated slats.

An exemplary lift cord locking mechanism 5350 for securing the lift cords 5355 and the slats 5130 in place is illustrated in FIGS. 122–126. Alternatively, the other conventional types of lift mechanisms and locking mechanisms can be utilized as would be obvious to one of ordinary skill in the art. Further, lift and locking mechanisms similar to the ones described in detail above may be modified as necessary for use in conjunction with a blind assembly that incorporates a balanced tilt mechanism.

Figure 117:
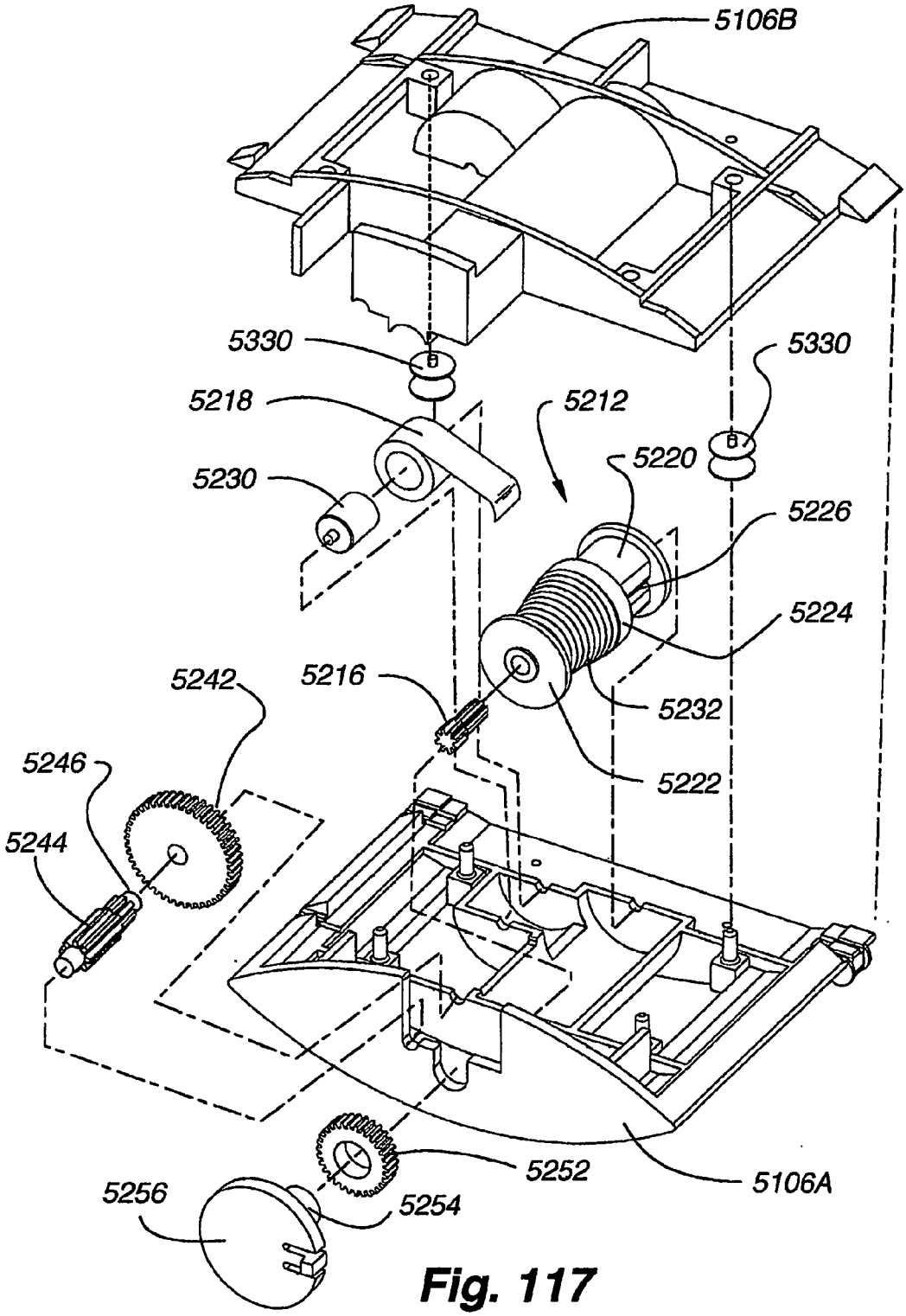
FIG. 117 is an exploded isometric view of the balanced tilt mechanism illustrating in detail the various components comprising the tilt mechanism including the end cap.
Figure 122:
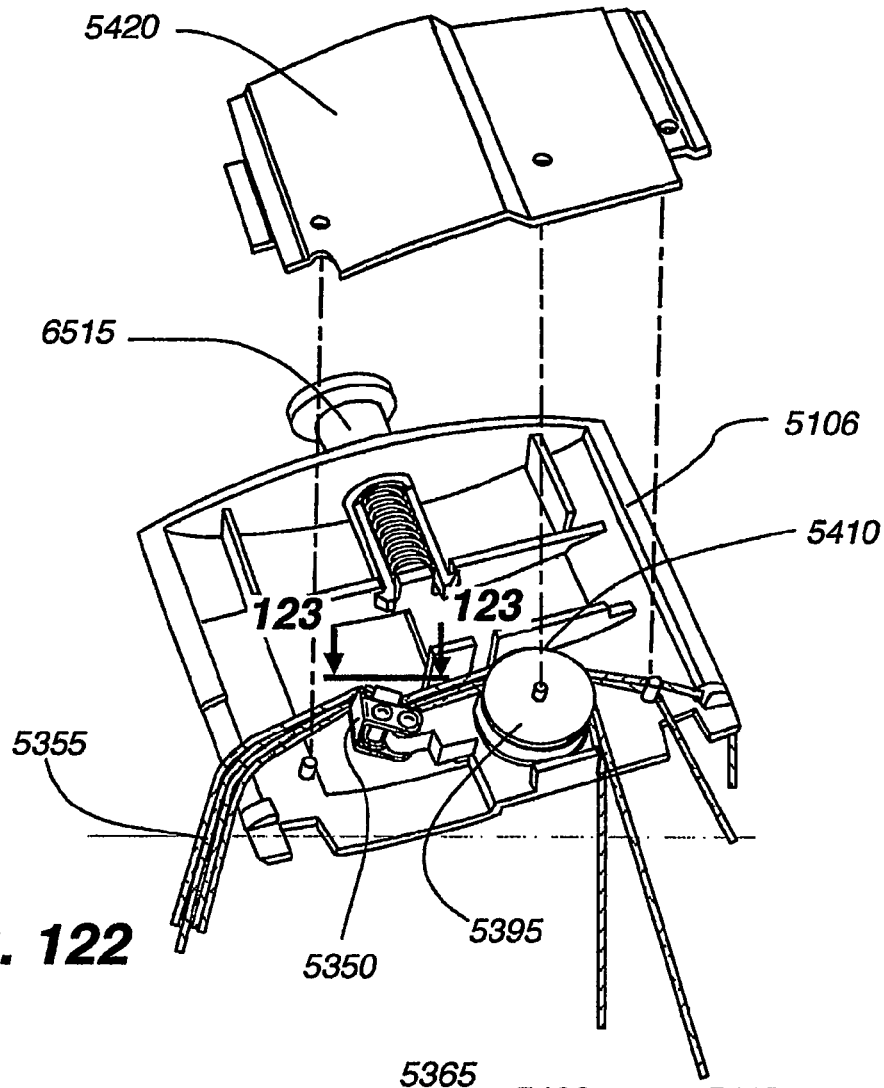
FIG. 122 is an isometric top view of a headrail end cap incorporating a tilt cord locking mechanism.

Referring to FIG. 122, the lift cord locking mechanism 5350 is contained within a headrail end cap. The headrail end cap 5106 is typically fabricated from a molded plastic and is adapted to be slid at least partially into the ends of a typically extruded rigid tubular longitudinally-extending headrail section 5108. The headrail end caps can be of various configurations. For instance, the one illustrated in FIG. 122 is adapted to contain only the lift locking mechanism, whereas the headrail end cap illustrated in FIG. 117 is adapted to contain the balanced tilt mechanism. Furthermore, end caps configured to contain both the balanced tilt mechanism and the lift cord locking mechanism are contemplated. Referring back to the end cap illustrated in FIG. 122, it is appreciated that the end cap is adapted for interfacing with a mounting bracket similar to the second alternative mounting bracket 6505 described in detail above and includes a flanged cylindrical member 6515 that is slidably attached to the end cap. It is appreciated that other types of mounting bracket systems may be utilized. Because the illustrated end cap also forms part of the length of the headrail, a cover 5420 is provided to hide the locking mechanism from view and act to hold and retain the components of the locking mechanism in place.

Figure 123:
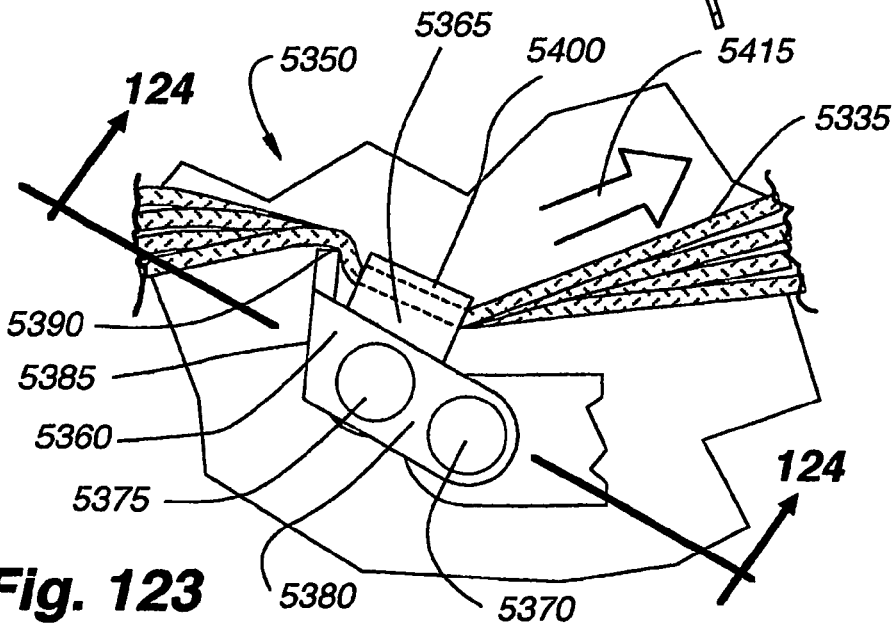
Figure 124:
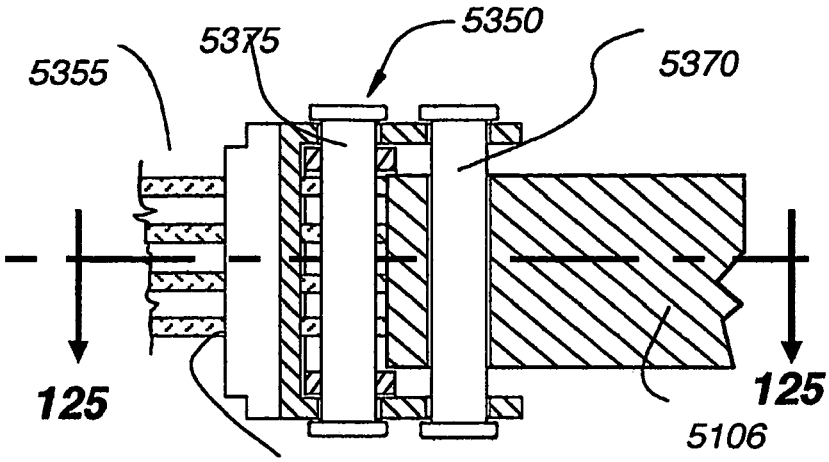

Referring to FIGS. 123–126, the locking mechanism comprises (i) a first U-shaped cord lock member 5360 that is pivotally connected to the end cap via a first pivot pin 5370, (ii) a second U-shaped cord lock member 5365 that is pivotally connected to the legs 5380 of the first U-shaped member via a second pivot pin 5375. A portion of the first U-shaped member extends beyond the base 5385 of the "U", forming a cord contact edge 5390. The lift cords 5355 pass into the headrail 5105 and are directed to and around a horizontally-pivotal pulley 5395 located laterally of the locking mechanism. The cords are then threaded through the second U-shaped member, passing against the interior surface of the base 5400 of the "U". Next, the cords pass over the cord contact edge of the first U-shaped member before exiting the end cap and terminating at a tassel 5405. As is best indicated in FIGS. 122 and 123, the first U-shaped member pivots generally horizontally about the first pivot pin at a location that is spaced in the headrail's longitudinal direction from the point 5410 on the pulley at which the cords diverge from the pulley as they extend towards the locking mechanism. This spacing is critical to the effective operation of the locking mechanism.

Figure 125:
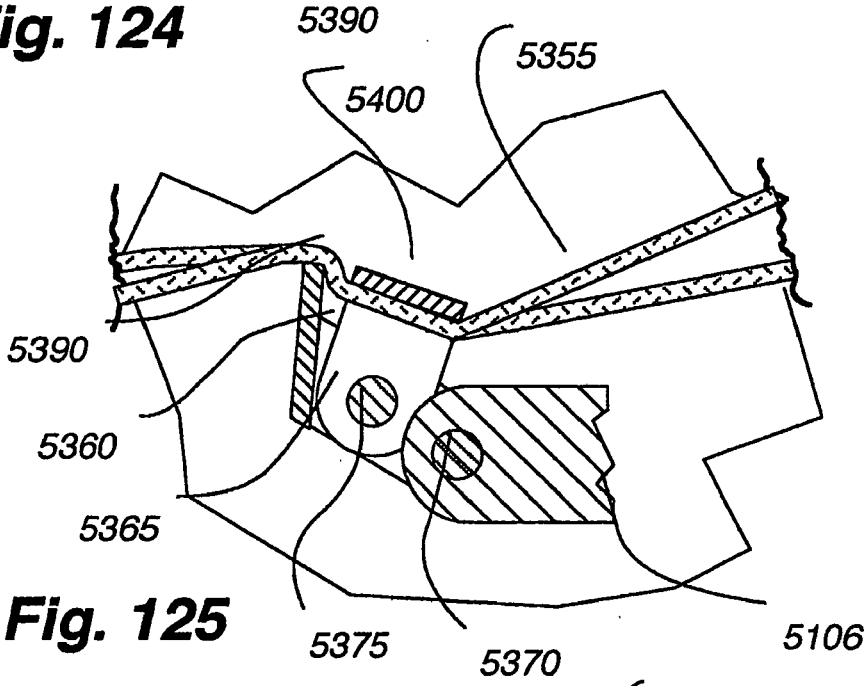
Figure 126:
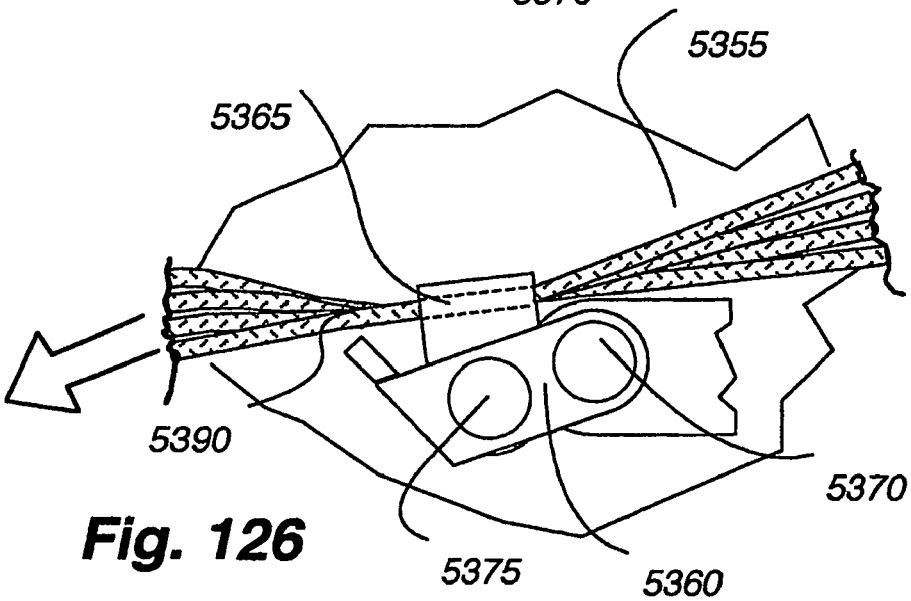

FIGS. 123 and 125 show the locking mechanism 5350 in its normal locked position. The locking mechanism is biased into this position by the weight of the foot rail 5120 and applicable slats 5130 acting through the lift cords 5355. The biasing force applied by this weight is indicated by the arrow 5415 in FIG. 123. As the biasing force attempts to pull the lift cords in the direction of the force, they slide along the inside surface of the base 5400 of the second U-shaped member causing friction. Because of this friction a moment is applied to the pivot location of the first U-shaped member. This moment urges the locking mechanism to pivot clockwise about the first pivot pin 5370 applying a rotational force against the cords along the cord contact edge 5390. As best seen in FIG. 125, the result of these forces acting on the locking mechanisms causes the lift cords to crimp increasing the lift cord friction in the locking mechanism and effectively locking the cord in place. To rise or lower the slats, a user applies enough force to move the lift cords longitudinally-away from the end of the end cap, pivoting the locking mechanism counterclockwise, and causing the cord edge to move off of the lift cords. Accordingly, the lift cords are provided a relatively straight path through the locking mechanism allowing it to be raised and lowered. Once the lift cords are released or are no longer pulled longitudinally away from the end cap's end, the forced applied by the weight of the slats and foot rail causes the locking mechanism to pivot clockwise and relock the lift cords in place.

Figure 103:
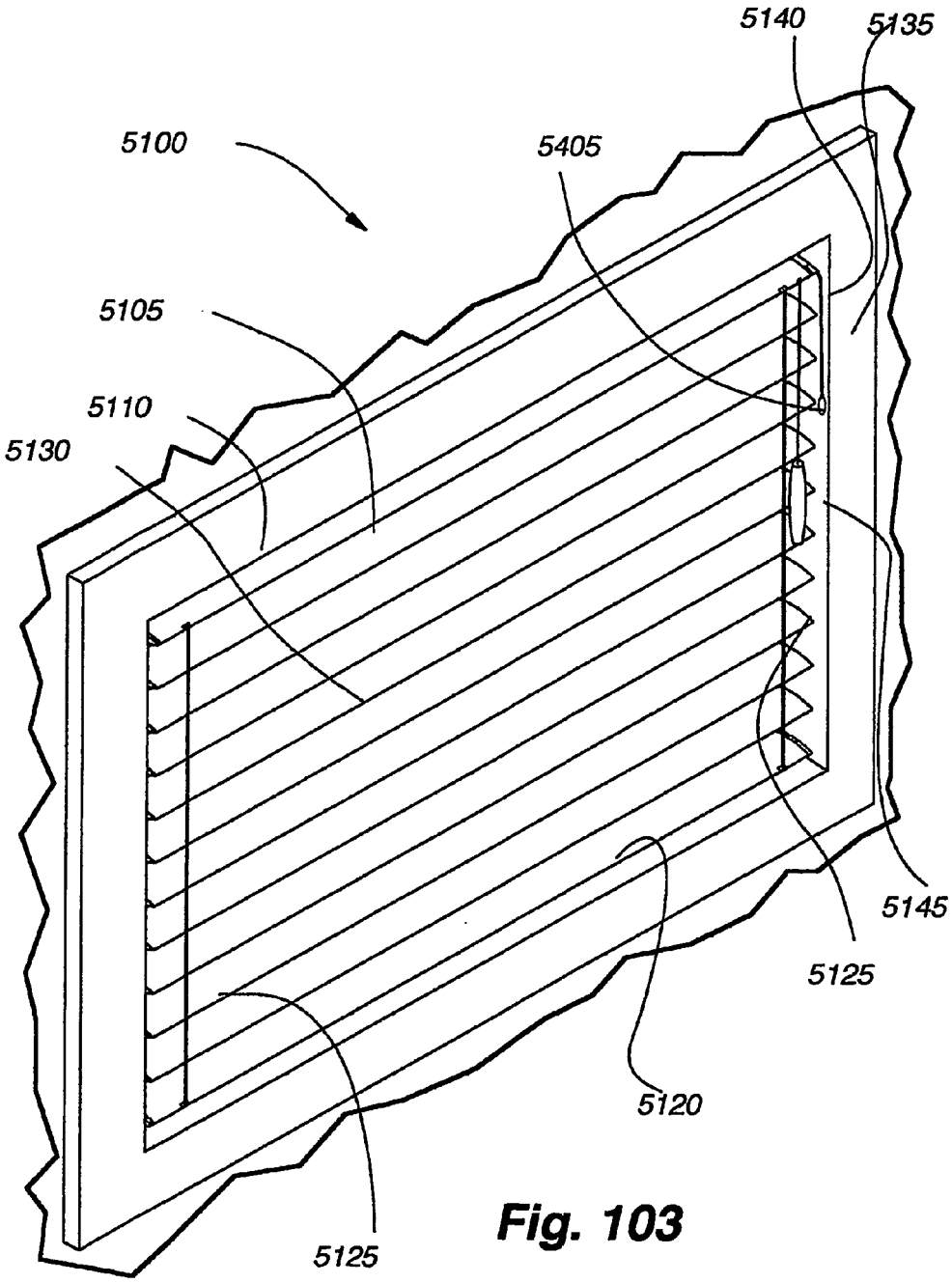
FIG. 103 is an isometric view of the front of a blind assembly incorporating a balanced tilt mechanism in its extended position with the slats in the open position.
Figure 104:
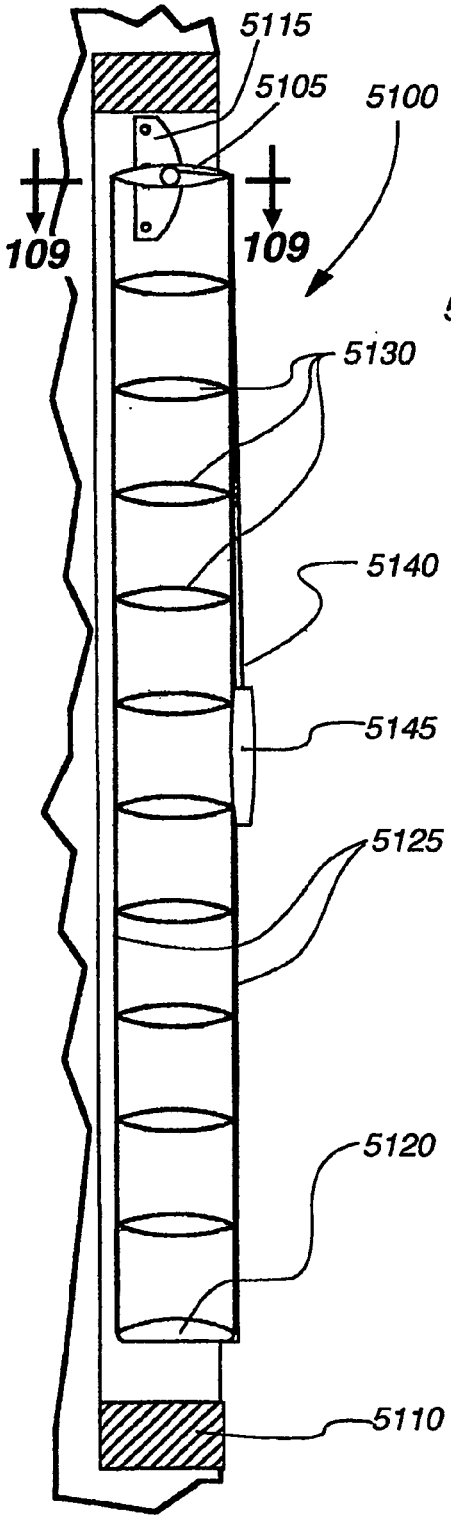
FIG. 104 is a partial front view of the horizontal blind assembly of FIG. 103 illustrating the weighted tassel on the end of the tilt actuating cord.
Figure 105:
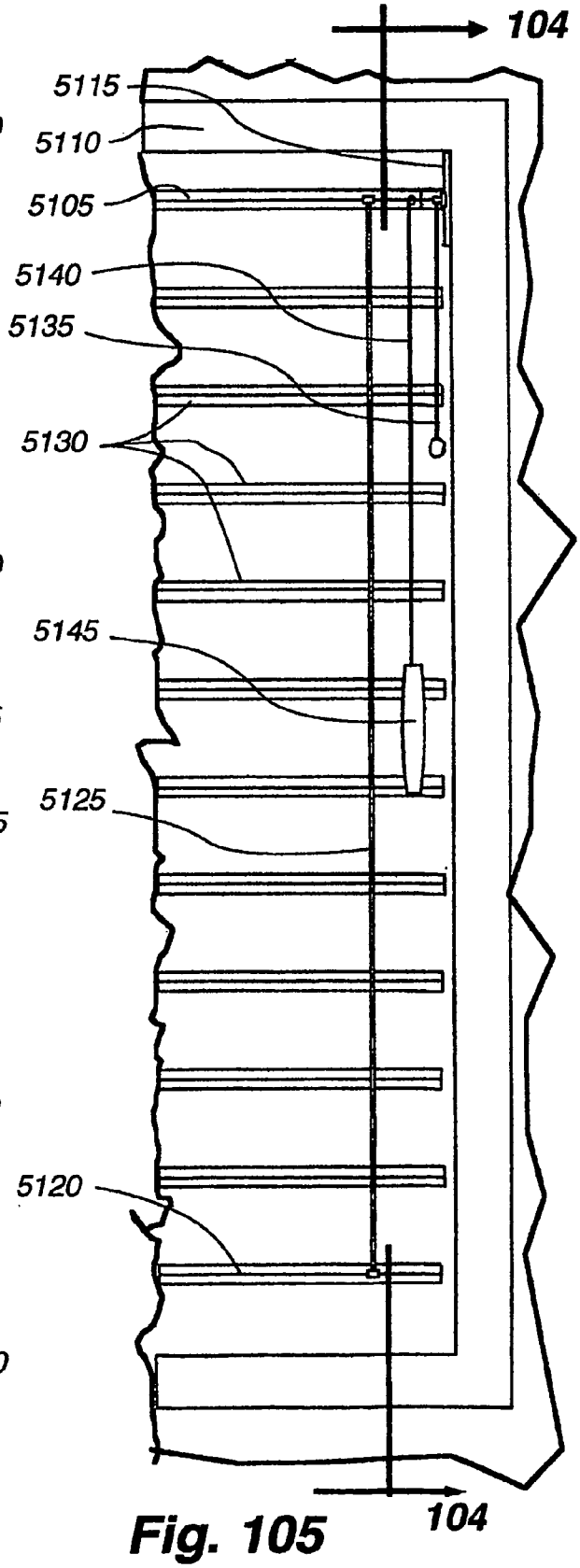
FIG. 105 is a cross sectional view of the horizontally blind assembly of FIG. 103 taken along line 105—105 of FIG. 104.
Figure 106:
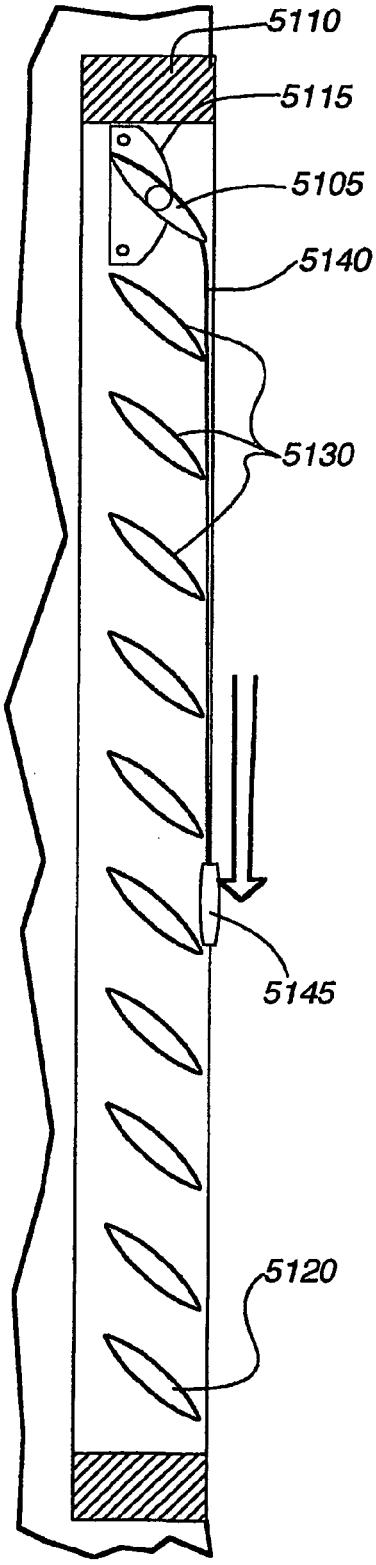
FIGS. 106–108 are cross sectional views of the horizontally extending blind assembly similar to the FIG. 105 view illustrating the slats (or vanes) in various tilt positions.

The ladder tapes 5125 illustrated in FIGS. 103–105 typically comprise front and rear vertical cords that extend vertically across the front edges and rear edges respectively of the slats. Cross rungs (not specifically illustrated) span between each set of vertical cords at vertically-spaced locations to support and cradle the slats 5130. In one embodiment, the top end of each vertical cord is secured to one of the front edge and the rear edge of the head rail (as illustrated in FIG. 109), wherein the tops of the vertical cords are threaded through holes in the edges of the head rail and secured therein by a knot or an adhesive bead 5150. Accordingly, when the head rail is tilted clockwise as shown in FIG. 106, the front vertical cord of each ladder tape 5125 is lowered and the rear vertical cord of each ladder tape is raised, thereby causing the cross rungs to pivot clockwise along with the slats cradled in the cross rungs. Conversely, when the head rail is tilted counterclockwise as shown in FIG. 108, the front vertical cord of each ladder tape 5125 is raised and the rear vertical cord of each ladder tape is lowered, thereby causing the cross rungs to pivot counterclockwise along with the slats cradled in the cross rungs.

Referring to FIG. 105, the blind assembly is illustrated with the slats in the fully open position. In this position the slats, head rail and foot rail are orientated substantially horizontally in their widthwise direction. The weighted tassel 5145 attached to the end of the tilt actuator cord 5140 is located at an intermediate vertical position that is easily reached by a user to move the slats into either a first or a second closed position.

One embodiment of the weighted tassel is illustrated in FIGS. 118–121. The tassel comprises a center metal piece 5305 of a predetermined weight to balance the constant tension spring. The metal piece has a generally oval shape with curved faces and rounded edges. Proximate the top edge of the metal piece a tie-off hole 5310 is provided for receiving the end of the tilt actuator cord 5140. At several locations along each of the right and left arcuate sides of the metal piece, slots 5315 are provided to receive detent arms 5320 of a matching pair of corresponding plastic covers 5325 and 5330. The plastic covers encapsulate the metal piece for a more aesthetically pleasing appearance. A male plastic cover 5325 has a plurality of detent arms extending from its edges that correspond to the slots in the metal piece in location. The female plastic cover 5330 has lips 5335 molded about its edges that correspond to the detent legs over which the detents of the detent arms are received to secure the plastic cover over the metal piece. At the top of each plastic piece, a semicircular slot 5345 is provided that interfaces with a similar semicircular slot in the other plastic piece to form a round opening through which the lift cord passes to the tie-off hole in the metal piece.

Figure 107:
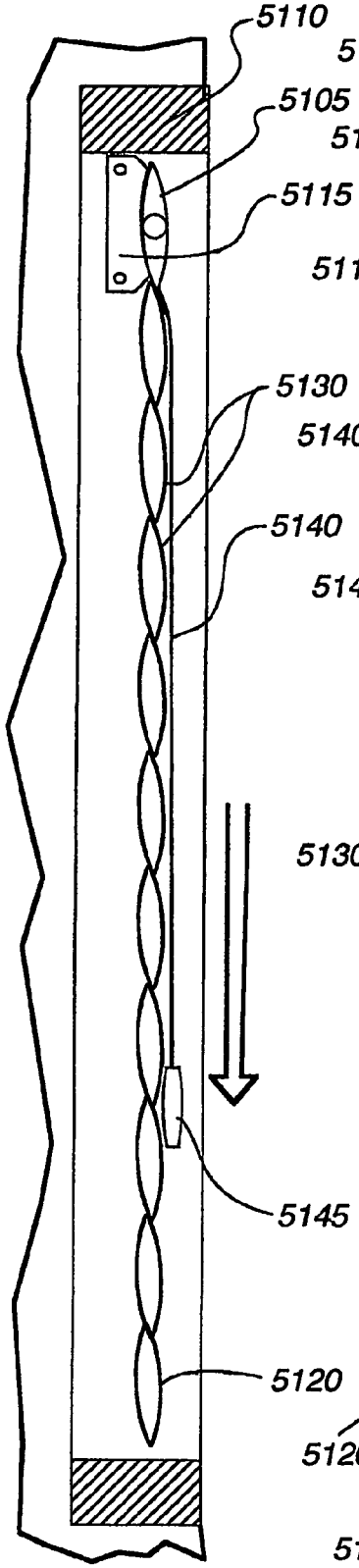
Figure 108:
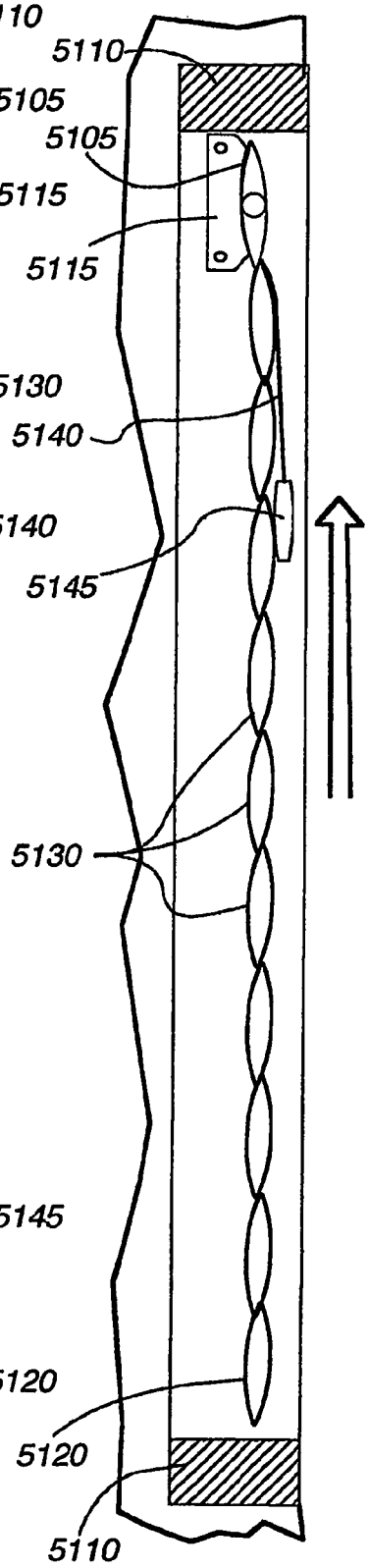
Figure 109:
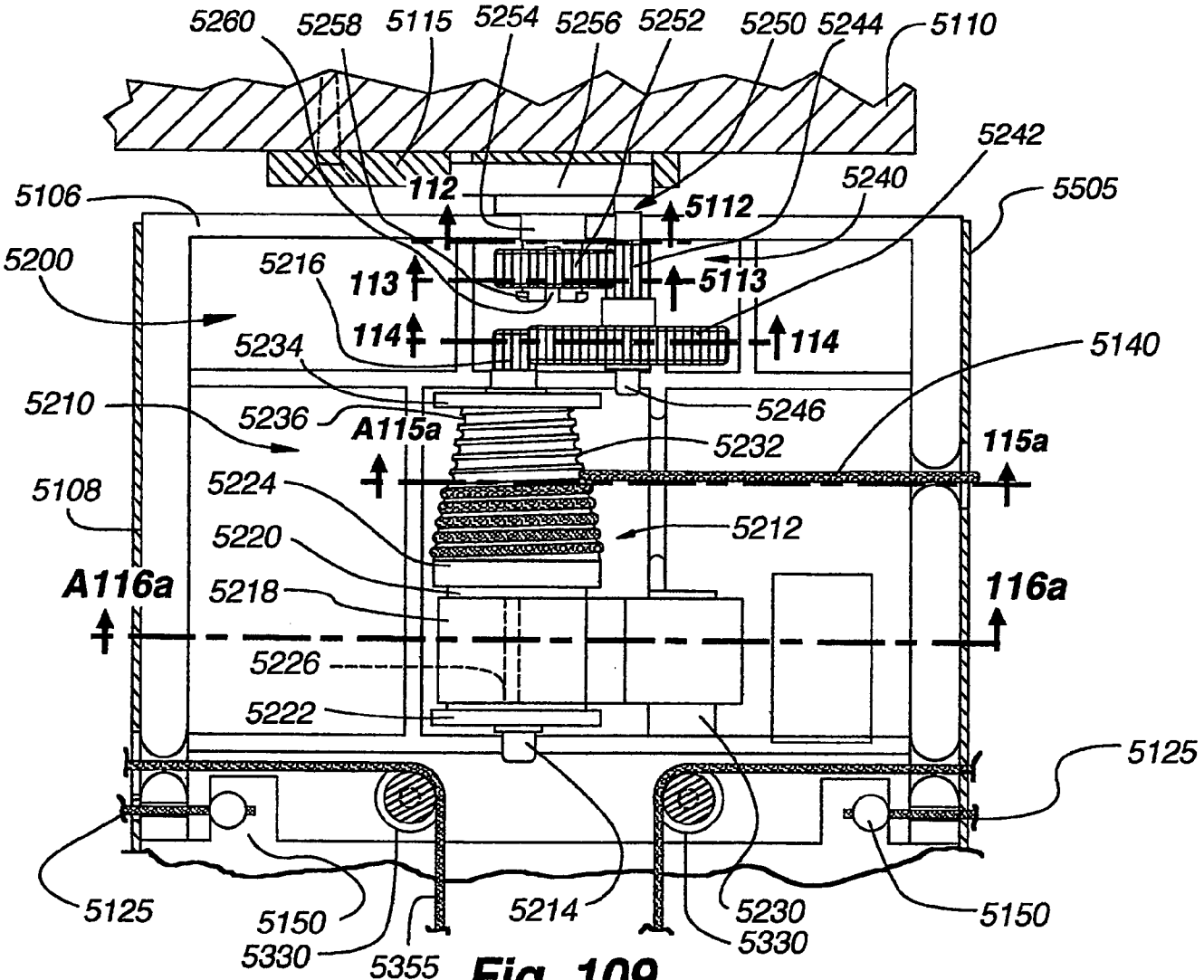
FIG. 109 is a top view of the balanced tilt mechanism taken along line 109—109 of FIG. 105 illustrating the positioning of the tilt actuating cord on the tapered bobbin when the vanes are in the fully open tilt position as illustrated in FIG. 105.
Figure 116C:
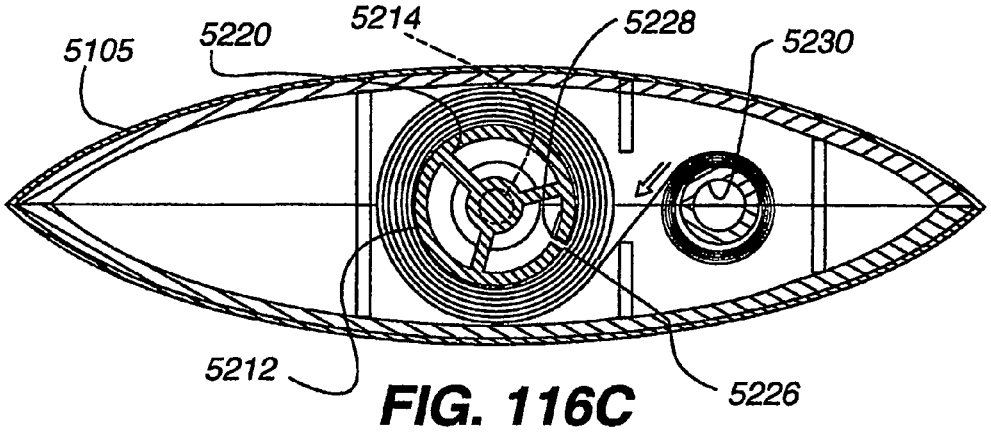
FIGS. 116A–C are partial cross sectional views of the balanced tilt mechanism taken along line 116A—116A of FIG. 109 illustrating the positioning of the constant tension-type spring when the slats are in three different tilt positions: the fully open position; the second closed position; and the first closed position respectively.
Figure 116A:
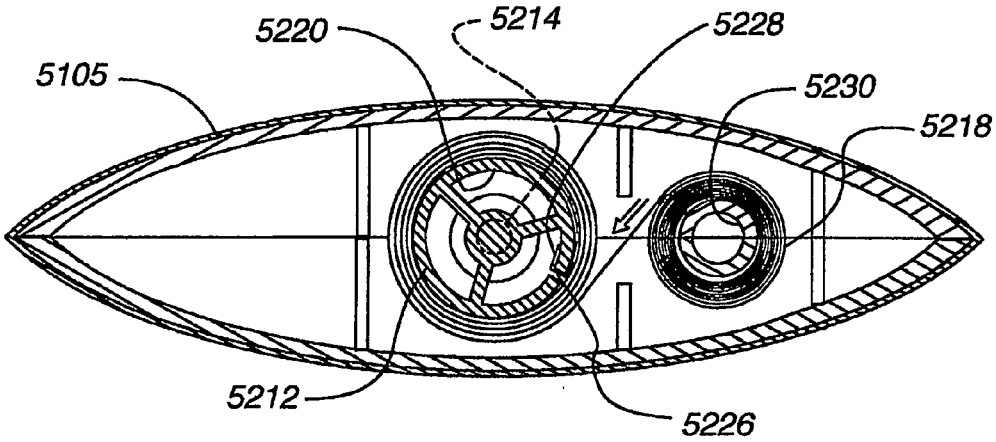
Figure 116C:
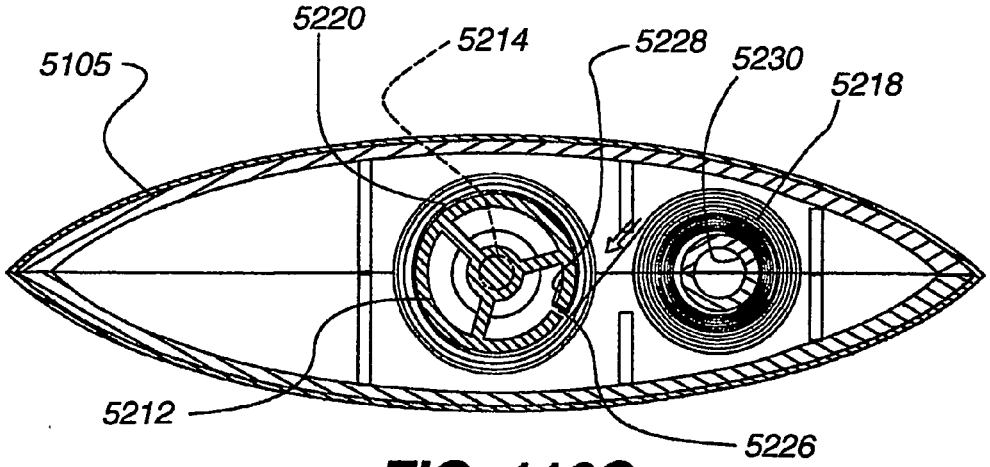
Figure 116B:
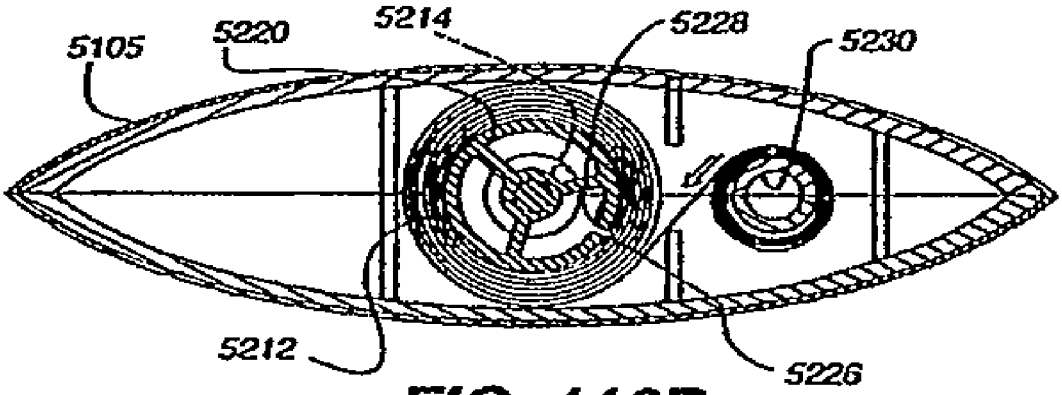
Figure 116A:
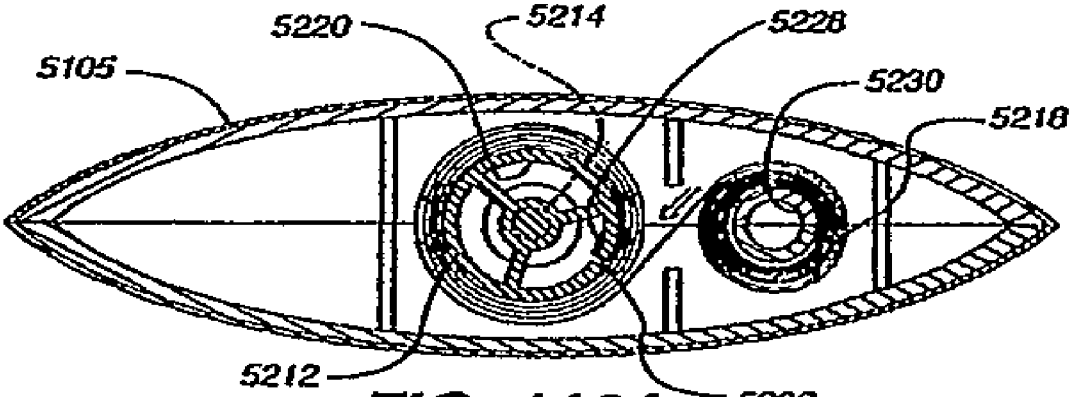
Figure 116C:
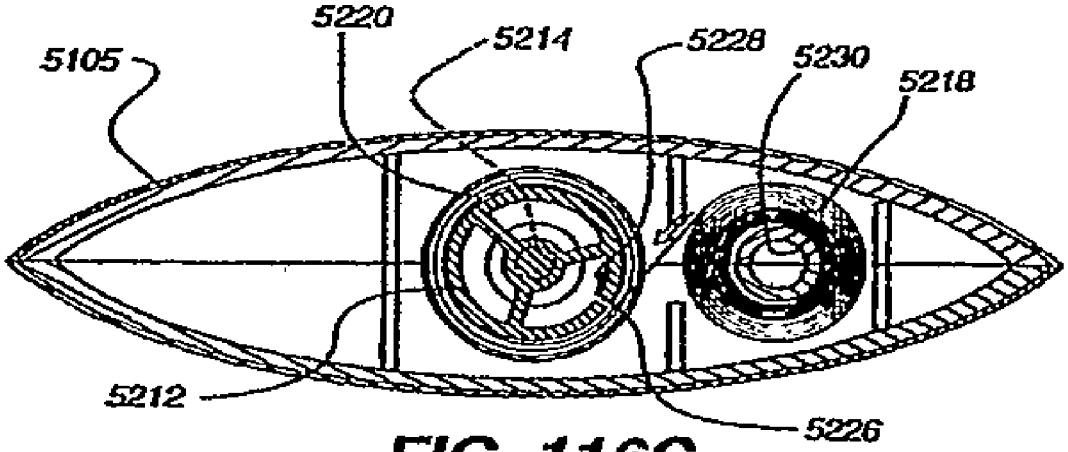

As illustrated by the arrows in FIGS. 106–108, by pulling the tassel 5145 and/or associated tilt actuator cord 5140 upwardly or downwardly, the head rail pivots about the mounting brackets 5115 causing the associated slats 5130 to pivot as well. By pulling downwardly with a small force on the tassel 5145 as shown in FIG. 106, the effective downwardly acting force is increased to an amount greater than an upwardly acting force applied by the contravening spring 5218 (as best shown in FIGS. 116A–C described in detail below). Accordingly, the head rail and the slats pivot in a clockwise direction until reaching a first closed position. The first closed position is illustrated in FIG. 107. Conversely, by gently pulling or pushing upwardly on the tassel 5145 or the lift actuator cord 5140, the effective downwardly acting force as applied by the tassel weight is decreased to an amount below the upwardly acting force applied by the contravening spring. Accordingly, the head rail and the slats pivot in a counterclockwise direction until reaching a second closed position as illustrated in FIG. 108.

It is to be appreciated the amount of force that must be applied by the user is very small comprising only the amount of force necessary to overcome any rotational friction inherent in the tilt mechanism. The amount of friction is largely dependant on the design of the mechanism, but a small amount of friction is desirable and necessary to prevent the slats from tilting to and fro when encountering even the smallest external forces, such as might be the result of breezes passing through an open window for example. It is contemplated that in alternative embodiments, a mechanism may be provided, such as a clamp arrangement around one or more of the pivoting shafts of either the tilt mechanism or the head rail to allow adjustment of the level of friction in the system.

Referring to FIGS. 109–116C, the preferred embodiment of the balanced tilt mechanism 5200 is illustrated. In general, the balanced tilt mechanism comprises: (i) the tilt actuator cord 5140; (ii) the weighted tassel 5145; (iii) a bobbin/spring assembly 5210 including a tapered bobbin 5212 rotatably mounted within the head rail by a bobbin shaft 5214, a bobbin spur gear 5216, and a constant tension-type spring 5218; (iv) a spur gear assembly 5240 including a large spur gear 5242 and a small spur gear 5244 attached by a rotating shaft 5246; and (v) a mounting bracket attachment assembly 5250 including a rotationally fixed spur gear 5252, and a head rail shaft 5254 about which the head rail pivots.

Figure 110:
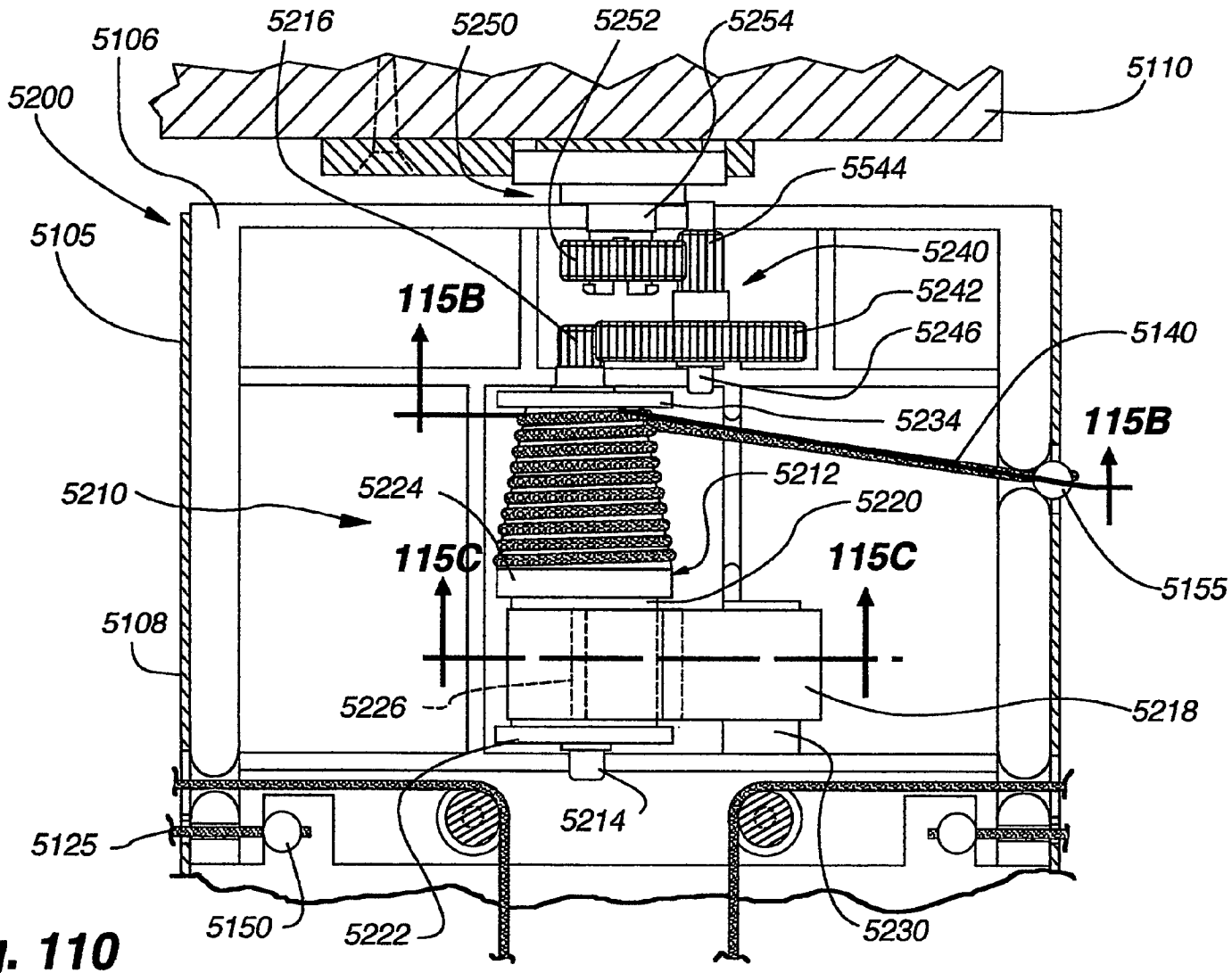
FIG. 110 is a top view of the balanced tilt mechanism taken along line 109—109 of FIG. 104 illustrating the positioning of the tilt actuating cord on the tapered bobbin when the vanes are in a second closed tilt position as illustrated in FIG. 108.
Figure 111:
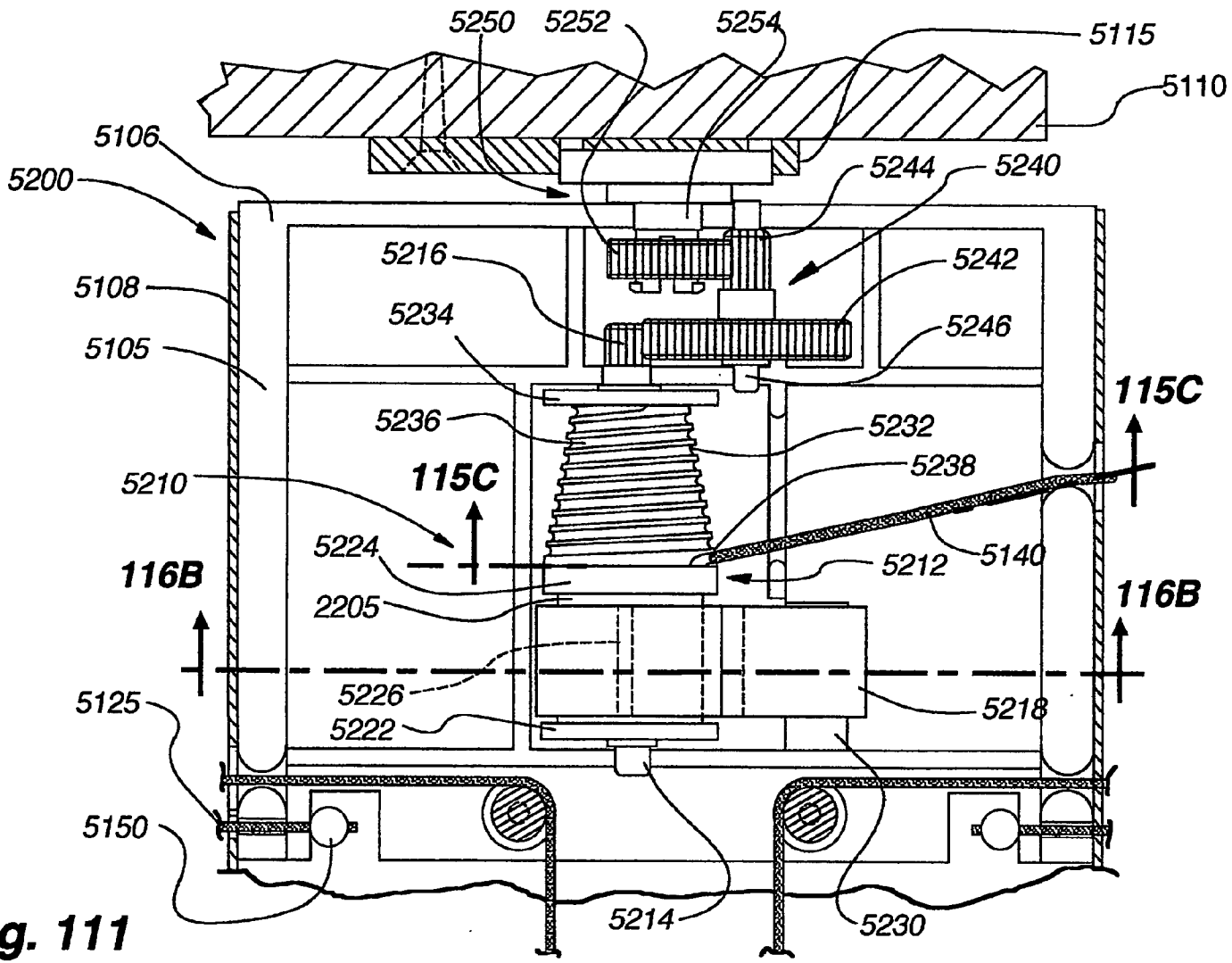
FIG. 111 is a top view of the balanced tilt mechanism taken along line 109—109 of FIG. 104 illustrating the positioning of the tilt actuating cord on the tapered bobbin when the vanes are in a first closed tilt position as illustrated in FIG. 107.

The bobbin/spring assembly 5210 is best illustrated in FIGS. 109–111 with transverse cross sections of the tapered bobbin 5212 provided in FIGS. 115A–C and 116A–C. The primary component of the bobbin/spring assembly is the tapered bobbin 5212. The tapered bobbin acts to transfer the spring force from the spring 5218 to the tilt actuator cord 5140 and to secure the tilt actuator cord to the tilt mechanism. The tapered bobbin 5212 is generally cylindrical with a tapered conical section and is adapted for rotation about a bobbin shaft 5214 that extends through the tapered bobbin's longitudinal axis. The tapered bobbin can be fabricated from any number of suitable materials including metals, plastics and composites, but in the preferred embodiment, the tapered bobbin is fabricated from an injection molded plastic. The bobbin shaft 5214 that is typically fabricated from a metallic material is press fit onto the bobbin along the bobbin's longitudinal axis. Alternatively, the shaft may be keyed to the shaft or adhesively bonded to the shaft for unitary rotation therewith. In an alternative embodiment, the bobbin shaft can be integrally molded with the bobbin. The bobbin shaft is rotatably received at either end of the bobbin into slots or openings formed in the head rail 5105. It is appreciated that as illustrated in FIGS. 109–111, the tilt mechanism is supported in an end cap section 5106 of the head rail that is received in a longitudinally-extending typically extruded section 5108 of the head rail 5105.

The tapered bobbin/bobbin shaft combination comprises several sections along its longitudinal length including a spring section 5220 at one end of the tapered bobbin 5212. The spring wrap section 5220 is essentially cylindrical and is bounded on both ends by first and second radial flanges 5222 and 5224. A longitudinally-extending slot 5226 (best illustrated in FIG. 116A) is provided through the wall of the cylindrical spring section for securing a hooked end 5228 of the spring 5218. As the slats are tilted in either direction during the operation of the tilt mechanism 5200, the constant tension-type spring 5218 either wraps around the spring section 5220 or unwinds from the spring section 5220 and wraps around a post 5230 provided in the head rail 5105.

Figure 115B:
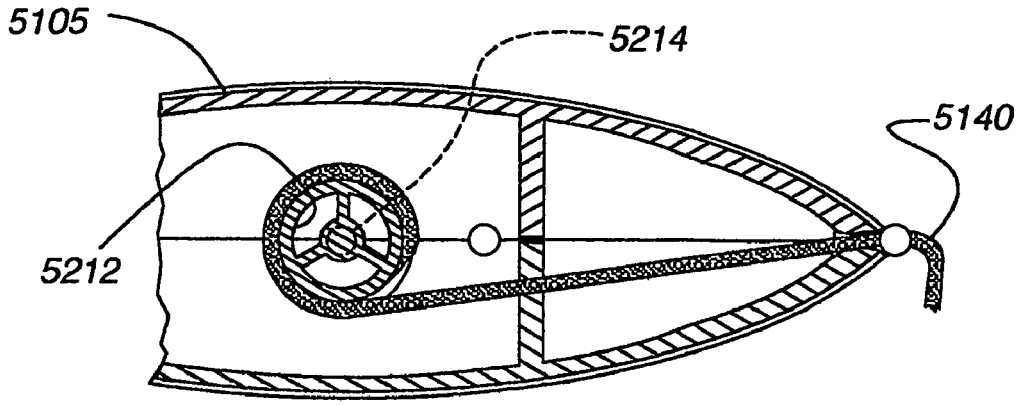
FIGS. 115A–C are partial cross sectional views of the balanced tilt mechanism taken along line 115A—115A of FIG. 109 illustrating the positioning of the tilt actuating cord relative to the bobbin when the slats are in three different tilt positions: the fully open position; the second closed position; and the first closed position respectively.
Figure 115A:
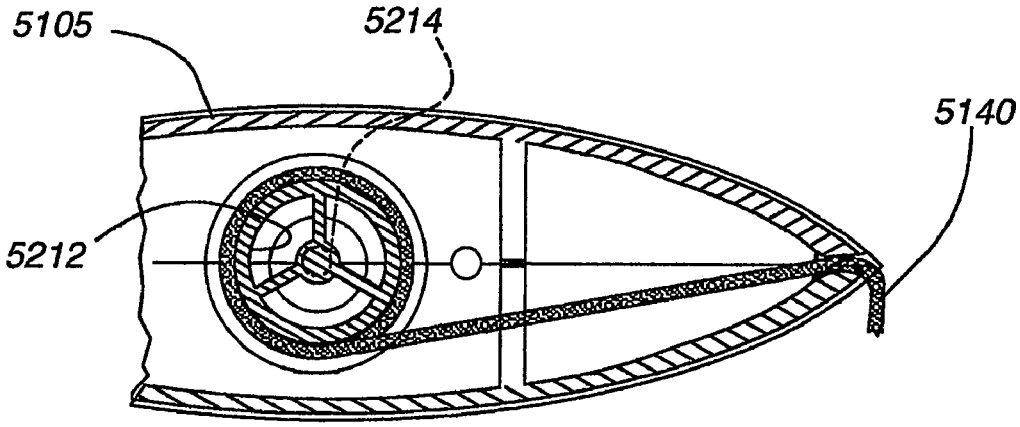
Figure 115C:
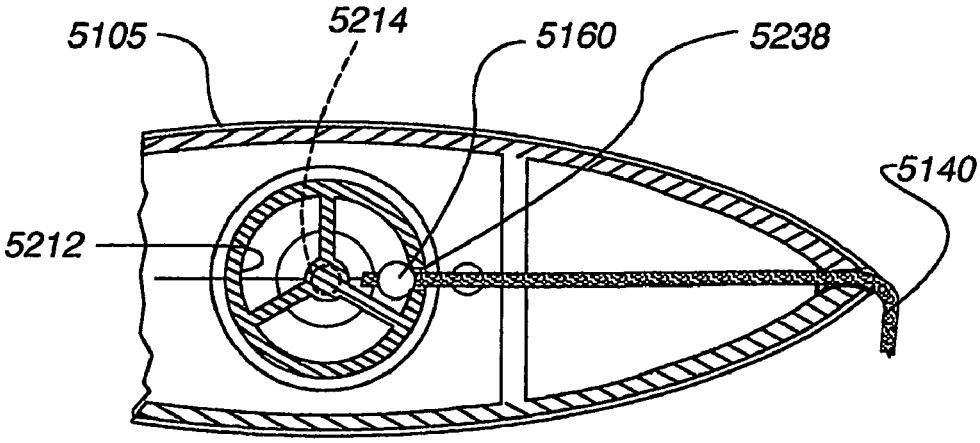

The tapered bobbin 5212 also includes a tapered section 5232 between the second radial flange 5224 and a third radial flange 5234 wherein the wall of the bobbin is tapered from a first diameter proximate the second radial flange to a second smaller diameter proximate the third radial flange. The change in diameter compensates for changes in the biasing force provided by the spring 5218 depending on the amount of the spring that is wrapped around the spring section 5220. The surface of the tapered section also includes a continuous groove 5236 which extends from one end of the section 5232 to the other wrapping about the surface of the tapered section multiple times. The groove is sized to receive the tilt actuator cord 5140 therein to guide the cord as it is wound and unwound from the bobbin 5212 during tilting operations. Proximate the second flange 5222, a hole 5238 of sufficient diameter to receive the top end of the tilt actuator cord passes through the wall of the tapered section 5232 at one end of the continuous groove 5236 (as best shown in FIG. 115C). This hole is used to secure the tilt actuator cord to the bobbin by passing the cord through the hole and either knotting the end or affixing an adhesive bead 5160 to the end of the cord that cannot fit back through the hole.

Finally, the bobbin shaft 5214 that passes through and is fixedly secured to the tapered bobbin 5214 has a bobbin spur gear 5260 located above the tapered section 5232 on the other side of the third flange 5234. The bobbin spur gear 5260 is fixedly received on the bobbin shaft for unitary rotation therewith. The bobbin spur gear can be keyed to the bobbin shaft, press fit onto the bobbin shaft, adhesively bonded to the shaft or affixed to the shaft by any suitable means. In an alternative embodiment, where the bobbin shaft is integrally fabricated with the tapered bobbin, the bobbin spur gear can also be integrally molded with the tapered bobbin.

Referring to FIG. 109 and FIGS. 116A–C, as mentioned above, one end of the constant tension-type spring 5218 is hooked within a slot 5226 in the spring section 5220 of the bobbin 5212. The other end of the spring is wrapped around the spring post 5230 provided in the head rail 5105 to receive the spring. The spring is typically fabricated from spring steel and provides a generally continuous tension across the span of the spring between the portion of the spring wrapped around the spring section 5220 and the portion of the spring wrapped around the spring post 5230 in the direction of the spring section as indicated by the arrows in FIGS. 116A–C. Accordingly, the spring applies a clockwise bias to the tapered bobbin 5212.

As successive layers of spring 5218 are wrapped around the spring section 5232, the effective counterclockwise rotational moment applied to the tapered bobbin 5212 from the spring increases since the distance from the longitudinal axis to the biasing portion of the spring increases and the force applied by the spring remains constant (the rotational moment is equal to the distance from the longitudinal axis to the location where the load is being applied times the force being applied). It is to be appreciated that in order for the bobbin to remain stationary when the tilt mechanism is not being operated the counterclockwise rotational moment applied by the weighted tassel 5145 acting through the tilt actuator cord 5140 must be the same as the contravening rotational moment applied by the spring. As the clockwise rotational moment increases, the counterclockwise rotational moment must also increase. The tapered section 5232 of the tapered bobbin causes the counterclockwise rotational moment to change in concert with the counterclockwise rotational moment.

For instance when the spring is wound its maximum amount around the spring section 5220 of the bobbin 5212 as shown in FIG. 116C, the tilt actuator cord will be completely unwound from the tapered section and be located at the largest diameter portion of the tapered section as shown in FIG. 111. When the spring and the tilt actuator cord are in these positions on the tapered bobbin, the vanes will be in their first closed position as shown in FIG. 106.

Conversely, when the spring is wound its minimum amount around the spring section 5220 of the bobbin 5212 as shown in FIG. 116B, the tilt actuator cord 5140 will be wound around the tapered section 5232 its maximum amount and the portion of the cord coming off of the tapered section will be located at the smallest diameter portion of the tapered section as shown in FIG. 110. When the spring and the tilt actuator cord are in these positions on the tapered bobbin, the vanes will be in their second closed position as shown in FIG. 108.

The spur gear assembly 5240 and the mounting bracket assembly 5250 are provided to transfer the rotational movement of the tapered bobbin 5212 during a tilting operation to pivotal movement of the head rail 5105 and the associated slats 5130. The spur gear assembly 5240 and the mounting bracket assembly 5250 are best illustrated in FIG. 109–114. The spur gear assembly includes the spur gear shaft 5246 that is rotatably mounted to the head rail and has the large spur gear 5242 affixed to it at one end and the small spur gear 5244 affixed to it at the other end. The large spur gear is meshed with the bobbin spur gear 5216 (as best shown in FIG. 114) such that clockwise rotation of the bobbin spur gear causes the large spur gear and the entire spur gear assembly to rotate counterclockwise. The various components of the spur gear assembly can be made out of a variety of suitable materials including plastic, metals and composites. Further, the spur gears can be joined to the spur gear shaft in any suitable manner including but not limited to press fitting, adhesive bonding, welding, brazing and keyed fitment. Additionally, in an alternative embodiment, the entire spur gear assembly can be injection molded as a single piece using a suitable reinforced or unreinforced plastic.

Figure 113:
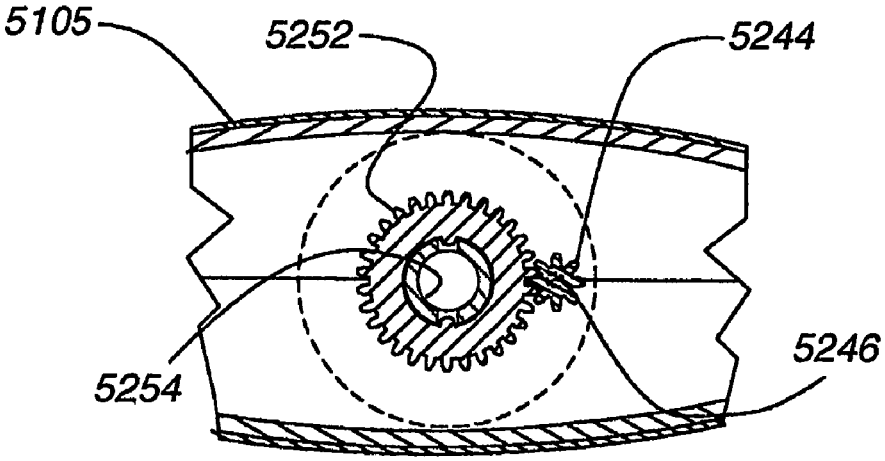
FIG. 113 is a cross sectional view of the balanced tilt mechanism taken along line 113—113 of FIG. 109.
Figure 114:
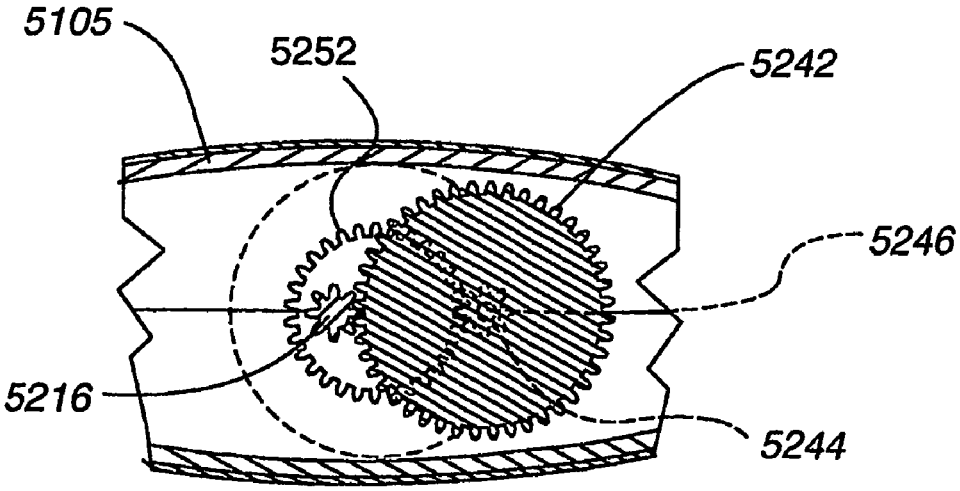
FIG. 114 is a cross sectional view of the balanced tilt mechanism taken along line 114—114 of FIG. 109.

As best shown in FIGS. 109 and 113 the small spur gear 5244 is meshed with the fixed spur gear 5252 of the mounting bracket assembly. The fixed spur gear is secured to the end of the head rail shaft 5254 of the mounting bracket pad 5256 that is fixedly secured to the mounting bracket 5115. Accordingly, the fixed spur gear does not rotate. Rather the small spur gear 5244 moves around the surface of the fixed spur gear and since the small spur gear, the spur gear assembly and the tapered bobbin assembly are all contained within and attached to the head rail, the head rail also pivots relative to the fixed spur gear.

In one alternative embodiment of the blind assembly incorporating the balanced tilt mechanism, the fixed spur gear 5252 has an axial opening that is keyed to a corresponding portion of the head rail shaft 5254 as is best illustrated in FIG. 113. The head rail shaft further includes a radial flange 5258 at its end to hold the fixed spur gear in place and prevent it from sliding off the end of the head rail shaft. In this portion of the head rail shaft there are two opposing slots 5260 in the walls of the shaft 5254 allowing the remaining walls to resiliently flex inwardly as the fixed spur gear 5252 is snapped into place. In alternative embodiments, the gear 5252 may be fixed to the head rail shaft in any suitable manner including welding and bonding.

Figure 112:
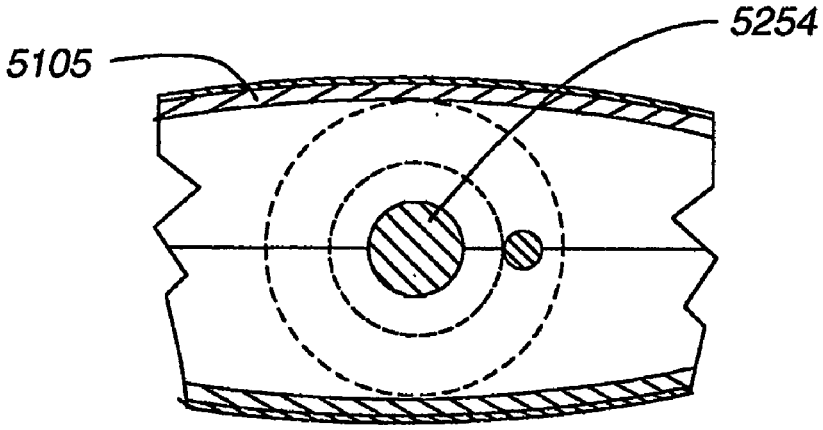
FIG. 112 is a cross sectional view of the balanced tilt mechanism taken along line 112—112 of FIG. 109.

As best shown in FIGS. 109 and 112, the end of the head rail 5105 is pivotally mounted to the mounting bracket assembly 5250 at another portion of the head rail shaft 5254. The head rail is free to pivot about the shaft but cannot slide longitudinally off the shaft as prevented by the mounting bracket pad 5256, which is typically integral with the shaft 5254, on one side and the fixed spur gear 5252 on the other side. It is to be appreciated that the head rail 5105 is longitudinally secured to a modified mounting bracket assembly for pivotal movement on the other end of the head rail although no fixed spur gear is required.

In this embodiment incorporating the balanced tilt mechanism, the mounting bracket pad 5256 includes a spring catch (not shown) molded therein or otherwise attached to the pad. The spring catch is designed to be received in a plurality of mounting holes (not shown) disposed in the mounting bracket 5215 at spaced circular locations about a center point coincident with the longitudinal axis of the head rail shaft 5254. Accordingly when mounting the blinds to an opening, the mounting brackets 5215 are first positioned and secured to the frame 5110 of the opening. Next, the tilt mechanism 5200 is activated to move the blinds into one of the closed positions before attaching the mounting bracket pads 5256 to the mounting bracket. Finally, the pads 5256 are aligned to the bracket with the head rail and slats substantially vertically disposed in their lateral direction and the pads are snapped into place.

It is to be appreciated that depending on the various sizes of the spur gears 5216, 5242, 5244, and 5252 utilized throughout the tilt mechanism 5200, the amount of weighted tassel movement necessary to move the slats 5130 from one closed position to another can be varied as would be obvious to one of ordinary skill in the art. In one embodiment, the total travel of the tilt actuator cord 5140 and the associated weighted tassel 5145 is about 22 inches, although the gearing could be changed to reduce that travel especially when used with small shades that are not very tall. To prevent the tilt actuator cord from over winding onto the tapered bobbin 5212 when pivoting the slats into the second closed position, the tilt actuator cord has a adhesive bead 5155 attached to it that braces against the cord opening in the head rail when the cord slats are fully tilted and the cord is fully wound about the tapered bobbin as shown in FIG. 110.

As described above and illustrated in FIGS. 106–107, to pivot the shades from the fully open position to the first closed position, a user gently pulls on the weighted tassel 5145 or the tilt actuator cord 5140. The force only need be enough to overcome any friction built into the tilt mechanism. As illustrated in FIG. 115A, the tapered bobbin is rotated in a counterclockwise direction, causing additional spring to be wound onto the spring section 5220 of the bobbin as illustrated in FIG. 116C, thereby increasing the clockwise acting rotational moment applied to the bobbin. To maintain the balance of forces, the tilt actuator cord moves along the groove 5236 to a portion of the tapered section 5232 having a greater diameter as shown in FIG. 111. The counterclockwise rotation of the tapered bobbin 5212 and the fixedly attached bobbin spur gear causes the spur gear assembly, which is meshed to the bobbin spur gear through the large spur gear 5242, to rotate clockwise. The small spur gear 5244, which is meshed against the fixed spur gear 5252, moves clockwise around the fixed spur gear. Since the spur gear assembly is attached to the head rail 5105, the headrail pivots clockwise about the mounting bracket assembly 5250 as the small spur gear moves around the fixed spur gear. The counterclockwise pivotal movement of the head rail causes the front vertical cord of the ladder tape 5125 to rise, the rear vertical cord to be lowered, and the slats to be tilted into the second closed position as shown in FIG. 107.

The foregoing balanced tilt mechanism has been described in terms of use with a blind assembly incorporating a tilting head rail. It is to be appreciated that elements of the balanced tilt mechanism can also be utilized in a more conventional Venetian blind assembly with a fixed head rail. In such an application the tapered bobbin/spring assembly would be interfaced either directly or through one or more gears with a tilt rod that extends within the head rail. By either lifting or pulling on the weighted tassel the balance of forces would be upset and the tapered bobbin and the tilt rod would rotate to effect the tilting of the blind assembly's slats. The balanced tilt mechanism could also be incorporated into other types of window coverings that tilt or pivot slats.

Additionally, many variations of the various components of the tilt mechanism are contemplated. For instance, the type of spring utilized could be varied or in another embodiment the spring could be replaced with a second weight that hangs down the back side of the blind to counteract the weighted tassel. In other embodiments, the various gears could be replaced as desired by pulleys and drive belts. In other variations, the bobbin may not be tapered.

Break Away Tassels for use with Lift Cords in Balanced Tilt Mechanism Blind Assembly FIGS. 133–149 illustrate two embodiments of breakaway tassels 7005 and 7105 for use with the lift cords of a blind assembly incorporating a balanced tilt mechanism. Further, the described breakaway tassels can be used in other types of blinds and window coverings. Breakaway tassels are designed to separate into a number of pieces when a non-vertical load is applied to one or more of the lift cords that feed into the tassel that has a different vector than another load applied to another lift cord. For instance, if a child gets a body part caught in the lift cords with one cord pulling to the left of his neck and another lift cord pulling to the right, the tassel will separate to free the child before injury could result.

Figure 133:
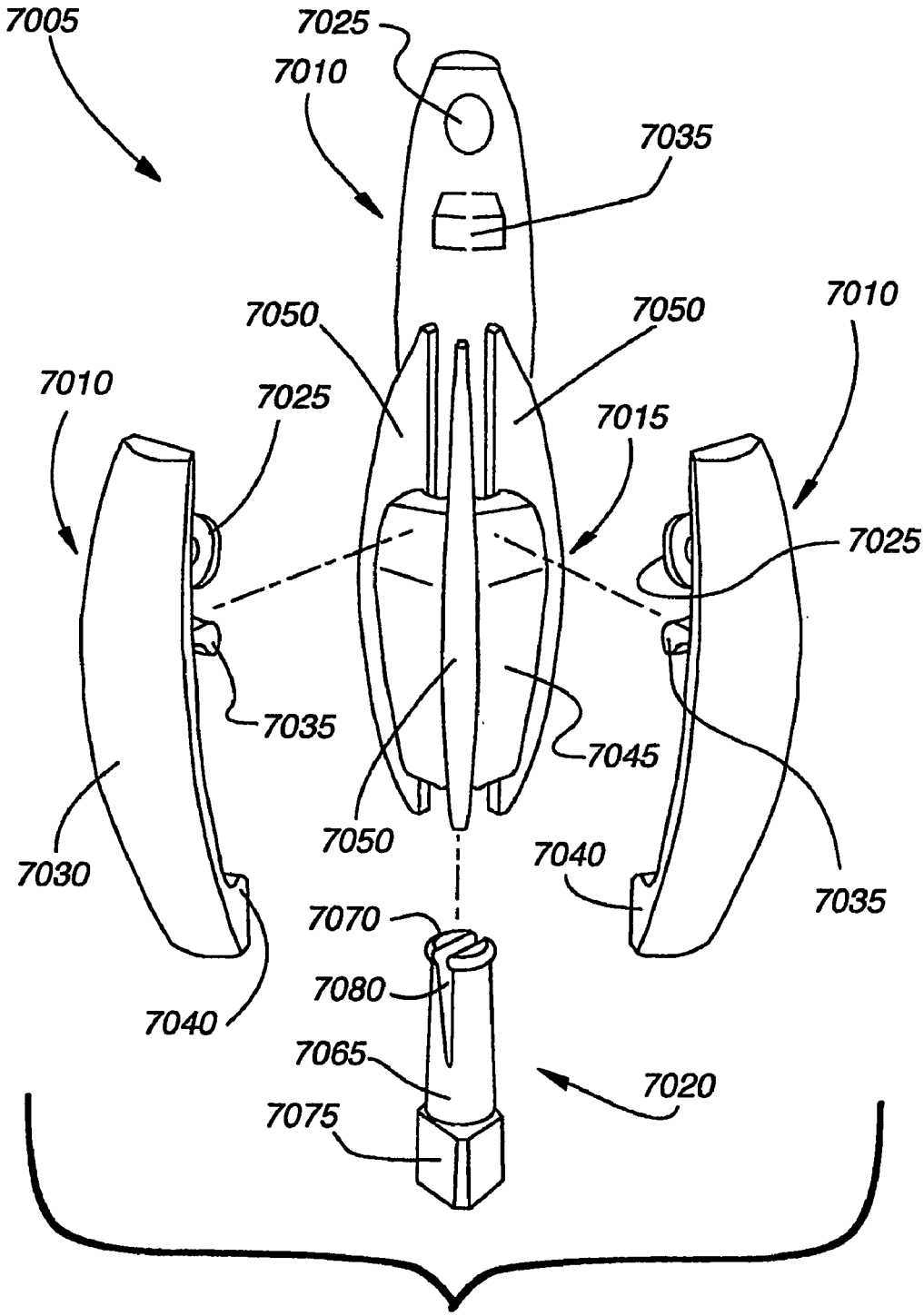

A first embodiment breakaway tassel 7005 as illustrated in FIGS. 133–137 comprises three peripheral cord securing members 7010, a cord securing plug 7020 and a center coupling member 7015. Referring primarily to FIG. 133, the center coupling member includes a center body portion 7045 that has a generally triangular horizontal cross section and tapers inwardly and downwardly over its length. A vertical bore 7055 extends through the center of the body portion the bore has (i) a top portion that is circular near its top edge and tapers downwardly and outwardly for a distance and (ii) a bottom portion that extends from the bottom of the top portion to its bottom edge that is generally square in cross section. From the respective corners of the outside surface of the coupling member, three fins 7050 extend radially outwardly. As best shown in FIG. 134, the outside edges of the fins correspond to the edges of the peripheral cord securing members 7010 with the peripheral members abutting the sides of the fins proximate the outside edges of the fins.

Still referring to FIG. 133, each of the three peripheral members 7010 includes an arcuate generally vertically-orientated wall having an outside surface and an inside surface. Proximate the top edge of the peripheral member, a cord tie off 7025 extends inwardly from the inside surface and is adapted to have a lift cord 7085 fixedly tied thereto. Vertically below the tie off, a downwardly hooked protrusion 7035 extends inwardly in a generally horizontal direction. Additionally, an upwardly hooked protrusion 7040 extends inwardly from the inside surface proximate the bottom edge of the peripheral member. As indicated in FIG. 133 and shown in FIG. 135, the hook is designed such that the peripheral member can be snapidly received over one of the top and bottom edge of one of the sides of the center body portion 7045. Accordingly, up to three lift cords can be secured to the tassel. If desired and necessary, a forth lift cord can be secured to the tassel using a cord securing plug 7020 that is received in the vertical bore 7055 of the center body portion.

The cord securing plug is best illustrated in FIGS. 136 and 137. It includes a gently outwardly and downwardly tapering cylindrical portion 7065 that corresponds generally to the top portion of the vertical bore. However, the top of the plug includes a flanged portion 7070 that is normally larger in diameter than the diameter of the vertical bore at its top edge. Additionally, a tapered v-shaped slot 7080 extends downwardly from the top edge of the plug extending downwardly about two-thirds the length of the tapered cylindrical portion. The plug also includes a bottom portion 7075 with a generally square cross section that matingly corresponds to the bottom portion of the vertical bore. The plug is, accordingly, adapted to be received in the vertical bore with the flanged portion being snapidly received over the top edge 7060 of the bore as shown in FIG. 135. A forth lift cord can be wrapped about the bottom of the plug and wedged in the V-slot before snapping the plug into the vertical bore to secure the forth lift cord to the tassel. As shown in FIG. 134, the forth tassel typically hangs from the bottom of the tassel and provides a cord to be grabbed when lifting or lowering the blind assembly.

Operationally, if unequal lateral forces are applied to the lift cords 7085, the resilient peripheral members, like all the elements of the tassel, are typically fabricated from a molded plastic and will snap apart from the center coupling member 7015. Variations of the first embodiment tassel are contemplated having four peripheral members and a center coupling member with a generally square cross section that can secure four lift cords without the use of the cord securing plug.

The second embodiment breakaway tassel 7105 is illustrated in FIGS. 138–149 and comprises four peripheral cord securing members 7115, and a center coupling member 7125. The center cord securing member includes a cylindrical lower portion 7135 having a vertical bore 7140 passing therethrough as best shown in FIG. 146. The bottom edge 7145 of the cylindrical portion is canted inwardly from its outside surface to the surface of the bore for reasons explained below. Four fin members 7050 extend radially from the surface of the cylindrical portion 7135 and also extend vertically above the top edge 7060 of the cylindrical member as shown in FIG. 146. As is best shown in FIGS. 141 and 142, the end 7155 of each fin forms a semicircular curved ledge 7160 in horizontal cross section on the backside of its ends at the intersection with the remainder of the fin for reasons provided below.

The four peripheral cord securing members 7115 are generally C-shaped with generally triangular top and bottom sides (FIGS. 139 and 141), and a generally rectangular vertical side. The vertical side of the cord securing members includes a concave portion as best shown in FIG. 140. A hole 7120 is provided through the top side of each cord securing members for receiving a lift cord 7110 therethrough, which is tied on its end in a knot to secure it to the cord securing member. The inside surface 7170 of the bottom side of the cord securing member is canted inwardly and upwardly as best shown in FIG. 149. As best shown in FIG. 146, the bottom side is adapted to mate with the bottom edge of the cylindrical portion.

Referring to FIGS. 146 and 142, once the lift cords are secured to each peripheral cord securing member 7115, the inside surface of the cord securing member's bottom side 7170 is placed against the bottom edge 7145 of the center coupling member's bottom edge of the cylindrical portion 7135. Each cord securing member is then rotated inwardly towards the coupling member 7125 until the concave side edges of the cord securing member are snapidly received over the semicircular ends 7155 of the fins and are retained against the curved ledges 7160. As shown in FIGS. 139 and 146 the edges of the top side of the cord securing members meet and abut each other. Similarly, the bottom side edges of the cord securing member abut each other but, as shown in FIG. 141, a center opening 7130 is formed through which a lift pull cord 7165 can pass. The optional pull cord can be passed through the cylindrical portion and secured to the cylindrical portion via a knot as shown in FIG. 146. The cylindrical pull cord can then be grabbed by a user to retract and extend the slats of a blind assembly.

The operation of the breakaway tassel when the lift cords are subject to uneven lateral forces is described with reference to FIGS. 147–149. The uneven lateral lift cord forces pulls the effected cord securing member outwardly from the tassel at its top edge, effectively causing the cord securing member to rotate outwardly about the interface between the bottom edge of the cylindrical portion of the coupling member as shown in FIG. 147. Next, referring to FIG. 148, the concave sides of the cord securing member resiliently pop out from the curved ledges of the semicircular fin ends. Finally, as shown in FIG. 149, the cord securing member(s) fully separates form the coupling member and any other cord securing members still connected with the coupling member.

An Alternative Embodiment Utilizing One-sided Center Cord Ladders

Figure 127:
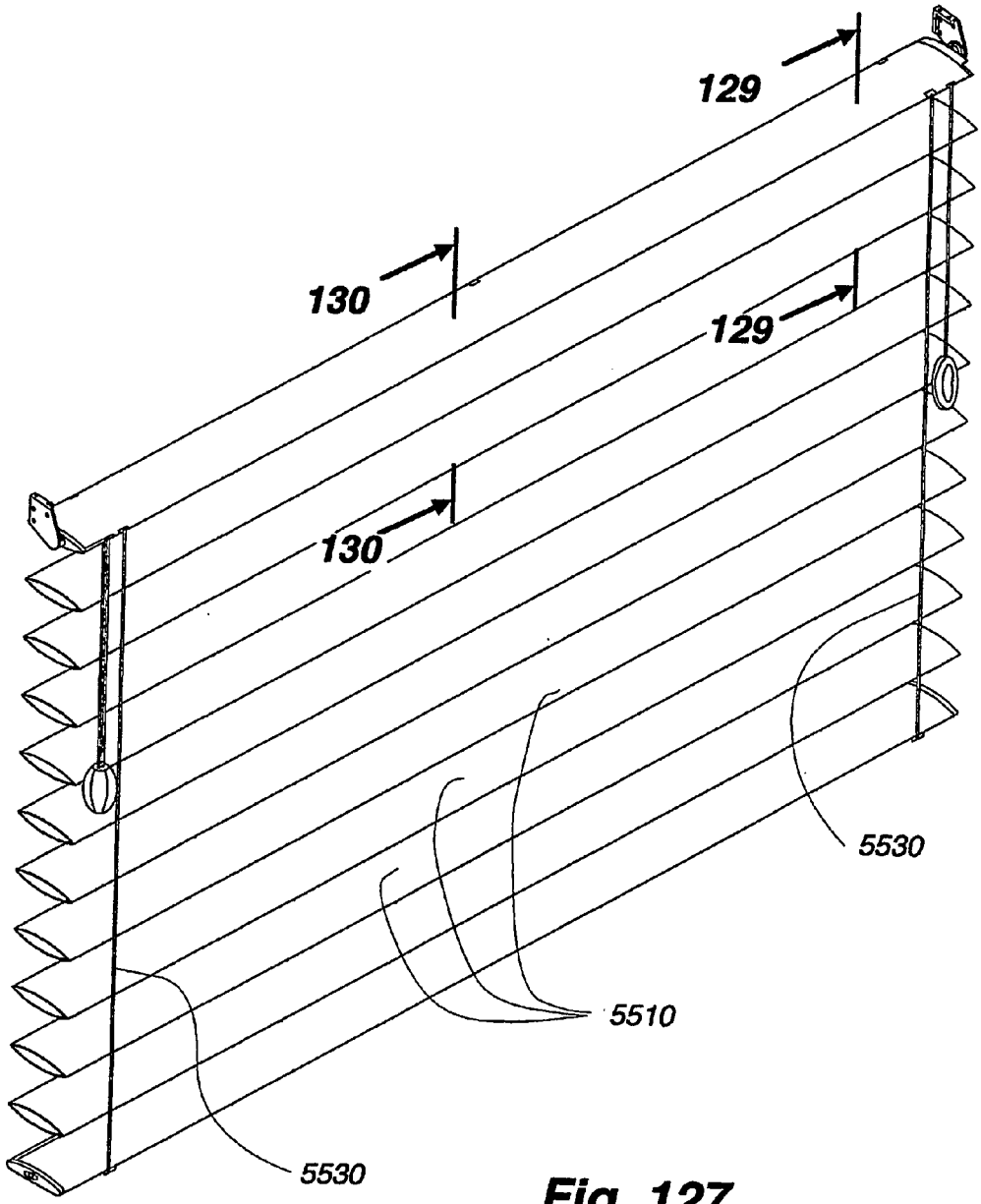
Figure 128:
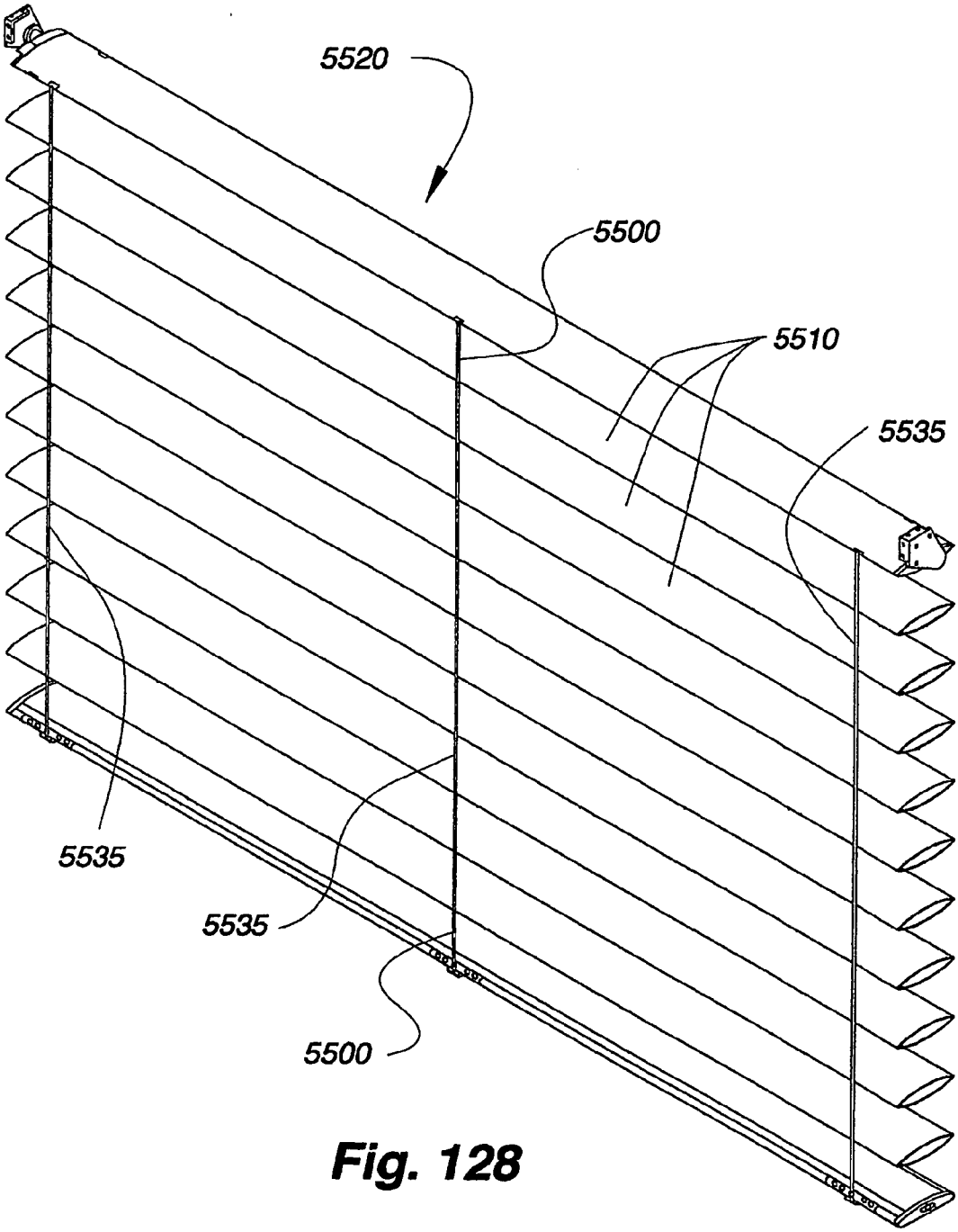

As described above, the cord ladders typically comprise front and rear riser cords and cross rungs spanning between the risers to cradle the associated slat. As illustrated in FIGS. 127–132, one sided cord ladders with partial cross rungs 5505 adhesively or otherwise attached to the slats 5510 may be utilized with alternative embodiments of the blind assemblies. The advantages and benefits of directly connecting the slats to the cross rungs of two sided ladder tapes are discussed in detail the aforementioned U.S. patent application Ser. No. 10/003,097 filed Dec. 6, 2001, which has been incorporated herein by reference in its entirety. It has been determined that by adhesively bonding a partial cross rung to the slats for the center cord ladder, the front riser can be removed leaving only a rear riser 5515 without hindering the pivoting of the slats when relatively rigid slats such as specified herein are utilized. It is to be appreciated that by removing the front risers the overall appearance of a wide blind assembly is improved significantly over wide blind assemblies using prior art two-sided center cord ladders. Typical front and rear views of an alternative embodiment blind assembly 5520 utilizing a one-sided center cord ladders are illustrated in FIGS. 127 and 128. As illustrated, the alternative blind assembly is of the type incorporating a balanced tilt mechanism, although it is to be appreciated that the one-sided cord ladders can be used with any of the embodiments of blind assemblies described above that are wide enough to require a center cord ladder.

Figure 129:
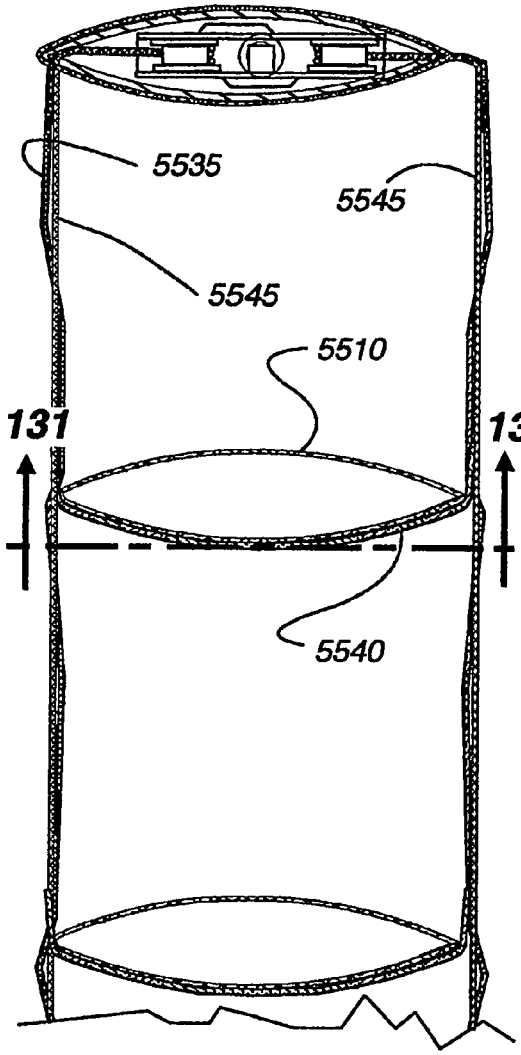
Figure 131:
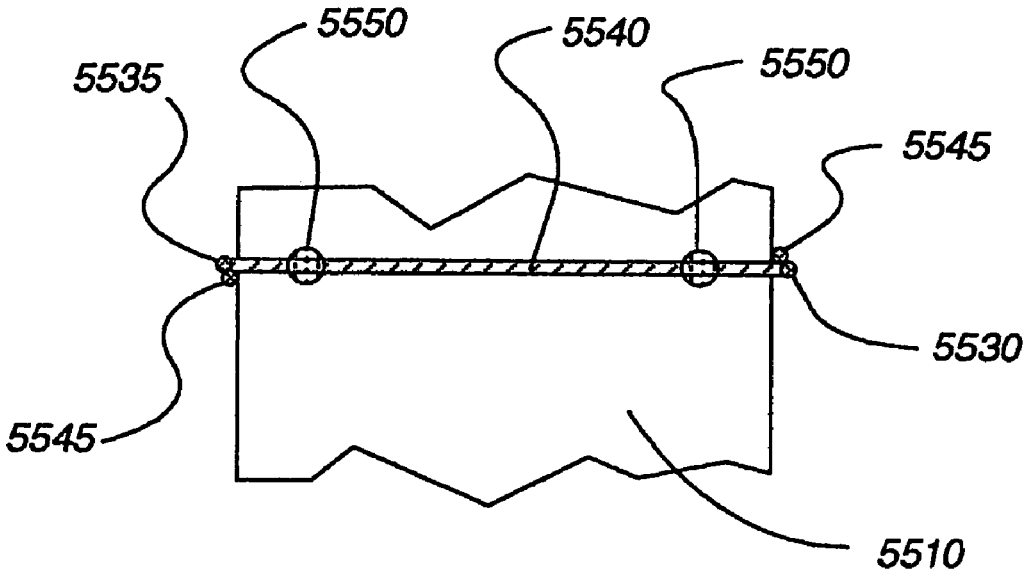

Referring to FIG. 129, the cord ladders located near the ends 5525 of the blind assembly's slats include two risers 5530 and 5535 with cross rungs 5540 spanning therebetween. Either front and rear or just front lift cords 5545 are intertwined with the riser cords as illustrated. As shown in FIG. 131, the cross rungs are secured to the slats with one or two adhesive beads 5550. Two adhesive beads are utilized when the cord ladder is located relatively close to the end of the slat, wherein the cross rung could partially slide off of the slat proximate the riser cords and cause improper operation of the blind. Only a single adhesive bead, usually located near the lateral center of the slat, is necessary when the cross rung is located inwardly of the slat end such that an end of the cross rung could not slide off the slat.

Figure 130:
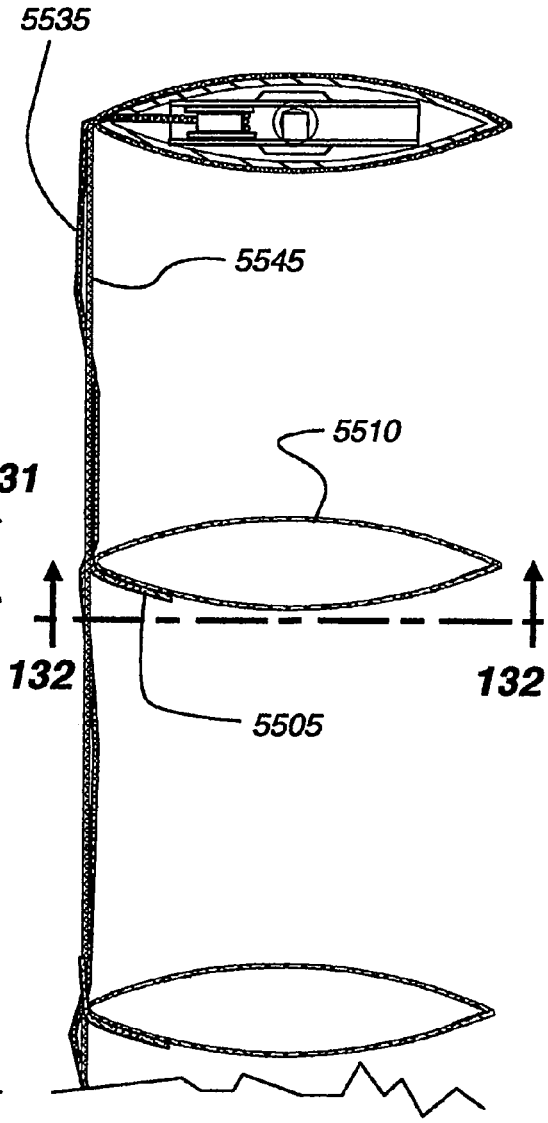
Figure 132:
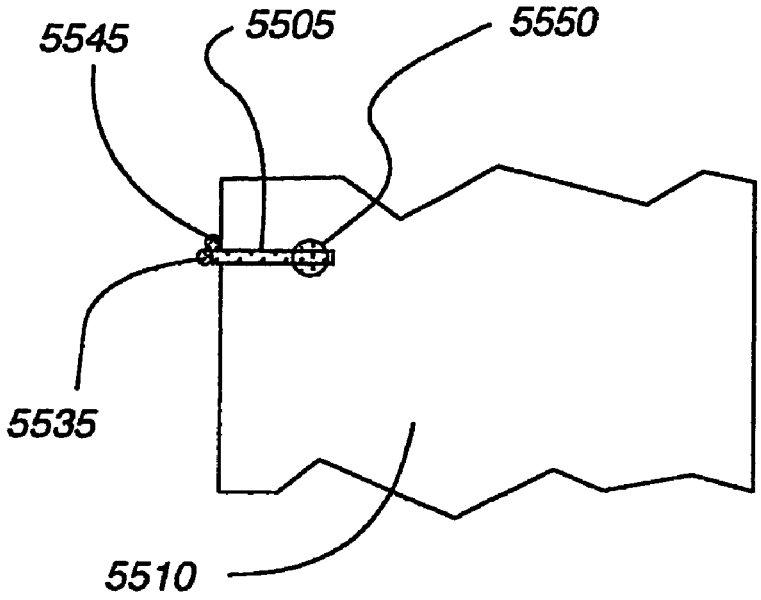

Referring to FIG. 130, the center cord ladder 5500 comprises only a single rear riser 5535 and a partial cross rung 5505 that is adhesively bonded or otherwise secured to the bottom side of the slat (as shown in FIG. 132). Since the slat is relatively rigid it does not droop or twist at its center despite the lack of a front riser cord. Further, the partial adhesively connected cross rung suspends or supports the slat in its proper vertical position relative to neighboring slats when the slats of the blind assembly are pivoted in either direction into either closed positions. It is appreciated that only a rear lift cord 5545 is used with the one sided cord ladders with the lift cord being preferably intertwined with the rear riser cord as illustrated best in FIG. 130.

Although the present invention has been described with a certain degree of particularity, it is understood that the present disclosure has been made by way of example, and changes in detail or structure not specifically discussed herein may be made without departing from the spirit of the invention as defined in the appended claims. For instance, a number of alternative embodiments of the present invention and a number of variations to the various components utilized in the invention are described and illustrated in a co-pending and concurrently filed United States patent application entitled "Shutter-Like Covering And Hardware For Architectural Openings".

We claim:

1. A covering for an architectural opening comprising:

one or more mounting brackets for attachment to the framework of the architectural opening;

a horizontal hollow headrail, the headrail having left and right ends, the left and right ends being pivotally attached to the one or more mounting brackets, wherein the headrail is pivotable between an open and a closed position about a longitudinal axis of the headrail; and a plurality of horizontally orientated slats suspended from the headrail by ladders, a plurality of lift cords passing longitudinally within the hollow head rail, each slat being (i) vertically spaced from an adjacent slat, (ii) pivotable between an open position and a closed position about a longitudinal axis of the slat by pivotal movement of said head rail, and (iii) vertically movable between a first position when the covering is extended and a second position when the covering is retracted by said lift cords, the open position permitting a substantial majority of light incident on the architectural opening to pass directly therethrough, the closed position blocking a substantial majority of the incident light from passing directly therethrough.

2. The covering of claim 1, wherein a cross sectional shape of the headrail is generally similar to a cross sectional shape of each slat of the plurality of slats.

3. The covering of claim 1 wherein a width of the head rail is greater than a width of each slat of the plurality of slats.

4. The covering of claim 1, wherein the headrail comprises an arcuate convex top side and an arcuate convex bottom side, the top side and the bottom side intersecting at common front and rear edges.

5. The covering of claim 4, wherein the headrail comprises an extruded metal.

6. The covering of claim 3, wherein the width of the headrail is about 110% the width of each slat of the plurality of slats.

7. The covering of claim 1, wherein the left and right ends of the headrail are attached to the one or more mounting brackets for generally horizontal movement in a direction substantially perpendicular to the longitudinal axis of the head rail.

8. The covering of claim 7, wherein the one or more mounting brackets comprise left and right mounting brackets, the left end of the headrail being attached to the left mounting bracket and the right end of the headrail being attached to the right mounting bracket.

9. The covering of claim 8, wherein the each of the left and right ends of the headrail further include one or more pins extending longitudinally outwardly therefrom, the one or more pins being adapted for pivotal receipt in the respective left or right mounting bracket.

10. The covering of claim 9, wherein the one or more pins comprise (i) a first pin extending substantially along the longitudinal axis of the headrail and (ii) a second pin offset from the first pin, and wherein the first and second pins are received into first and second slots respectively in the corresponding left or right mounting bracket.

11. The covering of claim 10, wherein the first slot extends in the mounting bracket generally horizontally from a front end to a rear end.

12. The covering of claim 1 further including a bottom slat and wherein the cross sectional shape of the bottom slat is generally similar to a cross sectional shape of each slat of the plurality of slats.

13. The covering of claim 9, wherein at least one pin of the one or more pins of the left and right ends of the mounting bracket are spring loaded.

14. The covering of claim 1, wherein the plurality of slats depend from the headrail by two or more cord ladders, each cord ladder comprising a front vertically-extending riser cord and a rear vertically-extending riser cord, the front and rear riser cords being connected by a plurality of cross rungs, each slat being one of cradled and suspended by a cross rung of the cord ladder, the front riser cord and the rear riser cord each having a top end, the top end of the front riser cord being attached with the headrail proximate a longitudinally-extending front edge of the headrail and the top end of the rear riser cord being attached with the head rail proximate a longitudinally-extending rear edge of the headrail.

15. The covering of claim 14, wherein each slat is adhesively joined to a cross rung of the plurality of cross rungs.

16. The covering of claim 15, wherein each slat is cradled by a cross rung of the plurality of cross rungs.

17. The covering of claim 14, wherein a left cord ladder of the two or more cord ladders is attached to the front and rear edges of the headrail at locations less than about one inch from the left end of the headrail and a right cord ladder of the two or more cord ladders is attached to the front and rear edges of the headrail at locations less than about one inch from the right end of the head rail.

18. The covering of claim 14, wherein a left cord ladder of the two or more cord ladders is attached to the headrail proximate a left end of the headrail and a right cord ladder of the two or more cord ladders is attached to the headrail proximate a right end of the headrail, and further comprising one or more one-sided cord ladders, the one or more one side cord ladders including a rear riser cord and a plurality of rungs spaced along the rear riser cord but having no front riser cord, each one-sided cord ladder being attached to the headrail at locations between the attachment locations of the first and second cord ladders, each cross rung of the one or more one-sided cord ladders being adhesively joined to a slat of the plurality of slats.

19. The covering of claim 14, further comprising a set of lift cords for each of the two or more cord ladders, each set of lift cords comprising a front lift cord and a rear lift cord, the front lift cord extending generally coextensively with the front riser cord of an associated cord ladder from a bottom end at a foot rail to the front edge of the head rail, the rear lift cord extending generally coextensively with the rear riser cord of the associated cord ladder from a bottom end at the foot rail to the rear edge of the headrail, each of the front and rear lifts cords continuing from the respective front and rear edges of the headrail into an interior of the headrail.

20. The covering of claim 19, wherein the rear lift cord is intertwined with the coextensively-extending rear riser cord of the associated cord ladder.

21. The covering of claim 1, further comprising an elongated substantially vertically-orientated tilt actuator rod, the actuator rod being pivotally connected with a longitudinally-extending front edge of the headrail, wherein vertical movement of the actuator rod causes the headrail to pivot between the open and closed positions.

22. The covering of claim 19, further comprising an elongated substantially vertically-orientated tilt actuator rod, the actuator rod being pivotally connected with the longitudinally-extending front edge of the headrail, wherein vertical movement of the actuator rod causes the headrail to pivot between the open and closed positions.

23. The covering of claim 21, further comprising a lift actuator slidably attached to the actuator rod, wherein slidable movement of the lift actuator causes the plurality of slats to move between the extended and retracted positions.

24. The covering of claim 22, further comprising a lift actuator slidably attached to the actuator rod and attached to the set of lift cords, wherein slidable movement of the lift actuator causes the plurality of slats to move between the extended and retracted positions.

25. The covering of claim 24, wherein the lift actuator further comprises a locking mechanism configured to selectively hold the lift actuator in a vertical position along the actuator rod.

26. The covering of claim 24, wherein the set of lift cords extend from the interior of the headrail through an opening in the headrail proximate the front edge into an interior of the actuator rod and downwardly to the lift actuator, wherein each lift cord terminates.

27. The covering of claim 22, wherein the actuator rod is positionally located along the front edge of the headrail to substantially conceal the front riser cord of one cord ladder of the two or more cord ladders when the covering is viewed from the front.

28. The covering of claim 21, further comprising a pivot arm and pivot arm mounting bracket for connecting the actuator rod to a frame of an architectural opening at a vertical location generally proximate a bottom end of the actuator rod, the mounting bracket being adapted for mounting to the frame of the architectural opening, the pivot arm being pivotally attached to the mounting bracket at a first end and to the actuator rod at a second end.

29. The covering of claim 2 further including a bottom slat and wherein the cross sectional shape of the bottom slat is generally similar to a cross sectional shape of each slat of the plurality of slats.

30. A covering for an architectural opening comprising: a headrail adapted for mounting to a framework of the architectural opening; a plurality of slats depending from the headrail, each slat having a longitudinal axis; a foot rail located beneath the plurality of slats; and a tilt mechanism assembly, the tilt mechanism assembly including at least one cord ladder having front and rear riser cords and interconnecting rungs, one or more one-sided cord ladders, the one or more one sided cord ladders including only a rear riser cord and a plurality of partial rungs spaced along the rear riser cord but having no front riser cord, each one-sided cord ladder extending from the foot rail to the headrail, each rung and partial rung of the plurality of rungs and partial rungs being adhesively joined to a slat of the plurality of slats.

31. The covering of claim 30 wherein the slats are supported only by the rungs and partial rungs of the cord ladders and one-sided cord ladders.

32. The covering of claim 30 wherein the slats are adhesively attached to the rungs of the one-sided cord ladders.

33. A covering for an architectural opening comprising:

a head rail adapted for mounting to a framework of the architectural opening;

a plurality of slats depending from the head rail, each slat having a longitudinal axis;

a foot rail located beneath the plurality of slats;

a tilt mechanism assembly, the tilt mechanism assembly including one or more one-sided cord ladders, the one or more one-sided cord ladders including a rear riser cord and a plurality of rungs spaced along the rear riser cord but having no front riser cord, each one-sided cord ladder extending from the foot rail to the head rail, each rung of the plurality of rungs being adhesively joined to a slat of the plurality of slats; and at least two cord ladders, each cord ladder comprising a front vertically extending riser cord and a rear vertically extending riser cord, the front and rear riser cords being connected by a plurality of cross rungs, each slat being cradled and suspended by a cross rung of the cord ladder, each cord ladder of the at least two cord ladders extending from the foot rail to the head rail.

34. The covering of claim 33, wherein each slat of the plurality of slats is adhesively joined to a cross rung of the plurality of cross rungs.

35. The covering of claim 34, wherein each slat is cradled in a cross rung of the plurality of cross rungs.

36. The covering of claim 35, wherein each slat has a bottom side, and the cross rung of the plurality of cross rungs is adhesively bonded to the bottom side of the slat at two separate locations.

37. The covering of claim 33, the at least two cord ladders comprise a first and a second cord ladder, the first cord ladder being located within about one inch from a left end of each slat of the plurality of slats, the second cord ladder being located within about one inch from a right side of each slat of the plurality of slats.

38. The covering of claim 33, wherein each of the one-sided cord ladders are located at longitudinal positions along each slat of the plurality of slats between the at least two cord ladders.

39. The covering of claim 33, wherein the headrail is pivotally mounted to the framework for pivotal movement about a longitudinally-extending axis of the headrail.

40. The covering of claim 39, wherein the a cross sectional shape of the headrail is generally similar to a cross sectional shape of the each slat of the plurality of slats.

41. The covering of claim 40, wherein a width of the headrail is greater than the width of each slat of the plurality of slats.

42. The covering of claim 39, wherein the rear riser cords of the one-sided cord ladder and the at least two cord ladders are attached with the headrail at locations along and proximate a longitudinally-extending rear edge of the headrail.

43. The covering of claim 42, wherein the front riser cords of the at least two cord ladders are attached with the headrail at locations along and proximate a longitudinally extending front edge of the headrail.

44. The covering of claim 33, further comprising a plurality of lift cords, The plurality of lift cords including at least one front lift cord and at least one rear lift cord, the at least one front lift cord of the plurality of lift cords extending generally coextensively with one of a front riser cord of one or more of the at least two ladder tapes from the foot rail to the head rail, the at least one rear lift cord extending generally coextensively with one or a rear riser cord of one or more of the at least two cord ladders and the one or more one-sided cord ladders from the foot rail to the head rail.

45. The covering of claim 44, wherein the rear lift cord is intertwined with the associated coextensively-extending rear riser cord.

46. The covering of claim 39, further comprising an elongated substantially vertically-orientated tilt actuator rod, the actuator rod being pivotally connected with a longitudinally-extending front edge of the headrail, wherein vertical movement of the actuator rod causes the headrail to pivot about the longitudinally-extending axis of the actuator rod.

47. The covering of claim 46, further comprising a lift mechanism assembly, the lift mechanism assembly including one or more lift cords, and a lift actuator, the lift actuator being slidably attached to the actuator rod, the one or more lift cords extending from the foot rail to the headrail, along the headrail and along at least a portion of the actuator assembly to the lift actuator.

48. The covering of claim 47, wherein the one or more lift cords terminate at the lift actuator.

49. The covering of claim 47, wherein the lift actuator further comprises a locking mechanism configured to selectively hold the lift actuator in a vertical position along the actuator rod.

50. A covering for an architectural opening comprising:

one or more mounting brackets for attachment to the framework of the architectural opening;

a horizontal head rail, the head rail having left and right ends, the left and rights ends being pivotally attached to the one or more mounting brackets wherein the head rail is pivotable between an open and a closed position about a longitudinal axis of the head rail;

a plurality of horizontally oriented slats depending from the head rail, each slat being (i) vertically spaced from an adjacent slat, (ii) pivotable between the open position and the closed position about a longitudinal axis of the slat, and (iii) vertically movable between a first position when the covering is extended and a second position when the covering is retracted, the open position permitting a substantial majority of light incident on the architectural opening to pass directly therethrough, the closed position blocking a substantial majority of the incident light from passing directly therethrough;

the left and right ends of the head rail being attached to the one or more mounting brackets for general horizontal movement in a direction substantially perpendicular to the longitudinal axis of the head rail;

the one or more mounting brackets comprising left and right mounting brackets, the left end of the head rail being attached to the left mounting bracket and the right end of the head rail being attached to the right mounting bracket;

each of the left and right ends of the head rail further including one or more pins extending longitudinally outwardly therefrom, the one or more pins being adapted for pivotal receipt in the respective left or right mounting bracket;

the one or more pins comprising (i) a first pin extending substantially along the longitudinal axis of the head rail, and (ii) a second pin offset from the first pin, and wherein the first and second pins are received into first and second slots respectively in the corresponding left or right mounting bracket;

the first slot extending in the mounting bracket generally horizontally from a front end to a rear end; and wherein the second slot has a rearmost location proximate the rear end of the first slot and extends (a) generally upwardly and forwardly from the rearmost location to a top end and (b) downwardly and forwardly from the rearmost location to a bottom end.

51. The covering of claim 50, wherein the second slot is generally v-shaped.

52. The covering of claim 50, wherein the second slot is arcuate.

53. The covering of claim 50, wherein each of the left and right mounting brackets further includes a horizontally orientated tongue member, the tongue member being slidably received into a body of the mounting bracket for horizontal movement and extension in front of a front edge of the body, the first slot being disposed in the tongue member.

* * * * *

UNITED STATES PATENT AND TRADEMARK OFFICE

CERTIFICATE OF CORRECTION

PATENT NO. : 7,168,475 B2
APPLICATION NO. : 10/479893
DATED : January 30, 2007
INVENTOR(S) : Wendell B. Colson et al.

It is certified that error appears in the above-identified patent and that said Letters Patent is hereby corrected as shown below:

Title page, Item (22), delete "Filed" and insert --PCT Filed--;

Title page, insert the following items:

| | | |
|---|---|---|
| Item --(86): | PCT No.: | PCT/US02/22577 |
| | 371 (c)(1), (2), (4), Date: | July 16, 2002-- |
| Item --(87) | PCT Pub. No.: | WO03/008751 |
| | PCT Pub. Date: | Jan. 30, 2003-- |

In The Drawings

Replace Figs. in Drawing Sheet 61 of 76 with the attached Drawing Sheet 61 of 76.

Signed and Sealed this

Third Day of July, 2007

JON W. DUDAS
*Director of the United States Patent and Trademark Office*